US007556918B2

(12) United States Patent
Yoneyama et al.

(10) Patent No.: US 7,556,918 B2
(45) Date of Patent: Jul. 7, 2009

(54) SILVER HALIDE COLOR PHOTOGRAPHIC LIGHT-SENSITIVE MATERIAL

(75) Inventors: Hiroyuki Yoneyama, Minami-ashigara (JP); Akira Ikeda, Minami-ashigara (JP); Shin Soejima, Minami-ashigara (JP); Kiyoshi Takeuchi, Minami-ashigara (JP); Naoto Matsuda, Minami-ashigura (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/968,016

(22) Filed: Dec. 31, 2007

(65) Prior Publication Data

US 2008/0113305 A1 May 15, 2008

Related U.S. Application Data

(60) Division of application No. 11/594,782, filed on Nov. 9, 2006, which is a division of application No. 10/969,205, filed on Oct. 21, 2004, now Pat. No. 7,183,044, which is a continuation of application No. 10/375,053, filed on Feb. 28, 2003, now abandoned.

(30) Foreign Application Priority Data

| | | |
|---|---|---|
| Mar. 1, 2002 | (JP) | 2002-056655 |
| Apr. 12, 2002 | (JP) | 2002-111023 |
| Apr. 12, 2002 | (JP) | 2002-111282 |
| Apr. 15, 2002 | (JP) | 2002-112176 |

(51) Int. Cl.

| | |
|---|---|
| ***G03C 1/08*** | (2006.01) |
| ***G03C 7/26*** | (2006.01) |
| ***G03C 7/32*** | (2006.01) |
| ***G03C 1/46*** | (2006.01) |

(52) U.S. Cl. ..... 430/546; 430/502; 430/503; 430/504; 430/505; 430/506; 430/507; 430/508; 430/551; 430/556; 430/557

(58) Field of Classification Search ..... 430/502–508, 430/543, 551, 556–557
See application file for complete search history.

(56) References Cited

U.S. PATENT DOCUMENTS

| | | | | |
|---|---|---|---|---|
| 3,841,880 | A | 10/1974 | Kertel | |
| 5,021,330 | A | 6/1991 | Bergthaller et al. | |
| 5,066,576 | A | 11/1991 | Ichijima et al. | |
| 5,110,714 | A | 5/1992 | Furusawa et al. | |
| 5,409,807 | A * | 4/1995 | Yoshioka et al. | 430/545 |
| 5,415,985 | A | 5/1995 | Sakai et al. | |
| 5,455,149 | A | 10/1995 | Bergthaller | |
| 6,677,110 | B2 | 1/2004 | Takeuchi et al. | |
| 6,727,053 | B2 * | 4/2004 | Takeuchi et al. | 430/558 |
| 7,183,044 | B2 | 2/2007 | Yoneyama et al. | |
| 2003/0073047 | A1 | 4/2003 | Takeuchi et al. | |
| 2004/0091825 | A1 | 5/2004 | Yoneyama | |

FOREIGN PATENT DOCUMENTS

| | | | |
|---|---|---|---|
| DE | 43 29 418 | A1 | 3/1995 |
| EP | 0 336 411 | A2 | 10/1989 |
| EP | 1 246 006 | A2 | 10/2002 |
| JP | 52-82423 | | 7/1977 |
| JP | 62-67536 | | 3/1987 |
| JP | 2-28645 | | 1/1990 |
| JP | 2-96146 | | 4/1990 |
| JP | 2-298936 | | 12/1990 |
| JP | 3-39958 | | 2/1991 |
| JP | 3-98049 | | 4/1991 |
| JP | 3-200961 | | 9/1991 |
| JP | 4-78582 | | 3/1992 |
| JP | 4-133052 | | 5/1992 |
| JP | 5-27389 | | 2/1993 |
| JP | 5-150418 | | 6/1993 |
| JP | 6-266075 | | 9/1994 |
| JP | 7-152130 | | 6/1995 |
| JP | 7-281370 | | 10/1995 |
| JP | 9-50100 | | 2/1997 |
| JP | 9-222707 | | 8/1997 |
| JP | 9-222708 | | 8/1997 |
| JP | 10-97039 | | 4/1998 |
| JP | 10-260502 | | 9/1998 |
| JP | 2001-133945 | | 5/2001 |
| JP | 2001-188311 | | 7/2001 |
| JP | 2002-107865 | | 4/2002 |

* cited by examiner

*Primary Examiner*—Geraldina Visconti
(74) *Attorney, Agent, or Firm*—Sughrue Mion, PLLC

(57) ABSTRACT

A silver halide color photographic light-sensitive material, having at least one each of blue-, green-, and red-sensitive emulsion layers containing yellow, magenta, and cyan couplers, respectively, on a support;

wherein said blue-sensitive emulsion layer contains at least one coupler of formula (I); and wherein the light-sensitive material satisfies expression a-1) and/or b-1):

formula (I)

wherein, Q forms a 5- to 7-membered ring with the —N=C—N(R1)-; R1 and R2 each are a substituent; m is 0 to 5; and X is a hydrogen atom, or a coupling split-off group;

$$0.5 \leqq D\max(UV)/D\min(UV) \leqq 1.1 \quad \text{a-1)}$$

wherein Dmax(UV)/Dmin(UV) is the smallest of the value in a wavelength range of 340 to 450 nm;

$$1300 \leqq (B-C)/A \leqq 20000 \quad \text{b-1)}$$

wherein B is yellow Dmax, C is yellow Dmin; and A is an amount mol/m$^2$ of the coupler of formula (I).

5 Claims, No Drawings

SILVER HALIDE COLOR PHOTOGRAPHIC LIGHT-SENSITIVE MATERIAL

CROSS-REFERENCE TO RELATED APPLICATION

This application is a Divisional of U.S. application Ser. No. 11/594,782 filed Nov. 9, 2006, which is a divisional of U.S. application Ser. No. 10/969,205 filed Oct. 21, 2004, issued as U.S. Pat. No. 7,183,044, which is a continuation of U.S. application Ser. No. 10/375,053 filed Feb. 28, 2003, abandoned; the above-noted applications incorporated herein by reference in their entirety.

FIELD OF THE INVENTION

The present invention relates to a silver halide photographic light-sensitive material, and, particularly, to a photographic light-sensitive material which attains improvement on the property for preventing static-induced fog from occurring without deteriorating properties for photographic light-sensitive materials, typified by sharpness, processability, and the like.

Further, the present invention relates to a silver halide color photographic light-sensitive material, and particularly to a silver halide color photographic light-sensitive material which is excellent in color reproducibility and rapid processability.

Further, the present invention relates to a silver halide color photographic light-sensitive material which is excellent in rapid processability, color reproducibility, preserving stability thereof in an unexposed state, and image fastness after processing.

Further, the present invention relates to a silver halide color photographic light-sensitive material with an increased silver and coupler utilization efficiency, allowing reduction in the coating amount of a material, having excellent suitability to a rapid high-productivity processing and cost reduction capability. The present invention also relates to a method for forming an image by using the silver halide color photographic light-sensitive material.

More particularly, the present invention relates to a silver halide color photographic light-sensitive material with which the period for forming an image by color development, the period for bleach fixing, and the period for washing with water can be shortened without exerting a harmful effect; and to a method for forming an image by using the same.

BACKGROUND OF THE INVENTION

In a silver halide photographic light-sensitive material (hereinafter, sometimes referred to simply as "a light-sensitive material") for subtractive color photography, a color image is formed by dyes of three primary colors of yellow, magenta, and cyan. In the color photography that uses a current p-phenylenediamine-series color-developing agent, an acylacetoanilide-series compound is used as a yellow coupler. However, the hue of the yellow dyes obtained from these yellow couplers becomes reddish, due to an inferior sharpness of a peak of the absorption curve at the longer wavelength side (that is, on the absorption curve, the peak in interest has subsidiary absorption at its foot portion at the longer wavelength side), which renders it difficult to obtain a yellow hue with high purity. Further, because the molecular extinction coefficient of the yellow dyes is low, it is necessary, to attain a desired color density, to use larger amounts of both of the coupler and the silver halide. The use of such larger amounts of these components raises the problem that the resulting increase in thickness of a light-sensitive material sometimes lowers the sharpness of the obtained color image. Further, accompanying sensitivity enhancement of a color photosensitive material in recent years, static-induced fog often occurs at the time of shooting with or producing of the color photosensitive material. Therefore, it has been desired to solve the problem.

In order to solve such the problems, improvement of acyl groups and anilido groups were proposed on the couplers. Recently, as improved couplers of the conventional acylacetoanilide-series, there were proposed, for example, 1-alkylcyclopropanecarbonyl acetoanilide-series compounds, described in JP-A-4-218042 ("JP-A" means unexamined published Japanese patent application); cyclomalonic acid diamide-type couplers, described in JP-A-5-11416; pyrrole-2- or 3-yl- or indole-2- or 3-yl-carbonylacetoanilide-series couplers, described in, for example, European Patent Nos. 953870A1, 953871A1, 953872A1, 953873A1, 953874A1 and 953875A1. The dyes formed from these couplers were improved in terms of both of hue and molecular extinction coefficient of dyes formed, compared with the conventional ones. However, they are not satisfactory in image stability still. Further, owing to their complicated chemical structure, the synthesis route became longer, and consequently cost of the couplers became higher, causing a practical problem. In addition, U.S. Pat. No. 3,841,880, JP-A-52-82423 and JP-A-2-28645 propose acetate ester-series and acetoanilide-series couplers to which 1,2,4-benzothiadiazine-1,1-dioxide is bonded. However, these couplers are low in color-forming property, and they are inferior in sharpness of a peak of the absorption curve owing to the foot portion on the longer wavelength side. Therefore, improvement of these properties has been desired. As a preventive measure for static-induced fog, it is known, for example, to add an ultraviolet-ray absorber (UV agent) to a protecting layer of a light-sensitive material, as described in JP-A-6-130549. However, when an amount of the UV agent to be used is increased for the purpose for further improving a property for preventing static-induced fog, the film thickness of the resulting light-sensitive material becomes to be thick, to cause deterioration of sharpness of an image and (rapid) processability, which is not preferable.

Silver halide photographic light-sensitive materials have been widely used until today as materials that are inexpensive, have stable quality, and provide an image with high quality. However, there is an increased demand by users for image quality enhancement, enhancement in stability of quality, and enhancement in productivity. As to the demand for image quality enhancement, improvements in whiteness, color reproducibility, and sharpness are demanded. As to the demand for enhancement in stability of quality, it is required to improve stability in the production of a light-sensitive material, stability during storage with the lapse of time in an unexposed state, and performance stability during development processing. Also, as to improving productivity, processing speed enhancement is strongly required.

Particularly, color reproducibility is important for photographic light-sensitive materials, such as color papers and color reversals, used for direct appreciation. To improve color reproducibility, first, it is necessary for the dye formed by a coupling reaction between a dye-forming coupler (hereinafter also referred to simply as a coupler) and an oxidized product of a developing agent, to itself be reduced in unnecessary absorption and have good absorbing characteristics. Further, in addition to the above, it is also important for, for example, remaining color due to a sensitizing dye, an irradiation-preventing dye, or the like, to be less, and fogging to be less.

To sufficiently exhibit color reproducibility of the formed dye, it is important for a light-sensitive material to be stable during development processing. Also, to sufficiently exhibit color reproducibility of the formed dye, it is important for 1) the change in performance of a light-sensitive material during storage in an unexposed state, to be small, and 2) a light-sensitive material to be stable during development processing. Also, if a dye image after processing is stable, a high-quality photographic image can be stored for a long period of time.

Particularly, technologies for the purpose to attain a reduction in the amount of a silver halide emulsion in a silver halide color photographic light-sensitive material, and to form a thin layer of a light-sensitive material, are demanded, from the viewpoint of improving productivity.

In recent years, in the field of photographic processing services, a photographic light-sensitive material that can be processed rapidly and form a high-quality image is demanded as part of improvement of service to users and as means for improving productivity. To respond to this demand, currently, a rapid processing is usually carried out in which a photographic light-sensitive material containing a high silver chloride emulsion (hereinafter, also referred to as "high silver chloride printing material") is processed in 45 seconds for a color developing time, and in about 4 minutes for a total processing time of from the start of the developing step to the completion of the drying step (for example, Color Processing CP-48S (trade name) or the like, manufactured by Fuji Photo Film Co., Ltd.). However, as compared with the rapidity of making images by other color image making methods (for example, an electrostatic transfer method, a thermal transfer method, an ink jet method), it cannot be said that even this rapid development processing system for high silver chloride printing materials provides a satisfactory rapidity. For this reason, there are demands for a super-rapid processing, of which the total processing time from the start of development of and the completion of drying of a high silver chloride color printing material, is on the level of below 1 minute.

Therefore, in the art of this field, various studies on means to improve super-rapid processing suitability and efforts for achieving it have been made. For example, as means for improving super-rapid processing suitability, (1) reduction in the coating amount of an organic material by adoption of a highly active coupler and a coupler giving a high molecular extinction coefficient of a coloring dye, and reduction in the coating amount of a hydrophilic binder, (2) adoption of a silver halide emulsion having a high development speed, and the like, have been studied. Also, a method for increasing the development speed by coating a silver halide emulsion layer having the lowest color-development speed (corresponding to the yellow coupler-containing layer in conventional color printing materials) on a more distant side from the support than other silver halide emulsion layers containing other couplers, has been known. This method has been proposed in, for example, JP-A-7-239538 and JP-A-7-239539.

Further, a method for enhancing a development speed, in which the position of a yellow coupler-containing layer is set on a relatively distant side from the support than at least one of a silver halide emulsion layer containing a magenta coupler and a silver halide emulsion layer containing a cyan coupler in order to make the developing agent easily permeate through the layer containing a yellow coupler that has a low color-developing speed, and, in addition, in which the amount of a hydrophilic binder is reduced, has been proposed in JP-A-2000-284428. However, locating the layer containing a yellow coupler upper than at least one of the layer containing a magenta coupler and the layer containing a cyan coupler without taking into consideration the balance among the coupling activities in the color forming layers, results in that the coupler coupling fails to win the competition with the color-mixing preventing layer, so that an oxidized product of a color-developing agent is lost. Actually, silver saving on the ultimate level has not been achieved yet. Use of thinner layers for rapid processing by reducing the amount of binder without taking into consideration the balance between the utilization efficiency of an oxidized product of a color-developing agent and the coupling activity, lowers the protective colloid function of the binder, and causes failure in image storability such as causing blurring of a color image.

Furthermore, according to JP-A-2-298936, the relative coupling rate of a yellow coupler and the dielectric constant of oil droplets are controlled by coemulsifying the yellow coupler with a cyan coupler. However, increasing the activity of the yellow coupler alone is undesirable in view of the balance, and has disadvantages in that the color mixing preventing layer must be thicker than ever, stain tends to occur due to the developing agent, and the like. Also, in the technique in which the relative coupling activity is controlled, co-emulsification results in an increase in the volume of oil droplets, which varies the amount of the developing agent incorporated, so that in some cases, the activity cannot be estimated exactly.

Also, in JP-A-5-303182, proposed is a method in which a pyrrolotriazole-type cyan coupler is applied to arrange between a color-forming layer containing a yellow coupler and a color-forming layer containing a magenta coupler, from the viewpoint of balance of coupling activities. However, the intention of the present invention is not satisfied by this method, because the amount of oil soluble contents in a high-boiling organic solvent dispersing therein the pyrrolotriazole-type cyan coupler is small and the activity in the oil droplets is low.

SUMMARY OF THE INVENTION

The present invention is a silver halide color photographic light-sensitive material, which has at least one blue-sensitive emulsion layer containing a yellow coupler, at least one green-sensitive emulsion layer containing a magenta coupler, and at least one red-sensitive emulsion layer containing a cyan coupler, on a support;

wherein said blue-sensitive emulsion layer contains at least one coupler represented by formula (I); and wherein the silver halide color photographic light-sensitive material satisfies the following expression a-1) and/or b-1):

formula (I)

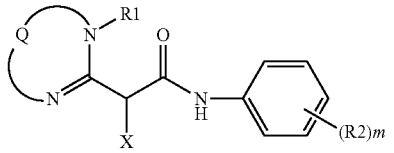

wherein, in formula (I), Q represents a group of non-metal atoms necessary to form a 5- to 7-membered ring together with the —N=C—N(R1)-; R1 represents a substituent; R2 represents a substituent; m represents 0 (zero) or an integer of 1 to 5; when m is 2 or more, R2s may be the same or different from each other, or R2s may bond together to form a ring; and X represents a hydrogen atom, or a group capable of being split-off upon a coupling reaction with an oxidized product of a developing agent;

$$0.5 \leqq D\max(UV)/D\min(UV) \leqq 1.1 \quad \text{a-1)}$$

wherein Dmax(UV)/Dmin(UV) is the smallest value in a range of wavelength UV, in which UV is a wavelength within the range of 340 nm or more and 450 nm or less, among values represented by (an absorbance at a wavelength UV, for a portion having the yellow maximum color density)/(an absorbance at the wavelength UV, for a portion having the yellow minimum color density);

$$1300 \leqq (B-C)/A \leqq 20000 \quad \text{b-1)}$$

wherein B represents the maximum color density of yellow, C represents the minimum color density of yellow, each of which means a transmission density when the support is a transmissive support, or a reflection density when the support is a reflective support; and A is an amount mol/$m^2$ of the coupler represented by formula (I) to be used.

Further, the present invention is a silver halide color photographic light-sensitive material, which has at least one yellow color-forming light-sensitive silver halide emulsion layer, at least one magenta color-forming light-sensitive silver halide emulsion layer, and at least one cyan color-forming light-sensitive silver halide emulsion layer, on a support, and which contains at least one yellow dye-forming coupler represented by the above formula (I) and at least one cyan coupler represented by the following formula (CC-I):

formula (CC-I)

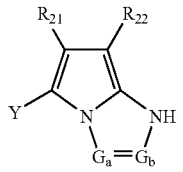

wherein, in formula (CC-I), $G_a$ represents —C($R_{23}$)═ or —N═; $G_b$ represents —C($R_{23}$)═ when $G_a$ represents —N═, or $G_b$ represents —N═ when $G_a$ represents —C($R_{23}$)═; $R_{21}$, and $R_{22}$ each independently represent an electron attractive group of which a Hammett's substituent constant $\sigma_p$ value is 0.20 or more and 1.0 or less; $R_{23}$ represents a substituent; and Y represents a hydrogen atom, or a group capable of being split-off upon a coupling reaction with an oxidized product of a developing agent.

Further, the present invention is a silver halide color photographic light-sensitive material, which has at least one yellow color-forming light-sensitive silver halide emulsion layer, at least one magenta color-forming light-sensitive silver halide emulsion layer, and at least one cyan color-forming light-sensitive silver halide emulsion layer, on a support, and which contains at least one yellow dye-forming coupler represented by the above formula (I), and at least one compound selected from the group consisting of compounds represented by any of the following formula [S-I], [S-II], [S-III], [S-IV], [S-V], [S-VI], [ST-I], [ST-II], [ST-III], [ST-IV] or [ST-V] and water-insoluble homopolymers or copolymers:

formula [S-I]

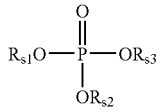

wherein, in formula [S-I], $R_{s1}$, $R_{s2}$ and $R_{s3}$ each independently represent an alkyl group, a cycloalkyl group, an alkenyl group or an aryl group, in which the total number of carbon atoms contained in the groups represented by $R_{s1}$, $R_{s2}$ and $R_{s3}$ is 12 to 60;

formula [S-II]

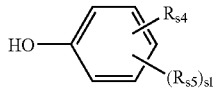

wherein, in formula [S-II], $R_{s4}$ and $R_{s5}$ each independently represent an alkyl group, a cycloalkyl group, an alkoxy group or a halogen atom; s1 represents an integer from 0 to 4; and when s1 is 2 or more, plural $R_{s5}$s may be the same or different, and $R_{s4}$ and $R_{s5}$ may bond with each other to form a five- or six-membered ring;

$$R_{s6}\text{-}(COOR_{s7}) \quad \text{formula [S-III]}$$

wherein, in formula [S-III], $R_{s6}$ represents a linking group having no aromatic group; $R_{s7}$ represents an alkyl, cycloalkyl, alkenyl or alkynyl group having 20 or less carbon atoms; sm represents an integer from 2 or more and 5 or less; and when sm is 2 or more, plural —$COOR_{s7}$s may be the same or different;

$$R_{s8}\text{-}(OCOR_{s9})_{sn} \quad \text{formula [S-IV]}$$

wherein, in formula [S-IV], $R_{s8}$ represents a linking group; $R_{s9}$ represents an alkyl, cycloalkyl, alkenyl or alkynyl group having 20 or less carbon atoms; sn represents an integer from 2 or more and 5 or less; and when sn is 2 or more, plural —$OCOR_{s9}$s may be the same or different;

formula [S-V]

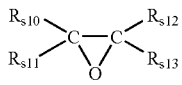

wherein, in formula [S-V], $R_{s10}$, $R_{s11}$, $R_{s12}$ and $R_{s13}$ each independently represent a hydrogen atom, an aliphatic group, an aliphatic oxycarbonyl group, an aromatic oxycarbonyl group or a carbamoyl group, in which the total number of carbon atoms contained in $R_{s10}$, $R_{s11}$, $R_{s11}$ and $R_{s13}$ is 8 to 60; and $R_{s10}$ and $R_{s11}$, $R_{s10}$ and $R_{s12}$, or $R_{s12}$ and $R_{s13}$ may bond with each other, to form a five- to seven-membered ring, respectively; with the proviso that all of $R_{s10}$, $R_{s11}$, $R_{s12}$ and $R_{s13}$ simultaneously do not represent a hydrogen atom;

$$R_{s14}\text{-}(COOR_{s15})_{sp} \quad \text{formula [S-VI]}$$

wherein, in formula [S-VI], $R_{s14}$ represents an aromatic linking group; $R_{s15}$ represents an alkyl, cycloalkyl, alkenyl or alkynyl group having 20 or less carbon atoms; sp represents an integer from 3 or more and 5 or less; and when sp is 2 or more, plural —$COOR_{s15}$s may be the same or different;

formula [ST-I]

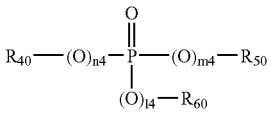

wherein, in formula [ST-I], $R_{40}$, $R_{50}$ and $R_{60}$ each independently represent an aliphatic group or an aromatic group; and l4, m4 and n4 each independently represent 0 or 1, with the proviso that l4, m4 and n4 simultaneously are not 1;

$R_A$—NH—$SO_2$—$R_B$ formula [ST-II]

wherein, in formula [ST-II], $R_A$ and $R_B$ each independently represent a hydrogen atom, an alkyl group, a cycloalkyl group, an alkenyl group, a cycloalkenyl group, an alkynyl group, an aryl group, a heterocyclic group, an alkoxy group, an aryloxy group, a heterocyclic oxy group, or a group represented by the following formula:

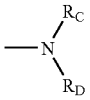

in which $R_C$ and $R_D$ each independently represent a hydrogen atom, an alkyl group or an aryl group; and $R_A$ and $R_B$ each may be the same or different;

formula [ST-III]

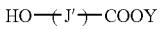

wherein, in formula [ST-III], J' represents a divalent organic group; and Y represents an alkyl group, a cycloalkyl group, an aryl group, an alkenyl group, an alkynyl group, a cycloalkenyl group or a heterocyclic group;

formula [ST-IV]

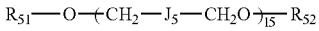

wherein, in formula [ST-IV], $R_{51}$ and $R_{52}$ each independently represent an aliphatic group or —$COR_{53}$, in which $R_{53}$ represents an aliphatic group; $J_5$ represents a divalent organic group or simply a connecting bond; and $l_5$ represents an integer from 0 to 6; and $R_{54}$—$Y_{54}$ formula [ST-V]

wherein, in formula [ST-V], $R_{54}$ represents a hydrophobic group having the total number of carbon atoms of 10 or more; and $Y_{54}$ represents a monovalent organic group containing an alcoholic hydroxyl group.

Further, the present invention is a silver halide color photographic light-sensitive material, which has, on a support, at least one yellow color-forming light-sensitive silver halide emulsion layer, at least one magenta color-forming light-sensitive silver halide emulsion layer, and at least one cyan color-forming light-sensitive silver halide emulsion layer, and which has at least one non-light-sensitive and non-color-forming hydrophilic colloid layer, wherein the silver halide color photographic light-sensitive material comprises a high silver chloride emulsion containing silver halide grains with a silver chloride content of 95 mol % or more, and wherein a color-forming coupler contained in the color-forming light-sensitive silver halide emulsion layers has an average relative coupling rate, kar, to a compound A of the following formula, of 0.6 or more and 2.0 or less.

compound A

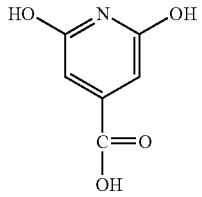

Other and further features and advantages of the invention will appear more fully from the following description.

DETAILED DESCRIPTION OF THE INVENTION

According to the present invention, there is provided the following means:

(1) A silver halide color photographic light-sensitive material, having at least one blue-sensitive emulsion layer containing a yellow coupler, at least one green-sensitive emulsion layer containing a magenta coupler, and at least one red-sensitive emulsion layer containing a cyan coupler, on a support;

wherein said blue-sensitive emulsion layer contains at least one coupler represented by formula (I); and wherein the silver halide color photographic light-sensitive material satisfies the following expression a-1) and/or b-1):

formula (I)

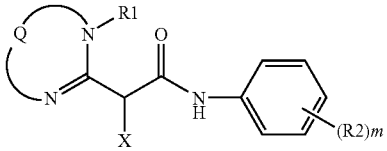

wherein, in formula (I), Q represents a group of non-metal atoms necessary to form a 5- to 7-membered ring together with the —N—C—N(R1)-; R1 represents a substituent; R2 represents a substituent; m represents 0 (zero) or an integer of 1 to 5; when m is 2 or more, R2s may be the same or different from each other, or R2s may bond together to form a ring; and X represents a hydrogen atom, or a group capable of being split-off upon a coupling reaction with an oxidized product of a developing agent;

$$0.5 \leqq D\max(UV)/D\min(UV) \leqq 1.1 \quad \text{a-1)}$$

wherein Dmax(UV)/Dmin(UV) is the smallest value in a range of wavelength UV, in which UV is a wavelength within the range of 340 nm or more and 450 nm or less, among values represented by (an absorbance at a wavelength UV, for a portion having the yellow maximum color density)/(an absorbance at the wavelength UV, for a portion having the yellow minimum color density);

$$1300 \leqq (B-C)/A \leqq 20000 \quad \text{b-1)}$$

wherein B represents the maximum color density of yellow, C represents the minimum color density of yellow, each of which means a transmission density when the support is a transmissive support, or a reflection density when the support is a reflective support; and A is an amount mol/m$^2$ of the coupler represented by formula (I) to be used.

(2) The silver halide color photographic light-sensitive material according to the above item (1), wherein Q in the above-mentioned formula (I) is a group represented by —C(—R11)=C(—R12)-$SO_2$— or —C(—R11)=C(—R12)-CO—, in which R11 and R12 bond with each other to form a 5- to 7-membered ring together with the —C=C—, or R11 and R12 each independently represent a hydrogen atom or a substituent.

(3) The silver halide color photographic light-sensitive material according to the above item (1), wherein the coupler represented by formula (I) is a coupler represented by formula (II):

formula (II)

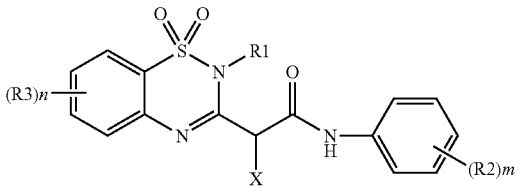

wherein, in formula (II), R1, R2, m and X each have the same meanings as those in formula (I); R3 represents a substituent; n represents 0 (zero) or an integer of 1 to 4; when n is 2 or more, R3s may be the same or different, or R3s may bond together to form a ring.

(4) The silver halide color photographic light-sensitive material according to any one of the above items (1) to (3), wherein the support is a transmissive support, and wherein the silver halide color photographic light-sensitive material satisfies the following expression a-2):

$$0.5 \leqq D\max(UV)/D\min(UV) \leqq 0.9 \quad \text{a-2)}$$

(5) The silver halide color photographic light-sensitive material according to any one of the above items (1) to (3), wherein the support is a transmissive support, and wherein the silver halide color photographic light-sensitive material satisfies the following expression a-2) and/or b-2):

$$0.5 \leqq D\max(UV)/D\min(UV) \leqq 0.9 \quad \text{a-2)}$$

$$1700 \leqq (B-C)/A \leqq 10000 \quad \text{b-2)}$$

(6) The silver halide color photographic light-sensitive material according to any one of the above items (1) to (3), wherein the support is a reflective support, and wherein the silver halide color photographic light-sensitive material satisfies the following expression a-1) and/or b-3):

$$0.5 \leqq D\max(UV)/D\min(UV) \leqq 1.1 \quad \text{a-1)}$$

$$4200 \leqq (B-C)/A \leqq 20000 \quad \text{b-3)}$$

(7) The silver halide color photographic light-sensitive material according to any one of the above items (1) to (6), having at least one emulsion layer containing a silver halide emulsion that contains silver halide grains whose silver chloride content is 95 mole % or more.

(8) A method of forming a color-image, comprising the steps of:

exposing image-wise the silver halide color photographic light-sensitive material as described in any one of the above items (1), (2), (3), (4), (5) or (7);

subjecting the exposed silver halide color photographic light-sensitive material to black-and white development;

subjecting the silver halide color photographic light-sensitive material to reversal-processing; and subjecting the silver halide color photographic light-sensitive material to color development.

(Hereinafter, a first embodiment of the present invention means to include the silver halide color photographic light-sensitive materials or the method of forming a color image, as described in the items (1) to (8) above.)

(9) A silver halide color photographic light-sensitive material, having at least one yellow color-forming light-sensitive silver halide emulsion layer, at least one magenta color-forming light-sensitive silver halide emulsion layer, and at least one cyan color-forming light-sensitive silver halide emulsion layer, on a support, and containing at least one yellow dye-forming coupler represented by the following formula (I) and at least one cyan coupler represented by the following formula (CC-I):

formula (I)

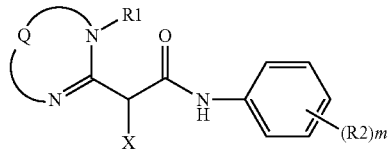

wherein, in formula (I), Q represents a group of non-metal atoms necessary to form a 5- to 7-membered ring together with the —N=C—N(R1)-; R1 represents a substituent; R2 represents a substituent; m represents an integer of 0 to 5; when m is 2 or more, R2s may be the same or different from each other, or R2s may bond together to form a ring; and X represents a hydrogen atom, or a group capable of being split-off upon a coupling reaction with an oxidized product of a developing agent;

formula (CC-I)

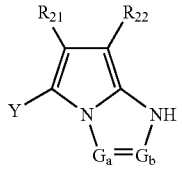

wherein, in formula (CC-I), $G_a$ represents —C($R_{23}$)= or —N=; $G_b$ represents —C($R_{23}$)= when $G_a$ represents —N=, or $G_b$ represents —N= when $G_a$ represents —C($R_{23}$)=; $R_{21}$ and $R_{22}$ each independently represent an electron attractive group of which a Hammett's substituent constant $\sigma_p$ value is 0.20 or more and 1.0 or less; $R_{23}$ represents a substituent; and Y represents a hydrogen atom, or a group capable of being split-off upon a coupling reaction with an oxidized product of a developing agent.

(10) The silver halide color photographic light-sensitive material according to the above item (9), wherein Q in the above-mentioned formula (I) is a group represented by —C(—R11)=C(—R12)-$SO_2$— or —C(—R11)=

C(—R12)-CO—, in which R11 and R12 bond with each other to form a 5- to 7-membered ring together with the —C═C—, or R11 and R12 each independently represent a hydrogen atom or a substituent.

(11) The silver halide color-photographic light-sensitive material according to the above item (9), wherein Q in the above-mentioned formula (I) is a group represented by —C(—R11)═C(—R12)-$SO_2$—, in which R11 and R12 bond with each other to form a 5- to 7-membered ring together with the —C═C—, or R11 and R12 each independently represent a hydrogen atom or a substituent.

(12) The silver halide color photographic light-sensitive material according to the above item (9), wherein the yellow dye-forming coupler represented by formula (I) is a yellow dye-forming coupler represented by formula (II):

formula (II)

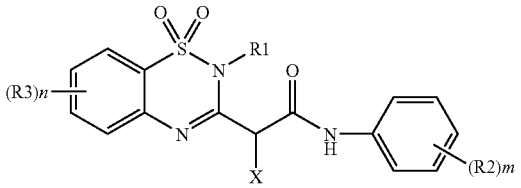

wherein, in formula (II), R1 represents a substituent; R2 represents a substituent; m represents an integer of 0 to 5; when m is 2 or more, R2s may be the same or different from each other, or R2s may bond together to form a ring; R3 represents a substituent; n represents an integer of 0 to 4; when n is 2 or more, R3s may be the same or different from each other, or R3s may bond together to form a ring; and X represents a hydrogen atom, or a group capable of being split-off upon a coupling reaction with an oxidized product of a developing agent.

(13) The silver halide color photographic light-sensitive material according to the above item (12), wherein R1 in the dye-forming coupler represented by formula (II) is a substituted or unsubstituted alkyl group.

(Hereinafter, a second embodiment of the present invention means to include the silver halide color photographic light-sensitive materials described in the items (9) to (13) above.)

(14) A silver halide color photographic light-sensitive material, having at least one yellow color-forming light-sensitive silver halide emulsion layer, at least one magenta color-forming light-sensitive silver halide emulsion layer, and at least one cyan color-forming light-sensitive silver halide emulsion layer, on a support, and containing at least one yellow dye-forming coupler represented by the following formula (I), and at least one compound selected from the group consisting of compounds represented by any of the following formula [S-I], [S-II], [S-III], [S-IV], [S-V], [S-VI], [ST-I], [ST-II], [ST-III], [ST-IV] or [ST-V] and water-insoluble homopolymers or copolymers:

formula (I)

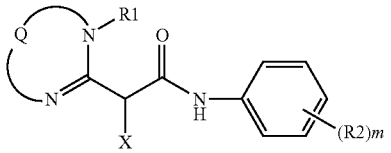

wherein, in formula (I), Q represents a group of non-metal atoms necessary to form a 5- to 7-membered ring together with the —N═C—N(R1)-; R1 represents a substituent; R2 represents a substituent; m represents an integer of 0 to 5; when m is 2 or more, R2s may be the same or different from each other, or R2s may bond together to form a ring; and X represents a hydrogen atom, or a group capable of being split-off upon a coupling reaction with an oxidized product of a developing agent;

formula [S-I]

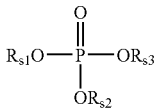

wherein, in formula [S-I], $R_{s1}$, $R_{s2}$ and $R_{s3}$ each independently represent an alkyl group, a cycloalkyl group, an alkenyl group or an aryl group, in which the total number of carbon atoms contained in the groups represented by $R_{s1}$, $R_{s2}$ and $R_{s3}$ is 12 to 60;

formula [S-II]

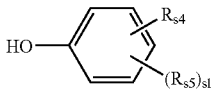

wherein, in formula [S-II], $R_{s4}$ and $R_{s5}$ each independently represent an alkyl group, a cycloalkyl group, an alkoxy group or a halogen atom; s1 represents an integer from 0 to 4; and when s1 is 2 or more, plural $R_{s5}$s may be the same or different, and $R_{s4}$ and $R_{s5}$ may bond with each other to form a five- or six-membered ring;

$R_{s6}$-($COOR_{s7}$)$_{sm}$ formula [S-III]

wherein, in formula [S-III], $R_{s6}$ represents a linking group having no aromatic group; $R_{s7}$ represents an alkyl, cycloalkyl, alkenyl or alkynyl group having 20 or less carbon atoms; sm represents an integer from 2 or more and 5 or less; and when sm is 2 or more, plural —$COOR_{17s}$ may be the same or different;

$R_{s8}$-($OCOR_{s9}$)$_{sn}$ formula [S-IV]

wherein, in formula [S-IV], $R_{s8}$ represents a linking group; $R_{s9}$ represents an alkyl, cycloalkyl, alkenyl or alkynyl group having 20 or less carbon atoms; sn represents an integer from 2 or more and 5 or less; and when sn is 2 or more, plural —$OCOR_{s9}$s may be the same or different;

formula [S-V]

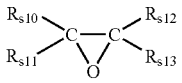

wherein, in formula [S-V], $R_{s10}$, $R_{s11}$, $R_{s12}$ and $R_{s13}$ each independently represent a hydrogen atom, an aliphatic group, an aliphatic oxycarbonyl group, an aromatic oxycarbonyl group or a carbamoyl group, in which the total number of carbon atoms contained in $R_{s10}$, $R_{s11}$, $R_{s12}$ and $R_{s13}$ is 8 to 60; and $R_{s10}$ and $R_{s11}$, $R_{s10}$ and $R_{s12}$, or $R_{s12}$ and $R_{s13}$ may bond with each other, to form a five- to seven-membered ring, respectively; with the proviso that all of $R_{s10}$, $R_{s11}$, $R_{s12}$ and $R_{s13}$ simultaneously do not represent a hydrogen atom;

$$R_{s14}\text{-}(COOR_{s15})_{sp} \qquad \text{formula [S-VI]}$$

wherein, in formula [S-VI], $R_{s14}$ represents an aromatic linking group; $R_{s15}$ represents an alkyl, cycloalkyl, alkenyl or alkynyl group having 20 or less carbon atoms; sp represents an integer from 3 or more and 5 or less; and when sp is 2 or more, plural —$COOR_{s15}$s may be the same or different;

formula [ST-I]

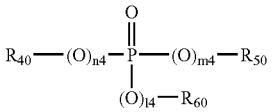

wherein, in formula [ST-I], $R_{40}$, $R_{50}$ and $R_{60}$ each independently represent an aliphatic group or an aromatic group; and l4, m4 and n4 each independently represent 0 or 1, with the proviso that l4, m4 and n4 simultaneously are not 1;

$$R_A\text{—NH—}SO_2\text{—}R_B \qquad \text{formula [ST-II]}$$

wherein, in formula [ST-II], $R_A$ and $R_B$ each independently represent a hydrogen atom, an alkyl group, a cycloalkyl group, an alkenyl group, a cycloalkenyl group, an alkynyl group, an aryl group, a heterocyclic group, an alkoxy group, an aryloxy group, a heterocyclic oxy group, or a group represented by the following formula:

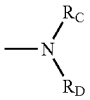

in which $R_C$ and $R_D$ each independently represent a hydrogen atom, an alkyl group or an aryl group; and $R_A$ and $R_B$ each may be the same or different;

formula [ST-III]

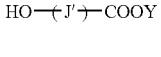

wherein, in formula [ST-III], J' represents a divalent organic group; and Y represents an alkyl group, a cycloalkyl group, an aryl group, an alkenyl group, an alkynyl group, a cycloalkenyl group or a heterocyclic group;

formula [ST-IV]

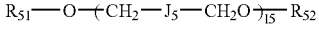

wherein, in formula [ST-IV], $R_{51}$ and $R_{52}$ each independently represent an aliphatic group or —$COR_{53}$, in which $R_{53}$ represents an aliphatic group; $J_5$ represents a divalent organic group or simply a connecting bond; and $l_5$ represents an integer from 0 to 6; and $$R_{54}\text{—}Y_{54} \qquad \text{formula [ST-V]}$$

wherein, in formula [ST-V], $R_{54}$ represents a hydrophobic group having the total number of carbon atoms of 10 or more; and $Y_{54}$ represents a monovalent organic group containing an alcoholic hydroxyl group.

(15) The silver halide color photographic light-sensitive material according to the above item (14), wherein Q in the above-mentioned formula (I) is a group represented by —C(—R11)=C(—R12)-$SO_2$— or —C(—R11)=C(—R12)-CO—, in which R11 and R12 bond with each other to form a 5- to 7-membered ring together with the —C=C—, or R11 and R12 each independently represent a hydrogen atom or a substituent.

(16) The silver halide color photographic light-sensitive material according to the above item (14), wherein Q in the above-mentioned formula (I) is a group represented by —C(—R11)=C(—R12)-$SO_2$—, in which R11 and R12 bond with each other to form a 5- to 7-membered ring together with the —C=C—, or R11 and R12 each independently represent a hydrogen atom or a substituent.

(17) The silver halide color photographic light-sensitive material according to the above item (14), wherein the yellow dye-forming coupler represented by formula (I) is a yellow dye-forming coupler represented by formula (II):

formula (II)

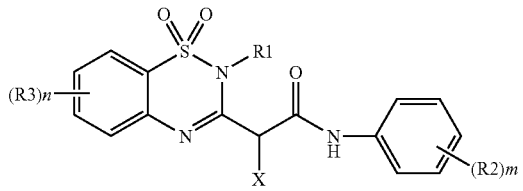

wherein, in formula (II), R1 represents a substituent; R2 represents a substituent; m represents an integer of 0 to 5; when m is 2 or more, R2s may be the same or different from each other, or R2s may bond together to form a ring; R3 represents a substituent; n represents an integer of 0 to 4; when n is 2 or more, R3s may be the same or different from each other, or R3s may bond together to form a ring; and X represents a hydrogen atom, or a group capable of being split-off upon a coupling reaction with an oxidized product of a developing agent.

(18) The silver halide color photographic light-sensitive material according to the above item (17), wherein R1 in the dye-forming coupler represented by formula (II) is a substituted or unsubstituted alkyl group.

(Hereinafter, a third embodiment of the present invention means to include the silver halide color photographic light-sensitive materials described in the items (14) to (18) above.)

(19) A silver halide color photographic light-sensitive material, having, on a support, at least one yellow color-forming light-sensitive silver halide emulsion layer, at least one magenta color-forming light-sensitive silver halide emulsion layer, and at least one cyan color-forming light-sensitive silver halide emulsion layer, and having at least one non-light-sensitive and non-color-forming hydrophilic colloid layer, wherein the silver halide color photographic light-sensitive material comprises a high silver chloride emulsion containing silver halide grains with a silver chloride content of 95 mol % or more, and wherein a color-forming coupler contained in the color-forming light-sensitive silver halide emulsion layers has an average relative coupling rate, kar, to a compound A of the following formula, of 0.6 or more and 2.0 or less.

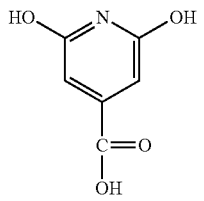

compound A

(20) The silver halide color photographic light-sensitive material according to the item (19) above, wherein the color-forming light-sensitive silver halide emulsion layer containing the color-forming coupler that has the maximum value of the average relative coupling rate, kar, is provided as an intermediate layer among the three color of cyan, magenta and yellow color-forming light-sensitive silver halide emulsion layers.

(21) The silver halide color photographic light-sensitive material according to the item (20) above, wherein the yellow color-forming light-sensitive silver halide emulsion layer is provided on a side closest to the support.

(22) The silver halide color photographic light-sensitive material according to any one of the items (19) to (21) above, wherein the total coating amount of silver is 0.25 $g/m^2$ or more and 0.50 $g/m^2$ or less.

(23) The silver halide color photographic light-sensitive material according to any one of the items (19) to (22) above, wherein the silver halide emulsion in each of the silver halide emulsion layers contains cubic grains with an average side length of 0.10 μm or more and 0.50 μm or less.

(24) The silver halide color photographic light-sensitive material according to any one of the items (19) to (23) above, wherein a hydrophilic binder in photographic constituent layers is in a total coating amount of 4.0 $g/m^2$ or more and 5.7 $g/m^2$ or less.

(25) The silver halide color photographic light-sensitive material according to any one of the items (19) to (24) above, which has a water-swelling rate of 200% or more and 300% or less.

(26) The silver halide color photographic light-sensitive material according to any one of the items (19) to (25) above, wherein photographic constituent layers have a film thickness of 5.0 μm or more and 7.7 μm or less.

(27) A method of forming an image, comprising, subjecting the silver halide color photographic light-sensitive material according to any one of the items (19) to (26) above, to development processing with a color developer containing N-ethyl-N-(β-methanesulfonamidoethyl)-3-methyl-4-aminoaniline.

(28) A method of forming an image, comprising, subjecting the silver halide color photographic light-sensitive material according to any one of the items (19) to (27) above, to scanning exposure for an exposure time of $1\times10^{-3}$ second or less per pixel, and to color-development processing.

(Hereinafter, a fourth embodiment of the present invention means to include the silver halide color photographic light-sensitive materials or the methods of forming an image, as described in the items (19) to (28) above.)

Herein, the present invention means to include all of the above first, second, third and fourth embodiments, unless otherwise specified.

In the present invention, preferably in the first embodiment, Dmax(UV)/Dmin(UV), which is defined as described above, is measured as follows.

A sample subjected to exposure to white light of a color temperature of 4,800° K. through a sharp cut filter SC-39 (trade name, which can cut light having a wavelength shorter than 390 nm) manufactured by Fuji Photo Film Co., Ltd., for an exposure time of 1 second at an exposure amount of 2,000 CMS, and an unexposed sample were each subjected to color development processing as described below. These two samples, exposed and unexposed, are measured for color density by the method described below. Of the values obtained, one measured for the sample having a higher color density is defined as Dmax, and the other measured for the sample having a lower color density is defined as Dmin.

The above color-development processing utilizes a color developer if necessary, and the followings can be mentioned as the processing: in the case where a transmission (transmitting) negative-type color photographic light-sensitive material is used, the development processing described in Example 1-1 hereinbelow; in the case where a transmitting positive-type color photographic light-sensitive material is used, the development processing-CR described in Example 1-4 hereinbelow; in the case where a reflective support color photographic light-sensitive material is used, the development processing A described in Example 1-5 hereinbelow.

(Measuring Method for Dmax and Dmin)

By using 10 $cm^2$ of each sample after the processing, the gelatin in the photographic constituent layer is enzymatically decomposed with 20 ml of water containing 5 mg of actinase at 40° C., for 60 minutes, to elute the photographic constituent layer. After cooling the eluate at 25° C., it is treated with 20 ml of ethyl acetate, to extract oil-soluble components. The extract is once dried up by use of a rotary evaporator under the conditions of 40° C. under reduced pressure, and the final amount of the extract is made to be 10 ml with ethyl acetate containing 0.3 mass % of acetic acid in a volumetric flask. The operations of preparing a solution from the enzymatic decomposition with actinase to this step are performed under light-shielded conditions. This solution was measured for absorption spectra at 340 nm to 450 nm in a 1-cm thick silica cell, and Dmax(UV)/Dmin(UV) defined below is determined by calculation. Herein, the term "a portion having the yellow maximum color density" means a portion of a sample, which is one of the two samples, exposed or unexposed, and which has a higher color density attained by using a color forming yellow coupler. Herein, the term "a portion having the yellow minimum color density" means a portion of a sample, which is another of the two samples, exposed or unexposed, and which has a lower color density obtained by not allowing or by allowing a color-forming yellow coupler to form color. Definition of Dmax(UV)/Dmin(UV): "the smallest value in a range of wavelength UV, in which UV is a wavelength within the range of 340 nm or more and 450 nm or less, among values represented by (an absorbance at a wavelength UV, for a portion having the yellow maximum color density)/(an absorbance at the wavelength UV, for a portion having the yellow minimum color density)." For example, when the value Dmax (UV)/Dmin(UV) has the smallest value 0.5 at 400 nm, Dmax (UV)/Dmin(UV) is represented by Dmax(400 nm/Dmin(400 nm)=0.5.

In the present invention, preferably in the first embodiment, the range of Dmax(UV)/Dmin(UV) is preferably 0.50 or more and 1.10 or less, more preferably 0.5 or more and 0.9 or less, still more preferably 0.6 or more and 1.0 or less, most preferably 0.7 or more and 0.9 or less.

The greater the value of Dmin(UV) (on this occasion, the value of Dmax(UV)/Dmin(UV) becomes smaller) is, the less the static-induced fog tends to be, which is preferable. However, in the case where Dmax(UV)/Dmin(UV) is smaller than 0.5, there arises an undesirably large harmful influence that a molar extinction coefficient of the dye formed by coupling with an oxidized developing agent is small or that absorption of the coupler gives yellow tint to the photographic light-sensitive material after processing.

In the present invention, preferably in the first embodiment, it is preferred that the value defined by (B−C)/A be within the above-mentioned specific range. Hereinafter, the measuring method thereof is described. An unexposed sample and a sample subjected to exposure to white light of a color temperature 4,800° K. in a yellow coupler containing silver halide emulsion layer through a sharp cut filter SC-39 (trade name) manufactured by Fuji Photo Film Co., Ltd., for an exposure time of 1 second at an exposure amount of 2,000 CMS (1×sec) were each subjected to color-development processing as described above. By using the yellow density B at the portion showing the maximum color density and the minimum yellow color density C and by using the amount to be used (coating amount) of the compound represented by formula (I), A mol/$m^2$, (B−C)/A is determined by calculation. The densitometer used is, for example, HPD Densitometer (trade name, manufactured by Fiji Photo Film Co., Ltd., 436 nm, a reflection light measuring densitometer) in the case of a reflective support photosensitive material, and SCD Densitometer (trade name, manufactured by Fuji Photo Film Co., Ltd., a transmission light measuring densitometer) in the case of a transmitting support photosensitive material.

In the present invention, preferably in the first embodiment, when a transmitting support is used, (B−C)/A is preferably 1,300 or more and 10,000 or less, more preferably 1,700 or more and 10,000 or less, still more preferably 1,800 or more and 8,000 or less, and most preferably 1,900 or more and 4,000 or less.

In the present invention, preferably in the first embodiment, when a reflective support photosensitive material is used, (B−C)/A is preferably 4,200 or more and 20,000 or less, more preferably 4,500 or more and 10,000 or less, and most preferably 4,600 or more and 6,500 or less.

In the present invention, preferably in the first embodiment, the yellow coupler represented by formula (I) may be used as a mixture with another yellow coupler in an arbitrary ratio. The ratio of the yellow coupler for use in the present invention in terms of mol ratio is preferably 10% or more, more preferably 25% or more, still more preferably 50% or more, and most preferably 75% or more and 100% or less.

The present invention is explained below in detail.

(Dye-forming Coupler)

The compounds (referred to also as a dye-forming coupler or a yellow dye-forming coupler in the present specification) represented by formula (I) for use in the present invention is explained in detail.

formula (I)

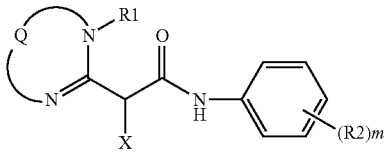

In formula (I), R1 represents a substituent other than a hydrogen atom. Examples of the substituent include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an alkylamino group and an anilino group), an acylamino group, an aminocarbonylamino group, an alkoxycarbonylamino group, an aryloxycarbonylamino group, a sulfamoylamino group, an sulfonamido group (including an alkyl- or aryl-sulfonylamino group), a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, and a silyl group.

The above-mentioned substituent may be further substituted with another substituent, and examples of this another substituent are the same to the above-mentioned examples of the substituent.

R1 is preferably a substituted or unsubstituted alkyl group. The total number of carbon atoms of R1 is preferably in the range of 1 to 60, more preferably in the range of 6 to 50, still more preferably in the range of 11 to 40, and most preferably in the range of 16 to 30. In the case where R1 is a substituted alkyl group, examples of the substituent on the alkyl group include those atoms and groups exemplified as the substituent of the above-mentioned R1.

The number of carbon atoms in the alkyl group itself represented by R1 is preferably in the range of 1 to 40, more preferably in the range of 3 to 36 and still more preferably in the range of 8 to 30. This preferable order does not particularly depend on Q, but this order is preferably applied in the case where Q described below is a group represented by —C(—R11)=C(—R12)-CO—.

R1 is preferably an unsubstituted alkyl group having 11 or more carbon atoms, or an alkyl group substituted with an alkoxy group or aryloxy group at the 2-, 3- or 4-position, more preferably an unsubstituted alkyl group having 16 or more carbon atoms, or an alkyl group substituted with an alkoxy group or aryloxy group at the 3-position, and most preferably a $C_{16}H_{33}$ group, a $C_{18}H_{37}$ group, 3-lauryloxypropyl group or 3-(2,4-di-t-amylphenoxy)propyl group.

In formula (I), Q represents a group of non-metal atoms necessary to form a 5- to 7-membered ring in combination with the —N=C—N(R1)-. The 5- to 7-membered ring thus formed is preferably a substituted or unsubstituted, and monocyclic or condensed heterocycle. More preferably, the ring-forming atoms are selected from carbon, nitrogen and sulfur atoms. Still more preferably, Q represents a group represented by —C(—R11)=C(—R12)-$SO_2$— or —C(—R11)=C(—R12)-CO— (in the present invention, these expressions of the foregoing groups do not limit the bonding orientation of the groups in formula (I), to the ones shown by these expressions). Q is preferably a group represented by —C(—R11)=C(—R12)-$SO_2$—. R11 and R12 represent groups that bond each other to form a 5- to 7-membered ring together with the —C=C— moiety, or R11 and R12 each independently represent a hydrogen atom or a substituent. The 5- to 7-membered ring thus formed may be saturated or unsaturated, and the ring may be an alicyclic, aromatic or heterocyclic ring. Examples of the ring include benzene, furan, thiophene, cyclopentane and cyclohexane rings. Further, examples of the substituent represented by R11 or R12 are those enumerated as the substituent of the above-described R1.

These substituents and the ring formed through bonding of multiple substituents may be further substituted with another substituent (examples of this another substituent are the same as described as the examples of the above-mentioned groups represented by R1).

In formula (I), R2 represents a substituent other than a hydrogen atom. Examples of the substituent are the same as those exemplified as the substituent represented by R1. R2 is preferably a halogen atom (e.g., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetoamido), a sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulfamoyl, N,N-diethylsulfamoyl), an alkylsulfonyl group (e.g., methanesulfonyl), an arylsulfonyl group (e.g., benzenesulfonyl), an alkylthio group (e.g., methylthio, dodecylthio), an arylthio group (e.g., phenylthio, naphthylthio), a cyano group, a carboxyl group, or a sulfo group. When R2 is at the ortho position to the —CONH— group, R2 is preferably a halogen atom, an alkoxy group, an aryloxy group, an alkyl group, an alkylthio group, or an arylthio group.

In the present invention, it is preferable that at least one R2 is at the ortho position to the —CONH— group.

In formula (I), m represents an integer of 0 to 5. When m is 2 or more, $R_2$s may be the same or different, or $R_2$s may bond with each other to form a ring.

m is preferably an integer of 0 to 3, more preferably 0 to 2, still more preferably 1 to 2, and most preferably 2.

In formula (I), X represents a hydrogen atom, or a group that is capable of being split-off upon a coupling reaction with an oxidized product of a developing agent. Examples of the group, represented by X, capable of being split-off upon a coupling reaction with an oxidized product of a developing agent, include a group capable of being split-off with a nitrogen, oxygen, or sulfur atom (a splitting-off atom), and a halogen atom (e.g., chlorine, bromine).

Examples of the group that splits off with a nitrogen atom include a heterocyclic group (preferably a 5- to 7-membered substituted or unsubstituted, saturated or unsaturated, aromatic (herein the term "aromatic" is used to embrace a substance that has (4n+2) cyclic conjugated electrons) or non-aromatic, monocyclic or condensed heterocyclic groups, more preferably a 5- to 6-membered heterocyclic group, in which the ring-forming atoms are selected from carbon, nitrogen and sulfur atoms and in addition at least one of hetero atoms selected from nitrogen, oxygen and sulfur atoms is incorporated, with specific examples of the heterocyclic group including succinimide, maleinimide, phthalimide, diglycolimide, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine parabanic acid, 1,2,4-triazolidine-3,5-dione, 2-pyridone, 4-pyridone, 2-pyrimidone, 6-pyridazone, 2-pyrazone, 2-amino-1,3,4-thiazolidine-4-one), a carbonamido group (e.g., acetamido, trifluoroacetamido), a sulfonamido group (e.g., methanesulfonamido, benzenesulfonamido), an arylazo group (e.g., phenylazo, naphthylazo), and a carbamoylamino group (e.g., N-methyl carbamoylamino).

Preferred of the group that splits off with a nitrogen atom are heterocyclic groups, more preferably aromatic heterocyclic groups having 1, 2, 3, or 4 nitrogen atom(s) as ring-forming atoms, or heterocyclic groups represented by the following formula (L).

formula (L)

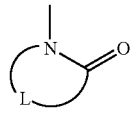

In formula (L), L represents a moiety that forms, together with the —NC(=O)—, a 5- to 6-membered nitrogen-containing heterocycle.

Examples of the moieties are enumerated in the explanation of the above-mentioned heterocyclic group, and such moieties as enumerated above are more preferred.

Particularly preferably L is a moiety that forms a 5-membered nitrogen-containing heterocycle.

Examples of the group that splits off with an oxygen atom include an aryloxy group (e.g., phenoxy, 1-naphthoxy), a heterocyclic oxy group (e.g., pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbamoyloxy), an aryloxycarbonyloxy group (e.g., phenoxycarbonyloxy), an alkoxycarbonyloxy group (e.g., methoxycarbonyloxy, ethoxycarbonyloxy), an alkylsulfonyloxy group (e.g., methanesulfonyloxy), and an arylsulfonyloxy group (e.g., benzenesulfonyloxy, toluenesulfonyloxy).

Preferred of the group that splits off with an oxygen atom are an aryloxy group, an acyloxy group, and a heterocyclic oxy group.

Examples of the group that splits off with a sulfur atom include an arylthio group (e.g., phenylthio, naphthylthio), a heterocyclic thio group (e.g., tetrazolylthio, 1,3,4-thiadiazolylthio, 1,3,4-oxazolylthio, benzimidazolylthio), an alkylthio group (e.g., methylthio, octylthio, hexadecylthio), an alkylsulfinyl group (e.g., methanesulfinyl), an arylsulfinyl group (e.g., benzenesulfinyl), an arylsulfonyl group (e.g., benzenesulfonyl), and an alkylsulfonyl group (e.g., methanesulfonyl).

Preferred of the group that splits off with a sulfur atom are an arylthio group and a heterocyclic thio group. A heterocyclic thio group is more preferred.

X may be substituted with a substituent. Examples of the substituent substituting on X include those enumerated as the substituent represented by R1.

X is preferably a group capable of being split-off upon a coupling reaction with an oxidized product of a developing agent, more preferably a group that can split off with a nitrogen atom, a group that can split off with an oxygen atom or a group that can split off with a sulfur atom, still more preferably a group that can split off with a nitrogen atom. Further preferably, the split-off group is the above-mentioned preferable examples for the group that splits off with a nitrogen atom, and they are preferable in the described order.

Preferable examples of X are explained in more detail below. The group that can split off with a nitrogen is preferable; and an aromatic heterocyclic group having at least two nitrogen atoms (preferably 2) (preferably a 5-membered aromatic heterocyclic group, such as a pyrazole group, optionally having a substituent) and a group represented by the above-mentioned formula (L) are particularly preferable.

X may be a group to give a photographically useful substance. Examples of the photographically useful substance include a development inhibitor, a desilvering accelerator, a redox compound, a dye, a coupler and the like, as well as their precursors.

In the present invention, it is preferable that X is not the above-described group to give a photographically useful substance.

In order to render the coupler immobile in the light-sensitive material, at least one of Q, R1, X and R2 has preferably 8 to 50 carbon atoms, more preferably 10 to 40 carbon atoms in total respectively, including carbon atoms of a substituent(s) that they may have.

Among the compounds represented by the formula (I) for use in the present invention, preferable compounds can be represented by formula (II).

The compounds (referred to also as a dye-forming coupler in the present specification) represented by formula (II) for use in the present invention is explained in detail.

formula (II)

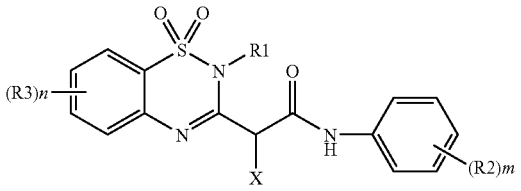

In formula (II), R1, R2, m and X each have the same meanings as those described in formula (I). Preferable ranges thereof are also the same.

In formula (II), R3 represents a substituent. Examples of the substituent are the same as those exemplified above as the substituent represented by R1. R3 is preferably a halogen atom (e.g., fluorine, chlorine, bromine), an alkyl group (e.g., methyl, isopropyl), an aryl group (e.g., phenyl, naphthyl), an alkoxy group (e.g., methoxy, isopropyloxy), an aryloxy group (e.g., phenoxy), an acyloxy group (e.g., acetyloxy), an amino group (e.g., dimethylamino, morpholino), an acylamino group (e.g., acetoamide), an sulfonamido group (e.g., methanesulfonamido, benzenesulfonamido), an alkoxycarbonyl group (e.g., methoxycarbonyl), an aryloxycarbonyl group (e.g., phenoxycarbonyl), a carbamoyl group (e.g., N-methylcarbamoyl, N,N-diethylcarbamoyl), a sulfamoyl group (e.g., N-methylsulfamoyl, N,N-diethylsulfamoyl), an alkylsulfonyl group (e.g., methanesulfonyl), an arylsulfonyl group (e.g., benzenesulfonyl), a cyano group, a carboxyl group, or a sulfo group.

n represents an integer of 0 to 4. When n is 2 or more, the plurality of R3s may be the same or different, and the R3s may bond with each other to form a ring.

In the present invention, preferably in the first embodiment, as the coupler represented by formula (I), a coupler, whose ultraviolet absorption density is high before color-forming (around the wavelength range of 340 nm to 400 nm), in which a molar extinction coefficient of a dye formed after color-forming is high, and in which ultraviolet absorption mentioned in the above is lower than coupler absorption before color-forming, is particularly preferably used.

Preferred specific examples of the couplers represented by formula (I) or (II) according to the present invention are shown below, but the present invention is not limited to these examples. Herein, the present invention also includes tautomers, in which the hydrogen atom at the coupling site (the hydrogen atom on the carbon atom to which X is substituting) is transferred on the nitrogen atom in the C═N portion bonding to the coupling site (the ring-constituting nitrogen atom that is not bonded with R1).

In the present specification, Me means a methyl group, Et means an ethyl group, and Ph means a phenyl group, respectively.

(1)

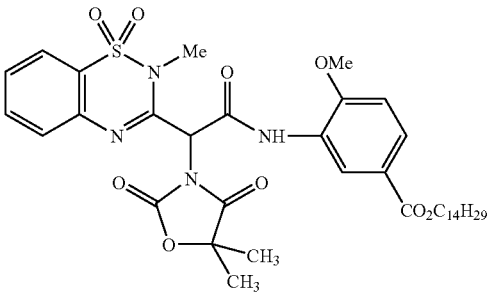

(2)

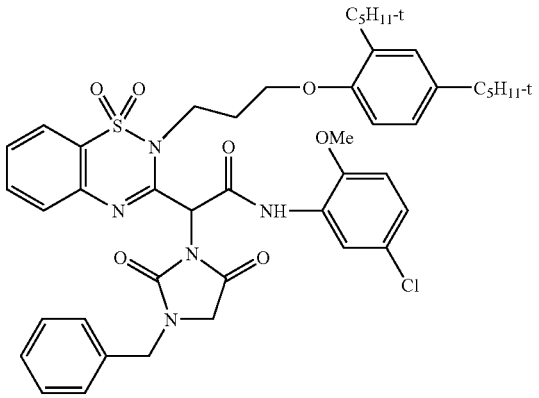

-continued
(3)
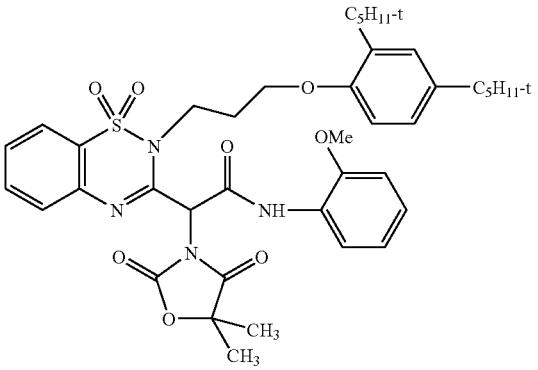
(4)
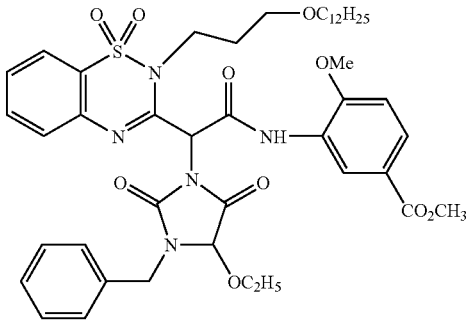
(5)
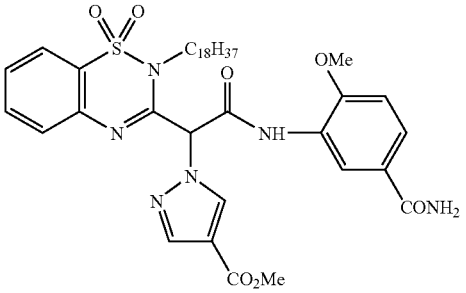
(6)
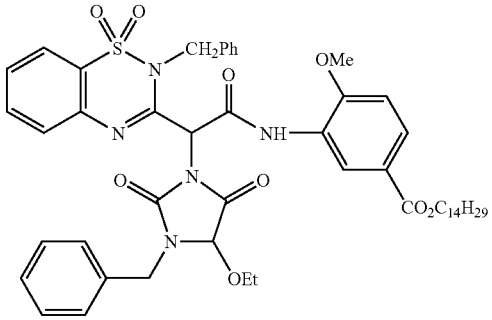
(7)
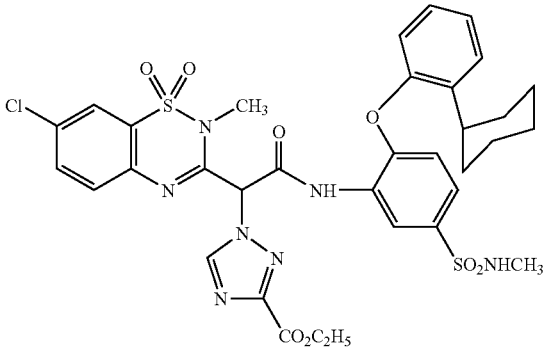
(8)
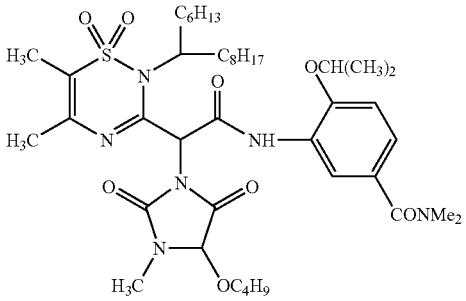
(9)
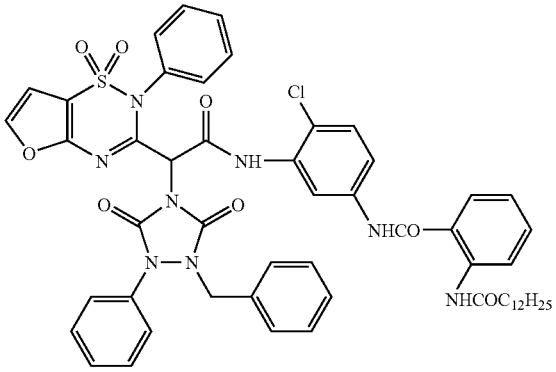
(10)
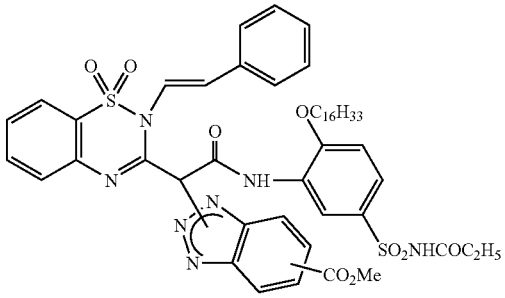

-continued
(11)
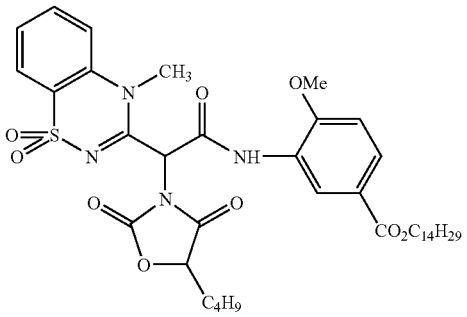
(12)
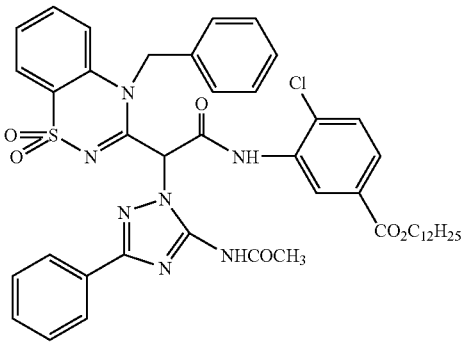
(13)
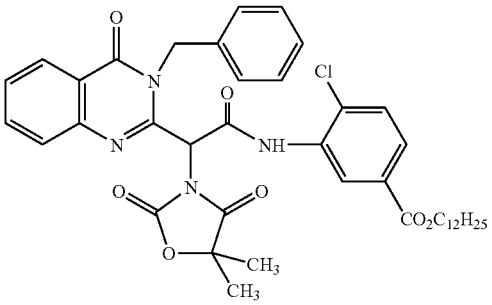
(14)
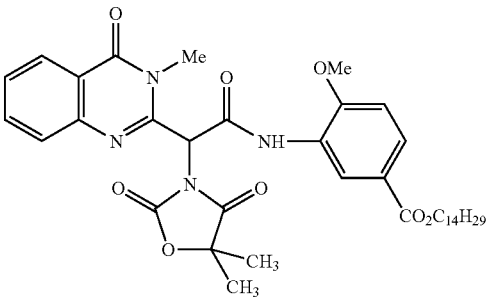
(15)
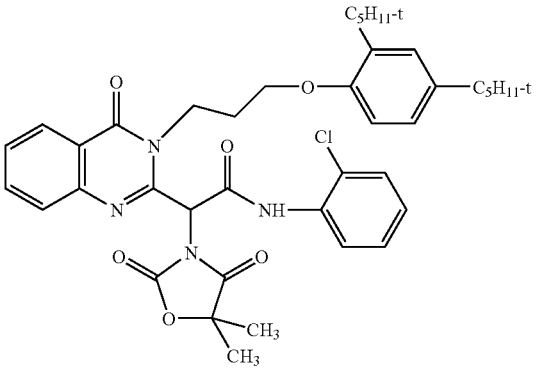
(16)
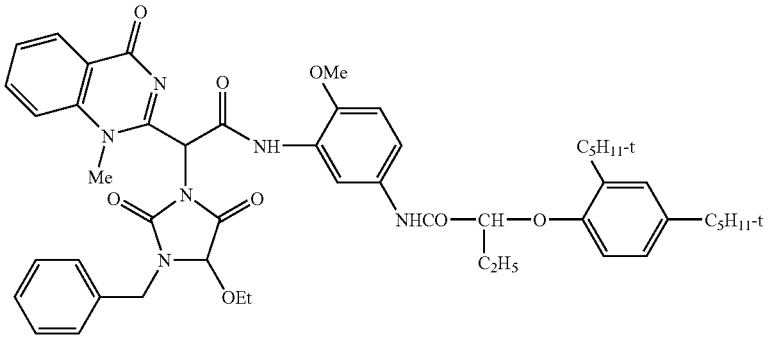

-continued
(17)
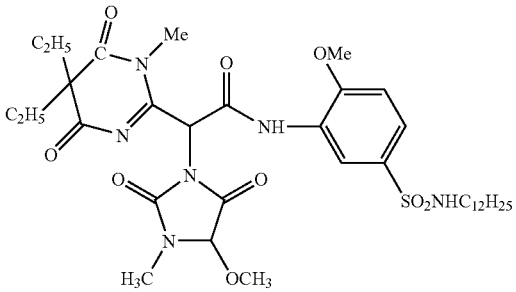
(18)
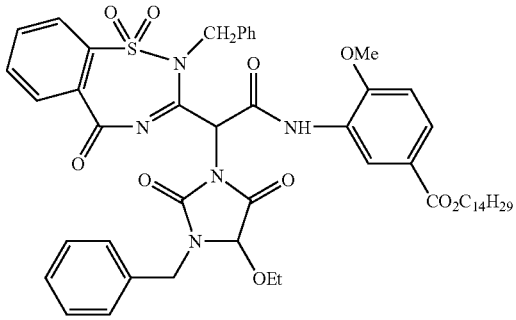
(19)
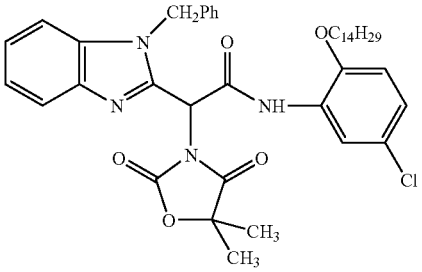
(20)
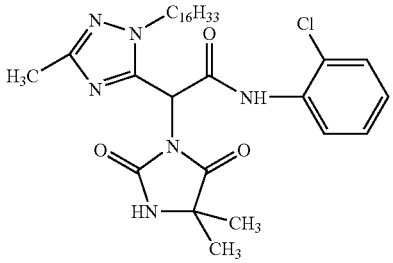
(21)
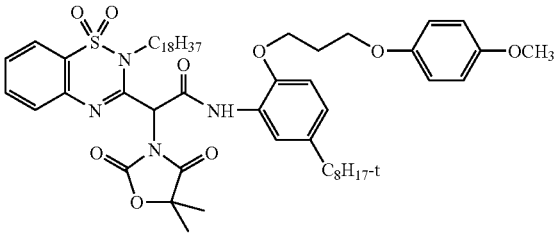
(22)
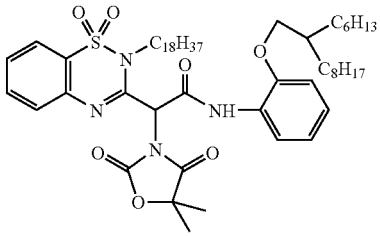
(23)
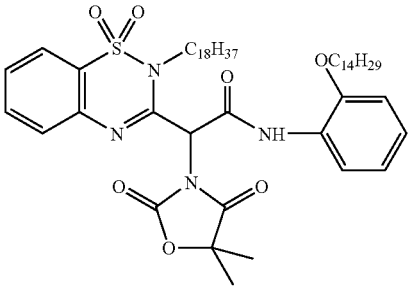
(24)
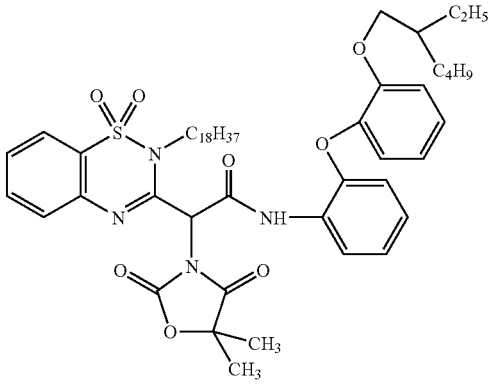

-continued
(25)
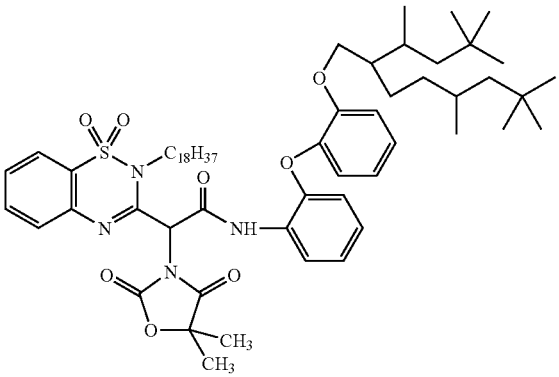
(26)
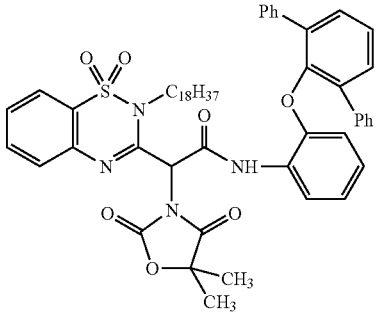
(27)
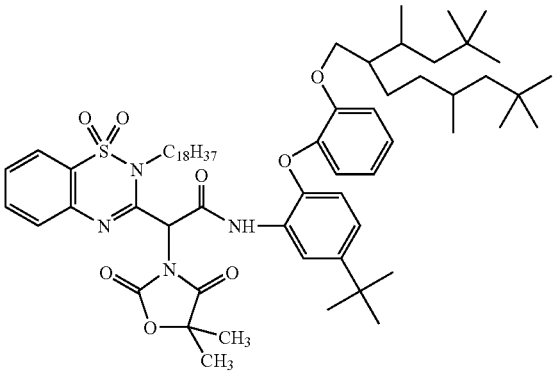
(28)
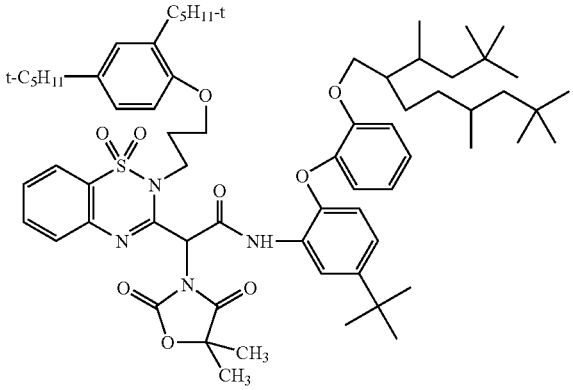
(29)
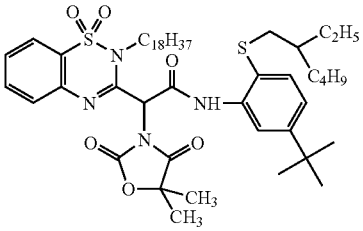
(30)
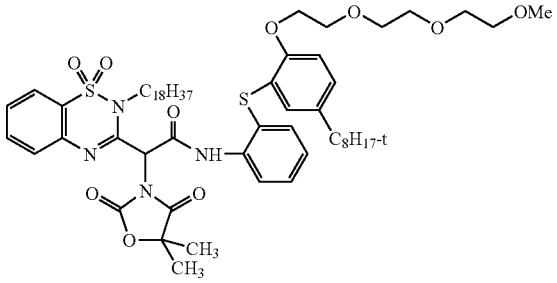
(31)
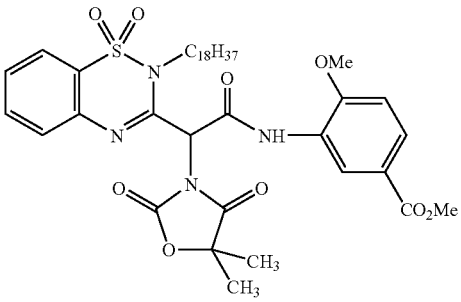
(32)
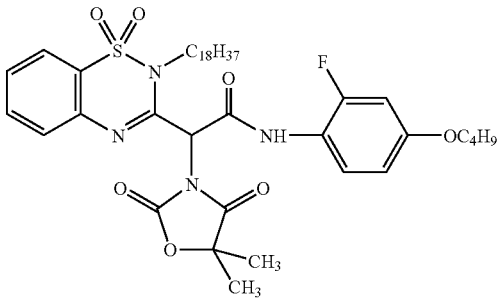

-continued
(33)
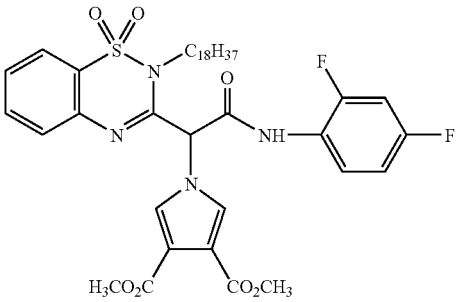
(34)
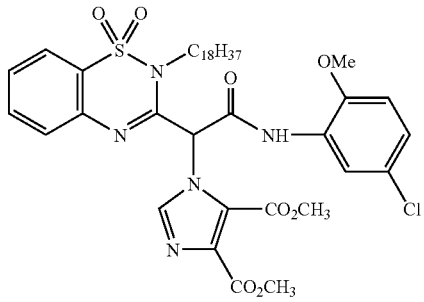
(35)
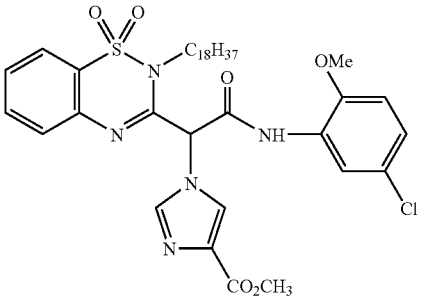
(36)
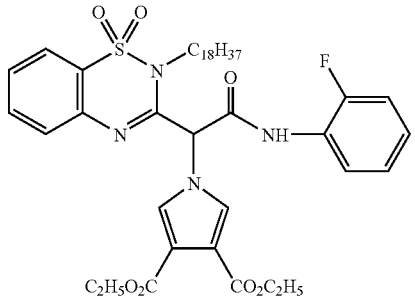
(37)
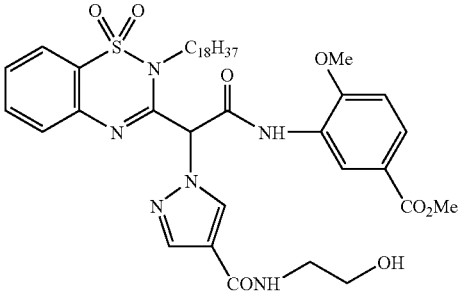
(38)
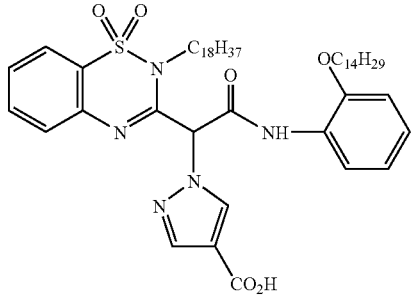
(39)
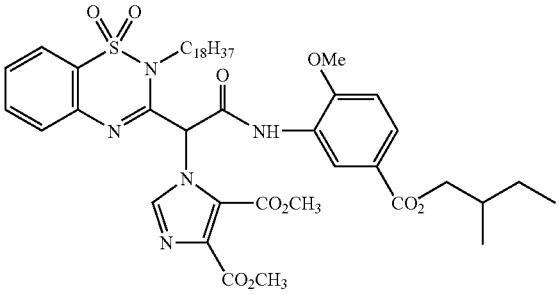
(40)
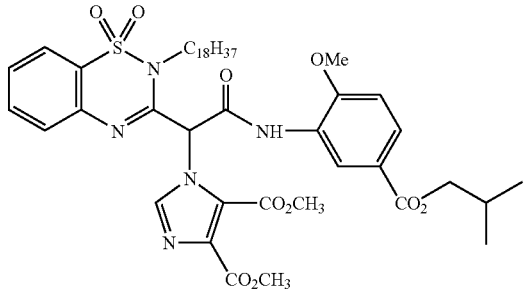
(41)
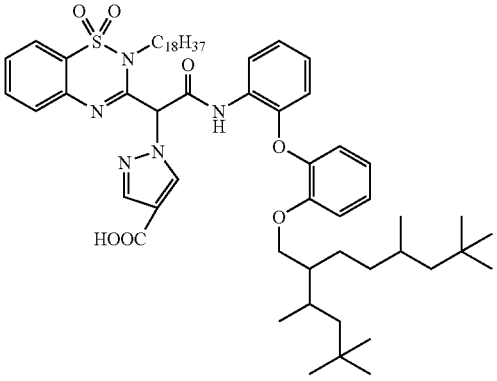
(42)
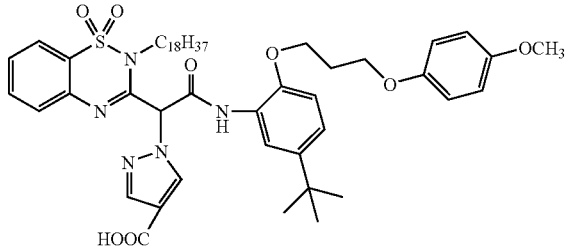

-continued
(43)
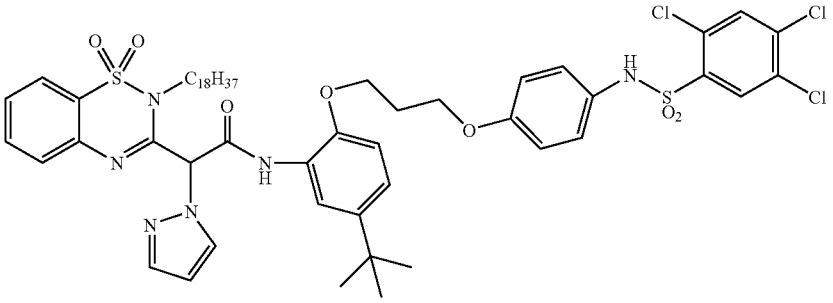
(44)
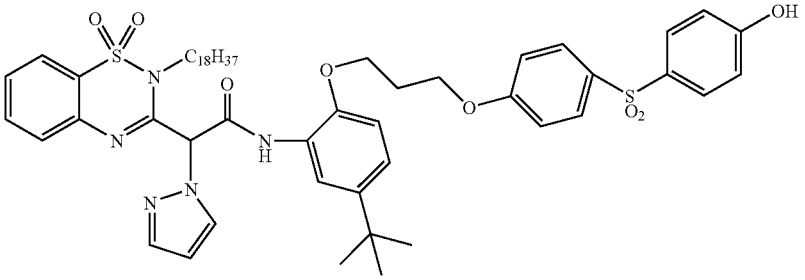
(45)
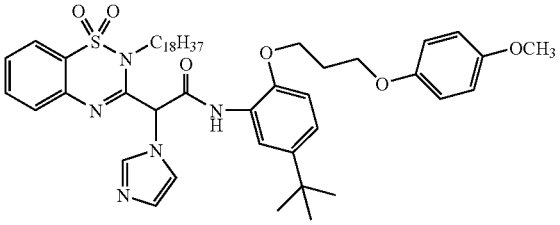
(46)
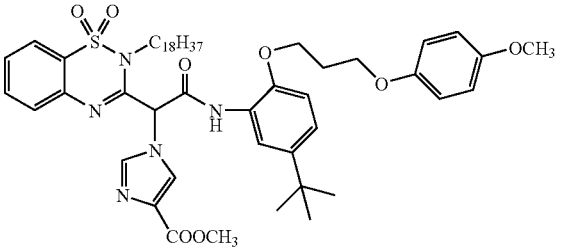
(47)
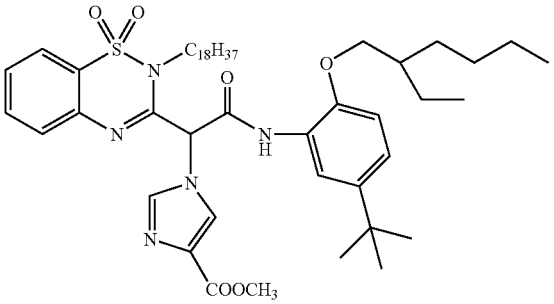
(48)
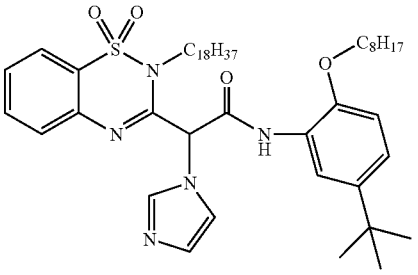
(49)
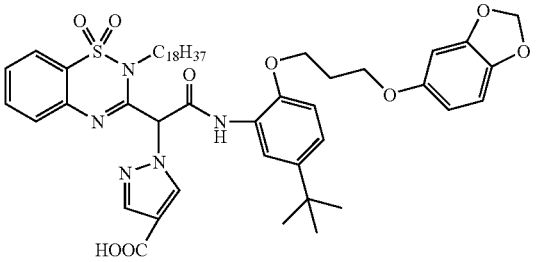
(50)
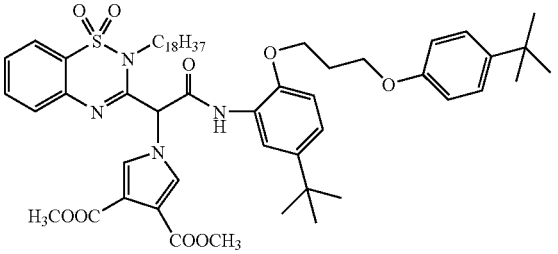

-continued
(51)
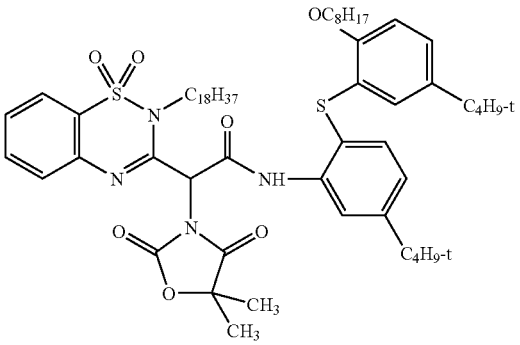
(52)
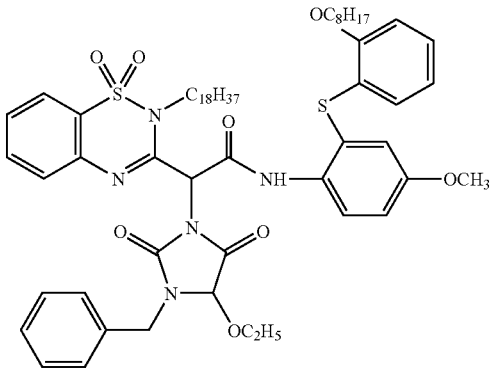
(53)
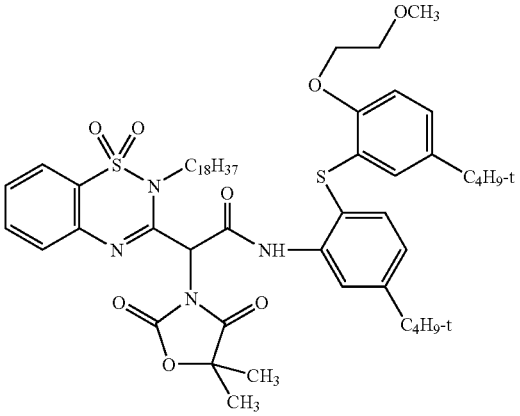
(54)
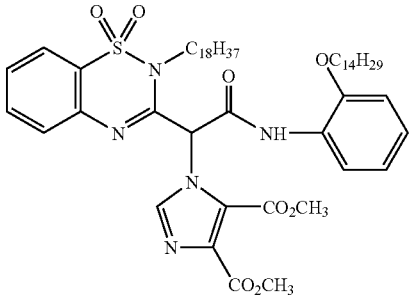
(55)
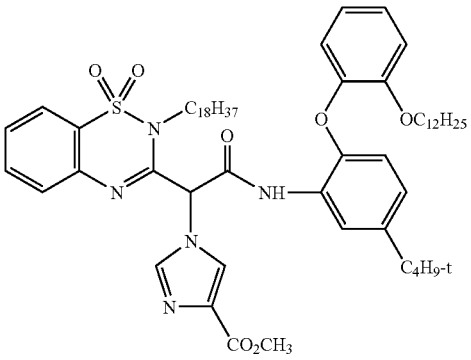
(56)
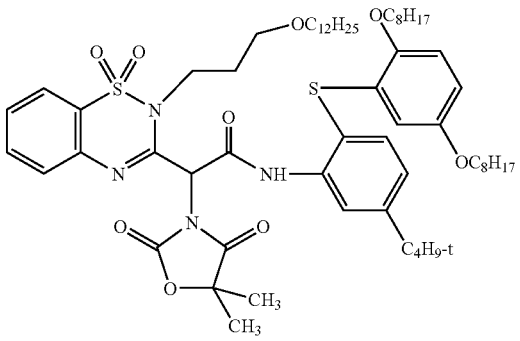

-continued
(57)
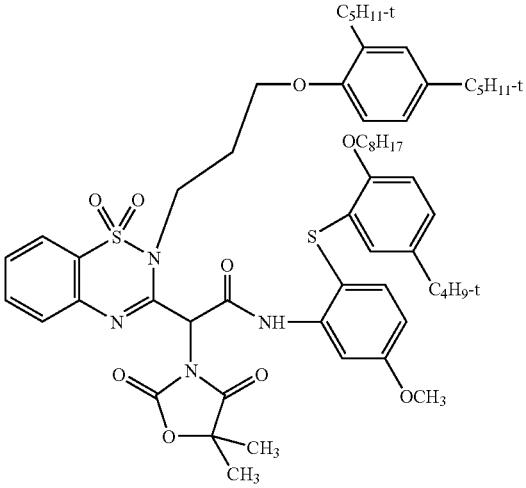
(58)
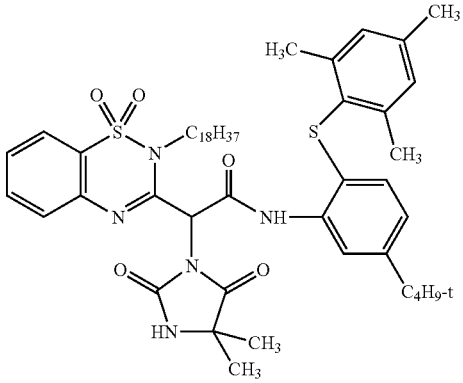
(59)
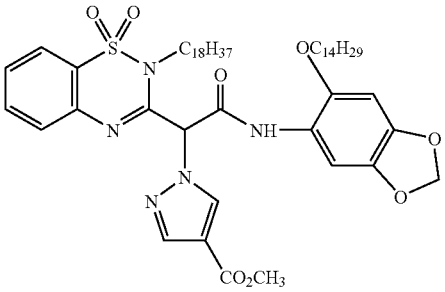
(60)
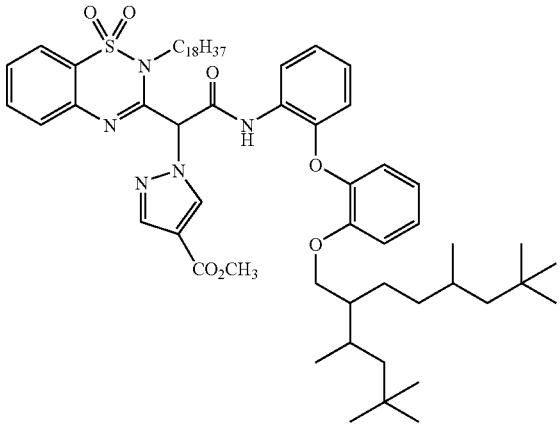
(61)
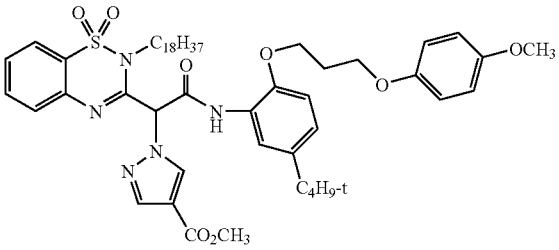
(62)
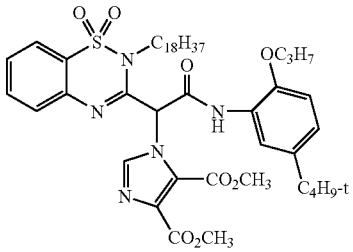
(63)
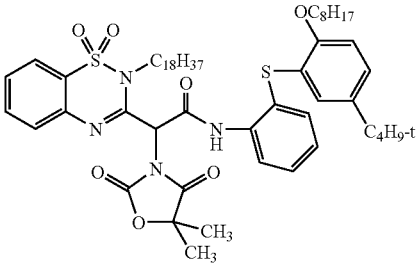
(64)
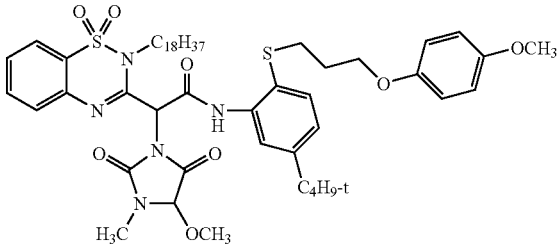

-continued (65)

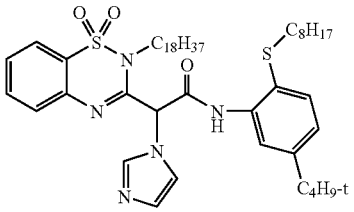

(66)

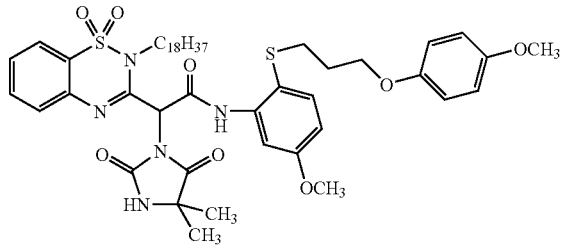

(67)

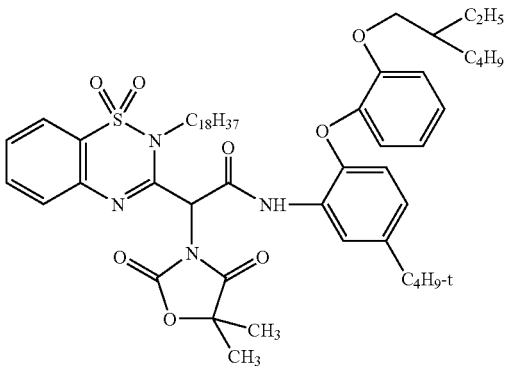

When any one of the exemplified compounds (which may also be referred to as a dye-forming coupler) shown above is referred to in the following description, a number X put in parentheses, that is, (X) attached to the exemplified compound is used to express the compound as "coupler (X)".

Specific synthetic examples of the compounds represented by the foregoing formula (I) and (II) are described below.

SYNTHETIC EXAMPLE 1

Synthesis of Coupler (1)

Coupler (1) was synthesized according to the following synthesis route:

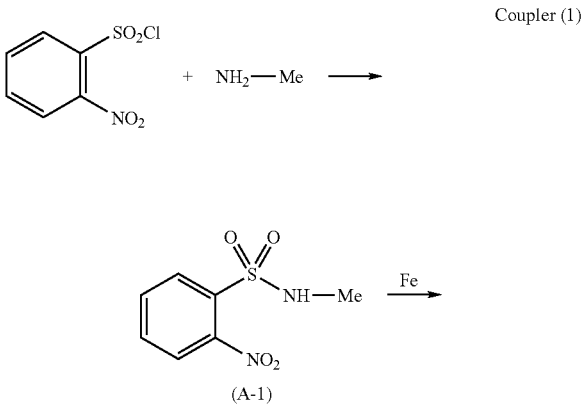

-continued

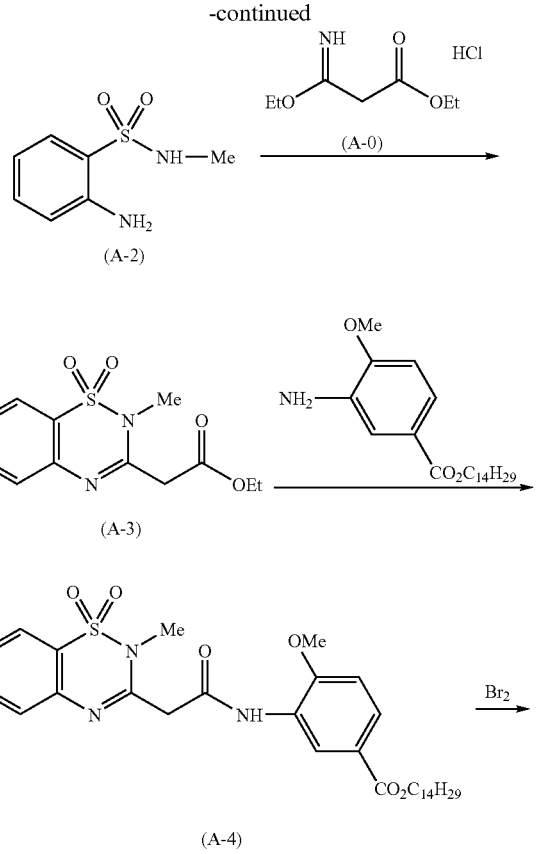

-continued

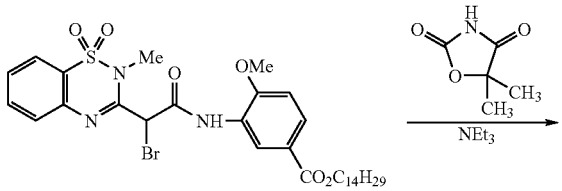

(A-5)

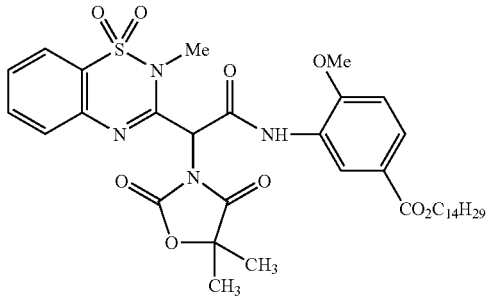

44.3 g of o-nitrobenzenesulfonyl chloride was gradually added, with stirring, to a mixture solution of 38.8 g of an aqueous 40% methylamine solution and 200 ml of acetonitrile, on an ice bath. The resulting reaction mixture was heated up to room temperature and stirred for another 1 hour. Thereafter, ethyl acetate and water were added, and the organic layer was separated from the aqueous layer. The organic layer was washed with dilute hydrochloric acid and then a saturated brine. After the organic layer was dried with magnesium sulfate anhydride, the solvent was removed by vacuum distillation. Crystallization from a mixed solvent of ethyl acetate and hexane gave 28.6 g of Compound (A-1).

44.8 g of reduced iron and 4.5 g of ammonium chloride were dispersed in a mixture of 270 ml of isopropanol and 45 ml of water, and heated for 1 hour under refluxing. To the resulting mixture, 25.9 g of Compound (A-1) was gradually added with stirring. After heating in refluxing for another 1 hour, insoluble matters were removed by a suction filtration through Celite. Ethyl acetate and water were added to the filtrate, and the organic layer was separated from the aqueous layer. The organic layer was washed with a saturated brine, and then dried with magnesium sulfate anhydride. The solvent was removed by vacuum distillation, to yield 21.5 g of Compound (A-2) as an oily product.

A solution of 18.9 g of Compound (A-2), 39.1 g of hydrochloride of iminoether (A-0) and 200 ml of ethyl alcohol was stirred with heating in refluxing for 1 day. Further, 19.2 g of hydrochloride of iminoether was added and stirred with heating in refluxing for another 1 day. Ethyl acetate and water were added, and the organic layer was separated from the aqueous layer. The organic layer was washed with dilute hydrochloric acid and a saturated brine, and then dried with magnesium sulfate anhydride. The solvent was removed by vacuum distillation. Crystallization from a mixed solvent of ethyl acetate and hexane gave 21.0 g of Compound (A-3).

A solution of 5.6 g of Compound (A-3), 7.2 g of 2-methoxy-5-tetradecyloxycarbonylaniline and 20 ml of m-dichlorobenzene was stirred with heating in refluxing for 6 hours. After cooling, crystallization by adding hexane gave 8.8 g of Compound (A-4).

To 110 ml of methylene chloride solution containing 5.4 g of Compound (A-4), 10 ml of methylene chloride solution containing 0.45 ml of bromine was added drop-wise on an ice bath. After the resultant mixture was stirred for 30 minutes at room temperature, methylene chloride and water were added, and the organic layer was separated from the aqueous layer. The organic layer was washed with a saturated brine, and then dried with magnesium sulfate anhydride. The solvent was removed by vacuum distillation, to obtain a crude product of Compound (A-5).

To a solution which was prepared by dissolving 3.5 g of 5,5-dimethyloxazolidine-2,4-dione and 3.8 ml of triethylamine in 110 ml of N,N-dimethyl acetoamide, a solution containing all the previously synthesized crude product of Compound (A-5) dissolved in 25 ml of acetonitrile was added drop-wise over 10 minutes at room temperature, and then stirred for 2 hours at room temperature. Ethyl acetate and water were added, and the organic layer was separated from the aqueous layer. The organic layer was washed with 0.1 normal aqueous potassium hydroxide solution, dilute hydrochloric acid and a saturated brine, and then dried with magnesium sulfate anhydride. The solvent was removed by vacuum distillation. The residue was purified on silica gel column chromatography using a mixed solvent of acetone and hexane as an eluate, and then recrystallized from a mixed solvent of ethyl acetate and hexane, to give 4.7 g of Coupler (1).

SYNTHETIC EXAMPLE 2

Synthesis of Coupler (3)

Coupler (3) was synthesized according to the following synthesis route:

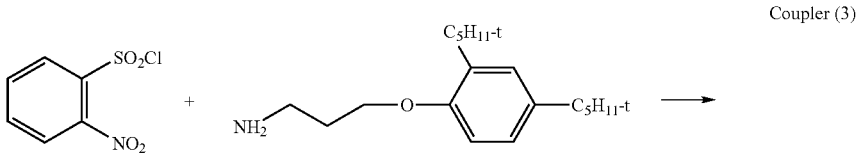

-continued
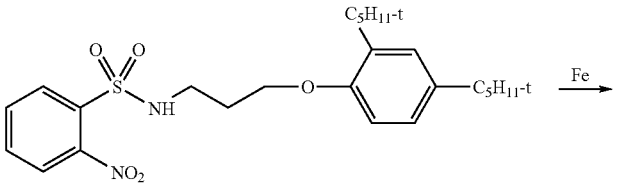
(B-1)
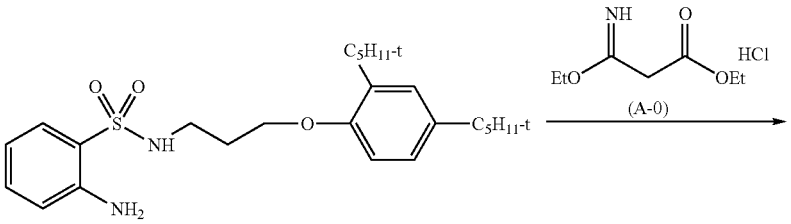
(B-2)
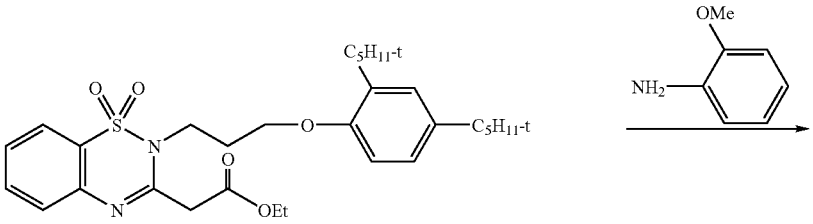
(B-3)
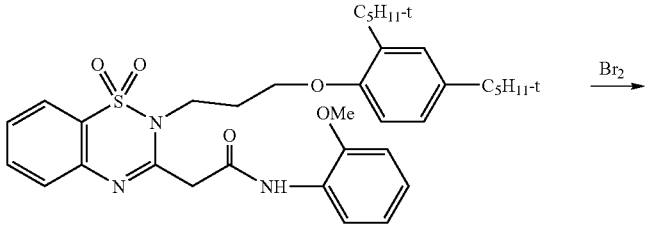
(B-4)
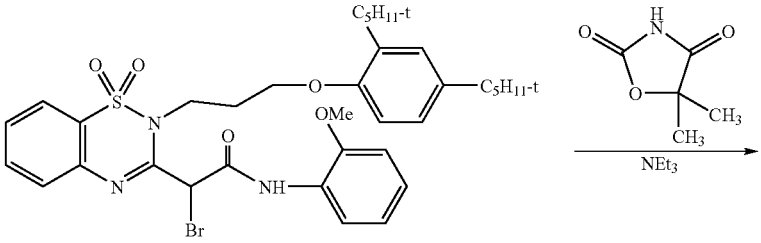
(B-5)
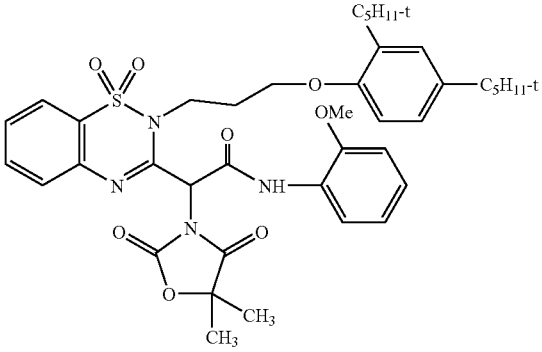

To a solution containing 438 g of 3-(2,4-di-t-amylphenoxy)propylamine, 210 ml of triethylamine and 1 liter of acetonitrile, 333 g of o-nitrobenzenesulfonyl chloride was gradually added with stirring on an ice bath. The resulting reaction mixture was heated up to room temperature and further stirred for 1 hour. Thereafter, ethyl acetate and water were added, and the organic layer was separated from the aqueous layer. The organic layer was washed with dilute hydrochloric acid and a saturated brine. After the organic layer was dried with magnesium sulfate anhydride, the solvent was removed by vacuum distillation. Crystallization from a mixed solvent of ethyl acetate and hexane gave 588 g of Compound (B-1).

84.0 g of reduced iron and 8.4 g of ammonium chloride were dispersed in a mixture of 540 ml of isopropanol and 90 ml of water, and heated in refluxing for 1 hour. To the resulting dispersion, 119 g of Compound (B-1) was gradually added with stirring. After heating in refluxing for another 2 hours, the reaction mixture was filtrated by a suction filtration through Celite. Ethyl acetate and water were added to the filtrate, and the organic layer was separated from the aqueous layer. The organic layer was washed with a saturated brine, and then dried with magnesium sulfate anhydride. The solvent was removed by vacuum distillation, to yield 111 g of Compound (B-2) as an oily product.

A solution of 111 g of Compound (B-2), 68.4 g of hydrochloride of iminoether (A-0) and 150 ml of ethyl alcohol was stirred with heating in refluxing for 1 hour. Additionally 4.9 g of hydrochloride of iminoether was added and stirred with heating in refluxing for 30 minutes. After cooling the reaction mixture, it was filtered under suction, 100 ml of p-xylene was added to the filtrate and then heated in refluxing for 4 hours while removing ethyl alcohol by distillation. The reaction solution was purified by a silica gel column chromatography using a mixed solvent of ethyl acetate and hexane as the eluate. Crystallization from methanol gave 93.1 g of Compound (B-3).

A solution of 40.7 g of Compound (B-3), 18.5 g of 2-methoxyaniline and 10 ml of p-xylene was stirred with heating in refluxing for 6 hours. Ethyl acetate and water were added, and the organic layer was separated from the aqueous layer. The organic layer was washed with dilute hydrochloric acid and a saturated brine, and then dried with magnesium sulfate anhydride. The solvent was removed by vacuum distillation. Purification of the residue by a silica gel column chromatography using a mixed solvent of ethyl acetate and hexane as the eluate gave 37.7 g of Compound (B-4) as an oily product.

To a solution of 24.8 g of Compound (B-4) in 400 ml of methylene chloride, 35 ml of methylene chloride solution containing 2.1 ml of bromine was added drop-wise on an ice bath. After the mixture was stirred for 30 minutes on an ice bath, methylene chloride and water were added, and the organic layer was separated from the aqueous layer. The organic layer was washed with a saturated brine, and then dried with magnesium sulfate anhydride. The solvent was removed by vacuum distillation, to obtain Compound (B-5) as a crude product.

To a solution of 15.5 g of 5,5-dimethyl oxazolidine-2,4-dione and 16.8 ml of triethylamine in 200 ml of N,N-dimethyl acetoamide, a solution containing all the previously synthesized crude product of Compound (B-5) dissolved in 40 ml of acetonitrile was added drop-wise over 10 minutes at room temperature. The resultant mixture was heated up to 40° C. and then stirred for 30 minutes. Ethyl acetate and water were added, and the organic layer was separated from the aqueous layer. The organic layer was washed with 0.1 normal aqueous potassium hydroxide solution, dilute hydrochloric acid and a saturated brine, and then dried with magnesium sulfate anhydride. The solvent was removed by vacuum distillation. The residue was purified by a silica gel column chromatography using a mixed solvent of acetone and hexane as the eluate. Crystallization from a mixed solvent of ethyl acetate and hexane gave 23.4 g of Coupler (3).

SYNTHETIC EXAMPLE 3

Synthesis of Coupler (6)

Coupler (6) was synthesized according to the following synthesis route:

Coupler (6)
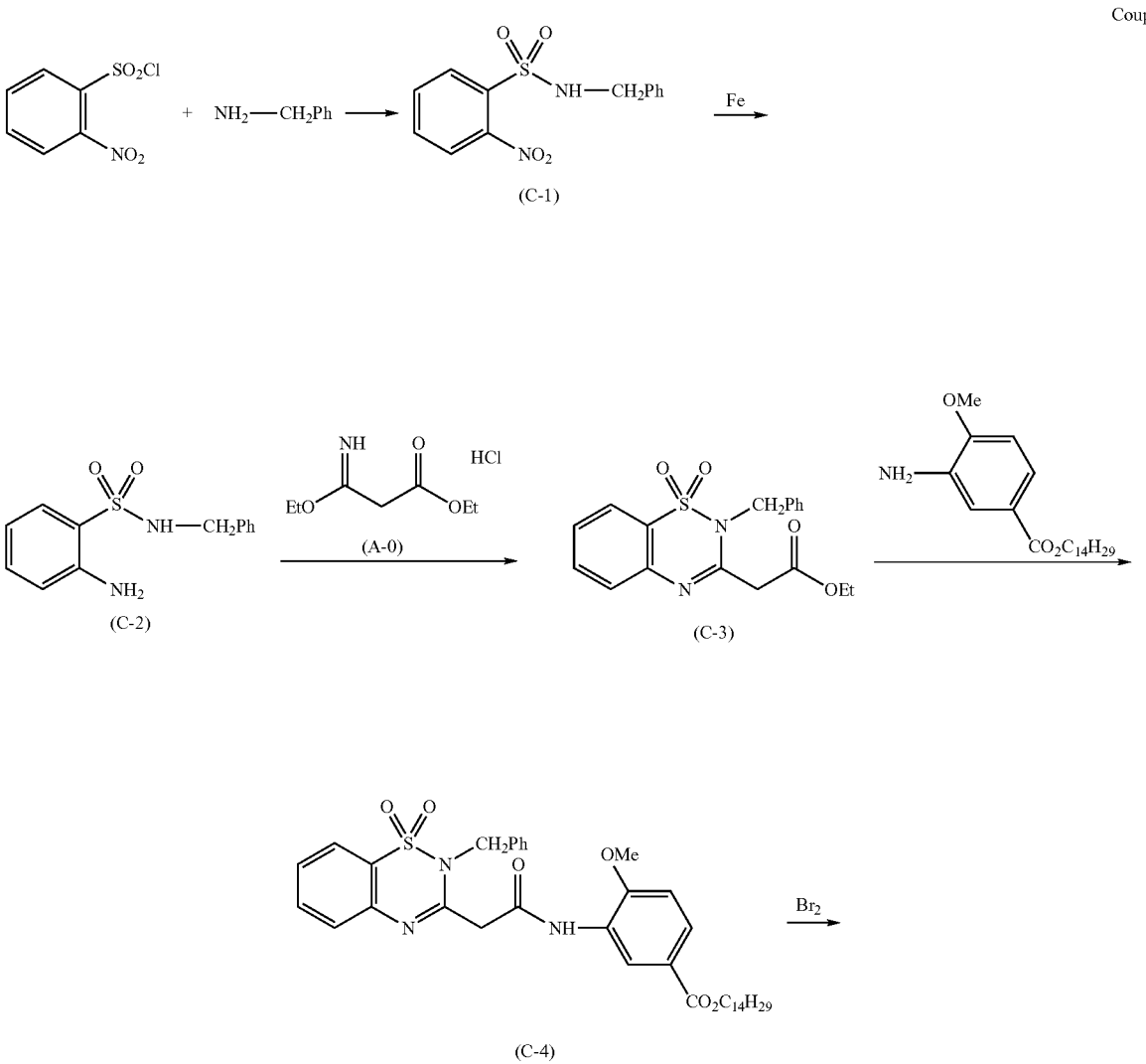

-continued
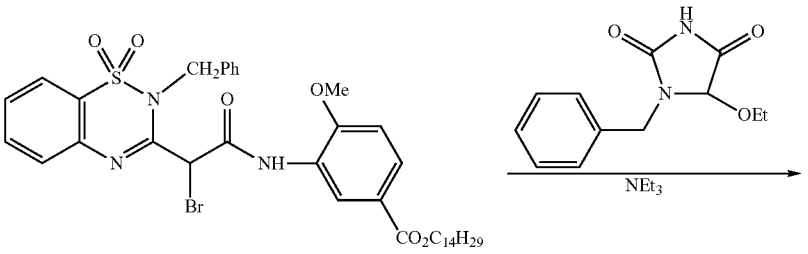
(C-5)
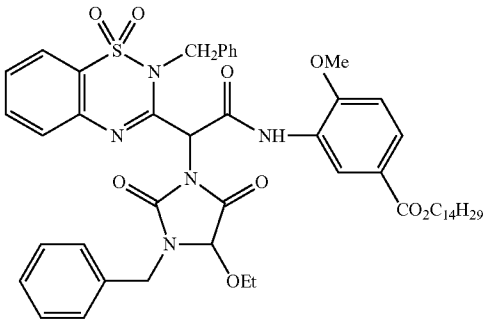

To a solution of 21.4 g of benzylamine in 200 ml of acetonitrile, 39.9 g of o-nitrobenzenesulfonyl chloride was gradually added with stirring on an ice bath. The resulting reaction mixture was heated up to room temperature. Further, 30 ml of triethylamine was added drop-wise and stirred for 1 hour. Thereafter, ethyl acetate and water were added, and the organic layer was separated from the aqueous layer. The organic layer was washed with dilute hydrochloric acid and then a saturated brine. After the organic layer was dried with magnesium sulfate anhydride, the solvent was removed by vacuum distillation. Crystallization from a mixed solvent of ethyl acetate and hexane gave 31.2 g of Compound (C-1).

44.8 g of reduced iron and 4.5 g of ammonium chloride were dispersed in a mixture of 270 ml of isopropanol and 45 ml of water, and heated for 1 hour in refluxing. To the resulting mixture, 29.2 g of Compound (C-1) was gradually added with stirring. After heating in refluxing for another 1 hour, the reaction mixture was filtrated by a suction filtration through Celite. Ethyl acetate and water were added to the filtrate, and the organic layer was separated from the aqueous layer. The organic layer was washed with a saturated brine, and then dried with magnesium sulfate anhydride. The solvent was removed by vacuum distillation, to yield 25.5 g of Compound (C-2) as an oily product.

A solution of 19.7 g of Compound (C-2) and 22.0 g of hydrochloride of iminoether (A-0) in 200 ml of ethyl alcohol was stirred with heating in refluxing for 4 hours. Further, 19.7 g of hydrochloride of the iminoether was added and stirred with heating under reflux for 4 hours. Additionally 13 g of p-toluene sulfonic acid monohydrate was added and stirred with heating in refluxing for 1 hour. Ethyl acetate and water were added, and the organic layer was separated from the aqueous layer. The organic layer was washed with dilute hydrochloric acid and a saturated brine, and then dried with magnesium sulfate anhydride. The solvent was removed by vacuum distillation. Crystallization from a mixed solvent of ethyl acetate and hexane gave 3.2 g of Compound (C-3).

A solution of 2.9 g of Compound (C-3), 2.9 g of 2-methoxy-5-tetradecyloxycarbonylaniline in 20 ml of o-dichlorobenzene was stirred for 6 hours with heating in refluxing. Ethyl acetate and water were added, and the organic layer was separated from the aqueous layer. The organic layer was washed with dilute hydrochloric acid and a saturated brine, and then dried with magnesium sulfate anhydride. The solvent was removed by vacuum distillation. The residue was purified by a silica gel column chromatography using a mixed solvent of ethyl acetate and hexane as the eluate. Crystallization from a mixed solvent of ethyl acetate and hexane gave 3.8 g of Compound (C-4).

To a solution containing 3.4 g of Compound (C-4) in 100 ml of methylene chloride, 10 ml of methylene chloride solution containing 0.26 ml of bromine was added drop-wise on an ice bath. After the mixture was stirred for 30 minutes at room temperature, methylene chloride and water were added, and the organic layer was separated from the aqueous layer. The organic layer was washed with a saturated brine, and then dried with magnesium sulfate anhydride. The solvent was removed by vacuum distillation, to obtain a crude product of Compound (C-5).

To a solution of 3.5 g of 1-benzyl-5-ethoxyhydantoin and 2.1 ml of triethylamine in 100 ml of N,N-dimethyl acetoamide, a solution containing all the previously synthesized crude product of Compound (C-5) dissolved in 20 ml of acetonitrile was added drop-wise over 30 minutes at room temperature, and then stirred at 40° C. for 2 hours. Ethyl acetate and water were added, and the organic layer was separated from the aqueous layer. The organic layer was washed with 0.1 normal aqueous potassium hydroxide solution, dilute hydrochloric acid and a saturated brine, and then dried with magnesium sulfate anhydride. The solvent was removed by vacuum distillation. The residue was purified by a silica gel column chromatography using a mixed solvent of ethyl acetate and hexane as the eluate. Crystallization from a mixed solvent of ethyl acetate and hexane gave 3.0 g of Coupler (6).

SYNTHETIC EXAMPLE 4

Synthesis of Coupler (11)

Coupler (11) was synthesized according to the following synthesis route:

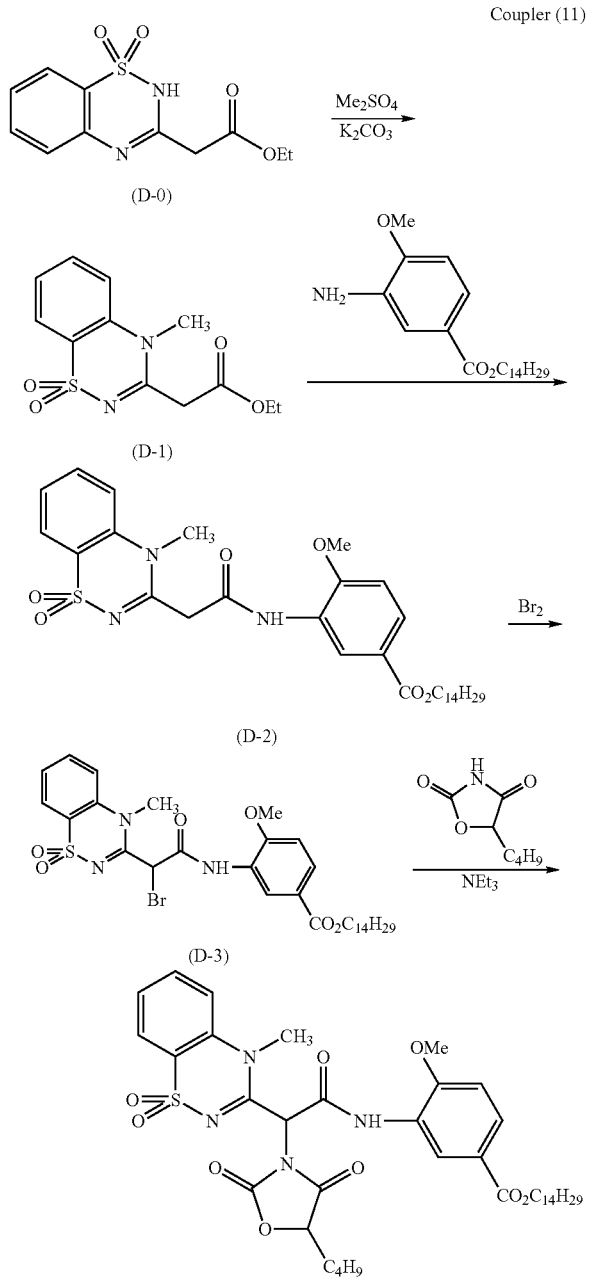

To a solution of 26.8 g of Compound (D-0) (Coupler-I described in U.S. Pat. No. 3,841,880) and 16.6 g of potassium carbonate in 300 ml of acetone, 13.9 g of dimethyl sulfate was added drop-wise and stirred for 2 hours with heating in refluxing. Ethyl acetate and water were added, and the organic layer was separated from the aqueous layer. The organic layer was washed with dilute hydrochloric acid and a saturated brine, and then dried with magnesium sulfate anhydride. The solvent was removed by vacuum distillation. The residue was purified by a silica gel column chromatography using a mixed solvent of acetone and hexane as the eluate. Crystallization from a mixed solvent of ethyl acetate and hexane gave 5.6 g of Compound (D-1). At the same time, 10.9 g of Compound (A-3) was obtained as a by-product. Coupler (1) may be synthesized using Compound (A-3) thus prepared.

A solution of 5.4 g of Compound (D-1) and 7.3 g of 2-methoxy-5-tetradecyloxycarbonylaniline in 50 ml of o-dichlorobenzene was stirred for 6 hours with heating in refluxing. Ethyl acetate and water were added, and the organic layer was separated from the aqueous layer. The organic layer was washed with dilute hydrochloric acid and a saturated brine, and then dried with magnesium sulfate anhydride. The solvent was removed by vacuum distillation. Crystallization from a mixed solvent of ethyl acetate and methanol gave 9.1 g of Compound (D-2).

To a solution of 4.8 g of Compound (D-2) in 100 ml of methylene chloride, 10 ml of a methylene chloride solution containing 0.4 ml of bromine was added drop-wise on an ice bath. The reaction mixture was stirred for 30 minutes on an ice bath. Thereafter, methylene chloride and water were added, and the organic layer was separated from the aqueous layer. The organic layer was washed with a saturated brine, and then dried with magnesium sulfate anhydride. The solvent was removed by vacuum distillation, to obtain a crude product of Compound (D-3).

To a solution of 3.8 g of 5-butyloxazolidine-2,4-dione and 3.4 ml of triethylamine dissolved in 100 ml of N,N-dimethyl acetamide, a solution containing all the previously synthesized crude product of Compound (D-3) dissolved in 50 ml of N,N-dimethylacetamide was added drop-wise at room temperature over 30 minutes, and the resultant mixture was stirred for 1 hour at room temperature. Ethyl acetate and water were added, and the organic layer was separated from the aqueous layer. The organic layer was washed with 0.1 normal aqueous potassium hydroxide solution, dilute hydrochloric acid and a saturated brine, and then dried with magnesium sulfate anhydride. The solvent was removed by vacuum distillation. The residue was purified by a silica gel column chromatography using a mixed solvent of acetone, tetrahydrofuran, and hexane as the eluate. Crystallization from a mixed solvent of ethyl acetate and hexane gave 2.1 g of Coupler (11).

SYNTHETIC EXAMPLE 5

Synthesis of Coupler (13)

Coupler (13) was synthesized in the synthesis route shown below.

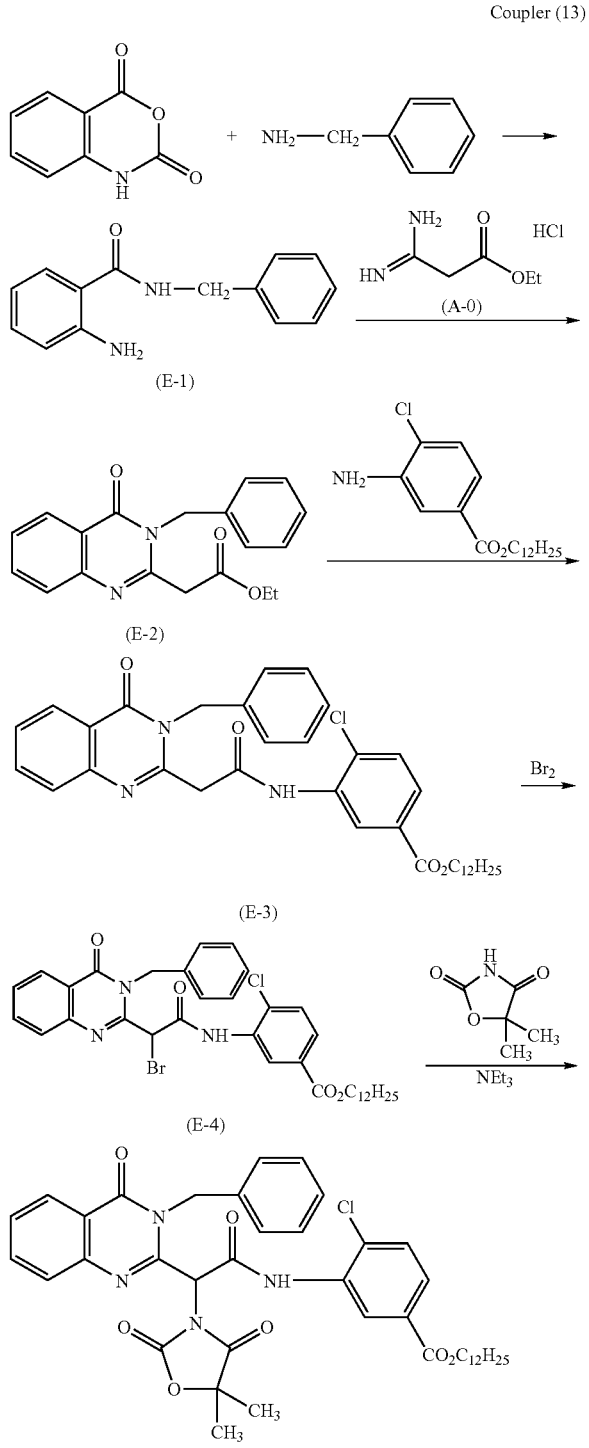

32.2 g of benzylamine was added, drop-wise, to 200 ml of an acetonitrile solution containing 48.9 g of isatoic acid anhydride, and the resulting mixture was stirred. The resulting mixture was heated up to 60° C. and further stirred for 10 minutes. Thereafter, ethyl acetate and water were added thereto, and the organic layer was separated from the aqueous layer. The organic layer was dried with magnesium sulfate anhydride, and then the solvent was removed by vacuum distillation. Crystallization from a mixed solvent of ether and hexane gave 54.6 g of Compound (E-1).

200 ml of an ethyl alcohol solution containing 24.9 g of Compound (E-1), 21.6 g of hydrochloride of iminoether (A-0) and 10.5 g of p-toluenesulfonic acid monohydrate was stirred for 3 hours with heating under reflux. After cooling, 21.6 g of hydrochloride of iminoether was added and further stirred with heating under reflux for 1 hour. Ethyl acetate and water were added, and the organic layer was separated from the aqueous layer. The organic layer was dried with magnesium sulfate anhydride. The solvent was removed by vacuum distillation. Crystallization from a mixed solvent of ether and hexane gave 33.6 g of Compound (E-2).

50 ml of p-xylene solution containing 6.5 g of Compound (E-2) and 6.5 g of 2-chloro-5-dodecyloxycarbonylaniline was stirred for 2 hours with heating under reflux. Further, 0.2 g of p-toluenesulfonic acid monohydrate was added and stirred for 4 hours with heating under reflux. Ethyl acetate and water were added, and the organic layer was separated from the aqueous layer. The organic layer was washed with 1-normal aqueous solution of hydrochloric acid and a saturated brine, and then dried with magnesium sulfate anhydride. The solvent was removed by vacuum distillation. Crystallization from a mixed solvent of ethyl acetate and hexane gave 6.7 g of Compound (E-3).

To 70 ml of a methylene chloride solution containing 5.5 g of Compound (E-3), 15 ml of a methylene chloride solution containing 0.48 ml of bromine was added drop-wise under cooling with ice. After the mixture was stirred at room temperature for 30 minutes, methylene chloride and water were added, and the organic layer was separated from the aqueous layer. The organic layer was washed with a saturated brine, and then dried with magnesium sulfate anhydride. The solvent was removed by vacuum distillation, to obtain a crude product of Compound (E-4).

To a solution which was prepared by dissolving 3.5 g of 5,5-dimethyloxazolidine-2,4-dione and 3.8 ml of triethylamine in 50 ml of N,N-dimethyl acetoamide, a solution containing all the previously synthesized crude product of Compound (E-4) dissolved in 50 ml of N,N-dimethyl acetoamide was added drop-wise over 10 minutes at room temperature, and then stirred for 1 hour at room temperature. Ethyl acetate and water were added, and the organic layer was separated from the aqueous layer. The organic layer was washed with 1 normal aqueous solution of potassium carbonate, 1 normal aqueous solution of hydrochloric acid and a saturated brine, and then dried with magnesium sulfate anhydride. The solvent was removed by vacuum distillation. Purification of the residue by silica gel column chromatography using a mixed solvent of ethyl acetate and hexane as the eluate gave 4.0 g of Coupler (13) as an amorphous product.

When the light-sensitive material of the present invention, preferably of the first embodiment, is a transmission-type color photographic light-sensitive material, it is enough for the light-sensitive material to have at least one light-sensitive layer on a support. A typical example thereof is a silver halide photographic light-sensitive material comprising, on a support, at least one light-sensitive layer consisting of two or more silver halide emulsion layers whose color sensitivities are substantially the same, but whose light-sensitivities are different from each other. Said light-sensitive layer is a unit light-sensitive layer that has a color sensitivity to any of blue light, green light and red light. In a multi-layer silver halide color photographic light-sensitive material, such unit light-sensitive layers are generally arranged in the order of a red-sensitive layer, a green-sensitive layer and a blue-sensitive layer from the support side. However, according to the intended use, this order of arrangement can be reversed. Alternatively, the layers may be arranged such that sensitive layers sensitive to the same color can sandwich another sensitive layer sensitive to a different color. Non-sensitive layers can be provided as an interlayer between the silver halide light-sensitive layers, or as the uppermost layer or the lowermost layer. These non-sensitive layers can contain, for example, couplers, DIR compounds, and color-mixing inhibitors, which are described below. Each of the silver halide emulsion layers constituting unit photosensitive layers can preferably take a two-layer constitution composed of a high-sensitive emulsion layer and a low-sensitive emulsion layer, as described in DE 1 121 470 or GB Patent No. 923 045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support.

Specific examples of the order include an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH, stated from the side most away from the support.

As described in JP-B-55-34932 ("JP-B" means examined Japanese patent publication), an order of a blue-sensitive layer/GH/RH/GL/RL stated from the side most away from the support is also possible. Further as described in JP-A-56-25738 and JP-A-62-63936, an order of a blue-sensitive layer/GL/RL/GH/RH stated from the side most away from the support is also possible.

Further as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer stated from the side away from support can be taken. In the case of four layers or more layers, the arrangement can be varied as above.

In order to improve color reproduction, as described in U.S. Pat. Nos. 4,663,271, 4,705,744, and 4,707,436, and JP-A-62-160448 and JP-A-63-89850, it is preferable to form a donor layer (CL), which has a spectral sensitivity distribution different from those of a principal (main) light-sensitive layer, such as BL, GL and RL, and which has an inter-layer effect, in a position adjacent or in close proximity to the principal light-sensitive layer.

The silver halide that can be used in the present invention, preferably in the first embodiment, is preferably silver iodobromide, silver iodochloride or silver iodochlorobromide, each containing about 30 mol % or less of silver iodide. The silver halide is particularly preferably silver iodobromide or silver iodochlorobromide, each containing about 2 mol % to about 10 mol % of silver iodide.

In the present invention, preferably in the first embodiment, silver halide grains in the photographic emulsion may have any of various crystalline shapes. Examples of the crystalline shapes include regular crystals, such as cubes, octahedrons, and tetradecahedrons; irregular crystals, such as spherical crystals and tabular crystals; crystals having crystal defect such as twin plane; and a mixture of grains of these crystalline shapes.

The silver halide grains may be fine grains whose grain diameter is about 0.2 μm or less, or large-size grains whose diameter of the projected area is up to about 10 μm. The silver halide emulsion may be a monodispersed emulsion or a polydispersed emulsion.

The silver halide photographic emulsion that can be used in the present invention, preferably in the first embodiment, can be prepared, for example, according to the methods described in Research Disclosure (hereinafter abbreviated to as RD) No. 17643 (December 1978), pp. 22-23, "I. Emulsion preparation and types"; RD No. 18716 (November 1979), p. 648; RD No. 307105 (November 1989), pp. 863-865; by P. Glafkides in "Chemie et Phisique Photographique," Paul Montel, 1967; by G. F. Duffin in "Photographic Emulsion Chemistry," Focal Press, 1966; by V. L. Zelikman et al. in "Making and Coating of Photographic Emulsion," Focal Press, 1964; and the like.

Monodispersed emulsions, described in U.S. Pat. Nos. 3,574,628 and 3,655,349, and U.K. Patent No. 1,413,748, can also be preferably used.

Further, in the present invention, preferably in the first embodiment, use can be made of tabular grains whose aspect ratio is about 3 or more. In particular, for the purpose for improving preservability with the lapse of time, use can be preferably made of a silver halide emulsion, in which 50% or more of the projected area of all the silver halide grains was occupied by tabular silver halide grains each having an aspect ratio of 8 or more.

There is no particular restriction on the upper limit of the aspect ratio, but the aspect ratio is preferably 30 or less. The silver halide emulsion containing tabular grains may be easily prepared using each of the methods described, for example, by Gutoff, "Photographic Science and Engineering", Vol. 14, pp. 248-257 (1970); in U.S. Pat. No. 4,434,226, No. 4,414,310, No. 4,433,048 and No. 4,439,520, and GB Patent No. 2,112,157.

As to the crystal structure, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of grains having various crystalline shapes may be used.

The silver halide emulsion may be any of a surface latent image-type emulsion which predominantly forms a latent image on the surface of the silver halide grain, an internal latent image-type emulsion which predominantly forms a latent image in the interior of the silver halide grain, and another type of emulsion which forms a latent image both on the surface and in the interior of the silver halide grain. However, the emulsion for use in the present invention, preferably in the first embodiment, must be a negative type emulsion. The internal latent image type emulsion may be a core/shell internal latent image type emulsion described in JP-A-63-264740. The method of preparing this core/shell internal latent image type emulsion is described in JP-A-59-133542. Although the thickness of the shell of this emulsion depends on, for example, development conditions, it is preferably 3 to 40 nm, and especially preferably 5 to 20 nm.

The silver halide emulsion is generally subjected to physical ripening, chemical ripening, and spectral sensitization steps before it is used. Additives for use in these steps are described in R.D. Nos. 17643, 18716, and 307105, and they are summarized in a table, which will be shown later. In the light-sensitive material of the present invention, preferably in the first embodiment, it is possible to mix, in a single layer, two or more types of emulsions different in at least one of characteristics of a light-sensitive silver halide emulsion, i.e., a grain size, a grain size distribution, a halogen composition, a grain shape, and a sensitivity. It is preferable to apply surface-fogged silver halide grains described in U.S. Pat. No. 4,082,553, internally fogged silver halide grains described in U.S. Pat. No. 4,626,498 and JP-A-59-214852, or colloidal silver, in light-sensitive silver halide emulsion layers and/or substantially non-light-sensitive hydrophilic colloid layers. The internally- or surface-fogged silver halide grain means a silver halide grain which can be developed uniformly (non image-wise) regardless of whether it exists at a non-exposed portion or an exposed portion of the light-sensitive material. A method of preparing the internally- or surface-fogged silver halide grain is described in U.S. Pat. No. 4,626,498 and JP-A-59-214852. Silver halides that form the internal nuclei of an internally fogged core/shell type silver halide grain may have different halogen compositions. As the internally or surface-fogged silver halide, any of silver chloride, silver chlorobromide, silver iodobromide and silver chloroiodobromide can be used. The average grain size of these fogged silver halide grains is preferably 0.01 to 0.75 μm, and particularly preferably 0.05 to 0.6 μm. The grain shape may be a regular grain shape. Although the emulsion may be a polydisperse emulsion, it is preferably a monodisperse emulsion (in which at least 95% in mass or in the number of silver halide grains have grain diameters falling within a range of ±40% of the average grain diameter).

In the present invention, preferably in the first embodiment, it is preferable to use non-light-sensitive fine grain silver halide. The non-light-sensitive fine grain silver halide is a silver halide fine grain which is not sensitive to light during imagewise exposure for obtaining a dye image, and is not substantially developed during processing. These silver halide fine grains are preferably not fogged in advance. In the fine grain silver halide, the content of silver bromide is any of 0 to 100 mole %. The fine grain-silver halide may contain silver chloride and/or silver iodide, if necessary. The fine grain silver halide preferably contains silver iodide of 0.5 to 10 mol %. The average grain diameter (the average value of a diameter of a circle whose area is equivalent to the projected area of an individual grain) of the fine grain silver halide is preferably 0.01 to 0.5 μm, more preferably 0.02 to 0.2 μm.

The fine grain silver halide may be prepared following the same procedure as for a conventional light-sensitive silver halide grains. The surface of each silver halide grain need not be optically sensitized nor spectrally sensitized. However, before the silver halide grains are added to a coating solution, it is preferable to add known stabilizers, such as triazole-series compounds, azaindene-series compounds, benzothiazolium-series compounds, mercapto-series compounds and zinc compounds. Colloidal silver may be added to this fine grain silver halide grains-containing layer.

The coating amount of silver in the light-sensitive material of the present invention, preferably of the first embodiment, is preferably 6.0 g/m$^2$ or less, and most preferably 4.5 g/m$^2$ or less.

The photographic additives that can be used in the present invention, preferably in the first embodiment, are described in RDs, whose particular parts are given below in the following table.

| Kind of Additive | RD 17643 | RD 18716 | RD 307105 |
|---|---|---|---|
| 1. Chemical sensitizers | p.23 | p.648 (right column) | p.866 |
| 2. Sensitivity-enhancing agents | — | p.648 (right column) | — |
| 3. Spectral sensitizers and Supersensitizers | pp.23-24 | pp.648 (right column)-649 (right column) | pp.866-868 |
| 4. Brightening agents | p.24 | pp.647 (right column) | p.868 |
| 5. Light absorbers, Filters, Dyes, and UV Absorbers | pp.25-26 | pp.649 (right column)-650 (left column) | p.873 |
| 6. Binders | p.26 | p.651 (left column) | pp.873-874 |
| 7. Plasticizers and Lubricants | p.27 | p.650 (right column) | p.876 |
| 8. Coating aids and Surfactants | pp.26-27 | p.650 (right column) | pp.875-876 |
| 9. Antistatic agents | p.27 | p.650 (right column) | pp.876-877 |
| 10. Matting agents | — | — | pp.878-879 |

In the light-sensitive material of the present invention, preferably of the first embodiment, various dye-forming couplers may be used in combination with the coupler for use in the present invention. The following couplers are especially preferred.

Yellow coupler (which may be used in combination with the coupler represented by formula (I)): a coupler represented by formula (I) or (II) in EP 502,424A; a coupler represented by formula (I) or (2) in EP 513,496A (especially, Y-28 on page 18); a coupler represented by formula (I) in claim 1 in EP 568,037A; a coupler represented by formula (I) in lines 45 to 55 in column 1 in U.S. Pat. No. 5,066,576; a coupler represented by formula (I) in paragraph 0008 in JP-A-4-274425; a coupler described in claim 1 on page 40 in EP 498,381A1 (especially, D-35 on page 18); a coupler represented by formula (Y) on page 4 in EP 447,969A1 (especially, Y-1 on page 17, Y-54 on page 41); a coupler represented by formula (II) to (IV) in lines 36 to 58 in column 7 in U.S. Pat. No. 4,476,219 (especially, II-17, 19 (column 17), II-24 (column 19)).

Magenta coupler: L-57 (page 11, right and lower column), L-68 (page 12, right and lower column), L-77 (page 13, right and lower column) in JP-A-3-39737; [A-4]-63 (page 134), [A-4]-73, -75 (page 139) in EP 456,257; M-4, -6 (page 26), M-7 (page 27) in EP 486,965; M-45 (page 19) in EP 571,959A; (M-1) (page 6) in JP-A-5-204106; M-22 in paragraph [0237] in JP-A-4-362631.

Cyan coupler: CX-1, 3, 4, 5, 11, 12, 14, 15 (pages 14 to 16) in JP-A-4-204843; C-7, 10 (page 35), 34, 35 (page 37), (1-1), (1-17) (pages 42 to 43) in JP-A-4-43345; a coupler represented by formula (Ia) or (Ib) in claim 1 in JP-A-6-67385.

Polymer coupler: P-1, P-5 (page 11) in JP-A-2-44345.

Preferable examples of couplers, which form a color dye having a suitable diffusive property, include those described in U.S. Pat. No. 4,366,237, GB 2,125,570, EP 96,873B, and DE 3,234,533.

Preferable examples of the coupler, which is used for compensating unnecessary absorption of a color dye, include a yellow-colored cyan coupler represented by formulae (CI), (CII), (CIII), and (CIV) described on page 5 in EP 456,257A1 (especially, YC-86 on page 84), a yellow-colored magenta coupler, ExM-7 (page 202), EX-1 (page 249), EX-7 (page 251), described in EP 456,257A1, a magenta-colored cyan coupler, CC-9 (column 8), CC-13 (column 10), described in U.S. Pat. No. 4,833,069, and a colorless masking coupler, represented by Formula (2) (column 8) in Us 4,837,136, and formula (A) in claim 1 in WO92/11575 (particularly the exemplified compounds on pages 36 to 45).

Examples of the compound (including a coupler), which reacts with an oxidized product of a developing agent, to release a photographically useful compound's residue, include the followings:

Development inhibitor releasing compounds: compounds represented by any one of Formulae (I), (II), (III), and (IV) described on page 11 in EP 378,236A1, (especially, T-101 (page 30), T-104 (page 31), T-113 (page 36), T-131 (page 45), T-144 (page 51), T-158 (page 58)); compounds represented by Formula (I) described on page 7 in EP 436,938A2, (especially, (D-49) (page 51); compounds represented by Formula (1) in EP 568,037A (especially, (23) (page 11), and compounds represented by Formula (I), (II), or (III) described on pages 5 to 6 in EP440,195A2, (especially, 1-(1) on page 29).

Bleaching accelerator releasing compounds: compounds represented by Formula (I) or (I') described on page 5 in EP 310,125A2, (especially, (60), (61) on page 61) and compounds represented by Formula (I) described in claim 1 of JP-A-6-59411, (especially, (7) on page 7).

Ligand releasing compounds: compounds represented by LIG-X described in claim 1 of U.S. Pat. No. 4,555,478, (especially, a compound in lines 21 to 41 in column 12).

Leuco dye releasing compounds: compounds 1 to 6 in U.S. Pat. No. 4,749,641, columns 3 to 8; Fluorescent dye releasing compounds: compounds represented by COUP-DYE described in claim 1 of U.S. Pat. No. 4,774,181, (especially, compounds 1 to 11 in column 7 to 10).

Compounds, which release a development accelerator or a fogging agent: compounds represented by Formula (1), (2) or (3) in U.S. Pat. No. 4,656,123, column 3, (especially, (1-22) in column 25), and the compound ExZK-2 described on page 75, lines 36 to 38, in EP 450,637A2.

Compounds which release a group capable of becoming a dye only after being split-off: compounds represented by Formula (1) described in claim 1 of U.S. Pat. No. 4,857,447, (especially, Y-1 to Y-19 in column 25 to 36).

As additives other than the coupler, the following ones are preferable.

Dispersion media for an oil-soluble organic compound: P-3, 5, 16, 19, 25, 30, 42, 49, 54, 55, 66, 81, 85, 86 and 93 (page 140 to page 144) in JP-A-62-215272; latex for impregnation with the oil-soluble organic compound: latex described in U.S. Pat. No. 4,199,363; scavengers for an oxidized product of a developing agent: compounds represented by the formula (I) in U.S. Pat. No. 4,978,606, column 2, line 54 to line 62 (particularly I-, (1), (2), (6), (12) (columns 4 to 5)), and compounds represented by the formula in U.S. Pat. No. 4,923,787, column 2, line 5 to line 10 (particularly Compound 1 (column 3)); stain preventive agents: compounds represented by one of the formulae (1) to (III) in EP 298321A, page 4, line 30 to line 33 (particularly, I-47, 72, III-1, 27 (page 24 to page 48)); anti-fading agents: A-6, 7, 20, 21, 23, 24, 25, 26, 30, 37, 40, 42, 48, 63, 90, 92, 94 and 164 (page 69 to page 118) in EP 298321A, and II-1 to III-23 in U.S. Pat. No. 5,122,444, columns 25 to 38 (particularly, III-10), I-1 to III-4 in EP 471347A, page 8 to page 12 (particularly, II-2), and A-1 to 48 in U.S. Pat. No. 5,139,931, columns 32 to 40 (particularly A-39 and 42); materials reducing the amount of a color development-enchanting agent or a color contamination preventive agent to be used: I-1 to II-15 in EP 411324A, page 5 to page 24 (particularly, I-46); formalin scavengers: SCV-1 to 28 in EP 477932A, page 24 to page 29 (particularly SCV-8); hardener: H-1, 4, 6, 8 and 14 in JP-A-1-214845 in page 17, compounds (H-1 to H-54) represented by one of the formulae (VII) to (XII) in U.S. Pat. No. 4,618,573, columns 13 to 23, compounds (H-1 to 76) represented by the formula (6) in JP-A-2-214852, page 8, the lower right (particularly, H-14), and compounds described in claim 1 in U.S. Pat. No. 3,325,287; precursors of developing inhibitor: P-24, 37, 39 (page 6 to page 7) in JP-A-62-168139, and compounds described in claim 1 of U.S. Pat. No. 5,019,492 (particularly 28 to 29 in column 7); antiseptics and mildew-proofing agents: I-1 to III-43 in U.S. Pat. No. 4,923,790, columns 3 to 15 (particularly II-1, 9, 10 and 18 and III-25); stabilizers and antifoggants: I-1 to (14) in U.S. Pat. No. 4,923,793, columns 6 to 16 (particularly, I-1, 60, (2) and (13)) and compounds 1 to 65 in U.S. Pat. No. 4,952,483, columns 25 to 32 (particularly, 36); chemical sensitizers: triphenylphosphine selenide, and compound 50 in JP-A-5-40324; dyes: a-1 to b-20 in JP-A-3-156450, page 15 to page 18 (particularly, a-1, 12, 18, 27, 35, 36, b-5 and V-1 to 23 on pages 27 to 29, particularly, V-1), F-1-1 to F-II-43 in EP 445627A, page 33 to page 55 (particularly F-I-11 and F-II-8), III-1 to 36 in EP 457153A, page 17 to page 28 (particularly III-1 and 3), microcrystal dispersions of Dye-1 to 124 in WO88/04794, 8 to 26, compounds 1 to 22 in EP319999A, page 6 to page 11 (particularly, compound 1), compounds D-1 to 87 (page 3 to page 2-8) represented by one of the formulae (1) to (3) in EP 519306A, compounds 1 to 22 (columns 3 to 10) represented by the formula (I) in U.S. Pat. No. 4,268,622, compounds (I) to (31) (columns 2 to 9) represented by the formula (I) in U.S. Pat. No. 4,923,788; UV absorbers: compounds (18b) to (18r) and 101 to 427 (page 6 to page 9) represented by the formula (I) in JP-A-46-3335, compounds (3) to (66) (page 10 to page 44) represented by the formula (I) and compounds HBT-1 to HBT-10 (page 14) represented by the formula (III) in EP 520938A, and compounds (I) to (31) (columns 2 to 9) represented by the formula (I) in EP 521823A.

The present invention, preferably the first embodiment can be applied to various color light-sensitive materials, such as black-and-white printing papers, black-and-white negative films, X-ray films, color negative films for general purposes or movies, color reversal films for slides or television, color papers, color positive films, and color reversal papers. Additionally, the present invention, preferably the first embodiment can be preferably applied to a film unit with a lens, as described in JP-B-2-32615 or JU-B-3-39784 ("JU-B" means an examined Japanese Utility model registration publication).

A support that can be suitably used in the present invention, preferably in the first embodiment, is described in, for example, the above-described R.D. No. 17643 (page 28), R.D. No. 18716 (page 647, right column to page 648, left column) and R.D. No. 307105 (page 879).

In a light-sensitive material of the present invention, preferably of the first embodiment, the total film thickness of hydrophilic colloid layers on the side having silver halide emulsion layers is preferably 28 μm or less, more preferably 23 μm or less, still more preferably 18 μm or less, and particularly preferably 16 μm or less. A film swelling speed $T_{1/2}$ is preferably 30 sec or less, and more preferably 20 sec or less. $T_{1/2}$ is defined as a time required to reach ½ the saturated film thickness, which is 90% of the maximum swelled film thickness reached when the film is processed with a color developer at 30° C. for 3 min and 15 sec. The film thickness means the thickness of a film measured under controlled moisture condition, at a temperature of 25° C. and a relative humidity of 55% (two days). $T_{1/2}$ can be measured by using a swellometer of a type described in Photogr. Sci. Eng., by A. Green et al., Vol. 19, 2, pp. 124 to 129. $T_{1/2}$ can be adjusted adding a film hardener to gelatin as a binder, or changing aging conditions after coating. The swell ratio is preferably 150 to 400%. The swell ratio can be calculated from the maximum swollen film thickness under the conditions above by using the expression: (maximum swollen film thickness−film thickness)/film thickness.

In the light-sensitive material of the present invention, preferably the first embodiment, hydrophilic colloid layers (referred to as backing layers) having a total dried film thickness of 2 to 20 μm are preferably formed, on the side opposite to the side having emulsion layers. The backing layers preferably contain, the aforementioned light absorbents, filter dyes, ultraviolet absorbents, antistatic agents, film hardeners, binders, plasticizers, lubricants, coating aids, and surfactants. The swell ratio of the backing layer is preferably 150 to 500%.

The light-sensitive materials of the present invention, preferably the first embodiment can be subjected to development processing according to usual manner, as described in the above-mentioned R.D. No. 17643, pp. 28 to 29, R.D. No. 18716, page 651, left to right columns, and R.D. No. 307105, pp. 880 to 881.

Next, color negative film processing solutions for use in the present invention, preferably the first embodiment will be described below.

Compounds described in JP-A-4-121739, from page 9, upper right column, line 1, to page 11, lower left column, line 4, can be used in a color developer that can be used in the present invention, preferably in the first embodiment. As a color-developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, and 2-methyl-4-[N-ethyl-N-(4-hydroxybutyl)amino]aniline are preferable.

The amount to be used of any of these color-developing agents is preferably 0.01 to 0.08 mole, more preferably 0.015 to 0.06 mole, and especially preferably 0.02 to 0.05 mole, per liter of a color developer. Also, a replenisher of a color developer preferably contains a color-developing agent at a concentration 1.1 to 3 times, particularly preferably 1.3 to 2.5 times the above concentration.

As a preservative of a color developer, hydroxylamine can be extensively used. When higher preservability is necessary, the use of a hydroxylamine derivative having a substituent such as an alkyl group, a hydroxyalkyl group, a sulfoalkyl group, or a carboxyalkyl group is preferable. Preferable examples include N,N-di-(sulfoethyl)hydroxylamine, monomethylhydroxylamine, dimethylhydroxylamine, monoethylhydroxylamine, diethylhydroxylamine, and N,N-di(carboxylethyl)hydroxylamine. Of these derivatives, N,N-di-(sulfoethyl)hydroxylamine is particularly preferable. Although these derivatives can be used together with hydroxylamine, it is preferable to use one or two types of these derivatives instead of hydroxylamine.

The amount to be used of a preservative is preferably 0.02 to 0.2 mole, more preferably 0.03 to 0.15 mole, and especially preferably 0.04 to 0.1 mole per liter. As in the case of a color-developing agent, a replenisher preferably contains a preservative at a concentration 1.1 to 3 times the concentration of a mother solution (processing tank solution).

A color developer contains sulfite as an agent for preventing an oxide of a color-developing agent from changing into tar. The amount to be used of this sulfite is preferably 0.01 to 0.05 mole, more preferably 0.02 to 0.04 mole per liter. Sulfite is preferably used in a replenisher at a concentration 1.1 to 3 times the above concentration.

The pH of a color developer is preferably 9.8 to 11.0, and more preferably 10.0 to 10.5. In a replenisher, the pH is preferably set to be higher by 0.1 to 1.0 than the above values. To stably maintain such a pH, a known buffer agent such as carbonate, phosphate, sulfosalicylate, or borate is used.

The replenishment rate of a color developer is preferably 80 to 1,300 ml per $m^2$ of a light-sensitive material to be processed. The replenishment rate is preferably smaller in order to reduce environmental-pollution-load. For example, the replenishment rate is preferably 80 to 600 ml, and more preferably 80 to 400 ml.

The bromide ion concentration in a color developer is usually 0.01 to 0.06 mole per liter. This bromide ion concentration is preferably set at 0.015 to 0.03 mole per liter, for the purpose of suppressing fog to improve discrimination with maintaining sensitivity, and of improving graininess at the same time. To set the bromide ion concentration in this range, it is only necessary to add bromide ion calculated by the following equation, to a replenisher. When C takes a negative value, however, no bromide ions are preferably added to a replenisher.

$$C=(A-W)/V$$

in which

C: a bromide ion concentration (mole/L) in a color developer replenisher

A: a target bromide ion concentration (mole/L) in a color developer

W: an amount (mole) of bromide ions dissolving into a color developer from a light-sensitive material when 1 $m^2$ of the light-sensitive material is color-developed V: a replenishment rate (L) of a color developer replenisher to 1 $m^2$ of a light-sensitive material As a method of increasing the sensitivity when the replenishment rate is decreased or high bromide ion concentration is set, it is preferable to use a development accelerator such as pyrazolidones represented by 1-phenyl-3-pyrazolidone, and 1-phenyl-2-methyl-2-hydroxymethyl-3-pyrazolidone, or a thioether compound represented by 3,6-dithia-1,8-octanediol.

Compounds and processing conditions described in JP-A-4-125558, from page 4, lower left column, line 16, to page 7, lower left column, line 6, can be applied to a processing solution having a bleaching capacity in the present invention, preferably in the first embodiment.

The bleaching agent preferably has an oxidation-reduction potential of 150 mV or more. Preferable specific examples of the bleaching agent are described in JP-A-5-72694 and JP-A-5-173312. In particular, 1,3-diaminopropane tetraacetic acid and ferric complex salt of a compound shown as specific example 1 in JP-A-5-173312, page 7, are preferable.

Further, to improve the biodegradability of a bleaching agent, it is preferable to use ferric complex salt of a compound described in JP-A-4-251845, JP-A-4-268552, EP 588,289, EP 591,934 and JP-A-6-208213, as a bleaching agent. The concentration of any of these bleaching agents is preferably 0.05 to 0.3 mole per liter of a solution having a bleaching capacity. To reduce the amount of discharge to the environment, the concentration is preferably designed to be 0.1 to 0.15 mole per liter of the solution having a bleaching capacity. When the solution having a bleaching capacity is a bleaching solution, preferably 0.2 to 1 mole, and more preferably 0.3 to 0.8 mole of a bromide is added per liter.

A replenisher of the solution having a bleaching capacity basically contains components at concentrations calculated by the following equation. This makes it possible to maintain the concentrations in a mother solution constant.

$$C_R=C_{T\times}(V_1+V_2)/V_1+C_P$$

In which $C_R$: concentration of a component in a replenisher $C_T$: concentration of a component in a mother solution (processing tank solution)

$C_P$: concentration of a component consumed during processing $V_1$: a replenishment rate (ml) of a replenisher having a bleaching capacity per $m^2$ of a light-sensitive material V2: an amount (ml) of carryover from a preceding bath by $m^2$ of a light-sensitive material Additionally, a bleaching solution preferably contains a pH buffering agent, and particularly preferably, it contains a dicarboxylic acid with little odor, such as succinic acid, maleic acid, malonic acid, glutaric acid, and adipic acid. Also, the use of known bleaching accelerators described in JP-A-53-95630, RD No. 17129, and U.S. Pat. No. 3,893,858 is preferable.

It is preferable to replenish 50 to 1,000 ml of a bleaching replenisher to a bleaching solution, per $m^2$ of a light-sensitive material. The replenishment rate is more preferably 80 to 500 ml, and especially preferably 100 to 300 ml. Conducting aeration of a bleaching solution is also preferable.

Compounds and processing conditions described in JP-A-4-125558, from page 7, lower left column, line 10, to page 8, lower right column, line 19, can be applied to a processing solution with a fixing capacity. In particular, to improve the fixing speed and preservability, the compound represented by formulae (1) or (II) described in JP-A-6-301169 is preferably added singly or in combination, a processing solution with a fixing capacity. To improve preservability, the use of sulfinic acid, including p-toluenesulfinate, described in JP-A-1-224762 is also preferable.

To improve the desilvering characteristics, ammonium is preferably used as cation, in a processing solution with a bleaching capacity or a processing solution with a fixing capacity. However, the amount of ammonium is preferably reduced, or not used at all, to reduce environmental pollution. In the bleaching, bleach-fixing, and fixing steps, it is particularly preferable to perform jet stirring described in JP-A-1-309059.

The replenishment rate of a replenisher in the bleach-fixing, or fixing step is preferably 100 to 1,000 ml, more preferably 150 to 700 ml, and furthermore preferably 200 to 600 ml per $m^2$ of a light-sensitive material.

In the bleach-fixing, or fixing step, an appropriate silver collecting apparatus is preferably installed either in-line or off-line to collect silver. When such an apparatus is installed in-line, processing can be performed while the silver concentration in a solution is reduced, and as a result of this, the replenishment rate can be reduced. It is also preferable to install such an apparatus off-line to collect silver and reuse the residual solution as a replenisher.

The bleach-fixing, or fixing step can be performed using a plurality of processing tanks, and these tanks are preferably piped in a cascade manner to form a multistage counter flow system. To balance the size of a processor, two-tank cascade system is generally efficient. The processing time ratio of the preceding tank to the subsequent tank is preferably (0.5:1) to (1:0.5), and more preferably (0.8:1) to (1:0.8).

In a bleach-fixing, or fixing solution, the presence of a free chelating agent, which is not a metal complex, is preferable to improve the preservability. As these chelating agents, the use of the biodegradable chelating agents previously described in connection to a bleaching solution is preferable.

Contents described in aforementioned JP-A-4-125558, from page 12, lower right column, line 6, to page 13, lower right column, line 16, can be applied to the washing and stabilization steps. To improve the safety of the working environment, it is preferable to use azolylmethylamines described in EP 504,609 and EP 519,190 or N-methylolazoles described in JP-A-4-362943, instead of formaldehyde, in a stabilizer, and to make a magenta coupler two-equivalent so that a solution of surfactant containing no image stabilizing agent such as formaldehyde can be used.

To reduce adhesion of dust to a magnetic recording layer coated on a light-sensitive material, a stabilizer described in JP-A-6-289559 can be preferably used.

The replenishment rate of washing water and a stabilizer is preferably 80 to 1,000 ml, more preferably 100 to 500 ml, and especially preferably 150 to 300 ml, per $m^2$ of a light-sensitive material to be processed, to maintain the washing and stabilization functions and at the same time reduce the waste liquors for environmental conservation. In a processing performed with such a replenishment rate, it is preferable to prevent the propagation of bacteria and mildew by using known mildew-proofing agents such as thiabendazole, 1,2-methylisothiazoline-3-one, and 5-chloro-2-methylisothiazoline-3-one, antibiotics such as gentamicin, and water deionized by an ion exchange resin or the like. It is more effective to use deionized water together with a mildew-proofing agent or an antibiotic.

The replenishment rate of a solution in a washing water tank or stabilizer tank is preferably reduced by a reverse osmosis membrane treatment described in JP-A-3-46652, JP-A-3-53246, JP-A-355542, JP-A-3-121448, and JP-A-3-126030. A reverse osmosis membrane used in this treatment is preferably a low-pressure reverse osmosis membrane.

In the processing that is used in the present invention, preferably in the first embodiment, it is particularly preferable to perform evaporation correction of the processing solution as described in JIII Journal of Technical Disclosure No. 94-4992. In particular, a method of performing correction on the basis of (formula-1) on page 2, by using temperature and humidity information of an environment in which a processor is set is preferable. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, from page 3, right column, line 15, to page 4, left column, line 32, are preferably used in the present invention, preferably in the first embodiment. As a processor used with these processing agents, a film processor described on page 3, right column, lines 22 to 28, is preferable.

Specific examples of processing agents, automatic processors, and evaporation correction methods suited to practicing the present invention, preferably the first embodiment are described in aforementioned JIII Journal of Technical Disclosure No. 94-4992, from page 5, right column, line 11, to page 7, right column, last line.

Processing agents used in the present invention, preferably in the first embodiment can be supplied in any form such as a liquid agent having the concentration as it is to be used, a concentrated liquid agent, granules, powder, tablets, paste, and emulsion. Examples of such processing agents are a liquid agent contained in a low-oxygen permeable vessel as described in JP-A-63-17453, vacuum-packed powders and granules described in JP-A-4-19655 and JP-A-4-230748, granules containing a water-soluble polymer described in JP-A-4-221951, tablets described in JP-A-51-61837 and JP-A-6-102628, and a paste described in JP-T-57-500485. Although any of these processing agents can be preferably used, the use of a liquid adjusted to have the concentration as it is to be used, in advance, is preferable for the sake of convenience in use.

As a vessel for containing these processing agents, polyethylene, polypropylene, polyvinylchloride, polyethyleneterephthalate, nylon and the like, are used singly or as a composite material. These materials are selected in accordance with the level of necessary oxygen permeability. For a readily oxidizable solution such as a color developer, a low oxygen permeable material is preferable. More specifically, polyethyleneterephthalate or a composite material of polyethylene and nylon is preferable. A vessel made of any of these materials preferably has a thickness of 500 to 1,500 μm and is preferably adjusted to have oxygen permeability of 20 $ml/m^2 \cdot 24 \cdot hrs$ atom or less.

Next, color reversal film processing solution used in the present invention, preferably in the first embodiment will be described below.

Processing for a color reversal film is described in detail in Aztech Ltd., Kochi Gijutsu No. 6 (1991, April 1), from page 1, line 5, to page 10, line 5, and from page 15, line 8, to page 24, line 2, and any of the contents can be preferably applied.

In a color reversal film processing, an image-stabilizing agent is contained in a control bath or a final bath. Preferable examples of such an image-stabilizing agent are formalin, sodium formaldehyde-bisulfite, and N-methylolazoles. Sodium formaldehyde-bisulfite, and N-methylolazoles are preferable in terms of preserving working environment, and N-methyloltriazole is particularly preferable as N-methylolazoles. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

Next, a magnetic recording layer preferably used in the present invention, preferably in the first embodiment is explained.

The magnetic recording layer preferably used in the present invention, preferably in the first embodiment refers to a layer provided by coating a base with an aqueous or organic solvent coating solution containing magnetic particles dispersed in a binder.

To prepare the magnetic particles used in the present invention, preferably in the first embodiment, use can be made of a ferromagnetic iron oxide such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, Ca ferrite, and the like. A Co-coated ferromagnetic iron oxide, such as Co-coated $\gamma Fe_2O_3$, is preferable. The shape may be any of a needle shape, a rice grain shape, a spherical shape, a cubic shape, a tabular shape, and the like. The specific surface area is preferably 20 $m^2/g$ or more, and particularly preferably 30 $m^2/g$ or more, in terms of $S_{BET}$.

The saturation magnetization (σs) of the ferromagnetic material is preferably $3.0\times10^4$ to $3.0\times10^5$ A/m, and particularly preferably $4.0\times10^4$ to $2.5\times10^5$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or organic material, as described in JP-A-4-259911 and JP-A-5-81652, can be used.

As the binder that can be used for the magnetic particles, as described in JP-A-4-219569, a thermoplastic resin, a thermosetting resin, a radiation-setting resin, a reactive resin, an acid-degradable polymer, an alkali-degradable polymer, a biodegradable polymer, a natural polymer (e.g. a cellulose derivative and a saccharide derivative), and a mixture of these can be used. The above resins have a Tg of −40 to 300° C. and a weight-average molecular weight of 2,000 to 1,000,000. Examples include vinyl copolymers, cellulose derivatives, such as cellulose diacetates, cellulose triacetates, cellulose acetate propionates, cellulose acetate butylates, and cellulose tripropionates; acrylic resins, and polyvinyl acetal resins. Gelatin is also preferable. Cellulose di(tri)acetates are particularly preferable. To the binder may be added an epoxy, aziridine, or isocyanate crosslinking agent, to harden the binder. Examples of the isocyanate crosslinking agent include isocyanates, such as tolylene diisocyanate, 4,4'-diphenylmethane diisocyanate, hexamethylene diisocyanate, and xylylene diisocyanate; reaction products of these isocyanates with polyalcohols (e.g. a reaction product of 3 mol of tolylene diisocyanate with 1 mol of trimethylolpropane), and polyisocyanates produced by condensation of these isocyanates. Those are described, for example, in JP-A-6-59357.

The method of dispersing the foregoing magnetic material in the foregoing binder is preferably one described in JP-A-6-35092, in which method use is made of a kneader, a pin-type mill, an annular-type mill, and the like, which may be used alone or in combination. A dispersant described in JP-A-5-088283 and other known dispersants can be used. The thickness of the magnetic recording layer is generally 0.1 to 10 μm, preferably 0.2 to 5 μm, and more preferably 0.3 to 3 μm. The weight ratio of the magnetic particles to the binder is preferably from (0.5:100) to (60:100), and more preferably from (1:100) to (30:100). The coating amount of the magnetic particles is generally 0.005 to 3 $g/m^2$, preferably 0.01 to 2 $g/m^2$, and more preferably 0.02 to 0.5 $g/m^2$. The transmission yellow density of the magnetic recording layer is preferably 0.01 to 0.50, more preferably 0.03 to 0.20, and particularly preferably 0.04 to 0.15. The magnetic recording layer can be provided to the undersurface of the photographic base by coating or printing through all parts or in a striped fashion. To apply the magnetic recording layer, use can be made of an air doctor, blade, air knife, squeezing, impregnation, reverse roll, transfer roll, gravure, kiss, cast, spraying, dipping, bar, extrusion, or the like. A coating solution described, for example, in JP-A-5-341436 is preferable.

The magnetic recording layer may be provided with functions, for example, of improving lubricity, of regulating curling, of preventing electrification, of preventing adhesion, and of abrading a head, or it may be provided with another functional layer that is provided with these functions. An abrasive in which at least one type of particles comprises aspherical inorganic particles having a Mohs hardness of 5 or more, is preferable. The aspherical inorganic particles preferably comprise a fine powder of an oxide, such as aluminum oxide, chromium oxide, silicon dioxide, and titanium dioxide; a carbide, such as silicon carbide and titanium carbide; diamond, or the like. The surface of these abrasives may be treated with a silane coupling agent or a titanium coupling agent. These particles may be added to the magnetic recording layer, or they may form an overcoat (e.g. a protective layer and a lubricant layer) on the magnetic recording layer. As a binder that can be used at that time, the above-mentioned binders can be used, and preferably the same binder as mentioned for the magnetic recording layer is used. Light-sensitive materials having a magnetic recording layer are described in U.S. Pat. Nos. 5,336,589, 5,250,404, 5,229,259, and 5,215,874, and European Patent No. 466,130.

A polyester support that is preferably used in the present invention, preferably in the first embodiment will be described below. Details of the polyester support, as well as details of light-sensitive materials, processing, cartridges, and examples (to be described later), are described in JIII Journal of Technical Disclosure No. 94-6023 (Japan Institute of Invention & Innovation, Mar. 15, 1994). Polyester for use in the present invention, preferably in the first embodiment is formed from diol and aromatic dicarboxylic acid as essential components. Examples of the aromatic dicarboxylic acid are 2,6-, 1,5-, 1,4-, and 2,7-naphthalene dicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, and polyethylenenaphthalate, and polycyclohexanedimethanol terephthalate. Polyester containing 50 to 100 mole % of 2,6-naphthalenedicarboxylic acid is particularly preferable. Polyethylene-2,6-naphthalate is particularly preferable among the above polymers. The average molecular weight is generally in the range of about 5,000 and 200,000. The Tg of the polyester for use in the present invention, preferably in the first embodiment is generally 50° C. or higher, preferably 90° C. or higher.

The polyester base is heat-treated at a heat treatment temperature of generally 40° C. or over, but less than the Tg, and preferably at a heat treatment temperature of the Tg −20° C. or more, but less than the Tg, so that it will hardly have core set curl. The heat treatment may be carried out at a constant temperature in the above temperature range, or it may be carried out with cooling. The heat treatment time is generally 0.1 hours or more, but 1,500 hours or less, and preferably 0.5 hours or more, but 200 hours or less. The heat treatment of the base may be carried out with the base rolled, or it may be carried out with it being conveyed in the form of web. The surface of the base may be made rough (unevenness, for example, by applying electroconductive inorganic fine-particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. The trouble of deformation of the support means that, when a support is wound on a core, on its second and further windings, the support follows unevenness of its cut edge of the first winding, deforming its flat film-shape. These heat treatments may be carried out at any stage after the production of the base film, after the surface treatment, after the coating of a backing layer (e.g. with an antistatic agent and a slipping agent), and after coating of an undercoat, with preference given to after coating of an antistatic agent.

Into the polyester may be blended (kneaded) an ultraviolet absorber. Further, prevention of light piping can be attained by blending dyes or pigments commercially available for polyesters, such as Diaresin (trade name, manufactured by Mitsubisi Chemical Industries Ltd.), and Kayaset (trade name, manufactured by Nippon Kayaku Co., Ltd.).

In the present invention, preferably in the first embodiment, these supports are preferably subjected to a surface treatment, in order to achieve strong adhesion between the support and a photographic constituting layer. For the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Among the surface treatments, an ultraviolet irradiation treatment, a flame treatment, a corona treatment, and a glow treatment are preferable.

With respect to the undercoating, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, and gelatins, can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 μm) may be included as a matting agent.

Further, in the present invention, preferably in the first embodiment, an antistatic agent is preferably used. As the antistatic agent, polymers containing a carboxylic acid, a carboxylate, or a sulfonate; cationic polymers, and ionic surface-active compounds can be mentioned. Most preferable antistatic agents are fine particles of at least one crystalline metal oxide selected from the group consisting of ZnO, $TiO_2$, $SnO_2$, $Al_2O_3$, $In_2O_3$, $SiO_2$, MgO, BaO, $MoO_3$, and $V_2O_5$, and having a specific volume resistivity of $10^7$ Ωcm or less, and more preferably $10^5$ Ωcm or less and a particle size of 0.001 to 1.0 μm, or fine particles of their composite oxides (Sb, P, B, In, S, Si, C, and the like); as well as fine particles of the above metal oxides in the form of a sol, or fine particles of composite oxides of these. The content thereof in the light-sensitive material is preferably 5 to 500 mg/$m^2$, and particularly preferably 10 to 350 mg/$m^2$. The ratio of the amount of the electroconductive crystalline oxide or its composite oxide to the amount of the binder is preferably from 1/300 to 100/1, and more preferably from 1/100 to 100/5.

The light-sensitive material of the present invention, preferably of the first embodiment preferably has a slip property. Slip agent-containing layers are preferably formed on both the sides of a light-sensitive-layer side and a back-layer side. A preferable slip property is 0.01 to 0.25 as a coefficient of kinetic friction. This represents a value obtained when a sample is transferred against stainless steel sphere of 5 mm in diameter, at a speed of 60 cm/min (25° C., 60% RH). In this evaluation, a value of nearly the same level is obtained when the surface of a light-sensitive layer is used as a partner material in place of the stainless steel sphere.

Examples of a slip agent that can be used in the present invention, preferably in the first embodiment include polyorganosiloxane, higher fatty acid amide, higher fatty acid metal salt, and ester of higher fatty acid and higher alcohol. As the polyorganosiloxane, it is possible to use, e.g., polydimethylsiloxane, polydiethylsiloxane, polystyrylmethylsiloxane, or polymethylphenylsiloxane. A layer to which the slip agent is added is preferably the outermost emulsion layer or a backing layer. Polydimethylsiloxane and ester having a long-chain alkyl group are particularly preferable.

The light-sensitive material of the present invention, preferably of the first embodiment preferably contains a matting agent. This matting agent can be added to either the emulsion side or back side, and especially preferably added to the outermost layer of the emulsion layer side. The matting agent can be either soluble or insoluble in processing solution, and the use of both types of matting agents is preferable. Preferable examples are polymethylmethacrylate grains, poly (methylmethacrylate/methacrylic acid=9/1 or 5/5 (molar ratio)) grains, and polystyrene grains. The grain diameter is preferably 0.8 to 10 μm, and a narrow grain diameter distribution is preferable. It is preferable that 90% or more of all grains have grain diameters 0.9 to 1.1 times the average grain diameter. To increase the matting property, it is preferable to simultaneously add fine grains with a grain size of 0.8 μm or smaller. Examples are polymethylmethacrylate grains (0.2 μm), poly (methylmethacrylate/methacrylic acid=9/1 (molar ratio), 0.3 μm) grains, and polystyrene grains (0.25 μm), and colloidal silica grains (0.03 μm).

Next, a film magazine (patrone) used in the present invention, preferably in the first embodiment is described below. The main material of the magazine for use in the present invention, preferably in the first embodiment may be a metal or synthetic plastic.

Preferable plastic materials are polystyrenes, polyethylenes, polypropylenes, polyphenyl ethers, and the like. Further, the magazine that can be used in the present invention, preferably in the first embodiment may contain various antistatic agents, and preferably, for example, carbon black, metal oxide particles; nonionic, anionic, cationic, and betaine-series surface-active agents, or polymers can be used. These antistatic magazines are described in JP-A-1-312537 and JP-A-1-312538. In particular, the resistance of the magazine at 25° C. and 25% RH is preferably $10^{12}$Ω or less. Generally, plastic magazines are made of plastics with which carbon black or a pigment has been kneaded, to make the magazines shield (screen) light. The size of the magazine may be size 135, which is currently used, and, to make cameras small, it is effective to change the diameter of the 25-mm cartridge of the current size 135, to 22 mm or less. Preferably the volume of a case of the magazine is 30 $cm^3$ or less, and more preferably 25 $cm^3$ or less. The weight of the plastic to be used for the magazine or the magazine case is preferably 5 to 15 g.

Further, in the present invention, preferably in the first embodiment, the magazine may be one in which a spool is rotated to deliver a film. Also the structure may be such that the forward end of a film is housed in the magazine body, and by rotating a spool shaft in the delivering direction, the forward end of the film is delivered out from a port of the magazine. These magazines are disclosed in U.S. Pat. No. 4,834,306, and U.S. Pat. No. 5,226,613. A photographic film for use in the present invention, preferably in the first embodiment may be a so-called raw film, which is before being subjected to development, and may be a photographic film after being processed. Further, a raw film and a photographic film after development may be housed in the same new magazine or in different magazines.

The color photographic light-sensitive material of the present invention, preferably of the first embodiment can be preferably used also as a negative film for advanced photo system (hereinafter referred to as AP system). Examples of the film include a film, manufactured by making the light-sensitive material film into AP system format and housing it into a cartridge for exclusive use, such as NEXIA A, NEXIA F, and NEXIA H (trade names, ISO 200/100/400 in that order) manufactured by Fuji Photo Film Co., Ltd. (hereinafter referred to as Fuji Film). These cartridge films for AP system are used after being loaded into cameras for AP system, such as EPION series, e.g. EPION 300Z (trade name) manufactured by Fuji Film. The color photographic light-sensitive material of the present invention, preferably of the first embodiment is also preferable for use in a film unit with a lens, which is represented by Fuji Color UTSURUNDESU Super Slim (trade name) manufactured by Fuji Film.

A film thus photographed is printed through the following steps in a mini Lab system.

(1) Reception (an exposed cartridge film is received from a customer)

(2) Detaching step (the film is transferred from the cartridge to an intermediate cartridge for development steps)

(3) Film development (4) Reattaching step (the developed negative film is returned to the original cartridge)

(5) Printing (prints of three types C, H, and P and an index print are continuously automatically printed on color paper {preferably Fuji Film SUPER FA8 (trade name)})

(6) Collation and shipment (the cartridge and the index print are collated by an ID number and shipped together with the prints)

As these systems, Fuji Film MINILAB CHAMPION SUPER FA-298, FA-278, FA-258, FA-238 (trade names) and Fuji Film DIGITAL LAB SYSTEM FRONTIER (trade name) are preferable. Examples of a film processor for MINILAB CHAMPION are FP922AL, FP562B, FP562B AL, FP362B, and FP362B AL (trade names), and recommended processing chemicals are FUJI COLOR JUST-IT CN-16L and CN-16Q (trade names). Examples of a printer processor are PP3008AR, PP3008A, PP1828AR, PP1828A, PP1258AR, PP1258A, PP728AR, and PP728A (trade names), and recommended processing chemicals are FUJI COLOR JUST-IT CP-47L and CP-40FAII (trade names). In FRONTIER SYSTEM, Scanner & Image Processor SP-1000 and Laser Printer & Paper Processor LP-1000P or Laser Printer LP-1000W (trade names) are used. Both a detacher used in the detaching step and a reattacher used in the reattaching step are preferably Fuji Film DT200 or DT100 and AT200 or AT100 (trade names), respectively.

The AP system can also be enjoyed by PHOTO JOY SYSTEM whose main component is Fuji Film Digital Image Workstation ALADDIN 1000 (trade name). For example, a developed APS cartridge film is directly loaded into ALADDIN 1000, or image information of a negative film, positive film, or print is input to ALADDIN 1000 by 35-mm Film Scanner FE-550 or Flat Head Scanner PE-550 (trade names). Obtained digital data can be easily processed and edited. This data can be printed out by Digital Color Printer NC-550AL (trade name) using a photo-fixing heat-sensitive color printing system or PICTROGRAPHY 3000 (trade name) using a laser exposure thermal development transfer system, or by existing laboratory equipment through a film recorder. ALADDIN 1000 can also output digital information directly to a floppy disk (registered trademark) or zip disk, or to CD-R via a CD writer.

In a home, a user can enjoy photographs on a TV set, simply by loading a developed AP system cartridge film into Fuji Film Photo Player AP-1 (trade name). Image information can also be continuously input to a personal computer with a high speed, by loading a developed AP system cartridge film into Fuji Film Photo Scanner AS-1 (trade name). Fuji Film Photo Vision FV-10 or FV-5 (trade names) can be used to input a film, print, or three-dimensional object, to a personal computer. Furthermore, image information recorded in a floppy disk (registered trademark), zip disk, CD-R, or hard disk can be variously processed on a computer by using Fuji Film Application Software Photo Factory. Fuji Film Digital Color Printer NC-2 or NC-2D (trade names) using a photo-fixing heat-sensitive color printing system is suited to outputting high quality prints from a personal computer. To keep developed AP system cartridge films, FUJICOLOR POCKET ALUBUM AP-5 POP L, AP-1 POP L, AP-1 POP KG, or CARTRIDGE FILE 16 (trade names) is preferable.

In the case of applying the present invention, preferably the first embodiment, to a reflective (base)-type photographic material, preferable as the silver halide grains in the silver halide emulsion that can be used are cubic or tetradecahedral crystal grains substantially having a {100} plane (the grain may have a round apex and a plane of a higher order); octahedral crystal grains; and tabular grains having an aspect ratio of 2 or more, in which 50% or more of the total projected area thereof is taken up by a {100} plane or {111} plane. The aspect ratio is defined as the value obtained by dividing the diameter of a circle corresponding to the circle having the same area as a projected area of an individual grain by the thickness of the grain. In the present invention, preferably in the first embodiment, cubic grains, or tabular grains having {100} planes as major faces, or tabular grains having {111} planes as major faces are preferably used.

As a silver halide emulsion, any of silver chloride, silver bromide, silver iodobromide, or silver chloro(iodo)bromide emulsions may be used. It is preferable for a rapid processing to use a silver chloride, silver chlorobromide, silver chloroiodide, or silver chlorobromoiodide emulsions having a silver chloride content of 90 mol % or greater, more preferably said silver chloride, silver chlorobromide, silver chloroiodide, or silver chlorobromoiodide emulsions having a silver chloride content of 95 mol % or greater, particularly preferably 98 mol % or greater. Preferred of these silver halide emulsions are those having in the shell parts of silver halide grains a silver iodochloride phase of 0.01 to 0.50 mol %, more preferably 0.05 to 0.40 mol %, per mol of the total silver, in view of high sensitivity and excellent high illumination intensity exposure suitability. Further, especially preferred of these silver halide emulsions are those containing silver halide grains having on the surface thereof a silver bromide localized phase of 0.2 to 5 mol %, more preferably 0.5 to 3 mol %, per mol of the total silver, since both high sensitivity and stabilization of photographic properties are attained.

In the present invention, for example, in the reflective (base)-type silver halide color photographic material, preferred examples of silver halide emulsions and other materials (additives or the like) for use, photographic constitutional layers (arrangement of the layers or the like), and processing methods for processing the photographic materials and additives for processing are disclosed in JP-A-62-215272, JP-A-2-33144 and European Patent No. 0355660 A2. Particularly, those disclosed in European Patent No. 0355660 A2 are preferably used. Further, it is also preferred to use silver halide color photographic light-sensitive materials and processing methods thereof disclosed in, for example, JP-A-5-34889, JP-A-4-359249, JP-A-4-313753, JP-A-4-270344, JP-A-5-

66527, JP-A-4-34548, JP-A-4-145433, JP-A-2-854, JP-A-1-158431, JP-A-2-90145, JP-A-3-194539, JP-A-2-93641 and European Patent Publication No. 0520457 A2.

Examples of the supports that can be used in the present invention include a reflective support, a transparent support, or the like.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizing dyes), the cyan, magenta, and yellow couplers and the emulsifying and dispersing methods thereof, the dye stability-improving agents (stain inhibitors and discoloration inhibitors), the dyes (coloring layers), the kinds of gelatin, the layer structure of the light-sensitive material, and the film pH of the light-sensitive material, those described in the patent publications as shown in the following table are preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

The silver halide color photosensitive material, for example, of a reflective (support)-type, of the present invention can preferably be used in combination with the exposure and development systems described in the following known materials. Example of the development system include the automatic print and development system described in JP-A-10-333253, the photosensitive material conveying apparatus described in JP-A-2000-10206, a recording system including the image reading apparatus described in JP-A-11-215312, exposure systems with the color image recording method described in JP-A-11-88619 and JP-A-10-202950, a digital photo print system including the remote diagnosis method described in JP-A-10-210206, and a photo print system including the image recording apparatus described in JP-A-2000-310822.

The preferred scanning exposure methods which can be applied to the present invention are described in detail in the table shown above.

It is preferred to use a band stop filter, as described in U.S. Pat. No. 4,880,726, when the photographic material of the present invention is subjected to exposure with a printer. Color mixing of light can be eliminated and color reproducibility can remarkably be improved by the above means.

In the present invention, a yellow microdot pattern may be previously formed by pre-exposure before giving an image information, to thereby perform a copy restraint, as described in European Patent Nos. 0789270 A1 and 0789480 A1.

With respect to the processing of the photographic material of the present invention, processing materials and processing methods, as disclosed in JP-A-2-207250, from page 26, right under column, line 1 to page 34, right upper column, line 9, and JP-A-4-97355, from page 5, left upper column, line 17 to page 18, right under column, line 20, can be preferably applied. Further, as preservatives which are used in the developing solution, compounds described in the patent publications as shown in the above table can be preferably used.

Typically, color-development processing when hue and white background preferable in the present invention are adjusted, is one, using CP48S Chemical (trade name) as a processing agent, and Minilabo "PP350" (trade name) manufactured by Fuji Photo Film Co., Ltd., which processing includes: imagewise exposing a sample of a photosensitive material to light through a negative having an average density; and processing with a processing solution that has undergone continuous processing performed until the volume of a color-developer replenisher becomes twice the volume of a color-developer tank.

As a chemical of the processing agent, CP45X, or CP47L, manufactured by Fuji Photo Film Co., Ltd., or RA-100, RA-4, manufactured by Eastman Kodak Co., (each trade name), or the like may be used.

The coupler represented by formula (CC-I) will be explained in detail.

formula (CC-I)

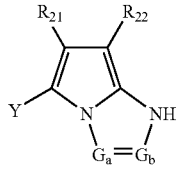

In the formula (CC-I), $G_a$ represents —C($R_{13}$)= or —N=, $G_b$ represents —C($R_{23}$)= when $G_a$ represents —N=, or $G_b$ represents —N=when $G_a$ represents —C($R_{23}$)=. $R_2$, and $R_{22}$ each represent an electron attractive group of which the Hammett's substituent constant $\sigma_p$ value is 0.20 or more and 1.0 or less. It is preferable that the sum of each $\sigma_p$ value of $R_{21}$ and $R_{22}$ is 0.65 or more. The coupler to be used in the present invention, preferably in the second embodiment, has excellent ability as a cyan coupler by introducing such a strong electron-attractive group. The sum of each $\sigma_p$ value of $R_{21}$ and $R_{22}$ is more preferably 0.70 or more, and the upper limit of the sum is generally about 1.8.

In the present invention-, preferably in the second embodiment, $R_{21}$ and $R_{22}$ each are an electron attractive group of which the Hammett's substituent constant $\sigma_p$ value is 0.20 or more and 1.0 or less. Preferably $R_{21}$ and $R_{22}$ are electron attractive group of which the $\sigma_p$ value is 0.30 or more and 0.8 or less.

The Hammett rule is an empirical rule proposed by L. P. Hammett in 1935 to discuss quantitatively the influence of substituents on the reaction or equilibrium of benzene derivatives, and its validity is approved widely nowadays. The substituent constant determined with the Hammett rule includes $\sigma_p$ value and $\sigma_m$ value, and these values can be found in many general literatures. For example, such values are described in detail in e.g. "Lange's Handbook of Chemistry", 12th edition, (1979), edited by J. A. Dean (McGraw-Hill), "Kagaku No Ryoiki" (Region of Chemistry), extra edition, No. 122, pp. 96-103, (1979) (Nankodo), and "Chemical Reviews", Vol. 91, pp. 165-195, (1991). In the present invention, preferably in the second embodiment, $R_{21}$ and $R_{22}$ are defined in terms of the Hammett substituent constant $\sigma_p$, but this does not mean that the substituent is limited to those having a value known in the literatures, which can be found in the above literatures; it is needless to say that even if the value is unknown in any literature, substituents which can have the value in the range if measured according to the Hammett rule are also included in the present invention.

Specific examples of the electron-attracting group $R_{21}$ and $R_{22}$ wherein the $\sigma_p$ value is 0.20 or more and 1.0 or less, include an acyl group, acyloxy group, carbamoyl group, aliphatic oxycarbonyl group, aryloxy carbonyl group, cyano group, nitro group, dialkyl phosphono group, diaryl phosphono group, diaryl phosphinyl group, alkyl sulfinyl group, aryl sulfinyl group, alkyl sulfonyl group, aryl sulfonyl group, sulfonyloxy group, acylthio group, sulfamoyl group, thiocyanate group, thiocarbonyl group, alkyl group substituted with at least two or more halogen atoms, alkoxy group substituted with at least two or more halogen atoms, aryloxy group substituted with at least two or more halogen atoms, alkylamino group substituted with at least two or more halogen atoms, alkylthio group substituted with at least two or more halogen atoms, aryl group substituted with another electron-attracting group with a $\sigma_p$ value of 0.20 or more, heterocyclic group, chlorine atom, bromine atom, azo group, and selenocyanate group. Among these substituents, those which can further have a substituent, may have the substituent such as those emplified as $R_{23}$ will be explained later.

It is to be noted that the aliphatic oxycarbonyl group may be provided with a straight-chain, branched or cyclic aliphatic moiety which may be saturated or may have an unsaturated bond. The aliphatic oxycarbonyl group includes alkoxycarbonyl, cycloalkoxycarbonyl, alkenyloxycarbonyl, alkynyloxycarbonyl and cycloalkenyloxycarbonyl, and the like.

Examples of the $\sigma_p$ value of typical electron attractive groups serving as 0.2 or more and 1.0 or less are as follows: bromine atom (0.23), chlorine atom (0.23), cyano group (0.66), nitro group (0.78), trifluoromethyl group (0.54), tribromomethyl group (0.29), trichloromethyl group (0.33), carboxyl group (0.45), acetyl group (0.50), benzoyl group (0.43), acetyloxy group (0.31), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), ethoxycarbonyl group (0.45), phenoxycarbonyl group (0.44), pyrazolyl group (0.37), methanesulfonyloxy group (0.36), dimethoxyphosphoryl group (0.60) and sulfamoyl group (0.57).

$R_{21}$ preferably represents a cyano group, an aliphatic oxycarbonyl group (which is a straight-chain or branched alkoxycarbonyl, aralkyloxycarbonyl, alkenyloxycarbonyl, alkynyloxycarbonyl, cycloalkoxycarbonyl or cycloalkenyloxycarbonyl group having 2 to 36 carbon atoms, e.g., methoxycarbonyl, ethoxycarbonyl, dodecyloxycarbonyl, octadecyloxycarbonyl, 2-ethylhexyloxycarbonyl, sec-butyloxycarbonyl, oleyloxycarbonyl, benzyloxycarbonyl, propargyloxycarbonyl, cyclopentyloxycarbonyl, cyclohexyloxycarbonyl or 2,6-di-t-butyl-4-methylcyclohexyloxycarbonyl), a dialkylphosphono group (which is a dialkylphosphono group having 2 to 36 carbon atoms, e.g., diethylphosphono or dimethylphosphono), an alkyl- or aryl-sulfonyl group (which is an alkyl- or aryl-sulfonyl group having 1 to 36 carbon atoms, e.g., methanesulfonyl group, butanesulfonyl group, benzenesulfonyl group or p-toluenesulfonyl group) or a fluorinated alkyl group (which is a fluorinated alkyl group having 1 to 36 carbon atoms, e.g., trifluoromethyl). $R_{21}$ is particularly preferably a cyano group, aliphatic oxycarbonyl group or fluorinated alkyl group, and most preferably a cyano group.

$R_{22}$ preferably represents an aliphatic oxycarbonyl group such as those exemplified as $R_{21}$, carbamoyl group (which is a carbamoyl group having 1 to 36 carbon atoms, e.g., diphenylcarbamoyl or dioctylcarbamoyl), sulfamoyl group (which is a sulfamoyl group having 1 to 36 carbon atoms, e.g., dimethylsulfamoyl or dibutylsulfamoyl), dialkylphosphono group such as those exemplified as $R_{21}$, or diarylphosphono group (which is a diarylphosphono group having 12 to 50-carbon atoms, e.g., diphenylphosphono or di(p-toluoyl) phosphono). $R_{22}$ is particularly preferably an aliphatic oxycarbonyl group represented by the following formula.

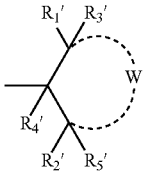

In the formula, $R_1'$ and $R_2'$ respectively represent an aliphatic group, e.g., a straight-chain or branched alkyl, aralkyl, alkenyl, alkynyl, cycloalkyl or cycloalkenyl group having 1 to 36 carbon atoms, specifically, e.g., methyl, ethyl, propyl, isopropyl, t-butyl, t-amyl, t-octyl, tridecyl, cyclopentyl or cyclohexyl. $R_3'$, $R_4'$ and $R_5'$ respectively represent a hydrogen atom or an aliphatic group. Examples of the aliphatic group include those previously exemplified as $R_1'$ and $R_2'$. $R_3'$, $R_4'$ and $R_5'$ each are preferably a hydrogen atom.

W represents a nonmetallic atomic group required to form a five- to eight-membered ring, which may be substituted, may be a saturated ring and may have an unsaturated bond. Preferable examples of the nonmetallic atom include a nitrogen atom, oxygen atom, sulfur atom or carbon atom, and a carbon atom is a most preferable example.

Examples of the ring formed by W include, e.g., a cyclopentane ring, cyclohexane ring, cycloheptane ring, cyclooctane ring, cyclohexene ring, piperazine ring, oxane ring and thiane ring. These rings may be substituted with a substituent such as those represented by $R_{23}$ as will be explained later.

The ring formed by W is preferably a cyclohexane ring which may be substituted, and particularly preferably a cyclohexane ring whose fourth position is substituted with an alkyl group (which may be substituted with a substituent such as those represented by $R_{23}$ as will be explained later) having 1 to 36 carbon atoms.

$R_{23}$ represents a substituent.

Examples of the substituent represented by $R_{23}$ include alkyl groups (e.g., methyl, ethyl, isopropyl, t-butyl, t-amyl, adamantyl, 1-methylcyclopropyl, t-octyl, cyclohexyl, 2-methanesulfonylethyl, 3-(3-pentadecylphenoxy)propyl, 3-{4-{2-[4-(4-hydroxyphenylsulfonyl)phenoxy] dodecanamido}phenyl}propyl, 2-ethoxytridecyl, trifluoromethyl, cyclopentyl and 3-(2,4-di-t-amylphenoxy)propyl), aralkyl groups (e.g., benzyl, 4-methoxybenzyl and 2-methoxybenzyl), aryl groups (e.g., phenyl, 4-t-butylphenyl, 2,4-di-t-amylphenyl and 4-tetradecanamidophenyl), alkoxy groups (e.g., methoxy, ethoxy, 2-methoxyethoxy, 2-dodecylethoxy, 2-methanesulfonylethoxy and 2-phenoxyethoxy), aryloxy groups (e.g., phenoxy, 2-methylphenoxy, 4-t-butylphenoxy, 3-nitrophenoxy, 3-t-butyloxycarbamoylphenoxy and 3-methoxycarbamoylphenoxy), amino groups (including anilino groups; e.g., methylamino, ethylamino, anilino, dimethylamino, diethylamino, t-butylamino, 2-methoxyanilino, 3-acetylaminoanilino and cyclohexylamino), acylamino groups (e.g., acetamide, benzamide, tetradecanamide, 2-(2,4-di-t-amylphenoxy)butanamide, 4-(3-t-butyl-4-hydroxyphenoxy)butanamide, 2-{4-(4-hydroxyphenylsulfonyl) phenoxy}decanamide), ureido groups (e.g., phenylureido, methylureido and N,N-dibutylureido), alkylthio groups (e.g., methylthio, octylthio, tetradecylthio, 2-phenoxyethylthio, 3-phenoxypropylthio and 3-(4-t-butylphenoxy)propylthio), arylthio groups (e.g., phenylthio, 2-butoxy-5-t-octylphenylthio, 3-pentadecylphenylthio, 2-carboxyphenylthio and 4-tetradecanamidophenylthio), alkoxycarbonylamino groups (e.g., methoxycarbonylamino and tetradecyloxycarbonylamino), carbamoyloxy groups (e.g., N-methylcarbamoyloxy and N-phenylcarbamoyloxy) and heterocyclic thio groups (e.g., 2-benzothiazolylthio, 2,4-di-phenoxy-1,3,5-triazole-6-thio and 2-pyridylthio).

$R_{23}$ is preferably a substituent selected from an aliphatic group, aryl group, alkoxy group, aryloxy group, amino group, acylamino group, arylthio group, alkylthio group, ureido group, alkoxycarbonylamino group, carbamoyloxy group and heterocyclic thio group. These groups may be substituted with a substituent (the substituents represented by $R_{23}$ shown in the following).

$R_{23}$ is more preferably an aliphatic group (preferably an alkyl group or aralkyl group), aryl group, alkoxy group or acylamino group. These groups may be substituted with a substituent exemplified as $R_{23}$.

Y represents a hydrogen atom or a group capable of being split-off upon a coupling reaction with an oxidant of a developing agent.

Y is preferably a hydrogen atom, halogen atom, aryloxy group, heterocyclic acyloxy group, dialkylphosphonooxy group, arylcarbonyloxy group, arylsulfonyloxy group, alkoxycarbonyloxy group or carbamoyloxy group. Further, the split-off group (releasing group) or a compound released from the split-off group preferably has the property of further reacting with an oxidant of a developing agent (preferably an oxidant of an aromatic primary amine color-developing agent). Examples of the split-off group include non-color-forming couplers, hydroquinone derivatives, aminophenol derivatives and sulfonamidophenol derivatives.

As to the couplers represented by the formula (CC-I), the group of $R_{22}$ or $R_{23}$ may contain a group to give a coupler represented by the formula (CC-I), to form a dimer or a polymer larger than a dimer; or the group of $R_{22}$ or $R_{23}$ may contain a high molecular chain, to form a homopolymer or copolymer. Typical examples of the homopolymer or copolymer containing a high molecular chain are homopolymers or copolymers of addition polymer ethylene-type unsaturated compounds having a group to give a coupler represented by the formula (CC-I). In this case, one or more types of cyan color-forming repeating unit having a group to give a coupler represented by the formula (CC-I) may be contained in the polymer. The coupler may be copolymers containing one or more non-color-forming ethylene-type monomers which do not couple with an oxidant of a developing agent, for example, acrylates, methacrylates and maleates as a copolymer component.

Hereinafter, specific examples of the couplers represented by formula (CC-I) are shown below, but the couplers for use in the present invention are not limited to these examples.
(CC-1)
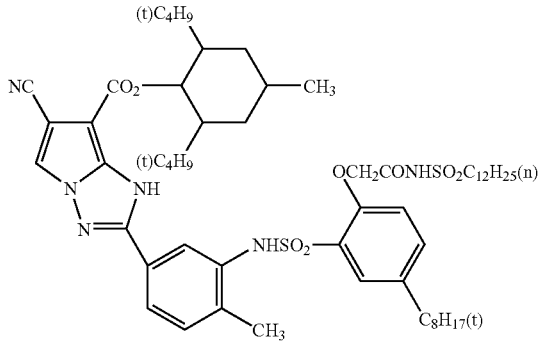
(CC-2)
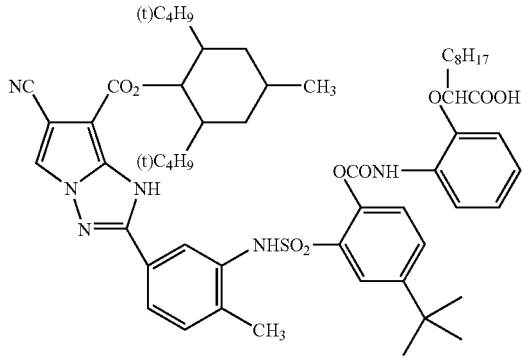
(CC-3)
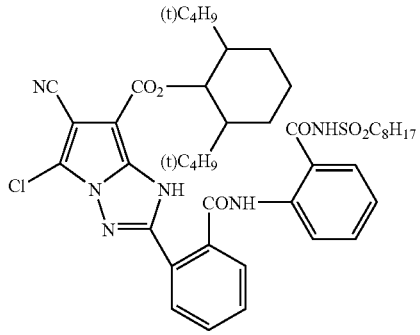
(CC-4)
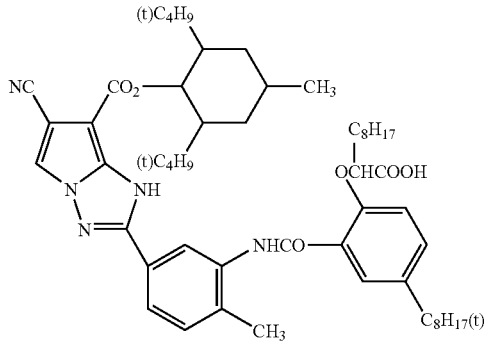
(CC-5)
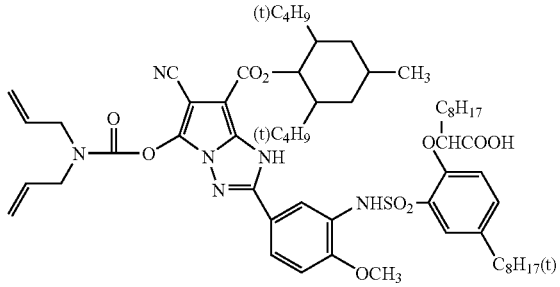
(CC-6)
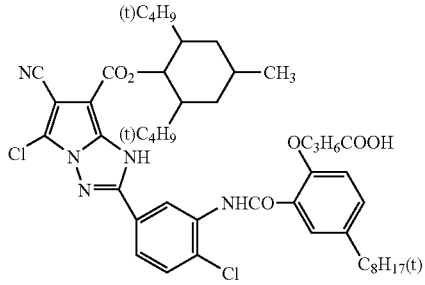
(CC-7)
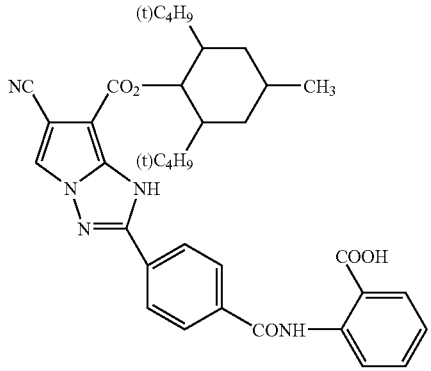
(CC-8)
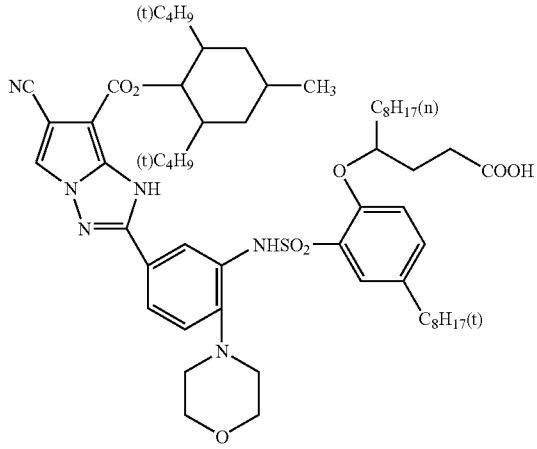

-continued
(CC-9)
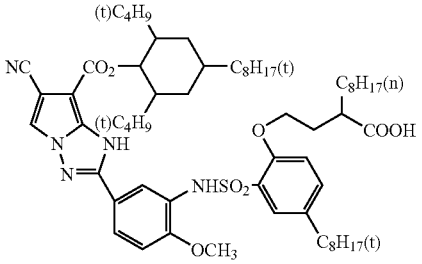
(CC-10)
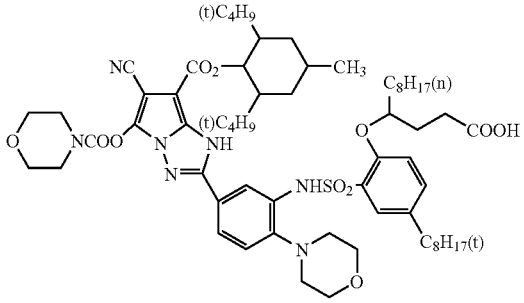
(CC-11)
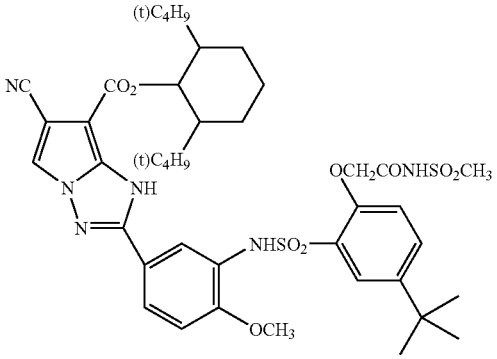
(CC-12)
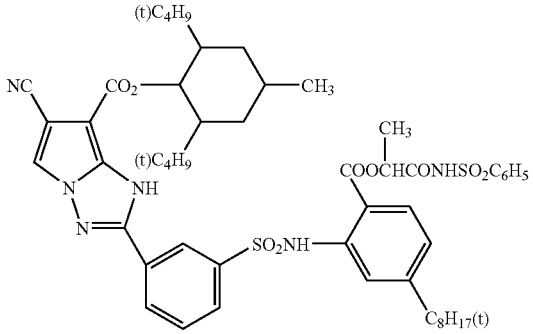
(CC-13)
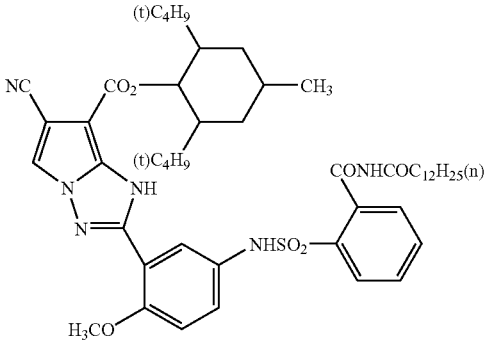
(CC-14)
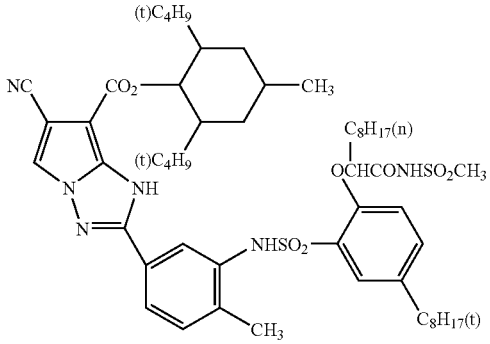
(CC-15)
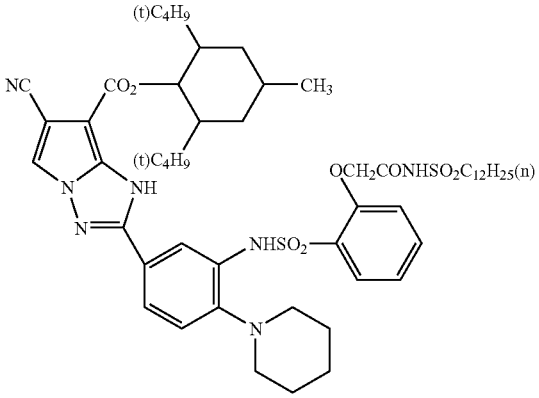
(CC-16)
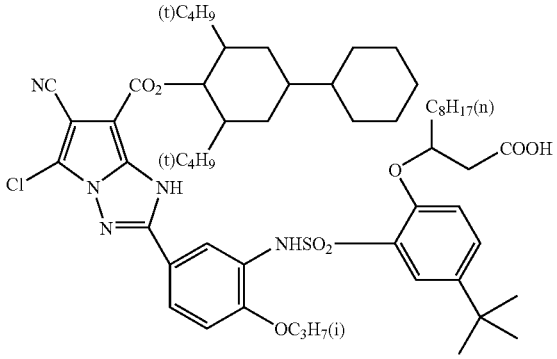

-continued
(CC-17)
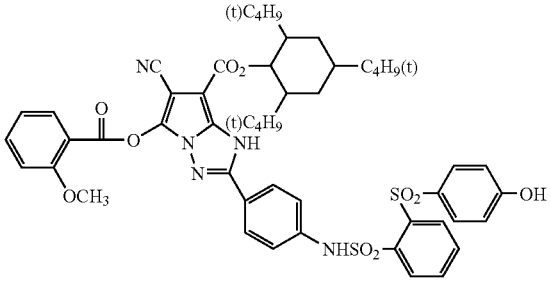
(CC-18)
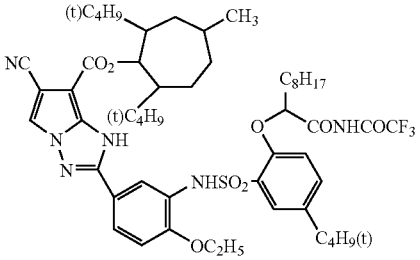
(CC-19)
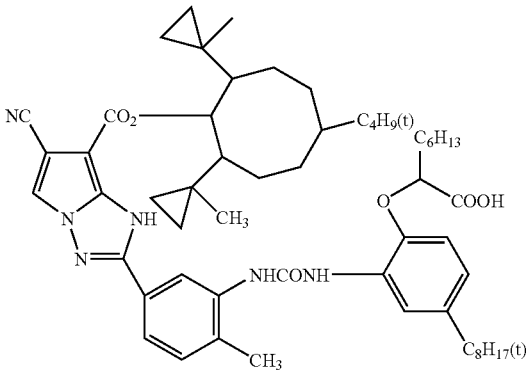
(CC-20)
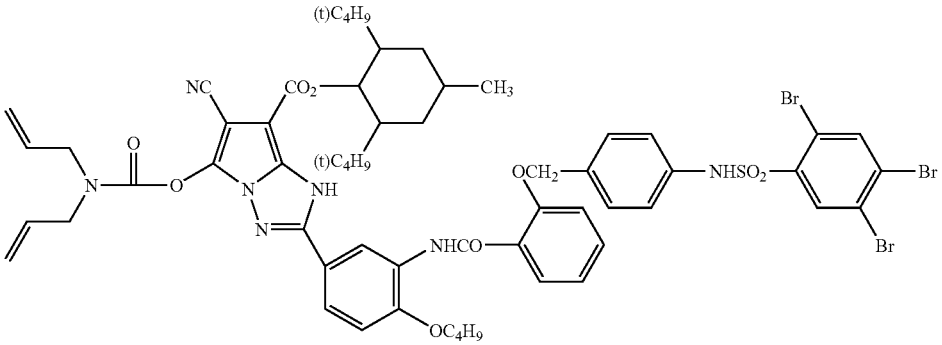
(CC-21)
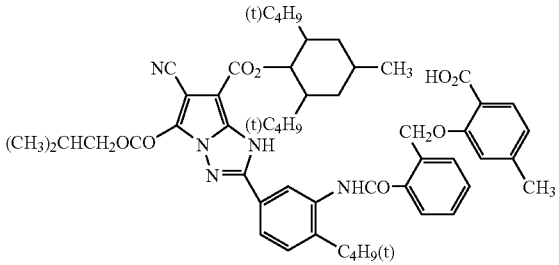
(CC-22)
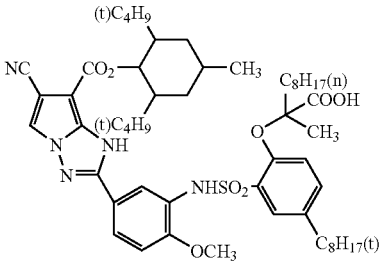

-continued
(CC-23)
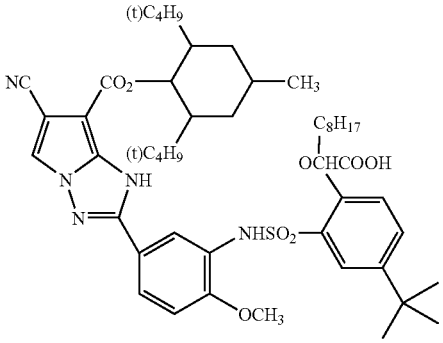
(CC-24)
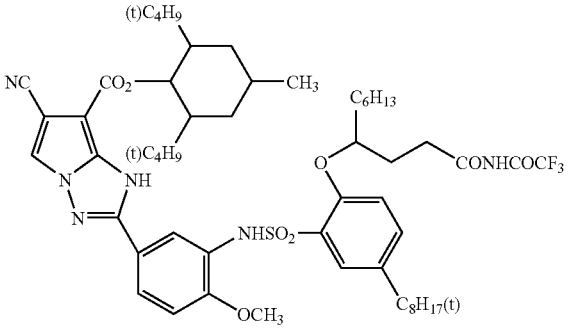
(CC-25)
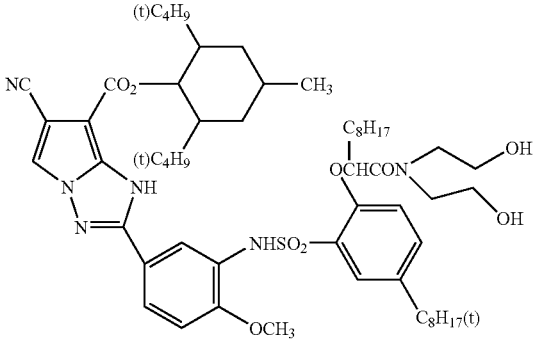
(CC-26)
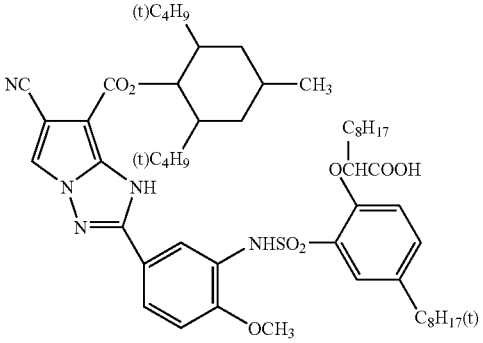
(CC-27)
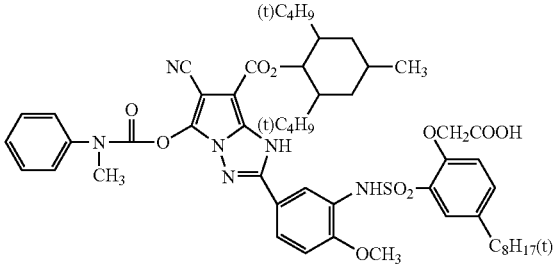
(CC-28)
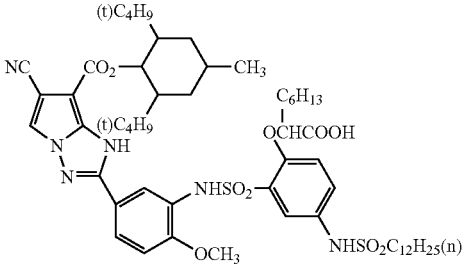
(CC-29)
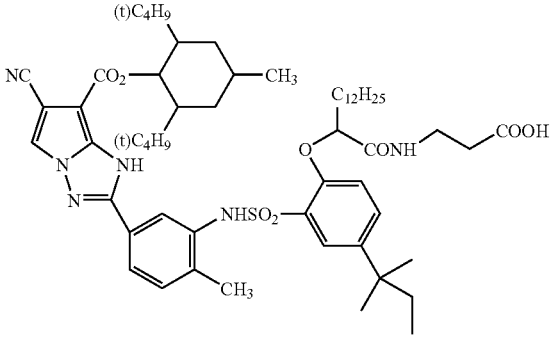
(CC-30)
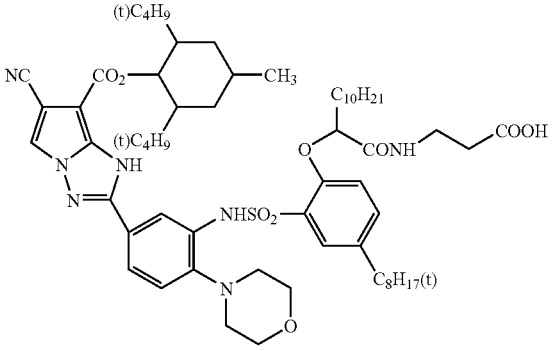

-continued
(CC-31)
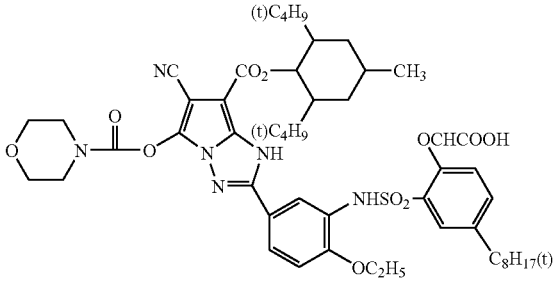
(CC-32)
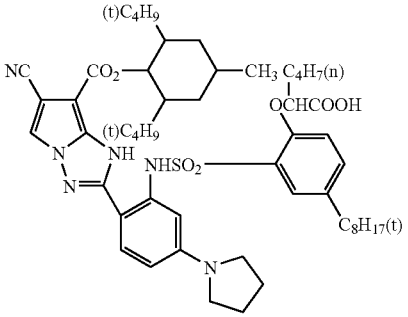
(CC-33)
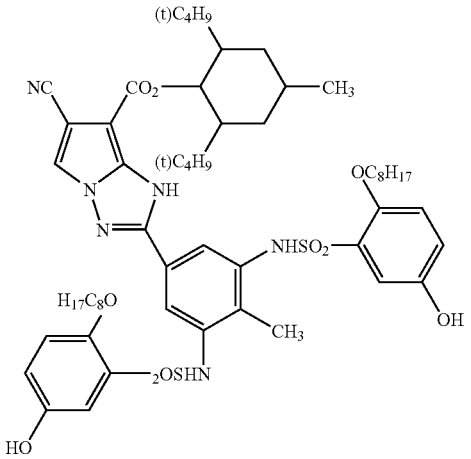
(CC-34)
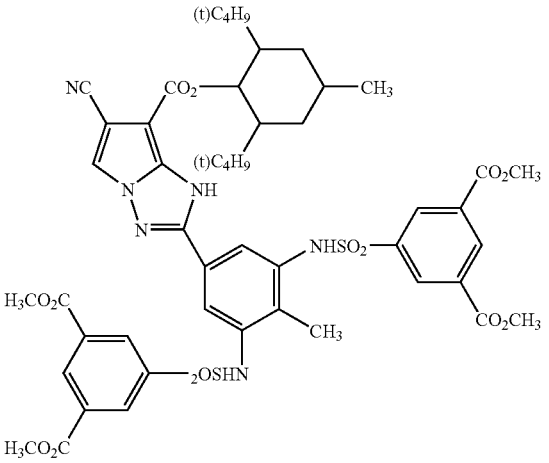
(CC-35)
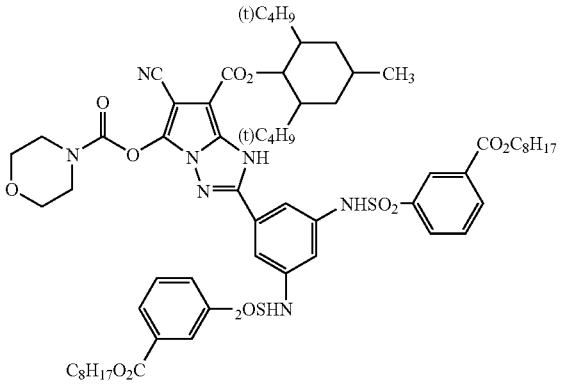
(CC-36)
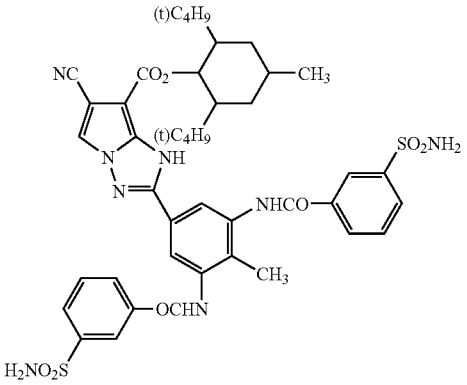

-continued
(CC-37)
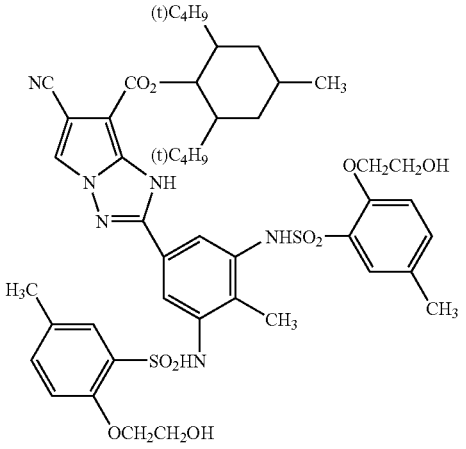
(CC-38)
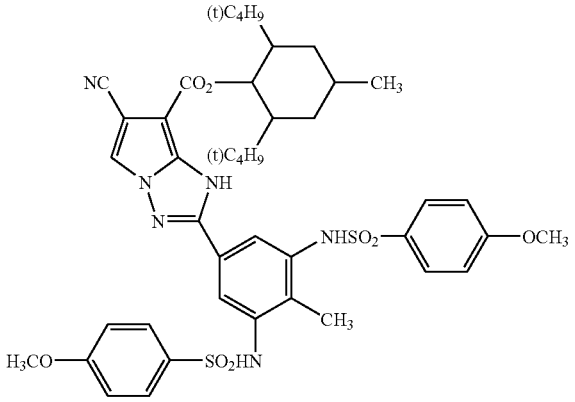
(CC-39)
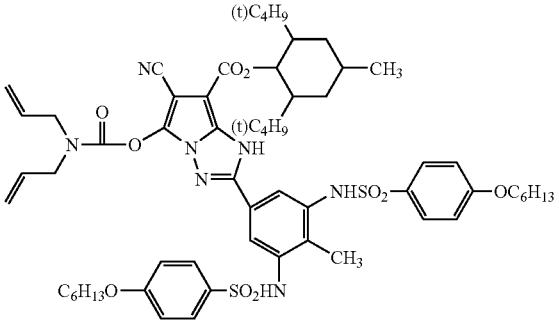
(CC-40)
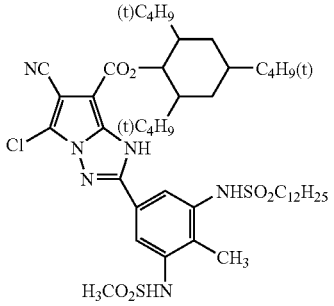
(CC-41)
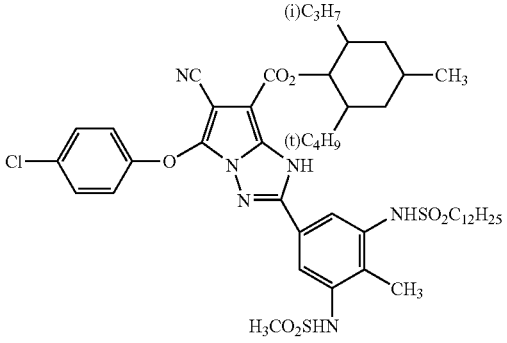
(CC-42)
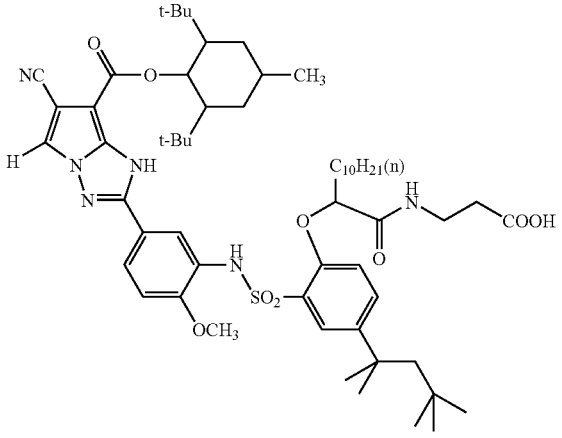

-continued
(CC-44)
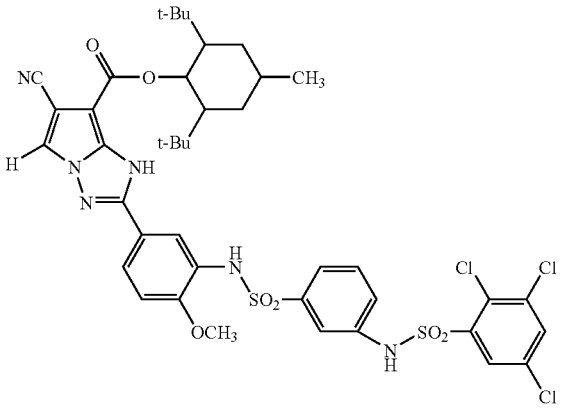
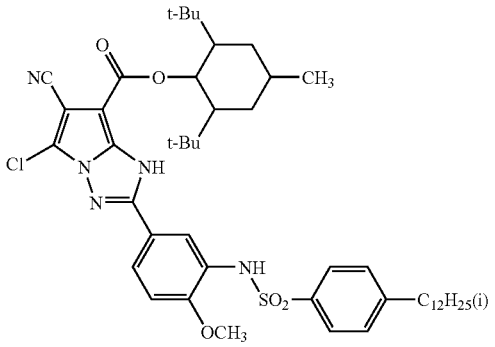
(CC-45)
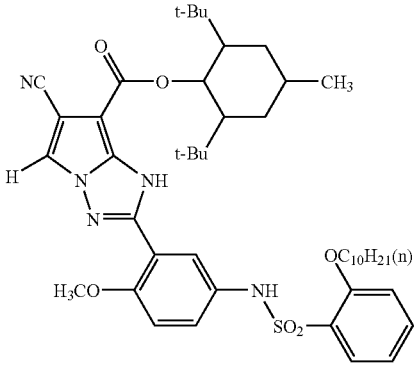
(CC-46)
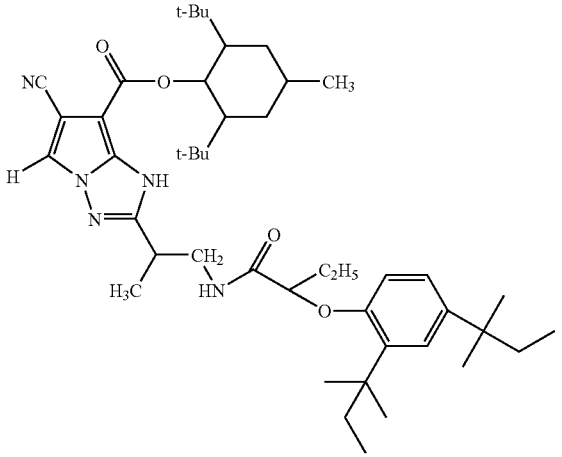
(CC-47)
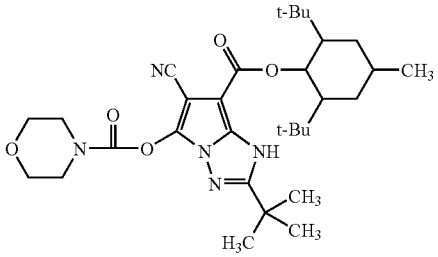
(CC-48)
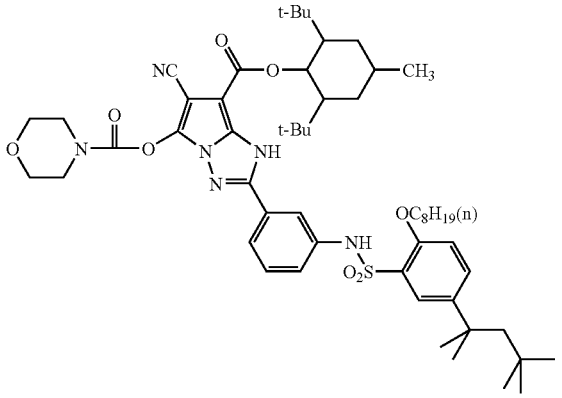

-continued
(CC-49)
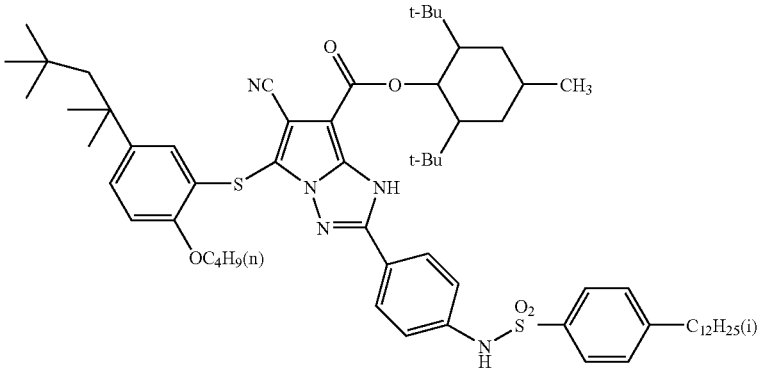
(CC-50)
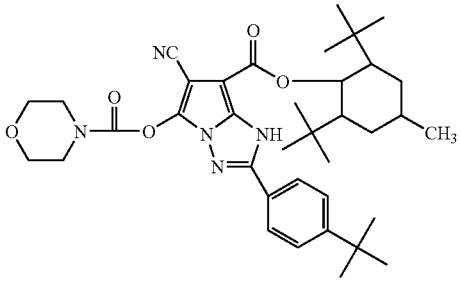
(CC-51)
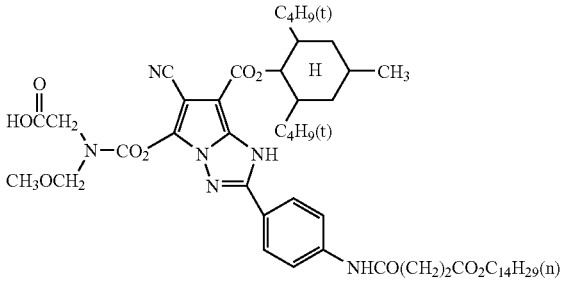
(CC-52)
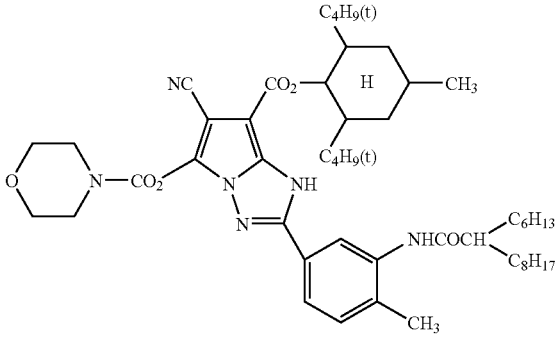
(CC-53)
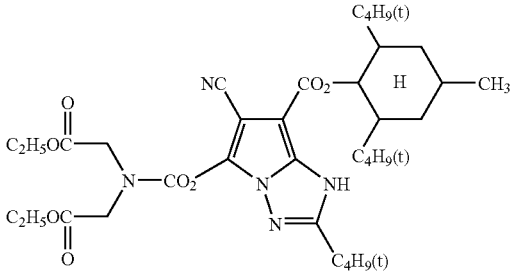
(CC-54)
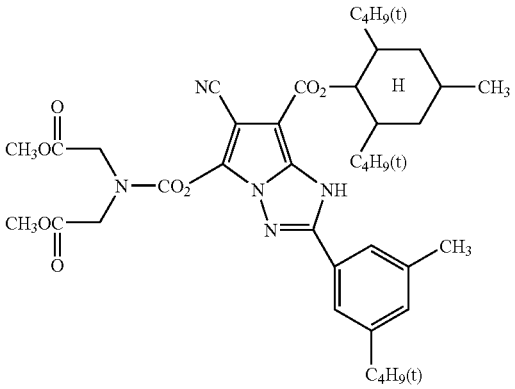
(CC-55)
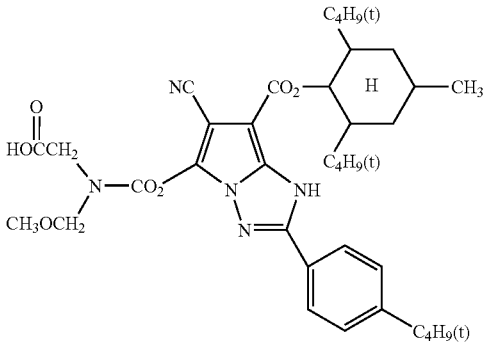

-continued (CC-56)

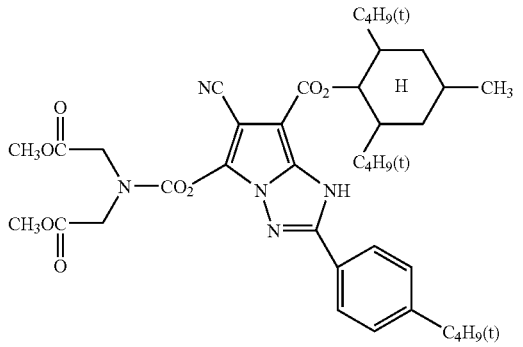

(CC-57)

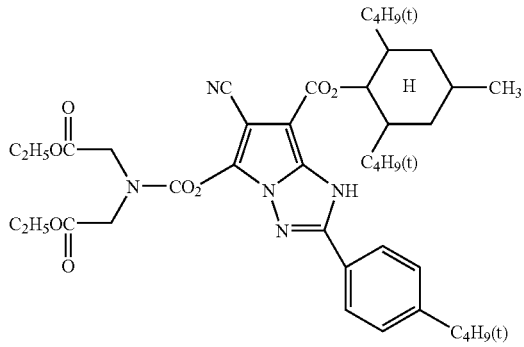

(CC-58)

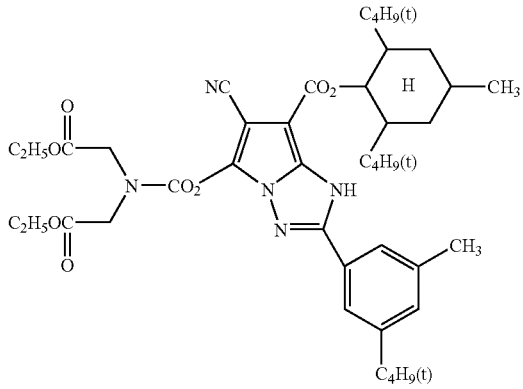

The coupler represented by the formula (CC-I) may be synthesized using known methods, for example, methods described in J.C.S., (1961), p. 518, J.C.S., (1962), p. 5149, Angew. Chem., Vol. 72, p. 956 (1960), and Berichte, Vol. 97, p. 3436 (1964), and methods described in the references cited therein or similar methods.

The couplers represented by any one of the formula (I), (II) or (CC-I) can be introduced into the light-sensitive material by using various known dispersing methods, among which an oil-in-water dispersing method is preferable in which the coupler is dissolved in a high-boiling point organic solvent (which may be used together with a low-boiling point solvent, if necessary) and is then emulsified and dispersed in an aqueous gelatin solution, which is then added to the silver halide emulsion.

Examples of the high-boiling point solvent that can be used in this oil-in-water dispersing method are described in U.S. Pat. No. 2,322,027 and the like. Specific examples of the step and effect of a latex dispersing method, as one of polymer dispersing methods, and the latex for impregnation, are described in, for example, U.S. Pat. No. 4,199,363, West German Patent Application (OLS) Nos. 2,541,274 and 2,541,230, JP-B-53-41091 and European Patent (Laid-Open) No. 029104. Also, particulars as to dispersion using an organic solvent-soluble polymer are described in the specification of PCT International Patent Application (Laid-Open) No. WO88/00723.

Examples of the high-boiling point solvent which may be used in the aforementioned oil-in-water dispersing method, include phthalates (e.g., dibutyl phthalate, dioctyl phthalate, dicyclohexyl phthalate, di-2-ethylhexyl phthalate, decyl phthalate, bis(2,4-di-tert-amylphenyl)isophthalate and bis(1,1-diethylpropyl)phthalate), phosphates or phosphonates (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate and di-2-ethylhexylphenyl phosphate), citrates (e.g., tributyl citrate and trihexyl citrate), benzoates (e.g., 2-ethylhexyl benzoate, 2,4-dichlorobenzoate, dodecyl benzoate and 2-ethylhexyl-p-hydroxybenzoate), amides (e.g., N,N-diethyldodecanamide and N,N-diethyllaurylamide), alcohols or phenols (e.g., isostearyl alcohol and 2,4-di-tert-amylphenol), aliphatic esters (e.g., dibutoxyethyl succinate, di-2-ethylhexyl succinate, 2-hexyldecyl tetradecanate, tributyl citrate, diethyl azelate, isostearyl lactate and trioctyl tosylate), aniline derivatives (e.g., N,N-dibutyl-2-butoxy-5-tert-octylaniline), chlorinated paraffins (paraffins containing 10% to 80% of chlorine), trimesates (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol and 4-(4-dodecyloxyphenylsulfonyl)phenol), carboxylates (e.g., 2-(2,4-di-tert-amylphenoxybutyric acid and 2-ethoxyoctadecanic acid), and alkyl phosphoric acids (e.g., di-(2-ethylhexyl)phosphoric acid and diphenylphosphoric acid). Besides the above high-boiling point solvents, compounds described in, for example, JP-A-6-258803 are also preferably used as the high-boiling point solvent.

Among these solvents, phosphates are preferable and also alcohols or phenols are preferably used together the phosphates.

In the silver halide photographic light-sensitive material of the present invention, preferably of the second embodiment, the ratio by mass of the high-boiling point organic solvent to be used together with the coupler represented by any of the aforementioned formula (I), (II) or (CC-I) to the coupler is preferably 0 to 2.0, more preferably 0 to 1.0, and particularly preferably 0 to 0.5.

Also, an organic solvent (e.g., ethyl acetate, butyl acetate, ethyl propionate, methyl ethyl ketone, cyclohexanone, 2-ethoxyethyl acetate and dimethylformamide) having a boiling point of 30° C. or more and about 160° C. or less, may be used together as an auxiliary solvent.

In the silver halide photographic light-sensitive material of the present invention, preferably of the second embodiment, the content of the coupler represented by any of the aforementioned formulae (1), (II) or (CC-I) in the light-sensitive material, is preferably 0.01 to 10 g/m$^2$, and more preferably 0.1 to 2 g/m$^2$. The content of the coupler is preferably $1\times10^{-3}$ mol to 1 mol, and more preferably $2\times10^{-3}$ mol to $3\times10^{-1}$ mol, per mol of the silver halide contained in the same light-sensitive emulsion layer.

Hereinafter, the silver halide color photographic light-sensitive material of the present invention (hereinafter, also referred to simply as "a light-sensitive (or photosensitive) material") is explained in detail.

In the present invention, preferably in the second and third embodiments, a silver halide color photosensitive material which has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, is preferably used.

In the present invention, preferably in the second and third embodiments, the silver halide emulsion layer containing a yellow dye-forming coupler functions as a yellow color-forming layer, the silver halide emulsion layer containing a magenta dye-forming coupler functions as a magenta color-forming layer, and the silver halide emulsion layer containing a cyan dye-forming coupler functions as a cyan color-forming layer. Preferably, the silver halide emulsions contained in the yellow color-forming layer, the magenta color-forming layer, and the cyan color-forming layer may have photosensitivities to mutually different wavelength regions (for example, light in a blue region, light in a green region and light in a red region).

In addition to the yellow color-forming layer, the magenta color-forming layer, and the cyan color-forming layer, the photosensitive material of the present invention, preferably of the second and third embodiments, may have a hydrophilic colloid layer, an antihalation layer, an intermediate layer, and a coloring layer, as described below, if necessary.

The silver halide photographic light-sensitive material of the present invention, preferably of the second, third and fourth embodiments, can be used in such applications as a color negative film, a color positive film, a color reversal film, a color reversal printing paper, a color printing paper, a color negative film for movies, a color positive film for movies, a display light-sensitive material, a color proof (digital color proof in particular) light-sensitive material.

In the present invention, preferably in the second, third and fourth embodiments, preferred applications are a light-sensitive material to be used in direct appreciation, a color printing paper (color paper), a display light-sensitive material, a color proof, a color reversal film (color reversal), a color reversal printing paper, and a color positive film for movies. Among these applications, a color printing paper and a color reversal film are preferable.

In case where the present invention, preferably the second, third and fourth embodiments, is applied to a color paper, the light-sensitive material and the like described in JP-A-11-7109, particularly descriptions in paragraph numbers 0071 to 0087 in JP-A-11-7109 are preferable, and therefore the above descriptions in JP-A-11-7109 are incorporated herein by reference.

In case where the present invention, preferably the second, third and fourth embodiments, is applied to a color negative film, the descriptions in paragraph Nos. 0115 to 0217 of the specification of JP-A-11-305396 can be preferably applied thereto, and therefore the descriptions are incorporated herein by reference.

In case where the present invention, preferably the second, third and fourth embodiments, is applied to a color reversal film, the light-sensitive material described in JP-A-2001-142181 is preferable, and the descriptions in paragraph Nos. 0164 to 0188 of the specification of JP-A-2001-142181 and the descriptions in paragraph Nos. 0018 to 0021 of the specification of JP-A-11-84601 can be preferably applied thereto, and therefore these descriptions are incorporated herein by reference.

The silver halide light-sensitive material that can be preferably used in the present invention, preferably in the second and third embodiments, is explained below in detail.

Preferable as the silver halide grains in the silver halide emulsion that can be used in the present invention, preferably in the second and third embodiments, are cubic or tetradecahedral crystal grains substantially having a {100} plane (each grain may have a round apex and a plane of a higher order); octahedral crystal grains; and tabular grains having an aspect ratio of 2 or more in which 50% or more of the total projected area thereof is taken up by a {100} plane or {111} plane. The aspect ratio is defined as the value obtained by dividing the diameter of a circle whose area is equal to the projected area of an individual grain by the thickness of the grain. In the present invention, preferably in the second and third embodiments, cubic grains, or tabular grains having {100} planes as major faces, or tabular grains having {111} planes as major faces are preferably used.

As a silver halide emulsion which can be used in the present invention, preferably in the second and third embodiments, for example, silver chloride, silver bromide, silver iodobromide, or silver chloro(iodo)bromide emulsion may be used. It is preferable, for the purpose of rapid processing, to use a silver chloride, silver chlorobromide, silver chloroiodide, or silver chlorobromoiodide emulsion having a silver chloride content of 90 mol % or greater, more preferably a silver chloride, silver chlorobromide, silver chloroiodide, or silver chlorobromoiodide emulsion having a silver chloride content of 98 mol % or greater. Preferred of these silver halide emulsions are those having in the shell parts of silver halide grains a silver iodochloride phase of 0.01 to 0.50 mol %, more preferably 0.05 to 0.40 mol %, per mol of the total silver, in view of high sensitivity and excellent high-illumination intensity exposure suitability. Further, especially preferred of these silver halide emulsions are those containing silver halide grains having on the surface thereof a silver bromide localized phase of 0.2 to 5 mol %, more preferably 0.5 to 3 mol %, per mol of the total silver, since both of high sensitivity and stabilization of photographic properties are attained.

To silver halide grains in the silver halide emulsion that can be used in the present invention, preferably in the second and third embodiments, iodide ions are introduced to make the grain include silver iodide. In order to introduce iodide ions, an iodide salt solution may be added singly, or it may be added in combination with both of a silver salt solution and a high chloride salt solution. In the latter case, the iodide salt solution and the high chloride salt solution may be added separately, or as a mixture solution of these salts of iodide and high chloride. The iodide salt is generally added in the form of a soluble salt, such as an alkali or alkali earth iodide salt. Alternatively, iodide ions may be introduced by cleaving the iodide ions from an organic molecule, as described in U.S. Pat. No. 5,389,508. As another source of iodide ion, fine silver iodide grains may be used.

The addition of an iodide salt solution may be concentrated at one time of grain formation process or may be performed over a certain period of time. For obtaining an emulsion with high sensitivity and low fog, the position of the introduction of an iodide ion to a high silver chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 80% or outer side. Moreover, the addition of an iodide salt solution is preferably finished at 98% or inner side of the volume of a grain, more preferably 96% or inner side. When the addition of an iodide salt solution is finished at a little inner side of the grain surface, an emulsion having higher sensitivity and lower fog can be obtained.

The distribution of an iodide ion concentration in the depth direction of a grain can be measured according to an etching/TOF-SIMS (Time of Flight-Secondary Ion Mass Spectrometry) method by means of, for example, a TRIFT II Model TOF-SIMS apparatus (trade name, manufactured by Phi Evans Co.). A TOF-SIMS method is specifically described in edited by Nippon Hyomen Kagakukai, *Hyomen Bunseki Gijutsu Sensho Niji Ton Shisuryo Bunsekiho* (*Surface Analysis Technique Selection-Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. It is preferred that when the silver halide emulsion for use in the present invention, preferably in the second and third embodiments, contains silver iodide, the silver halide grains have the maximum concentration of iodide ions at the surface of the grain, and the iodide ion concentration decreases inwardly in the grain, for the analysis with etching/TOF-SIMS.

It is preferable that the silver halide emulsion in the light-sensitive material of the present invention, preferably of the second and third embodiments, has a localized silver bromide phase.

In the case where a silver halide emulsion for use in the present invention, preferably in the second and third embodiments, has a localized silver bromide phase, it is preferable to prepare silver halide grains by epitaxially growing, on the grain surface, the localized silver bromide phase having a silver bromide content of at least 10 mol % or more. It is also preferable to have an outermost shell portion having a silver bromide content of 1 mol % or more in the vicinity of the surface layer.

The silver bromide content of the localized silver bromide phase is preferably in the range of 1 to 80 mol % and most preferably in the range of 5 to 70 mol %. The localized silver bromide phase is made up of preferably 0.1 to 30 mol % of silver, more preferably 0.3 to 20 mol % of silver, based on the total moles of silver constituting the silver halide grains in the present invention, preferably in the second and third embodiments. It is preferable to incorporate a complex ion of a Group VIII metal, such as an iridium ion, into the localized silver bromide phase. The amount of the compound (complex) to be added varies widely depending on purposes, and the amount in the range of $10^{-9}$ to $10^{-2}$ mol, per mole of silver halide, is preferable.

In the present invention, preferably in the second and third embodiments, it is preferable to incorporate metal ions into the interior and/or surface of silver halide grains, by the addition of transition metal ions at a step in which the silver halide grains are formed and/or grown. As the metal ion that can be used, a transition metal ion is preferable. Among the transition metal ions, ions of iron, ruthenium, iridium, osmium, lead, cadmium or zinc are preferable. It is still more preferable that these metal ions are used in the form of a six-coordination complex of octahedron-type having ligands. When employing an inorganic compound as a ligand, a cyanide ion, halide ion, thiocyanato, hydroxide ion, peroxide ion, azide ion, nitrite ion, water (aquo), ammonio, nitrosyl ion, or thionitrosyl ion is preferably used. Such a ligand is preferably coordinated to any metal ion selected from the group consisting of the above-mentioned iron, ruthenium, iridium, osmium, lead, cadmium and zinc. Two or more kinds of these ligands are also preferably used in one complex molecule.

In order to alleviate high-intensity illumination reciprocity failure for the silver halide emulsion in the present invention, preferably in the second and third embodiments, it is particularly preferable that silver halide grains of the emulsion has (is doped with) an iridium ion having at least one organic ligand.

In the case where an organic compound is used as the ligand, as a common practice with other transition metal, preferred examples of the organic compound include a linear compound whose main chain has 5 or less carbon atoms and/or a 5-membered or 6-membered heterocyclic compound. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Among these compounds, a thiazole ligand, in particular 5-methylthiazole, is used as a ligand particularly preferable to an iridium ion.

Preferable combinations of a metal ion and a ligand are those of iron and/or ruthenium ion and cyanide ion. Preferred of these compounds are those in which the number of cyanide ions accounts for the majority of the coordination sites intrinsic to the iron or ruthenium that is the central metal. The remaining coordination sites are preferably occupied by thiocyan, ammonia, water, nitrosyl ion, dimethylsulfoxide, pyridine, pyrazine, or 4,4'-bipyridine. Most preferably, each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver.

The use of the iridium ion is not limited to the combination with the above organic ligand. Preferred examples of the ligand include a fluoride ion, a chloride ion, a bromide ion, and an iodide ion. Among these ions, the use of a chloride ion or a bromide ion is preferable. Preferred specific examples of the iridium complex include: $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$, besides those having any of the above organic ligands.

The amount of the iridium complex to be added during the silver halide grain formation is preferably $1\times10^{-10}$ to $1\times10^{-3}$ moles and most preferably $1\times10^{-8}$ to $1\times10^{-5}$ moles per mole of silver. In the case where ruthenium or osmium is used as the central metal, it is also preferable to use a nitrosyl ion, a thionitrosyl ion, or water molecule together with a chloride ion as a ligand. More preferred is the formation of a pentachloronitrosyl complex, a pentachlorothionitrosyl complex, a pentachloroaquo complex. It is also preferable to form a hexachloro complex. The amount of the complex to be added during the silver halide grain formation is preferably $1\times10^{-10}$ to $1\times10^{-6}$ moles and more preferably $1\times10^{-9}$ to $1\times10^{-6}$ moles per mole of silver.

In the present invention, preferably in the second and third embodiments, the above-mentioned complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, it is also preferable to combine these methods, to incorporate the complex into the inside of the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening with fine grains having complexes incorporated therein to modify the grain surface phase. Further, these methods may be used in combination. Two or more kinds of complexes may be incorporated in the inside of an individual silver halide grain. The halogen composition of the position into which the complex is incorporated is not particularly limited, and it is also preferable to incorporate the complex into any of a silver chloride layer, a silver chlorobromide layer, a silver bromide layer, a silver iodochloride layer, and a silver iodobromide layer.

The silver halide grains contained in the silver halide emulsion for use in the present invention, preferably in the second and third embodiments, have an average grain size (the grain size herein means the diameter of the circle equivalent to the projected area of the grain, and the number average is taken as the average grain size) of preferably from 0.01 μm to 2 μm.

With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred. For obtaining a wide latitude, it is also preferred to blend the above-described monodisperse emulsions in the same layer or to form a multilayer structure using the monodisperse emulsions.

Various compounds or precursors thereof can be contained in the silver halide emulsion for use in the present invention, preferably in the second, third and fourth embodiments, to prevent fogging from occurring or to stabilize photographic performance, during manufacture, storage or photographic processing of the photosensitive material. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-attractive group) disclosed in European Patent No. 0447647 can also be preferably used.

Further, in order to enhance storage stability of the silver halide emulsion for use in the present invention, it is also preferred in the present invention, preferably in the second, third and fourth embodiments, to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (particularly compounds represented by formula (S1); the description in paragraph Nos. 0036 to 0071 of JP-A-11-327094 is incorporated herein by reference); sulfo-substituted catechols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid, and salts of these acids); hydroxylamines represented by formula (A) in U.S. Pat. No. 5,556,741 (the descriptions of column 4, line 56 to column 11, line 22 in U.S. Pat. No. 5,556,741 can be preferably applied to the present invention, and incorporated herein by reference), and water-soluble reducing agents represented by formula (I), (II), or (III) of JP-A-11-102045.

A spectral sensitizing dye can be incorporated, for the purpose of imparting sensitivity in a desired light wavelength region, so-called spectral sensitivity, to the silver halide emulsion in each layer of the photosensitive material of the present invention, preferably of the second, third and fourth embodiments.

Spectral sensitizing dyes which can be used in the photosensitive material of the present invention, preferably of the second, third and fourth embodiments, for spectral sensitization of blue, green and red light regions include, for example, those disclosed by F. M. Harmer, in *Heterocyclic Compounds—Cyanine Dyes and Related Compounds*, John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are particularly preferred as red-sensitive spectral sensitizing dyes for silver halide emulsion grains having a high silver chloride content, from the viewpoint of stability, adsorption strength, temperature dependency of exposure, and the like.

The amount of these spectral sensitizing dyes to be added can be varied in a wide range depending on the occasion, and it is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide.

The silver halide emulsions for use in the present invention, preferably in the second, third and fourth embodiments, are generally chemically sensitized. Chemical sensitization can be performed by utilizing a sulfur sensitization, represented by the addition of an unstable sulfur compound, noble metal sensitization represented by gold sensitization, and reduction sensitization, each singly or in combination thereof. Compounds that are preferably used for chemical sensitization include those described in JP-A-62-215272, from page 18, right lower column to page 22, right upper column of these, gold-sensitized silver halide emulsion is particularly preferred, since a fluctuation in photographic properties which occurs when scanning exposure with laser beams or the like is conducted, can be further reduced by gold sensitization.

In order to conduct gold sensitization to the silver halide emulsion that can be used in the present invention, preferably in the second, third and fourth embodiments, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), are preferably used.

As the gold (I) compounds having an organic ligand (organic compound), the bis gold (I) mesoionic heterocycles described in JP-A-4-267249, for example, gold (I) tetrafluoroborate bis(1,4,5-trimethyl-1,2,4-triazolium-3-thiolate), the organic mercapto gold (I) complexes described in JP-A-11-218870, for example, potassium bis(1-[3-(2-sulfonatobenzamido)phenyl]-5-mercaptotetrazole potassium salt)aurate (I) pentahydrate, and the gold (I) compound with a nitrogen compound anion coordinated therewith, as described in JP-A-4-268550, for example, gold (I) bis(1-methylhydantoinate) sodium salt tetrahydrate, may be used. As the gold (I) compound having the organic ligand, one that has been synthesized and isolated in advance may be used. Alternatively, it can be added to the emulsion by mixing an organic ligand with an Au compound (for example, (tetra)chloroauric acid or its salt), to generate a gold (I) compound in the system without isolation. Further, the gold (I) compound having an organic ligand may be generated in an emulsion, by adding an organic ligand and an Au compound (for example, (tetra) chloroauric acid or its salt) to the emulsion separately. Also, the gold (I) thiolate compound described in U.S. Pat. No. 3,503,749, the gold compounds described in JP-A-8-69074, JP-A-8-69075 and JP-A-9-269554, and the compounds described in U.S. Pat. No. 5,620,841, U.S. Pat. No. 5,912,112, U.S. Pat. No. 5,620,841, U.S. Pat. No. 5,939,245, and U.S. Pat. No. 5,912,111 may be used.

The amount of these compounds to be added can be varied in a wide range depending on the occasion, and it is generally in the range of $5\times10^{-7}$ mole to $5\times10^{-3}$ mole, preferably in the range of $5\times10^{-6}$ mole to $5\times10^{-4}$ mole, per mole of silver halide.

The silver halide emulsion for use in the present invention is preferably subjected to gold sensitization using a colloidal gold sulfide. A method of producing the colloidal gold sulfide is described in, for example, *Research Disclosure*, No. 37154, *Solid State Ionics*, Vol. 79, pp. 60 to 66 (1995), and *Compt. Rend. Hebt. Seances Acad. Sci. Sect. B*, Vol. 263, p. 1328 (1966). Colloidal gold sulfide having various grain sizes are applicable, and even those having a grain diameter of 50 nm or less are also usable. The amount of colloidal gold sulfide to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide.

In the present invention, gold sensitization may be used in combination with other sensitizing methods, for example, sulfur sensitization, selenium sensitization, tellurium sensitization, reduction sensitization, or noble metal sensitization using a noble metal compound other than gold compounds.

The light-sensitive material according to the present invention, preferably the second, third and fourth embodiments, preferably contains, in their hydrophilic colloid layers, dyes (particularly oxonole dyes and cyanine dyes) that can be discolored by processing, as described in European Patent No. 0337490 A2, pages 27 to 76, for the purpose to prevent irradiation or halation or to enhance safelight safety (immunity). Further, dyes described in European Patent No. 0819977 are also preferably used in the present invention, preferably in the second, third and fourth embodiments. Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, preferably in the second, third and fourth embodiments, it is possible to use a colored layer which can be discolored during processing, in place of the water-soluble dye, or in combination with the water-soluble dye. The colored layer that can be discolored with processing to be used, may contact with a light-sensitive emulsion layer directly, or indirectly through an interlayer containing an agent for preventing color-mixing during processing, such as gelatin and hydroquinone. The colored layer is preferably provided as a lower layer (closer to a support) with respect to the emulsion layer which develops the same primary color as the color of the colored layer. It is possible to provide colored layers independently, each corresponding to respective primary colors. Alternatively, only one layer selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible-light region from 400 nm to 700 nm for an ordinary printer exposure, and the wavelength of the light generated from the light source in the case of scanning exposure), the optical density is within the range of 0.2 to 3.0, more preferably 0.5 to 2.5, and particularly preferably 0.8 to 2.0.

The colored layer described above may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer, a method in which a dye is adsorbed onto fine grains of silver halide or the like and fixed in the layer, and a method in which a colloidal silver is used as described in JP-A-1-239544. As to a method of dispersing fine-powder of a dye in solid state, for example, JP-A-2-308244, pages 4 to 13 describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing a colloidal silver for use as a light absorber. Among these methods, preferred are the methods of incorporating fine particles of dye and of using a colloidal silver.

In the case where the present invention, preferably the second, third and fourth embodiments, is applied to a color printing paper, the light sensitive material preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer and the cyan color-forming silver halide emulsion layer.

However, another layer arrangement which is different from the above, may be adopted.

In the light-sensitive material of the present invention, preferably of the second, third and fourth embodiments, a yellow coupler-containing silver halide emulsion layer may be provided at any position on a support. However, in the case where silver halide tabular grains are contained in the yellow coupler-containing layer, it is preferable that the yellow coupler-containing layer may be positioned more apart from the support than at least one of a magenta coupler-containing silver halide emulsion layer and a cyan coupler-containing silver halide emulsion layer. Further, it is preferable that the yellow coupler-containing silver halide emulsion layer be positioned most apart from the support than other silver halide emulsion layers, from the viewpoint of color-development acceleration, desilvering acceleration, and reducing residual color due to a sensitizing dye. Further, it is preferable that the cyan coupler-containing silver halide emulsion layer be provided in the middle of other silver halide emulsion layers, from the viewpoint of reducing blix fading. On the other hand, it is preferable that the cyan coupler-containing silver halide emulsion layer be the lowest layer, from the viewpoint of reducing light fading. Further, each of the yellow-color-forming layer, the magenta-color-forming layer and the cyan-color-forming layer may be composed of two or three layers. It is also preferable that a color-forming layer be formed by providing a silver halide emulsion-free layer containing a coupler in adjacent to a silver halide emulsion layer, as described in, for example, JP-A-4-75055, JP-A-9-114035, JP-A-10-246940, and U.S. Pat. No. 5,576,159.

In the present invention, preferably in the second, third, and fourth embodiments, for example, as a photographic support (base), a transmissive type support and a reflective type support may be used. As the transmissive type support, it is preferred to use a transparent film, such as a cellulose nitrate film, a transparent film of polyethylene terephthalate, a cellulose triacetate film, or a polyester of 2,6-naphthalenedicarboxylic acid (NDCA) and ethylene glycol (EG), or a polyester of NDCA, terephthalic acid and EG, provided thereon with an information-recording layer such as a magnetic layer. In the present invention, preferably in the second, third and fourth embodiments, it is preferable to use a reflective support (reflection-type support). As the reflective type support, it is especially preferable to use a reflective support having a substrate laminated thereon with a plurality of polyethylene layers or polyester layers (water-proof resin layers or laminate layers), at least one of which contains a white pigment such as titanium oxide.

As cyan, magenta and yellow couplers which can be used in the present invention, preferably in the second, third and fourth embodiments (including the case when these couplers are used in combination with the specific coupler as defined in the present invention), in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent No. 0355,660 (A2), page 4, lines 15 to 27, page 5, line 30 to page 28, bottom line, page 45, lines 29 to 31, page 47, line 23 to page 63, line 50, are also preferably used.

Further, it is preferred in the present invention, preferably in the second, third and fourth embodiments, to add compounds represented by formula (II) or (III) in WO 98/33760 and compounds represented by formula (D) described in JP-A-10-221825.

The cyan dye-forming coupler (hereinafter also referred to as "cyan coupler") which can be used in the present invention, preferably in the second embodiment, may be used singly or in combination with another cyan coupler. Examples of the another cyan dye-forming coupler that may be used in combination, include phenol-series or naphthol-series cyan couplers. For example, cyan couplers represented by formula (ADF) described in JP-A-10-333297 are preferred. As cyan couplers other than the foregoing cyan couplers, there are pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, the cyan dye-forming coupler can also be a diphenyllmidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in EP 0333185 A2; a cyclic active methylene-series cyan coupler (particularly couplers 3, 8, and 34 enumerated as specific examples are particularly preferable) described in JP-A-64-32260; a pyrrolopyrozole cyan coupler described in European Patent No. 0456226 A1; and a pyrroloimidazole cyan coupler described in European Patent No. 0484909.

As the magenta dye-forming coupler (which may be referred to simply as a "magenta coupler" herein) that can be used in the present invention, preferably in the second, third and fourth embodiments, use can be made of 5-pyrazolone-series magenta couplers and pyrazoloazole-series magenta couplers such as those described in the above-mentioned patent publications in the above tables. Among these, preferred are pyrazolotriazole couplers in which a secondary or tertiary alkyl group is directly bonded to the 2-, 3- or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 0226849 A2 and 0294785 A, in view of the hue and stability of image to be formed therefrom and color-forming property of the couplers. Particularly as the magenta coupler, pyrazoloazole couplers represented by formula (CC-I) described in JP-A-8-122984 are preferred. The descriptions of paragraph Nos. 0009 to 0026 of the patent publication JP-A-8-122984 are entirely applied to the present invention and therefore are incorporated by reference, in the specification as a part thereof. In addition, pyrazoloazole couplers having a steric hindrance group at both the 3- and 6-positions, as described in European Patent Nos. 854384 and 884640, JP-A-2000-147725, and JP-A-2001-356455, can also be preferably used.

Further, the yellow dye-forming coupler (which may be referred to simply as a "yellow coupler" herein), that can be used in the present invention, preferably in the second and third embodiments, may be used singly or in combination with another yellow dye-forming coupler. Examples of the another yellow dye-forming coupler that can be preferably used, include acylacetamide-type yellow couplers in which the acyl group has a 3-membered to 5-membered cyclic structure, such as those described in European Patent No. 0447969 A1; malondianilide-type yellow couplers having a cyclic structure, as described in European Patent No. 0482552 A1; pyrrol-2 or 3-yl- or indol-2 or 3-yl-carbonyl acetic acid anilide-series couplers, as described in European Patent (laid open) Nos. 953870 A1, 953871 A1, 953872 A1, 953873 A1, 953874 A1 and 953875 A1; acylacetamide-type yellow couplers having a dioxane structure, such as those described in U.S. Pat. No. 5,118,599; in addition to the compounds described in the above-mentioned tables. Among the above, acylacetamide-type yellow couplers in which the acyl group is an 1-alkylcyclopropane-1-carbonyl group, and malondianilide-type yellow couplers in which one anilide constitutes an indoline ring are especially preferably used. These couplers may be used singly or as combined.

In the fourth embodiment of the present invention, as the yellow dye-forming coupler, the above-mentioned various compounds and the compound represented by formula (I) may be used singly or in combination. Among these compounds, the compound represented by formula (I) is preferred.

It is preferred that couplers for use in the present invention, preferably in the second, third and fourth embodiments, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution. Examples of the water-insoluble but organic solvent-soluble polymer which can be preferably used, include the homo-polymers and co-polymers as disclosed in U.S. Pat. No. 4,857,449, from column 7 to column 15 and WO 88/00723, from page 12 to page 30. The use of methacrylate-series or acrylamide-series polymers, especially acrylamide-series polymers, are more preferable, in view of color-image stabilization and the like.

In the present invention, preferably in the second, third and fourth embodiments, known color mixing-inhibitors may be used. Among these compounds, those described in the following patent publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615 and German Patent No. 19629142 A1, may be used. Particularly, in order to accelerate developing speed by increasing the pH of a developing solution, redox compounds described in, for example, German Patent No. 19,618,786 A1, European Patent Nos. 0,839,623 A1 and 0,842,975 A1, German Patent No. 19,806,846 A1 and French Patent No. 2,760,460 A1, are also preferably used.

In the present invention, preferably in the second, third and fourth embodiments, as an ultraviolet ray absorbent, it is preferred to use compounds having a high molar extinction coefficient and a triazine skeleton. For example, those described in the following patent publications can be used. These compounds are preferably added to the light-sensitive layer or/and the light-nonsensitive layer. For example, use can be made of the compounds described in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19,739,797A, European Patent No. 0,711,804 A, JP-T-8-501291 ("JP-T" means searched and published International patent application), and the like.

As the binder or protective colloid which can be used in the light-sensitive material of the present invention, preferably of the second, third and fourth embodiments, gelatin is used advantageously, but another hydrophilic colloid can be used singly or in combination with gelatin. It is preferable for the gelatin that the content of heavy metals, such as Fe, Cu, Zn and Mn, contained as impurities, be reduced to 5 ppm or below, more preferably 3 ppm or below. Further, the amount of calcium contained in the light-sensitive material is preferably 20 mg/m$^2$ or less, more preferably 10 mg/m$^2$ or less, and most preferably 5 mg/m$^2$ or less.

In the present invention, preferably in the second, third and fourth embodiments, it is preferred to add an antibacterial (fungi-preventing) agent and antimold agent, as described in JP-A-63-271247, in order to destroy various kinds of molds and bacteria which propagate in a hydrophilic colloid layer and deteriorate the image. Further, the pH of the film of the light-sensitive material is preferably in the range of 4.0 to 7.0, more preferably in the range of 4.0 to 6.5.

In the present invention, preferably in the second and third embodiments, a surface-active agent may be added to the light-sensitive material, in view of improvement in stability for coating the light-sensitive material, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, preferably in the second and third embodiments, a fluorine-containing surface-active agent is particularly preferred. The fluorine-containing surface-active agent may be used singly or in combination with known another surface-active agent. The fluorine-containing surfactant is preferably used in combination with known another surface-active agent. The amount of the surface-active agent to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

The photosensitive material of the present invention, preferably of the second, third and fourth embodiments, can form an image, via an exposure step in which the photosensitive material is irradiated with light according to image information, and a development step in which the photosensitive material irradiated with light is developed.

The light-sensitive material of the present invention, preferably of the second, third and fourth embodiments, can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted. In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green and blue, and fluorophoroes which can emit a light in a region of yellow, orange, purple or infrared can also be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred from the viewpoint of high quality enhancement, because a cathode ray tube having a high resolving power can be used.

The light-sensitive material of the present invention, preferably of the second, third and fourth embodiments can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material of the present invention, preferably of the second, third and fourth embodiments, can be arbitrarily set up in accordance with the wavelength of a scanning exposure light source to be used. Since oscillation wavelength of a laser can be made half, using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a photographic material in normal three wavelength regions of blue, green and red. The exposure time in such a scanning exposure is defined as the time necessary to expose the size of the picture element (pixel) with the density of the picture element being 400 dpi, and preferred exposure time is $10^{-3}$ sec or less, more preferably $10^{-4}$ sec or less, and further preferably $10^{-6}$ sec or less.

Moreover, the developing agent that can be used in the present invention, preferably in the fourth embodiment, is preferably a p-phenylenediamine-series aromatic primary amine developing agent. Representative examples of the developing agent include 4-amino-3-methyl-N-ethyl-N—(β-methanesulfonamidoethyl)aniline, 4-amino-3-methyl-N-ethyl-N-(β-hydroxyethyl)aniline, and 4-amino-3-methyl-N, N-diethylaniline. Most preferred in the present invention, preferably in the fourth embodiment is 4-amino-3-methyl-N-ethyl-N-(β-methanesulfonamidoethyl)aniline.

The present invention, preferably the second, third and fourth embodiments, can be preferably applied to a light-sensitive material having rapid processing suitability. In the case of conducting rapid processing, the color-developing time is preferably 60 sec or less, more preferably from 50 sec to 6 sec, and further preferably from 30 sec to 6 sec. Likewise, the blix time is preferably 60 sec or less, more preferably from 50 sec to 6 sec, and further preferably from 30 sec to 6 sec. Further, the washing or stabilizing time is preferably 150 sec or less, and more preferably from 130 sec to 6 sec.

Herein, the term "color-developing time" as used herein means a period of time required from the beginning of dipping a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color-developing solution (so-called "time in the solution") and a time in which the light-sensitive material has left the color-developing solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (so-called "time in the solution").

Examples of a development method applicable to the light-sensitive material of the present invention, preferably of the second, third and fourth embodiments, after exposure, include a conventional wet system, such as a development method using a developing solution containing an alkali agent and a developing agent, and a development method wherein a developing agent is incorporated in the light-sensitive material and an activator solution, e.g., a developing agent-free alkaline solution is employed for the development, as well as a heat development system using no processing solution. In particular, the activator method is preferred over the other methods, because the processing solutions contain no developing agent, thereby it enables easy management and handling of the processing solutions and reduction in waste disposal load to make for environmental preservation.

The preferable developing agents or their precursors incorporated in the light-sensitive materials in the case of adopting the activator method include the hydrazine-type compounds described in, for example, JP-A-8-234388, JP-A-9-152686, JP-A-9-152693, JP-A-9-211814 and JP-A-9-160193.

Further, the processing method in which the photographic material reduced in the amount of silver to be applied undergoes the image amplification processing using hydrogen peroxide (intensification processing), can be employed preferably. In particular, it is preferable to apply this processing method to the activator method. Specifically, the image-forming methods utilizing an activator solution containing hydrogen peroxide, as disclosed in JP-A-8-297354 and JP-A-9-152695 can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, preferably in the second, third and fourth embodiments, known ones can be used. Preferably, those described in *Research Disclosure*, Item 36544, pp. 536-541 (September 1994), and JP-A-8-234388 can be used in the present invention, preferably in the second, third and fourth embodiments.

In the silver halide photographic light-sensitive material of the present invention, preferably of the third and fourth embodiments, the content of the coupler represented by the formula (I) or (II) preferably used in the light-sensitive material is preferably 0.01 g to 10 g per $m^2$, more preferably 0.1 g to 2 g per $m^2$, and it is preferably $1\times10^{-3}$ mol to 1 mol, more preferably $2\times10^{-3}$ mol to $3\times10^{-1}$ mol, per mol of the silver halide in the same light-sensitive emulsion layer.

Next, the compound (a high-boiling-point organic solvent), which can be used in the present invention, preferably in the third embodiment, and which is represented by any one of the formula [S-I] to [S-VI], will be explained in detail.

First, the high-boiling-point organic solvent, which is represented by the formula [S-I], will be explained.

In the formula [S-I], $R_{s1}$, $R_{s2}$, and $R_{s3}$ each independently represent an alkyl group, a cycloalkyl group, an alkenyl group, or an aryl group, with the proviso that the total of the carbon atoms of the groups represented by $R_{s1}$, $R_{s2}$, and $R_{s3}$ is 12 to 60.

The alkyl group is preferably a straight-chain or branched alkyl group having 1 to 32 carbon atoms. These alkyl groups include those having a substituent(s). Examples of the alkyl group include a straight-chain or branched butyl group, hexyl group, octyl group, dodecyl group, octadecyl group, and other groups. Among the alkyl groups, particularly preferred are those having 4 to 18 carbon atoms, and further preferred are those having 6 to 12 carbon atoms.

Examples of the cycloalkyl group include a cyclopentyl group, a cyclohexyl group, a cycloheptyl group, and other groups. These cycloalkyl groups include those having a substituent(s). Among the cycloalkyl groups, a cyclohexyl group is particularly preferable.

Examples of the alkenyl group include a butenyl group, a pentenyl group, a hexenyl group, a heptenyl group, an octenyl group, a decenyl group, a dodecenyl group, an octadecenyl group and other groups. These alkenyl groups include those having a substituent(s).

Examples of the aryl group include a phenyl group, a naphthyl group, and other groups. These groups include those having a substituent(s). Specific examples of the aryl group include phenyl, p-cresyl, m-cresyl, o-cresyl, p-chlorophenyl, p-t-butyl-phenyl, and other groups.

Specific examples of the high-boiling-point organic solvent represented by the formula [S-I] will be shown below, but the present invention should not be considered to be limited thereto.

| No. | $Rs_1$ | $Rs_2$ | $Rs_3$ |
|---|---|---|---|
| S-I-1 | $—C_6H_{13}$ | $—C_6H_{13}$ | $—C_6H_{13}$ |
| S-I-2 | $—C_8H_{17}$ | $—C_8H_{17}$ | $—C_8H_{17}$ |
| S-I-3 | $—C_{12}H_{25}$ | $—C_{12}H_{25}$ | $—C_{12}H_{25}$ |
| S-I-4 | 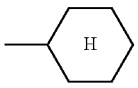 | 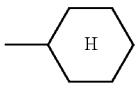 | 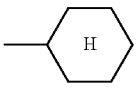 |
| S-I-5 | 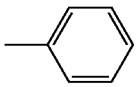 | 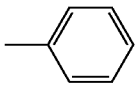 | 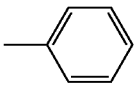 |
| S-I-6 | 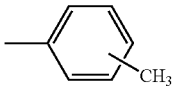 | 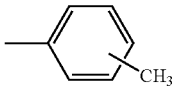 | 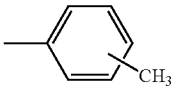 |
| S-I-7 | $—CH_2—CH(CH_2)_3CH_3$ <br> $\lvert$ <br> $CH_2CH_3$ | $—CH_2—CH(CH_2)_3CH_3$ <br> $\lvert$ <br> $CH_2CH_3$ | $—CH_2—CH(CH_2)_3CH_3$ <br> $\lvert$ <br> $CH_2CH_3$ |
| S-I-8 | $—C_4H_9$ | $—C_8H_{17}$ | $—C_8H_{17}$ |
| S-I-9 | 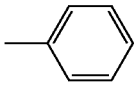 | 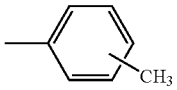 | 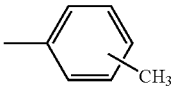 |
| S-I-10 | 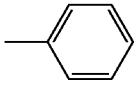 | 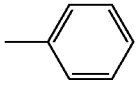 | 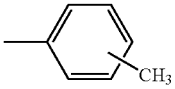 |

-continued

| No. | $Rs_1$ | $Rs_2$ | $Rs_3$ |
|---|---|---|---|
| S-I-11 | 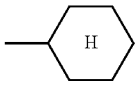 | 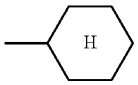 | 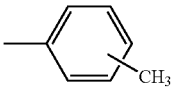 |
| S-I-12 | 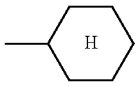 | $—C_8H_{17}$ | $—C_8H_{17}$ |
| S-I-13 | 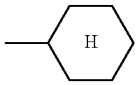 | $—C_6H_{13}$ | $—C_6H_{13}$ |
| S-I-14 | 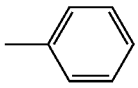 | 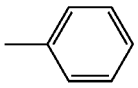 | $—CH_2—CH(C_2H_5)C_4H_9$ |
| S-I-15 | $—C_8H_{17}$ | $—C_8H_{17}$ | $—CH_2CH_2OCH_2CH_3$ |
| S-I-16 | 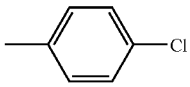 | 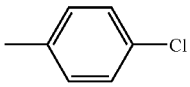 | 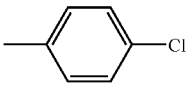 |
| S-I-17 | $—CH_2CH_2C(CH_3)_3$ | $—CH_2CH_2C(CH_3)_3$ | $—CH_2CH_2C(CH_3)_3$ |
| S-I-18 | 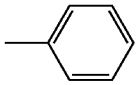 | 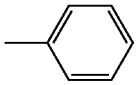 | 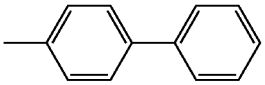 |
| S-I-19 | 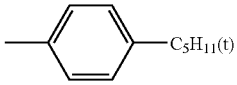 | 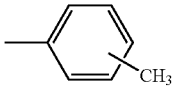 | 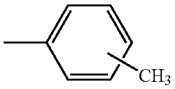 |
| S-I-20 | $—CH(CH_3)C_5H_{11}$ | $—CH(CH_3)C_5H_{11}$ | $—CH(CH_3)C_5H_{11}$ |
| S-I-21 | 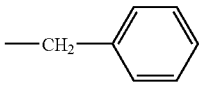 | 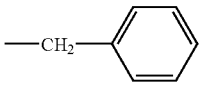 | 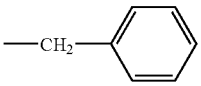 |
| S-I-22 | 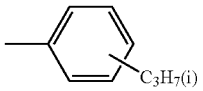 | 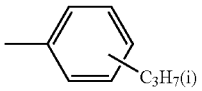 | 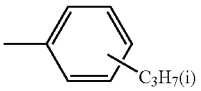 |

The high boiling point organic solvents represented by the formula [S-I] include phosphoric ester-based compounds described, for example, in JP-B-48-32727, JP-A-53-13923, JP-A-54-119235, JP-A-54-119921, JP-A-59-119922, JP-A-55-25057, JP-A-55-36869, JP-A-56-81836, and the like. The high boiling point organic solvents can be synthesized according to the methods described in these official gazettes.

Next, the high boiling point organic solvent, which is represented by the formula [S-II], will be explained in detail.

In the formula [S-II], an alkyl group or a cycloalkyl group represented by $R_{s4}$ and $R_{s5}$ is preferably an alkyl group or a cycloalkyl group having 1 to 20 carbon atoms. Examples thereof include a methyl group, an ethyl group, a butyl group, a dodecyl group, an eicosyl group, an i-propyl group, a t-butyl group, a t-pentyl group, an i-butyl group, a 1,1-dimethylbutyl group, a 1,1,3,3-tetramethylbutyl group, a 2-ethylhexyl group, a cyclopropyl group, a cyclohexyl group, and a 4-methylcyclohexyl group.

Further, an alkoxy group represented by $R_{s4}$ and $R_{s5}$ is preferably an alkoxy group having 1 to 20 carbon atoms. Examples thereof include a methoxy group, an ethoxy group, a butoxy group, a dodecyloxy group, an eicosyloxy group, an i-propoxy group, a t-butoxy group, a t-pentyloxy group, an i-butoxy group, a 1,1-dimethylbutoxy group, a 2-ethylhexyloxy group, a cyclopropyloxy group, and a cyclohexyloxy group.

The above-mentioned alkyl, cycloalkyl, and alkoxy groups may have a substituent(s) (e.g., a chlorine atom, a hydroxyl group, an alkoxycarbonyl group, an acyl group, and an acylamino group).

Among the high boiling point organic solvents represented by the formula [S-II], the compounds represented by the following formula [S-II'] are preferable.

formula [S-II']

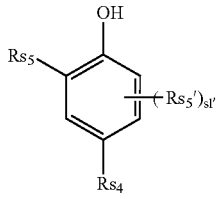

$R_{s4}$ in formula [S-II'] has the same meaning as $R_{s4}$ in formula [S-II]. $R_{s5}$ in formula [S-II'] represents a hydrogen atom or has the same meaning as $R_{s5}$ in formula [S-II]. $R_{s5}'$ in formula [S-II'] has the same meaning as $R_{s5}$ in formula [S-II]. s1' represents an integer of 1 to 3. In the case where $R_{s5}'$ is 2 or more, the plural $R_{s5}$'s may be the same or different, and $R_{s5}'$ and $R_{s5}$ may be the same or different.

In the formula [S-II'], more preferable is the case where $R_{s5}$ is a hydrogen atom, an alkyl group, or a halogen atom (e.g., chlorine atom or bromine atom).

$R_{s4}$, $R_{s5}$, and $R_{s5}'$ are selected based on the nondiffusibility and solubility of the compound, and on the effects to shift the wavelength at maximum (peak) absorption of the color-formed dye. The total of the carbon atoms of the groups represented by $R_{s4}$, $R_{s5}$, and $R_{s5}'$ is preferably 50 or less (preferably 12 to 50) and more preferably 32 or less (preferably 12 to 32).

Hereinafter, specific examples of the high boiling point organic solvent represented by formula [S-II] will be shown, but the present invention should not be considered to be limited thereto.

S-II-1

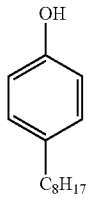

S-II-2

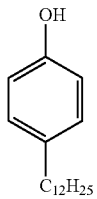

S-II-3

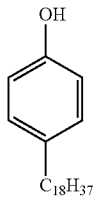

-continued

S-II-4

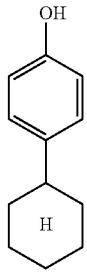

S-II-5

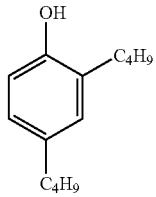

S-II-6

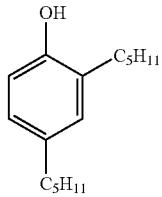

S-II-7

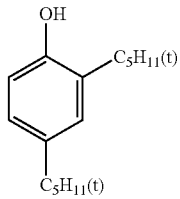

S-II-8

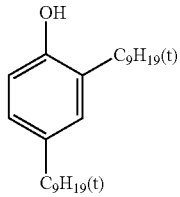

S-II-9

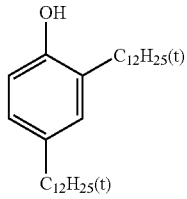

S-II-10

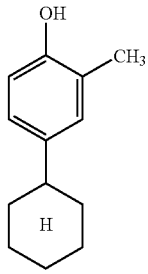

-continued

S-II-11

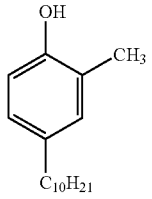

S-II-12

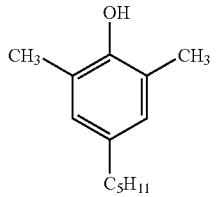

S-II-13

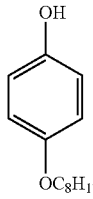

S-II-14

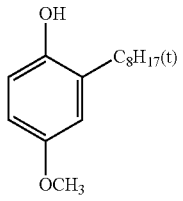

S-II-15

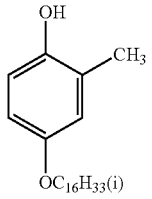

S-II-16

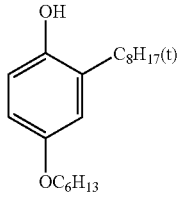

S-II-17

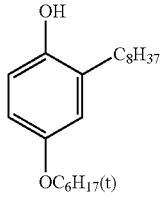

-continued

S-II-18

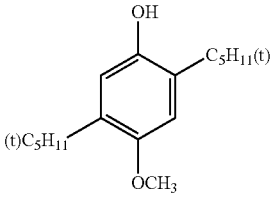

S-II-19

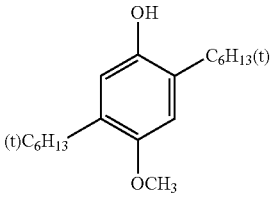

S-II-20

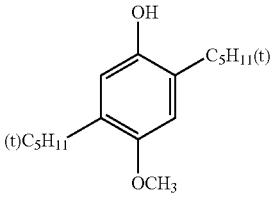

S-II-21

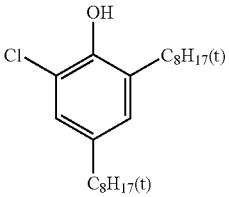

The high boiling point organic solvents represented by the formula [S-II] can be synthesized according to the methods in, for example, U.S. Pat. No. 2,835,579, JP-B-52-27534, and the like.

Next, the high boiling point organic solvent, which is represented by the formula [S-III], will be explained.

In the formula [S-III], $R_{s6}$ represents a linking group having no aromatic group, which linking group is bivalent in the case where sm is 2, trivalent in the case where sm is 3, tetravalent in the case where sm is 4, and pentavalent in the case where sm is 5.

The linking group may be straight-chain, branched, or cyclic. The linking group may also have an unsaturated bond.

Examples of the linking group include an alkylidene group, a cycloalkylidene group, an alkylene group, a cycloalkylene group, an alkenylene group, a cycloalkenylene group, an alkanetriyl group, a cycloalkanetriyl group, an alkenetriyl group, a cycloalkenetriyl group, an alkanetetrayl group, a cycloalkanetetrayl group, an alkenetetrayl group, a cycloalkenetetrayl group, an alkanepentayl group, a cycloalkanepentayl group, an alkenepentayl group, and a cycloalkenepentayl group. Specific examples of these groups include methylene, ethylidene, isopropylidene, cyclohexylidene, ethylene, ethylethylene, propylene, trimethylene, tetramethylene, pentamethylene, hexamethylene, heptamethylene, octamethylene, undecamethylene, 2,2-dimethyltrimethylene, 1,2-cyclohexylene, 1,4-cyclohexylene, 3,4-epoxycyclohexane-1,2-ylene, 3,8-tricyclo[5.2.1.$0^{2,6}$]decylene, vinylene, propenylene, 4-cyclohexene-1,2-ylene, 2-pentenylene, 4-propyl-2-octenylene, 1,2,3-propanetriyl, 1,2,4-butanetriyl, 2-hydroxy-1,2,3-propanetriyl, 2-acetyloxy-1,2,3-propanetriyl, 1,5,8-octanetriyl, 1,2,3-propenetriyl, 2-propene-1,2,4-triyl, 2,6-octadiene-1,4,8-triyl, 1,2,3,4-butanetetrayl, 1,3-propanediyl-2-ylidene, 1,3,5,8-octanetetrayl, 1-butene-1,2,3,4-tetrayl, 3-octene-1,3,5,8-tetrayl, 1,2,3,4,5-pentanepentayl, 1,2,3,5,6-hexanepentayl, 2-pentene-1,2,3,4,5-pentayl, and 3,5-decadiene-1,2,3,9,10-pentayl.

sm represents an integer of 2 to 5, preferably 2 or 3, more preferably 2.

In the case where sm is 2 or more, the plural —$COOR_{s7}$s may be the same or different.

$R_{s7}$ represents an alkyl group (number of carbon atoms is preferably 1 to 20), a cycloalkyl group (number of carbon atoms is preferably 3 to 20), an alkenyl group (number of carbon atoms is preferably 2 to 20), or an alkynyl group (number of carbon atoms is preferably 2 to 20), each having 20 or less carbon atoms. Specific examples of $R_{s7}$ are straight-chain or branched alkyl groups or cycloalkyl groups such as methyl, ethyl, n-butyl, pentyl, neopentyl, hexyl, cyclohexyl, octenyl, 2-ethylhexyl, decyl, dodecyl, hexadecyl, and eicosanyl; alkenyl groups such as 2-butenyl, 2-pentenyl, 2-nonyl-2-butenyl, and 1,2,5-octadienyl; and alkynyl groups such as 2-propynyl, 2-pentene-4-ynyl, and octane-5-ynyl. The groups represented by $R_{s7}$ are alkyl groups, preferably.

$R_{s6}$ and $R_{s7}$ may each have a further substituent. Preferred examples of the substituent include an alkoxy group, an aryloxy group, an epoxy group, a hydroxyl group, an acyloxy group, an aryl group, an alkylthio group, an arylthio group, an acyl group, an acylamino group, a halogen atom and the like, more preferably an alkoxy group (e.g. methoxy, butoxy, butoxyethoxy), an epoxy group, a hydroxyl group, an acyloxy group (e.g. acetyloxy, propionyloxy, cyclohexanoyloxy) and a halogen atom (e.g. fluorine atom).

Hereinafter, specific examples of the high boiling point organic solvent represented by formula [S-III] will be shown, but the present invention should not be considered to be limited thereto.

S-III-1

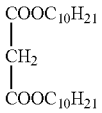

S-III-2

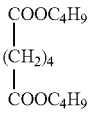

S-III-3

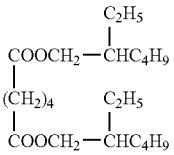

S-III-4

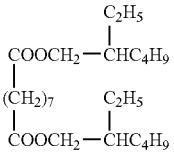

-continued

S-III-5

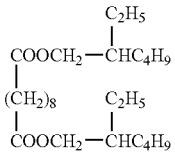

S-III-6

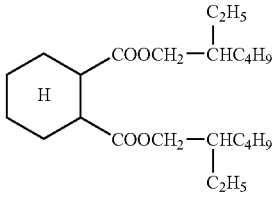

S-III-7

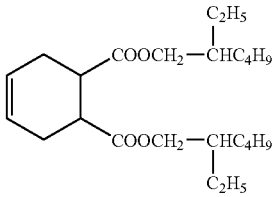

S-III-8

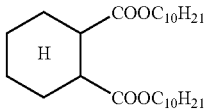

S-III-9

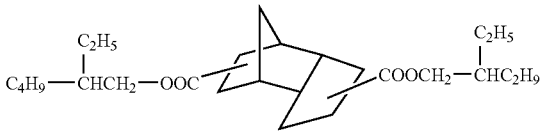

S-III-10

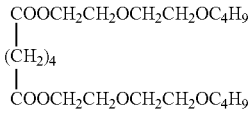

S-III-11

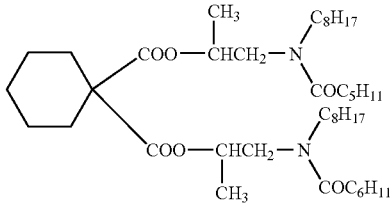

S-III-12

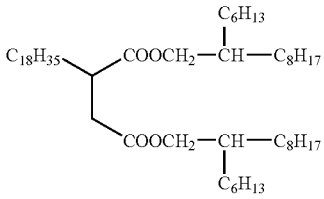

-continued
S-III-13
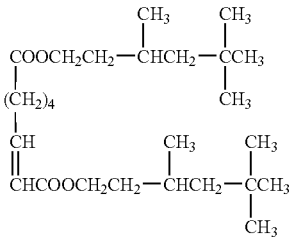
S-III-14
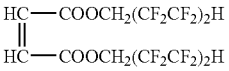
S-III-15
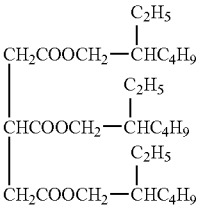
S-III-16
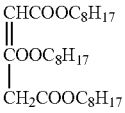
S-III-17
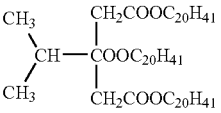
S-III-18
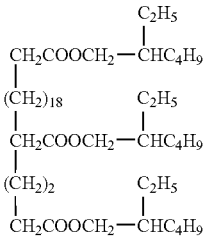
S-III-19
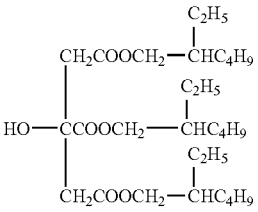
S-III-20
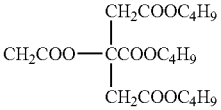
S-III-21
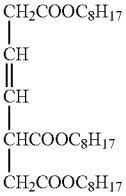
-continued
S-III-22
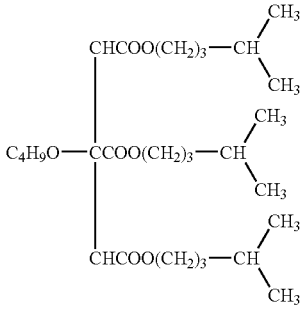
S-III-23
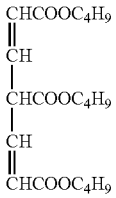
S-III-24
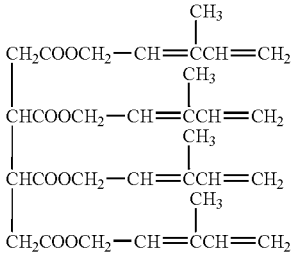
S-III-25
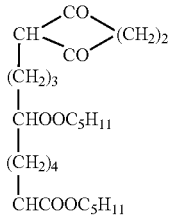
S-III-26
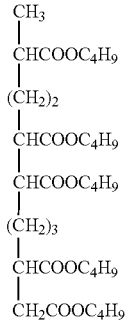
S-III-27
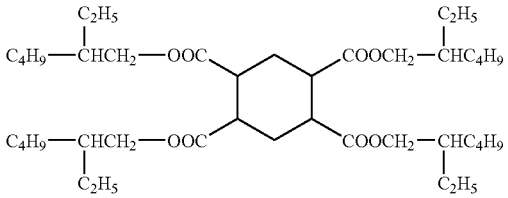
Next, the high boiling point organic solvent, which is represented by the formula (S-IV), will be explained in detail.

In the formula [S-IV], $R_{s8}$ represents a linking group, which linking group is bivalent in the case where sn is 2, trivalent in the case where sn is 3, tetravalent in the case where sn is 4, and pentavalent in the case where sn is 5.

The linking group may be straight-chain, branched, or cyclic. The linking group may also have an unsaturated bond.

The above liking group is preferably one having no aromatic group. Examples of the linking group include an alkylidene group, a cycloalkylidene group, an alkylene group, a cycloalkylene group, an alkenylene group, a cycloalkenylene group, an alkanetriyl group, a cycloalkanetriyl group, an alkenetriyl group, a cycloalkenetriyl group, an alkanetetrayl group, a cycloalkanetetrayl group, an alkenetetrayl group, a cycloalkenetetrayl group, an alkanepentayl group, a cycloalkanepentayl group, an alkenepentayl group, and a cycloalkenepentayl group.

Specific examples of these groups include methylene, ethylidene, isopropylidene, cyclohexylidene, ethylene, ethylethylene, propylene, trimethylene, tetramethylene, pentamethylene, hexamethylene, heptamethylene, octamethylene, undecamethylene, 2,2-dimethyltrimethylene, 1,2-cyclohexylene, 1,4-cyclohexylene, 3,4-epoxycyclohexane-1,2-ylene, 3,8-tricyclo[5.2.1.$0^{2,6}$]decylene, vinylene, propenylene, 4-cyclohexene-1,2-ylene, 2-pentenylene, 4-propyl-2-octenylene, 1,2,3-propanetriyl, 1,2,4-butanetriyl, 2-hydroxy-1,2,3-propanetriyl, 2-acetyloxy-1,2,3-propanetriyl, 1,5,8-octanetriyl, 1,2,3-propenetriyl, 2-propene-1,2,4-triyl, 2,6-octadiene-1,4,8-triyl, 1,2,3,4-butanetetrayl, 1,3-propanediyl-2-ylidene, 1,3,5,8-octanetetrayl, 1-butene-1,2,3,4-tetrayl, 3-octene-1,3,5,8-tetrayl, 1,2,3,4,5-pentanepentayl, 1,2,3,5,6-hexanepentayl, 2-pentene-1,2,3,4,5-pentayl, and 3,5-decadiene-1,2,3,9,10-pentayl.

sn represents an integer of 2 to 5, preferably 2 or 3, more preferably 2. In the case where sn is 2 or more, the plural —$OCOR_{s9}$s may be the same or different.

$R_{s9}$ represents an alkyl group (number of carbon atoms is preferably 1 to 20), a cycloalkyl group (number of carbon atoms is preferably 3 to 20), an alkenyl group (number of carbon atoms is preferably 2 to 20), or an alkynyl group (number of carbon atoms is preferably 2 to 20), each having 20 or less carbon atoms. Specific examples of $R_{s9}$ are straight-chain or branched alkyl groups or cycloalkyl groups such as methyl, ethyl, n-butyl, pentyl, neopentyl, hexyl, cyclohexyl, octenyl, 2-ethylhexyl, decyl, dodecyl, hexadecyl, and elcosanyl; alkenyl groups such as 2-butenyl, 2-pentenyl, 2-nonyl-2-butenyl, and 1,2,5-octadienyl; and alkynyl groups such as 2-propynyl, 2-pentene-4-ynyl, and octane-5-ynyl. The groups represented by $R_{s9}$ are alkyl groups, preferably.

$R_{s8}$ and $R_{s9}$ may each have a further substituent. Preferred examples of the substituent include an alkoxy group, an aryloxy group, an epoxy group, a hydroxyl group, an acyloxy group, an aryl group, an alkylthio group, an arylthio group, an acyl group, an acylamino group, a ketone group, a halogen atom and the like, more preferably an alkoxy group (e.g. methoxy, butoxy, butoxyethoxy), an epoxy group, a hydroxyl group, an acyloxy group (e.g. acetyloxy, propionyloxy, cyclohexanoyloxy) and a halogen atom (e.g. fluorine atom).

Hereinafter, specific examples of the high boiling point organic solvent represented by formula [S-IV] will be shown, but the present invention should not be considered to be limited thereto.

S-IV-1

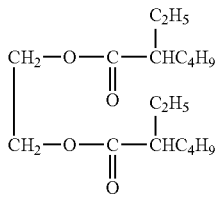

S-IV-2

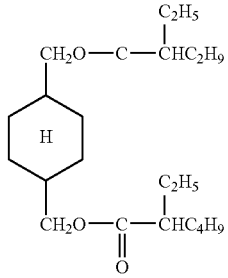

S-IV-3

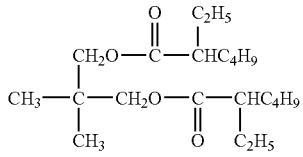

S-IV-4

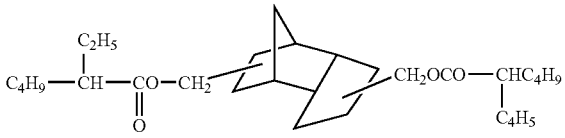

S-IV-5

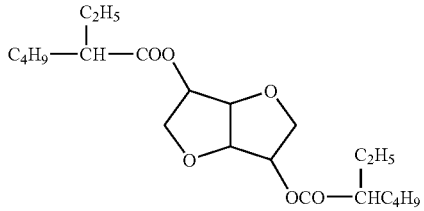

S-IV-6

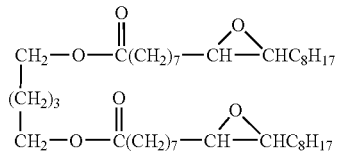

S-IV-7

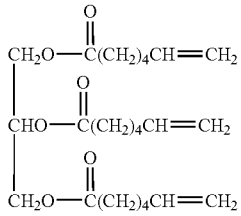

-continued

S-IV-8

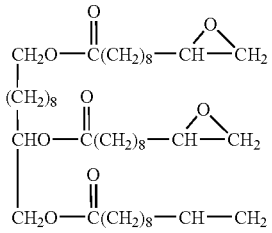

S-IV-9

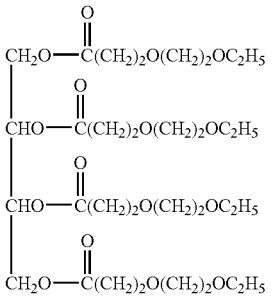

S-IV-10

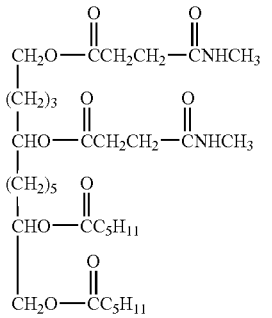

S-IV-11

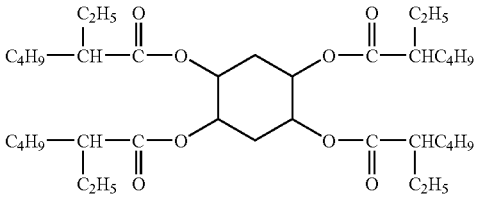

S-IV-12

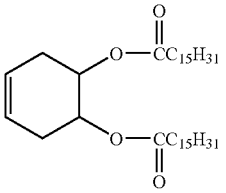

S-IV-13

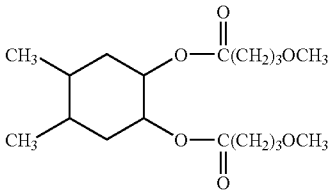

-continued

S-IV-14

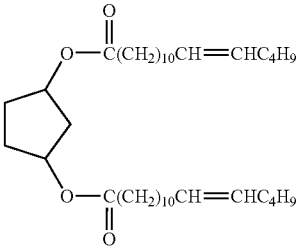

S-IV-15

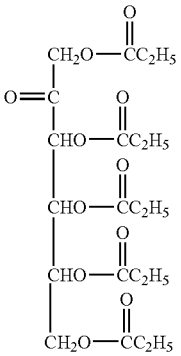

S-IV-16

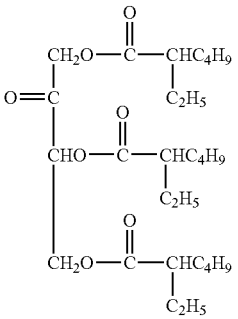

S-IV-17

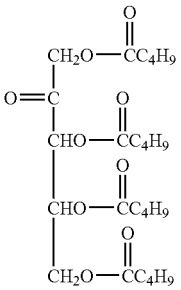

Next, the high boiling point organic solvent, which is represented by the formula [S-V], will be explained.

In the formula [S-V], $R_{s10}$, $R_{s11}$, $R_{s12}$, and $R_{s13}$ each independently represent a hydrogen atom, an aliphatic group, an aliphatic oxycarbonyl group (e.g., dodecyloxycarbonyl, allyloxycarbonyl), an aromatic oxycarbonyl group (e.g., phenoxycarbonyl), or an carbamoyl group (e.g., tetradecylcarbamoyl, phenyl-methylcarbamoyl), wherein all of $R_{s10}$, $R_{s11}$, $R_{s12}$, and $R_{s13}$ simultaneously do not represent a hydrogen atom, and the total of the carbon atoms of these groups is 8 to 60. These groups may each have a substituent(s).

In formula [S-V], $R_{s10}$ and $R_{s11}$, $R_{s12}$ and $R_{s13}$, or $R_{s10}$ and $R_{s12}$, may bond each other, to form a 5- to 7-membered ring, respectively.

In the formula [S-V], it is preferable that at least one of $R_{s10}$, $R_{s11}$, $R_{s12}$, and $R_{s13}$ is a hydrogen atom and it is more preferable that two of $R_{s10}$, $R_{s11}$, $R_{s12}$, and $R_{s13}$ are each a hydrogen atom.

In the formula [S-V], it is preferable that at least one of $R_{s10}$, $R_{s11}$, $R_{s12}$ and $R_{s13}$ is an alkyl group substituted with an aryl- or alkyl-ether group, an ester group, or an amido group.

The high boiling point organic solvent, which is used in the present invention, preferably in the third embodiment, and which is represented by the formula [S-V], can be synthesized according to the methods in, for example, U.S. Pat. Nos. 4,239,851, 4,540,654.

Hereinafter, specific examples of the high boiling point organic solvent represented by formula [S-V] will be shown, but the present invention should not be considered to be limited thereto.

S-V-1

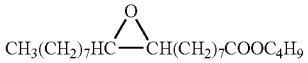

S-V-2\

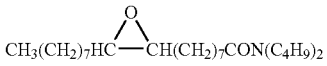

S-V-3

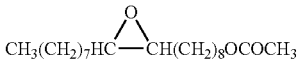

S-V-4

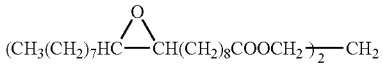

S-V-5

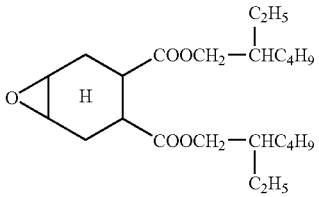

S-V-6

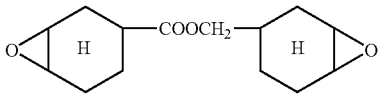

S-V-7

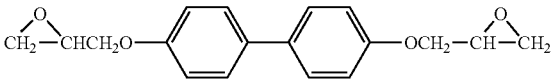

S-V-8

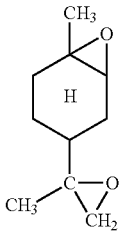

S-V-9

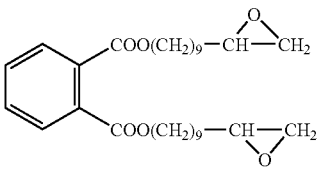

-continued

S-V-10

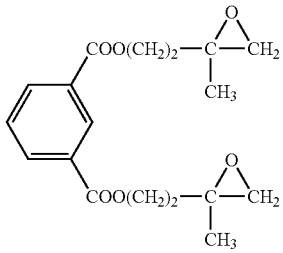

S-V-11

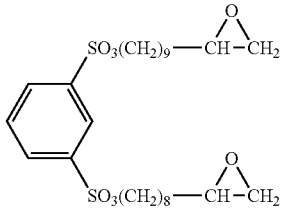

S-V-12

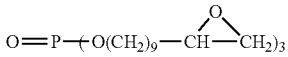

S-V-13

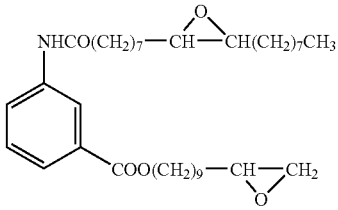

S-V-14

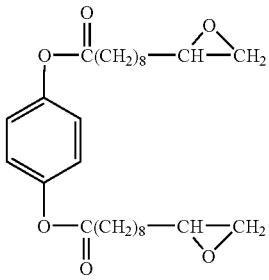

S-V-15

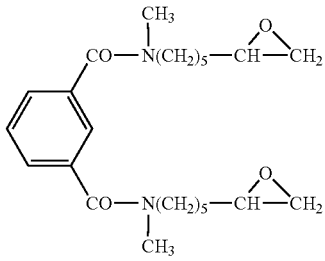

S-V-16

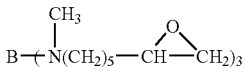

-continued

S-V-17

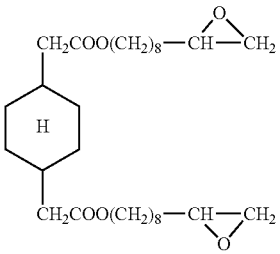

S-V-18

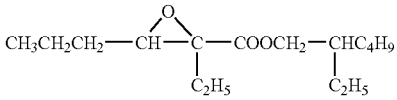

S-V-19

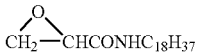

S-V-20

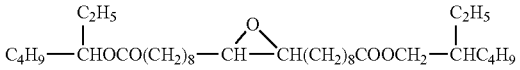

Next, the high boiling point organic solvent, which is represented by the formula [S-VI], will be explained.

In the formula [S-VI], $R_{s14}$ represents an aromatic linking group which may have a substituent. sp represents an integer of 3 or more but 5 or less and is preferably 3 or 4. Besides, $R_{s14}$ is a trivalent group in the case where sp is 3, a tetravalent group in the case where sp is 4, and a pentavalent group in the case where sp is 5. In the case where sp is 2 to 5, the plural —$COOR_{s15}$ groups may be the same or different. $R_{s14}$ is preferably a benzene ring group having a valency of sp.

$R_{s15}$ represents an alkyl group (the number of carbon atoms is preferably 1 to 20), a cycloalkyl group (the number of carbon atoms is preferably 3 to 20), an alkenyl group (the number of carbon atoms is preferably 2 to 20), or an alkynyl group (the number of carbon atoms is preferably 2 to 20), each having 20 or less carbon atoms. Specific examples of $R_{s15}$ are straight-chain or branched alkyl groups or cycloalkyl groups such as methyl, ethyl, n-butyl, pentyl, neopentyl, hexyl, cyclohexyl, octenyl, 2-ethylhexyl, decyl, dodecyl, hexadecyl, and eicosanyl; alkenyl groups such as 2-butenyl, 2-pentenyl, 2-nonyl-2-butenyl, and 1,2,5-octadienyl; and alkynyl groups such as 2-propynyl, 2-pentene-4-ynyl, and octane-5-ynyl. The group represented by $R_{s15}$ is an alkyl group, preferably.

$R_{s15}$ may further have a substituent. Preferred examples of the substituent include an alkoxy group, an aryloxy group, an epoxy group, a hydroxyl group, an acyloxy group, an aryl group, an alkylthio group, an arylthio group, an acyl group, an acylamino group, a halogen atom and the like, more preferably an alkoxy group (e.g. methoxy, butoxy, butoxyethoxy), an epoxy group, a hydroxyl group, an acyloxy group (e.g. acetyloxy, propionyloxy, cyclohexanoyloxy) and a halogen atom (e.g. fluorine atom).

Hereinafter, specific examples of the high boiling point organic solvent represented by formula [S-VI] will be shown, but the present invention should not be considered to be limited thereto.

S-VI-1

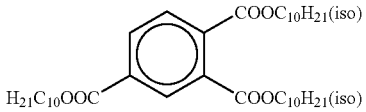

S-VI-2

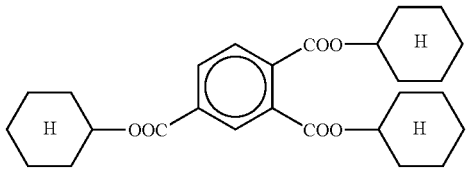

S-VI-3

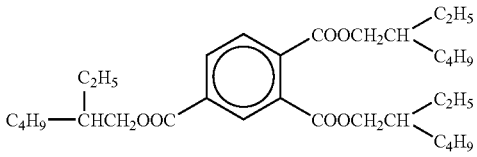

S-VI-4

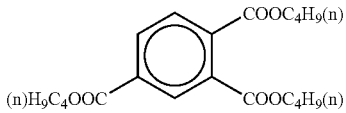

S-VI-5

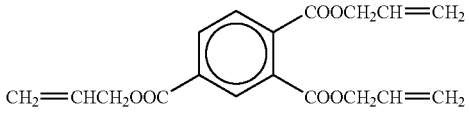

S-VI-6

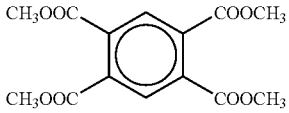

S-VI-7

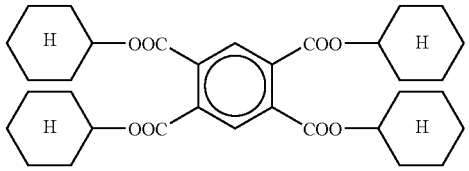

The compound represented by the formula [S-VI] can be easily synthesized, according to, for example, a reaction between an acid halide of a corresponding carboxylic acid and a corresponding alcohol, or a transesterification reaction between the ester of a corresponding carboxylic acid and a corresponding alcohol.

The high boiling point organic solvent in the present invention, preferably in the third embodiment means an organic solvent whose boiling point at 1 atm. is 160° C. or higher.

In the present invention, preferably in the third embodiment, the amount to be used of the high boiling point organic solvent represented by any one of the formula [S-I] to [S-VI] cannot be specified specifically, because the amount varies depending on the kind and amount to be used of the coupler in the present invention. However, the high boiling point organic solvent (mass)/coupler (mass) ratio is preferably 0.05 to 20, more preferably 0.1 to 10, and most preferably 0.1 to 3.

In the present invention, preferably in the third embodiment, although many methods can be used as the method of incorporating the coupler for use in the present invention and the high boiling point organic solvent that can be used in the present invention, preferably in the third embodiment into a silver halide emulsion layer, the method preferably comprises: dissolving, and dispersing the coupler in the present invention with the high boiling point organic solvent in the present invention, preferably in the third embodiment.

The high boiling point organic solvent according to the present invention, preferably to the third embodiment may be used singly or in a combination of two or more thereof. The high boiling point organic solvent according to the present invention, preferably to the third embodiment may be used together with another high boiling point organic solvent. Further, in order to accelerate the above-mentioned dissolution, a low boiling point organic solvent, and an organic solvent miscible with water can be additionally used.

Examples of the low boiling point organic solvent include ethyl acetate, butyl acetate, cyclohexanone, isobutyl alcohol, methyl ethyl ketone, methyl cellosolve, and the like.

Examples of the organic solvent miscible with water include methanol, ethanol, acetone, phenoxyethanol, tetrahydrofuran, dimethylformamide, and the like.

These low boiling point organic solvent and organic solvent miscible with water can be removed by such method as washing with water or drying after applying.

The organic solvents described above may be used in combination of two or more thereof.

Next, the compound represented by the formula [ST-I] will be explained.

Examples of the aliphatic groups represented by $R_{40}$, $R_{50}$, and $R_{60}$ include an alkyl group having 1 to 32 carbon atoms, an alkenyl group having 2 to 32 carbon atoms, an alkynyl group having 2 to 32 carbon atoms, a cycloalkyl group having 3 to 32 carbon atoms, and a cycloalkenyl group having 3 to 32 carbon atoms. The alkyl group, alkenyl group, and alkynyl group may be straight-chain or branched ones. These aliphatic groups include those having a substituent(s).

Examples of the aromatic group represented by $R_{40}$, $R_{50}$, and $R_{60}$ include aryl groups (e.g., phenyl and the like), aromatic heterocyclic groups (e.g., pyridyl, furyl, and the like), and the like. These aromatic groups include those having a substituent(s).

Preferably $R_{40}$, $R_{50}$, and $R_{60}$ are each an alkyl group or an aryl group, wherein $R_{40}$, $R_{50}$, and $R_{60}$ may be the same or different. The total number of the carbon atoms of the groups represented by $R_{40}$, $R_{50}$, and $R_{60}$ is preferably 6 to 50.

Although the substituent on the aliphatic group or aromatic group represented by $R_{40}$, $R_{50}$, and $R_{60}$ is not particularly limited, preferred examples of the substituent include an alkoxy group, an aryloxy group, an acyl group, an acyloxy group, an alkoxycarbonyl group, an aryloxycarbonyl group, a carbamoyl group, a sulfamoyl group, an acylamino group, an amino group, and the like.

l4, m4, and n4 each independently represent 0 or 1, but all of l4, m4, and n4 simultaneously do not represent 1. That is, at least one of the aliphatic groups or aromatic groups represented by $R_{40}$, $R_{50}$, and $R_{60}$ is linked directly to the phosphorus atom. It is preferable that all of l4, m4, and n4 are 0.

Hereinafter, representative examples of the compound represented by formula [ST-I] will be shown, but the present invention should not be considered to be limited thereto.

ST-I-1

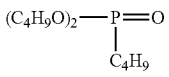

-continued

ST-I-2

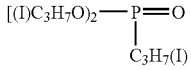

ST-I-3

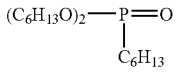

ST-I-4

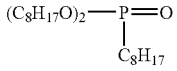

ST-I-5

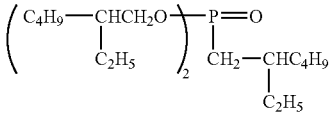

ST-I-6

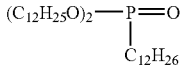

ST-I-7

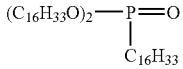

ST-I-8

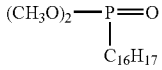

ST-I-9

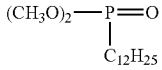

ST-I-10

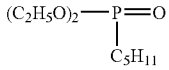

ST-I-11

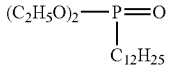

ST-I-12

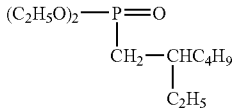

ST-I-13

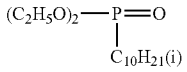

ST-I-14

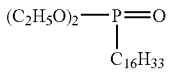

ST-I-15

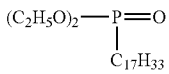

ST-I-16

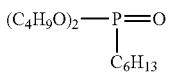

ST-I-17

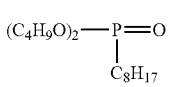

ST-I-18

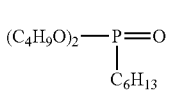

ST-I-19

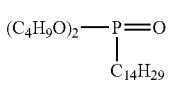

-continued
ST-I-20
$(C_6H_{13}O)_2-P(=O)-C_3H_7(i)$
ST-I-21
$(C_6H_{13}O)_2-P(=O)-CH_2-CH(C_2H_5)C_4H_9$
ST-I-22
$(C_4H_9-CH(C_2H_5)CH_2O)_2-P(=O)-C_4H_9$
ST-I-23
$((CH_3)_3CCH_2-CH(CH_3)CH_2OCH_2)_2-P(=O)-C_4H_9$
ST-I-24
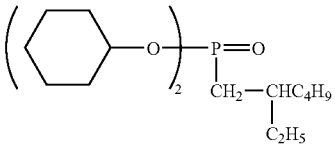
ST-I-25
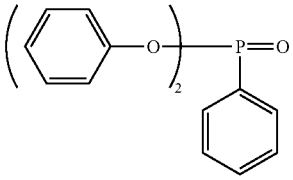
ST-I-26
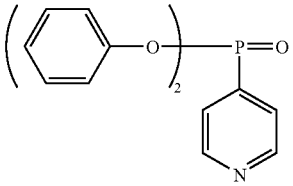
ST-I-27
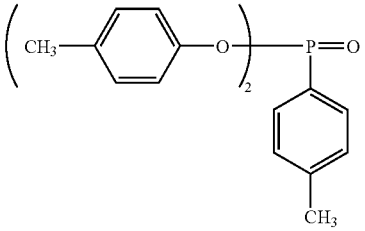
ST-I-28
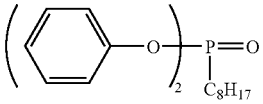
ST-I-29
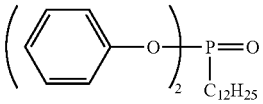
ST-I-30
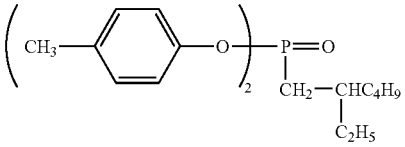
-continued
ST-I-31
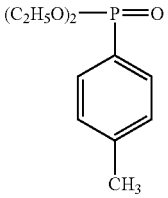
ST-I-32
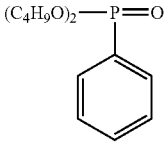
ST-I-33
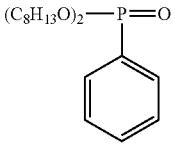
ST-I-34
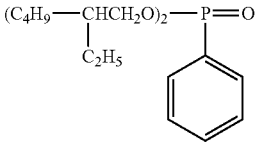
ST-I-35
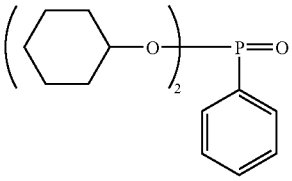
ST-I-36
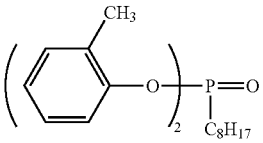
ST-I-37
$(C_2H_5O)_2-P(=O)-CH_2CH_2CH_2OC_{12}H_{25}$
ST-I-38
$(C_4H_9O)_2-P(=O)-CH_2CH_2COCH_2CH_2CH_3$
ST-I-39
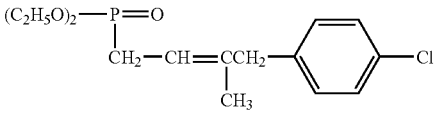
ST-I-40
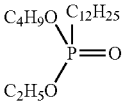
ST-I-41
$(C_4H_9O)_2-P(=O)-(CH_2)_{10}COOC_2H_5$
ST-I-42
$(C_2H_5O)_2-P(=O)-CH_2CH_2COOC_{14}H_{29}$ -continued

ST-I-43

$(C_6H_{13}O)_2-P(=O)-CH_2CH_2OCOC_8H_{17}$

ST-I-44

$(C_4H_9O)_2-P(=O)-(CH_2)_{10}COOCH_2-CH(C_2H_5)C_4H_9$

ST-I-45

$(C_4H_9O)_2-P(=O)-CH(CH_2)_{11}CH_3-COOCH_2-CH(C_2H_5)C_4H_9$

ST-I-46

$(C_2H_5O)_2-P(=O)-(CH_2)_{10}CO-N(C_2H_5)_2$

ST-I-47

$(C_4H_9O)_2-P(=O)-CH_2CH_2CON(CH_2-CH(C_2H_5)C_4H_9)_2$

ST-I-48

$(CH_3-C_6H_4-O)_2-P(=O)-CH_2CH_2CH_2COOC_{10}H_{21}$

ST-I-49

$(C_4H_9-CH(C_2H_5)CH_2O)_2-P(=O)-(CH_2)_{10}CO-N(C_2H_5)_2$

ST-I-50

$((i)C_4H_9O)_2-P(=O)-(CH_2)_8COO-C_6H_5$

ST-I-51

$((i)C_4H_9O)_2-P(=O)-CH_2CH_2SO_2-N(C_4H_9)_2$

ST-I-52

$(C_6H_5-O)_2-P(=O)-(CH_2)_{10}COO-C_6H_4-NHCOCH_3$

ST-I-53

$(C_6H_{13}O)_2-P(=O)-CH(C_6H_{13})COOC_4H_9$

ST-I-54

$(C_4H_9O)_2-P(=O)-CH(CH_2COOCH_2-CH(C_2H_5)C_4H_9)-CH_2COOCH_2-CH(C_2H_5)C_4H_9$

-continued

ST-I-55

$(C_8H_{17})_2-P(=O)-OC_8H_{17}$

ST-I-56

$(C_4H_9)_2-P(=O)-OC_4H_9$

ST-I-57

$(C_4H_9-CH(C_2H_5)CH_2)_2-P(=O)-OCH_2-CH(C_2H_5)C_4H_9$

ST-I-58

$(C_4H_9)_2-P(=O)-OC_{12}H_{25}$

ST-I-59

$(C_6H_5)_2-P(=O)-OC_{10}H_{21}(i)$

ST-I-60

$(C_8H_{18})_2-P(=O)-O-C_6H_4-CH_3$

ST-I-61

$(C_2H_5OCO(CH_2)_{10})_2-P(=O)-OC_4H_9$

ST-I-62

$(C_4H_9)_2-NCO(CH_2)_8)_2-P(=O)-OC_{12}H_{25}$

ST-I-63

$(C_{12}H_{25})_2-P(=O)-O-C_6H_5$

ST-I-64

$(C_2H_5)_3-P(=O)$

ST-I-65

$(C_4H_9)_3-P(=O)$

ST-I-66

$((i)C_4H_9)_3-P(=O)$

ST-I-67

$(C_5H_{11})_3-P(=O)$

ST-I-68

$(C_6H_{13})_3-P(=O)$

ST-I-69

$(C_8H_{17})_3-P(=O)$

ST-I-70

$(C_4H_9-CH(C_2H_5)CH_2)_3-P(=O)$

ST-I-71

$((CH_3)_3CCH_2-CH(CH_3)CH_2CH_2)_2-P(=O)$

ST-I-72

$(C_{10}H_{21})_3-P(=O)$

ST-I-73

$((i)C_{10}H_{21})_3-P(=O)$

ST-I-74

$(C_{12}H_{25})_2-P(=O)$

ST-I-75

$(C_{14}H_{29})_3-P(=O)$

ST-I-76

$(C_{17}H_{33})_3-P(=O)$

-continued

ST-I-77

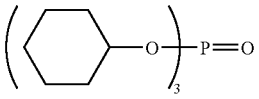

ST-I-78

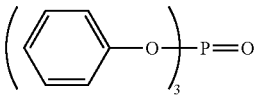

ST-I-79

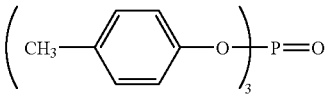

ST-I-80

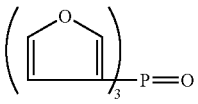

ST-I-81

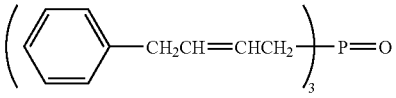

ST-I-82

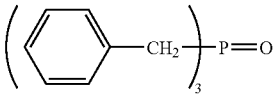

ST-I-83

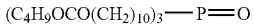

ST-I-84

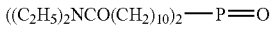

ST-I-85

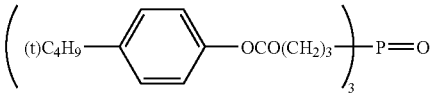

ST-I-86

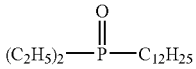

ST-I-87

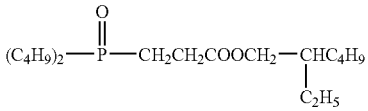

ST-I-88

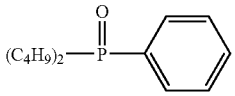

ST-I-89

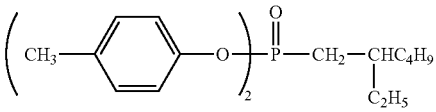

ST-I-90

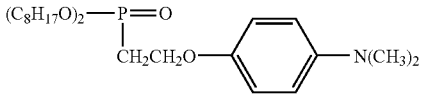

ST-I-91

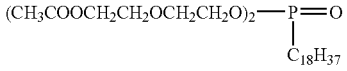

-continued

ST-I-92

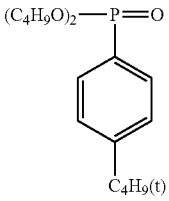

ST-I-93

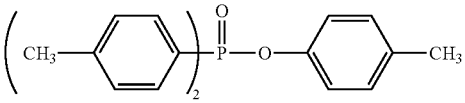

ST-I-94

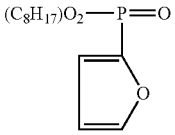

ST-I-95

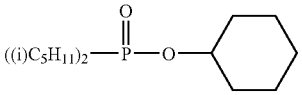

The compounds represented by the formula [ST-I] include the compounds described on pages 4 to 5 of JP-A-56-19049.

Some of the compounds represented by the formula [ST-I] are commercially available. Otherwise, these compounds can be synthesized according to the methods described in, for example, JP-A-56-19049; U.K. Patent No. 694,772; J. Am. Chem. Soc., 79, 6524 (1957); J. Org. Chem., 25, 1000 (1960); Org. Synth., 31, 33 (1951), and others.

Next, the compound represented by the formula [ST-II] will be explained.

In the formula [ST-II], example of the groups represented by $R_A$ and $R_B$ include an alkyl group having 1 to 32 carbon atoms, an alkenyl or alkynyl group having 2 to 32 carbon atoms, and a cycloalkyl or cycloalkenyl group having 3 to 12 carbon atoms. The alkyl group, alkenyl group, and alkynyl group may be straight-chain or branched ones. These aliphatic groups include those having a substituent(s).

The aryl groups represented by $R_A$ and $R_B$ are preferably phenyl groups, which include those having a substituent(s).

The heterocyclic groups represented by $R_A$ and $R_B$ are preferably 5- to 7-membered ones, which may be condensed with another ring, and include those having a substituent(s).

The alkoxy groups represented by $R_A$ and $R_B$ include those having a substituent(s). Examples of the alkoxy group include 2-ethoxyethoxy, pentadecyloxy, 2-dodecyloxyethoxy, phenethyloxyethoxy, and the like.

The aryloxy group is preferably a phenyloxy group, wherein the aryl nuclei may have a substituent(s). Examples of the aryloxy group include phenoxy, p-t-butylphenoxy, m-pentadecylphenoxy, and the like.

Further, the heterocycloxy group is preferably those having a 5- to 7-membered heterocycle which may have a substituent(s). Examples of the heterocycloxy group include 3,4,5,6-tetrahydropyranyl-2-oxy, 1-phenyltetrazole-5-oxy, and the like.

Among the compounds represented by the formula [ST-II], particularly preferred compounds are those represented by the following formula [ST-II'].

$$RE\text{-}NHSO_2\text{—}RF \qquad \text{Formula [ST-II']}$$

In the formula [ST-II'], RE and RF each independently represent an alkyl group or an aryl group each of which may have a substituent(s). It is preferable that at least one of RE and RF is an aryl group, and it is more preferable that RE and RF each are an aryl group, a phenyl group in particular. In the case where RE is a phenyl group, it is particularly preferable that the Hammett OP constant of the substituent in a para-position with respect to a sulfonamide group is −0.4 or more.

The alkyl group and the aryl group represented by RE and RF have the same meanings as the alkyl group and the aryl group represented by $R_A$ and $R_B$ in the formula [ST-II], respectively.

Further, the compounds represented by the formula [ST-II] may form a polymer greater than a dimer at $R_A$ or $R_B$. Further, $R_A$ and $R_B$ may bond together to form a 5- or 6-membered ring.

Still further, the total of the carbon atoms of the compound represented by the formula [ST-II] is preferably 8 or more, and more preferably 12 or more. The total of the carbon atoms is preferably 60 or less in any case.

Hereinafter, representative examples of the compound represented by formula [ST-II] will be shown, but the present invention should not be considered to be limited thereto.

$R_A$—$NHSO_2$—$R_B$

| Compound No. | $R_A$ | $R_B$ |
|---|---|---|
| ST-II-1 | 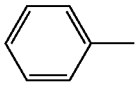 | 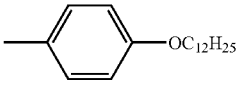 |
| ST-II-2 | 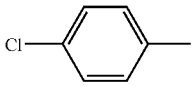 | 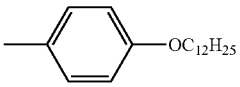 |
| ST-II-3 | 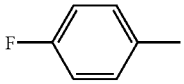 | 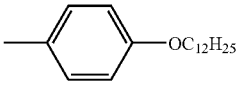 |
| ST-II-4 | 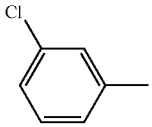 | 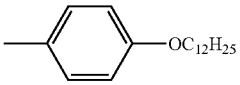 |
| ST-II-5 | 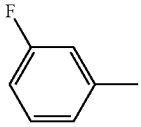 | 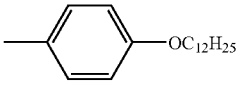 |
| ST-II-6 | 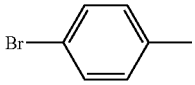 | 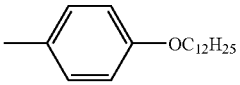 |
| ST-II-7 | 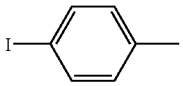 | 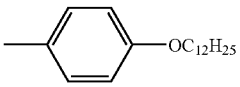 |
| ST-II-8 | 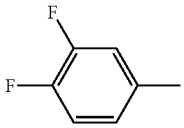 | 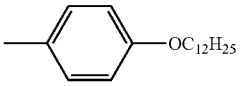 |
| ST-II-9 | 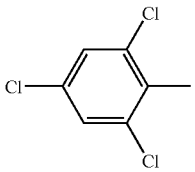 | 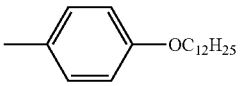 |
| ST-II-10 | 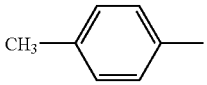 | 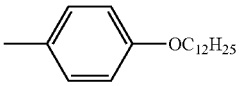 |

-continued
| Compound No. | $R_A$—$NHSO_2$—$R_B$ | |
|---|---|---|
| | $R_A$ | $R_B$ |
| ST-II-11 | 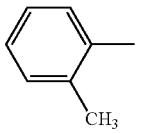 | 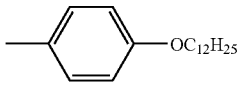 |
| ST-II-12 | 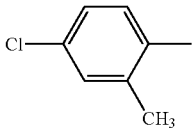 | 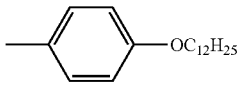 |
| ST-II-13 | 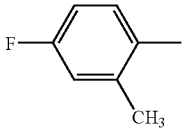 | 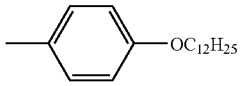 |
| ST-II-14 | 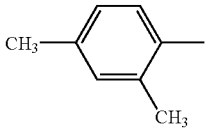 | 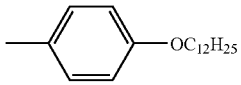 |
| ST-II-15 | 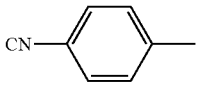 | 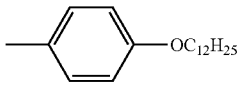 |
| ST-II-16 | 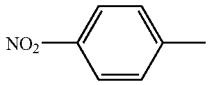 | 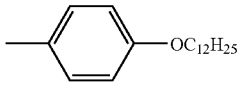 |
| ST-II-17 | 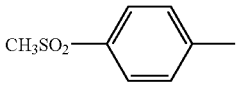 | 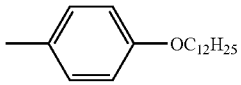 |
| ST-II-18 | 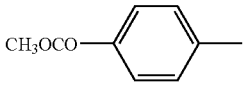 | 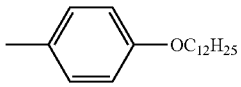 |
| ST-II-19 | 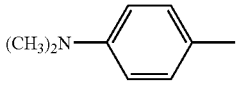 | 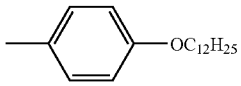 |
| ST-II-20 | 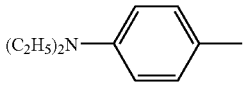 | 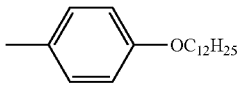 |
| ST-II-21 | 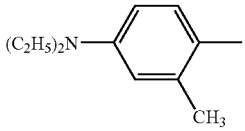 | 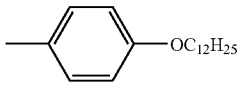 |
| ST-II-22 | 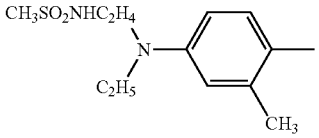 | 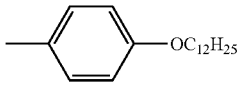 |

-continued
| Compound No. | $R_A$—$NHSO_2$—$R_B$ | |
|---|---|---|
| | $R_A$ | $R_B$ |
| ST-II-23 | 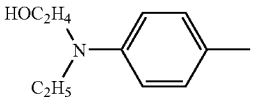 | 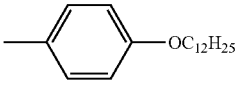 |
| ST-II-24 | 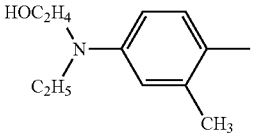 | 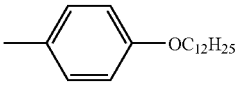 |
| ST-II-25 | 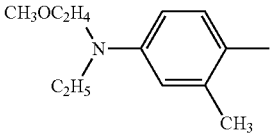 | 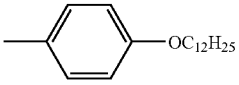 |
| ST-II-26 | 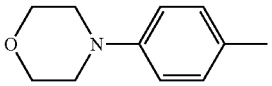 | 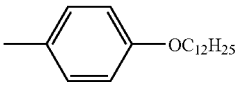 |
| ST-II-27 | 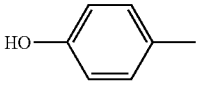 | 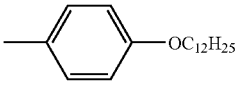 |
| ST-II-28 | 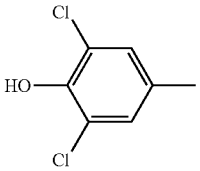 | 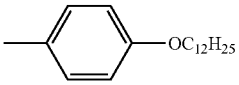 |
| ST-II-29 | 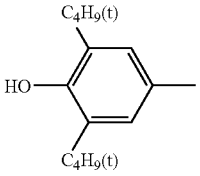 | 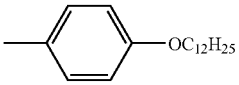 |
| ST-II-30 | 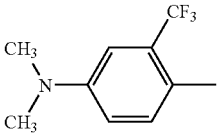 | 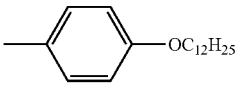 |
| ST-II-31 | 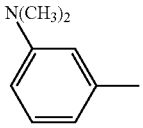 | 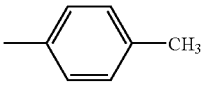 |
| ST-II-32 | 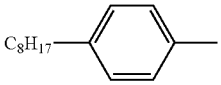 | 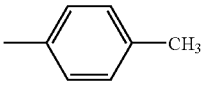 |
| ST-II-33 | 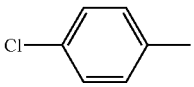 | 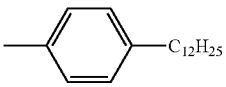 |

-continued
| Compound No. | $R_A$—NHSO$_2$—$R_B$ $R_A$ | $R_B$ |
|---|---|---|
| ST-II-34 | 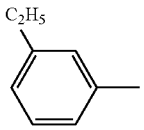 | 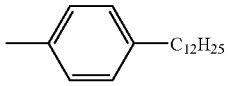 |
| ST-II-35 | 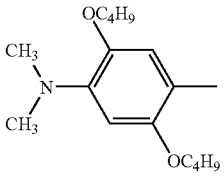 | 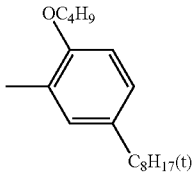 |
| ST-II-36 | 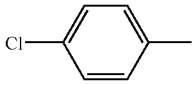 | 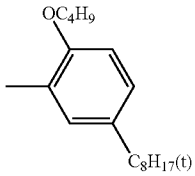 |
| ST-II-37 | 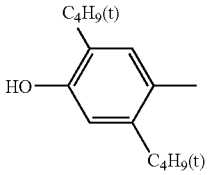 | 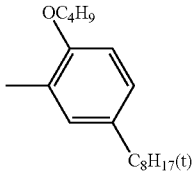 |
| ST-II-38 | 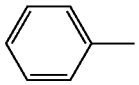 | 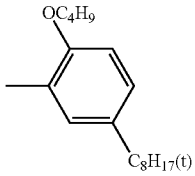 |
| ST-II-39 | 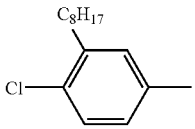 | 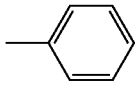 |
| ST-II-40 | 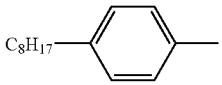 | 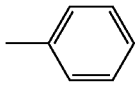 |
| ST-II-41 | 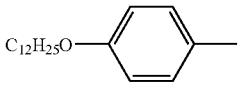 | 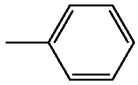 |
| ST-II-42 | 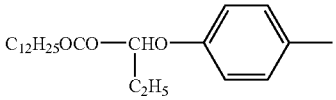 | 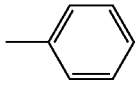 |
| ST-II-43 | 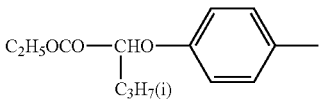 | 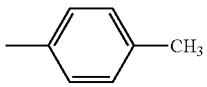 |

-continued

| Compound No. | $R_A$—NHSO$_2$—$R_B$ | |
|---|---|---|
| | $R_A$ | $R_B$ |
| ST-II-44 | $CF_3$ | $OC_{12}H_{25}$ |
| ST-II-45 | $C_5H_{11}$ | $C_5H_{11}$ |
| ST-II-46 | | $OC_{12}H_{25}$ |
| ST-II-47 | $CH_3CO$ | $OC_{12}H_{25}$ |
| ST-II-48 | $CH_3O$ | $OC_{12}H_{25}$ |
| ST-II-49 | | —$C_{16}H_{33}$ |
| ST-II-50 | Cl | —$C_{16}H_{33}$ |
| ST-II-51 | F | —$C_{16}H_{33}$ |
| ST-II-52 | $CH_3$ | —$C_{16}H_{33}$ |
| ST-II-53 | $CH_3$ | —$C_{16}H_{33}$ |
| ST-II-54 | $CH_3OCO$ | —$C_{16}H_{33}$ |
| ST-II-55 | $CH_3SO_2$ | —$C_8H_{17}$ |
| ST-II-56 | | —$CH_2$—CH(OH)— |
| ST-II-57 | $C_8H_{17}$ | —$C_3H_7$(i) |

-continued
| Compound No. | $R_A$—NHSO$_2$—$R_B$ | |
|---|---|---|
| | $R_A$ | $R_B$ |
| ST-II-58 | $C_8H_{17}$— | 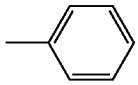 |
| ST-II-59 | 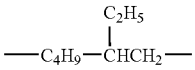 | 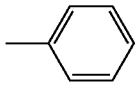 |
| ST-II-60 | $CH_3$— | 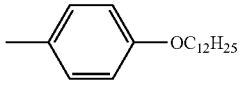 |
| ST-II-61 | $Cl(CH_2)_2$— | 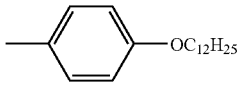 |
| ST-II-62 | $CF_3CF_2$— | 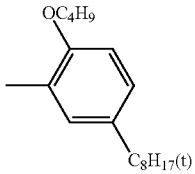 |
| ST-II-63 | 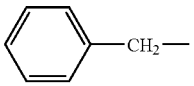 | 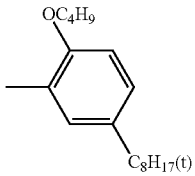 |
| ST-II-64 | $C_8H_{17}$— | 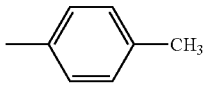 |
| ST-II-65 | $C_{12}H_{25}$— | 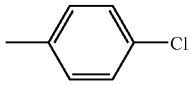 |
| ST-II-66 | 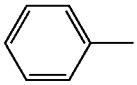 | 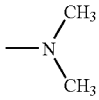 |
| ST-II-67 | 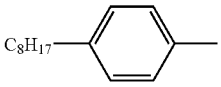 | 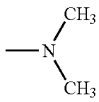 |
| ST-II-68 | 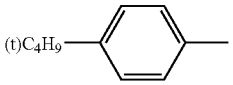 | 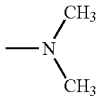 |
| ST-II-69 | 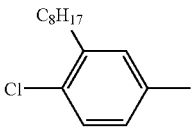 | 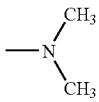 |

-continued

| Compound No. | $R_A$—NHSO$_2$—$R_B$ | |
|---|---|---|
| | $R_A$ | $R_B$ |
| ST-II-70 | $C_{12}H_{25}CO$— | —N($CH_3$)$_2$ |
| ST-II-71 | $C_8H_{17}OCO$—CH($C_4H_9$)O— | —N($CH_3$)$_2$ |
| ST-II-72 | $CH_3OCO$—CH($C_{12}H_{25}$)O— | —N($CH_3$)$_2$ |
| ST-II-73 | $C_{12}H_{25}OCO$—CH($C_2H_5$)O— | —N($CH_3$)$_2$ |
| ST-II-74 | $C_8H_{17}OCO$— | —N($CH_3$)$_2$ |
| ST-II-75 | $C_{12}H_{25}O$— | —N($C_2H_5$)$_2$ |
| ST-II-76 | $C_8H_{17}$— | —N($C_2H_5$)$_2$ |
| ST-II-77 | CN—C$_6$H$_3$($C_8H_{17}$(t))— | —N($C_2H_5$)$_2$ |
| ST-II-78 | $C_{12}H_{25}OCO$— | —N($C_2H_5$)$_2$ |
| ST-II-79 | $CH_3OCO$—CH($C_{12}H_{25}$)O— | —N($C_2H_5$)$_2$ |
| ST-II-80 | $CH_3OCO$—CH($C_3H_7$(t))O— | —N($C_2H_5$)$_2$ |
| ST-II-81 | $C_{12}H_{25}OCOCH_2$— | —N($C_2H_5$)$_2$ |
| ST-II-82 | $C_{12}H_{25}OCO$—CH($C_2H_5$)OCO— | —N($C_2H_5$)$_2$ |

-continued
| Compound No. | $R_A$—NHSO$_2$—$R_B$ | |
|---|---|---|
| | $R_A$ | $R_B$ |
| ST-II-83 | $C_{12}H_{25}OCO(CH_2)_3O$— 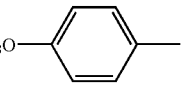 | —N($CH_3$)$_2$ |
| ST-II-84 | $C_{10}H_{21}NHCO$— 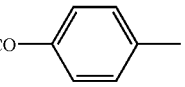 | —N($CH_3$)$_2$ |
| ST-II-85 | $C_8H_{17}$— | —N($C_2H_5$)$_2$ |
| ST-II-86 | $C_8H_{17}$— 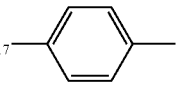 | —NH— 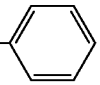 |
| ST-II-87 | $C_8H_{17}$— | —C($CH_3$)$_3$ |
| ST-II-88 | $CCl_3CH_2$— | —$C_{16}H_{33}$ |
| ST-II-89 | $C_5H_{11}$— 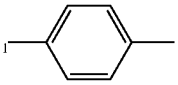 | —N($C_3H_7$)$_2$ |
| ST-II-90 | H— | — 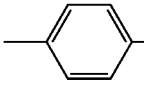 —$OC_{12}H_{25}$ |
| ST-II-91 | 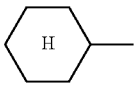 | — 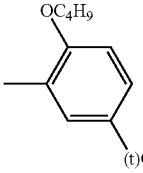 |
| ST-II-92 | $CF_3CH{=}CH$— | — 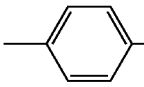 —$OC_{12}H_{25}$ |
| ST-II-93 | 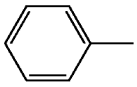 | — 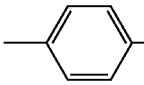 —$C_8H_{17}$(t) |
| ST-II-94 | $HOCH_2CH_2C{=}C$— | — 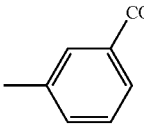 —$CONHC_9H_{19}$ |
| ST-II-95 | 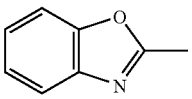 | —$C_{18}H_{37}$ |
| ST-II-96 | 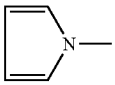 | — 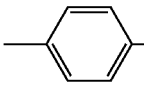 —$OC_{12}H_{25}$ |

-continued
| Compound No. | $R_A$—NHSO$_2$—$R_B$ | |
|---|---|---|
| | $R_A$ | $R_B$ |
| ST-II-97 | $C_4H_9CO$— | 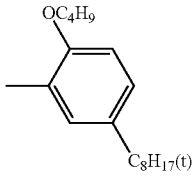 |
| ST-II-98 | $C_{10}H_{21}NHCO$— | 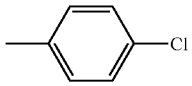 |
| ST-II-99 | 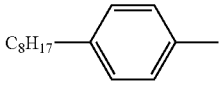 | —$OC_2H_5$ |
| ST-II-100 | 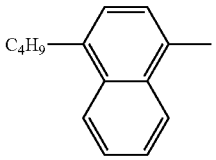 | 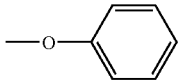 |
| ST-II-101 | 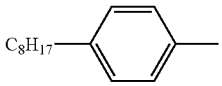 | 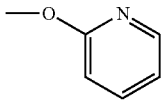 |
| ST-II-102 | 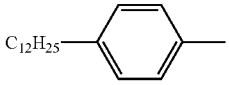 | —$NH_2$ |
| ST-II-103 | 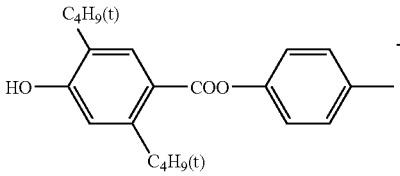 | 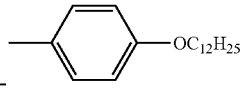 |
| ST-II-104 | 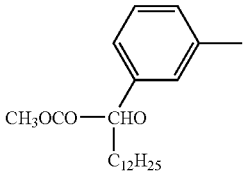 | 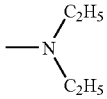 |
| ST-II-105 | 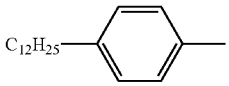 | 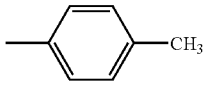 |
| ST-II-106 | 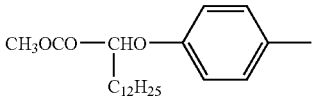 | 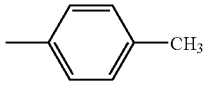 |
| ST-II-107 | 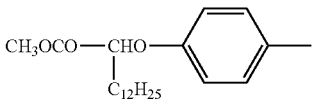 | 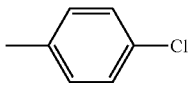 |

-continued
| Compound No. | $R_A$—$NHSO_2$—$R_B$ | |
|---|---|---|
| ST-II-108 | 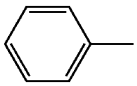 | 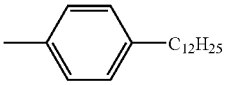 |
| ST-II-109 | 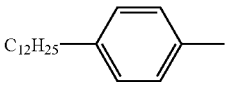 | 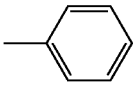 |
| ST-II-110 | 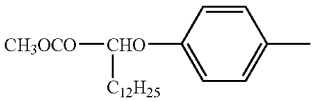 | 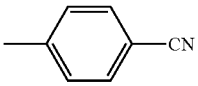 |
| ST-II-111 | 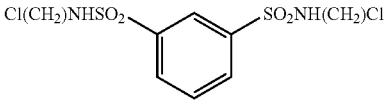 | |
| ST-II-112 | 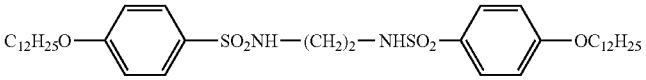 | |
| ST-II-113 | 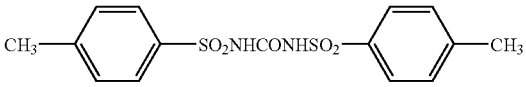 | |
| ST-II-114 | 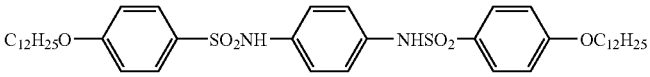 | |
| ST-II-115 | 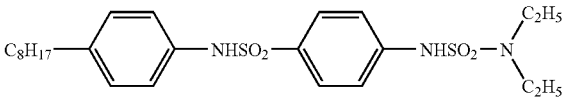 | |
| ST-II-116 | 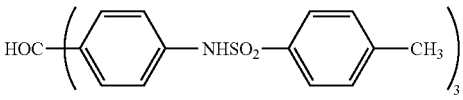 | |
| ST-II-117 | 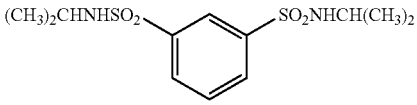 | |
| ST-II-118 | 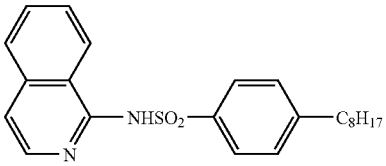 | |
| ST-II-119 | 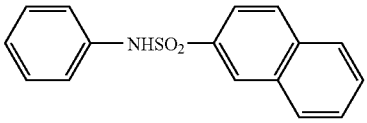 | |

-continued

| Compound No. | $R_A$—$NHSO_2$—$R_B$ | |
|---|---|---|
| ST-II-120 | 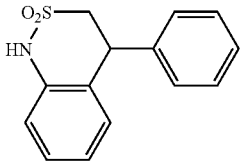 | |
| ST-II-121 | 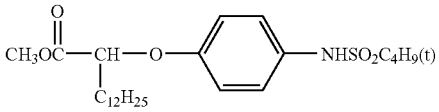 | |
| ST-II-122 | 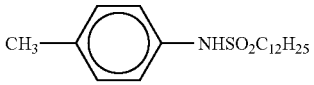 | |

The compound represented by the formula [ST-II] can be synthesized according to a conventionally known method such as the method described in JP-A-62-178258.

The amount to be used of the compound represented by the formula [ST-II] is preferably 5 to 50 mol %, more preferably 10 to 300 mol %, to the amount of the coupler.

Part of the compounds represented by the formula [ST-II] are described in JP-A-57-76543, JP-A-57-179842, JP-A-58-1139, JP-A-62-178258, and others.

Next, the compound represented by the formula [ST-III] will be explained.

Examples of the bivalent group represented by J' include an alkylene group, and alkenylene group, a cycloalkylene group, an arylene group, a heterocyclic group, and a -J"-NH— group (wherein J" represents an arylene group). These groups may have a substituent(s).

It is preferable that the alkyl group, cycloalkyl group, aryl group, alkenyl group, alkynyl group, and cycloalkenyl group, which are each represented by Y, have carbon atoms in the range of 1 to 32. These alkyl group, alkenyl group, and alkynyl group may each be a straight-chain group or a branched group. Further, these groups include those having a substituent(s).

Further, the heterocyclic group represented by Y is preferably a nitrogen-containing heterocyclic group.

Examples thereof include such groups as pyrrolyl, pyrazolyl, imidazolyl, pyridyl, pyrrolinyl, imidazolidinyl, imidazolinyl, piperazinyl, and piperidinyl. These heterocyclic groups include those having a substituent(s).

Hereinafter, representative examples of the compound represented by formula [ST-III] will be shown, but the present invention should not be considered to be limited thereto.

ST-III-1

$HO-(CH_2)_4-COOC_8H_{17}$

ST-III-2

$HO-(CH_2)_8-COOCH_2-CH(C_2H_5)C_4H_9$

ST-III-3

$HO-CH(CH_3)CH_2-COOC_{12}H_{25}$

-continued

ST-III-4

$HO-C(CH_3)_2CH_2-COOC_{10}H_{21}(i)$

ST-III-5

$HO-CH(C_3H_7(i))CH_2COOC_{10}H_{21}$

ST-III-6

$HO-(CH_2)_4-COOC_8H_{18}(t)$

ST-III-7

$HO-CH(C_7H_{15})CH_2-COOC_5H_{11}(t)$

ST-III-8

$HO-CH-CHCH_2COOCH_2-CH(C_2H_5)C_4H_9$

ST-III-9

$HO-CH_2CH_2OCH_2CH_2COOC_{10}H_{33}(i)$

ST-III-10

$HO-(CH_2)_4-COO-(CH_2)_8-CH=CHC_9H_{17}$

ST-III-11

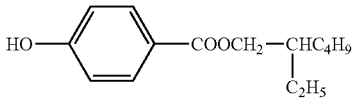

ST-III-12

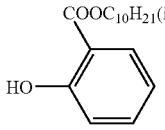

ST-III-13

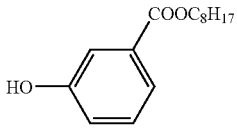

ST-III-14

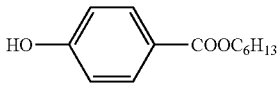

-continued

ST-III-15

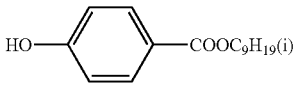

ST-III-16

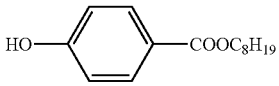

ST-III-17

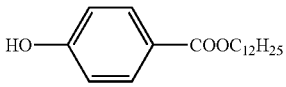

ST-III-18

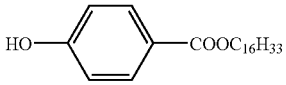

ST-III-19

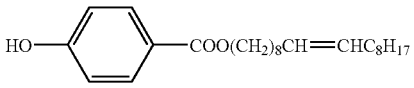

ST-III-20

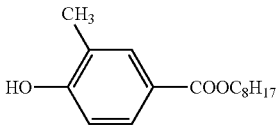

ST-III-21

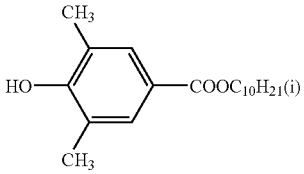

ST-III-22

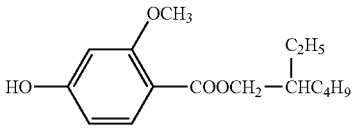

ST-III-23

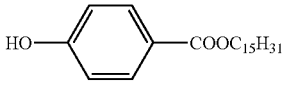

ST-III-24

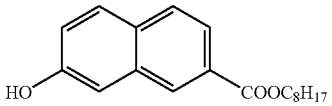

ST-III-25

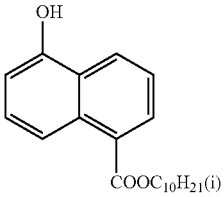

ST-III-26

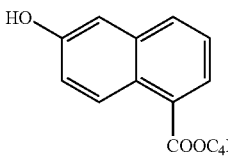

-continued

ST-III-27

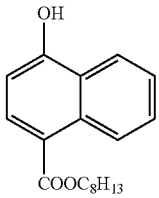

ST-III-28

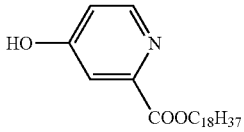

ST-III-29

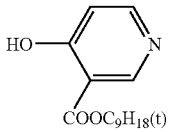

ST-III-30

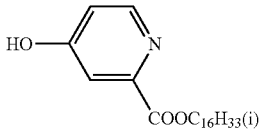

ST-III-31

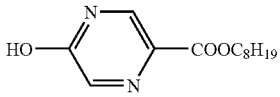

ST-III-32

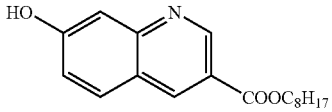

ST-III-33

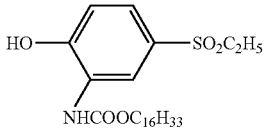

Among the compounds represented by the formula [ST-IV], particularly preferred compounds in the present invention, preferably in the third embodiment are those represented by any of the following formulae [ST-IV-I] to [ST-IV-IV].

formula (ST-IV-I)

formula (ST-IV-II)

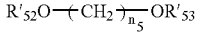

formula (ST-IV-III)

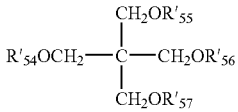

formula (ST-IV-IV)

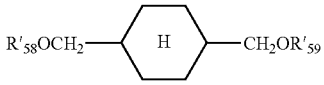

$R'_{50}$ to $R'_{59}$ in the above formulae each have the same meanings as $R_{51}$ and $R_{52}$ in the formula [ST-IV].

m5 represents an integer of 0 to 6 and n5 represents an integer of 1 to 10.

Further, in the formula [ST-IV-III], any two selected from $R'_{54}$ to $R'_{57}$ may bond together to form a ring.

Further, the compounds described in JP-A-62-257152, JP-A-62-257153, and JP-A-62-272247 can also be used preferably in the present invention, preferably in the third embodiment.

Hereinafter, representative examples of the compound represented by formula [ST-IV] will be shown, but the present invention should not be considered to be limited thereto.

$R_{51}O-(CH_2CH_2O)_{m_5}-R_{52}$

| No. | $R_{51}$ | $R_{52}$ | $m_5$ |
|---|---|---|---|
| ST-IV-1 | $-C_6H_{13}$ | $-C_6H_{13}$ | 1 |
| ST-IV-2 | $-C_6H_{13}$ | $-C_6H_{13}$ | 2 |
| ST-IV-3 | $-C_6H_{13}$ | $-C_6H_{13}$ | 3 |
| ST-IV-4 | $-C_6H_{13}$ | $-C_6H_{13}$ | 0 |
| ST-IV-5 | $-CH_2-CH(C_2H_5)C_4H_9$ | $-CH_2-CH(C_2H_5)C_4H_9$ | 1 |
| ST-IV-6 | $-CH_2-CH(C_2H_5)C_4H_9$ | $-CH_2-CH(C_2H_5)C_4H_9$ | 2 |
| ST-IV-7 | $-CH_2-CH(C_2H_5)C_4H_9$ | $-CH_2-CH(C_2H_5)C_4H_9$ | 3 |
| ST-IV-8 | $-CH_2-CH(C_2H_5)C_4H_9$ | $-CH_2-CH(C_2H_5)C_4H_9$ | 0 |
| ST-IV-9 | $-CH_2-C_6H_5$ | $-CH_2-C_6H_5$ | 1 |
| ST-IV-10 | $-CH_2-C_6H_5$ | $-CH_2-C_6H_5$ | 2 |
| ST-IV-11 | $-COCH_3$ | $-COCH_3$ | 1 |
| ST-IV-12 | $-COCH_3$ | $-COCH_3$ | 2 |
| ST-IV-13 | $-COCH_3$ | $-COCH_3$ | 3 |
| ST-IV-14 | $-COCH_3$ | $-COCH_3$ | 4 |
| ST-IV-15 | $-C_6H_{13}$ | $-COCH_3$ | 1 |
| ST-IV-16 | $-C_6H_{13}$ | $-COCH_3$ | 2 |
| ST-IV-17 | $-C_6H_{13}$ | $-COCH_3$ | 3 |
| ST-IV-18 | $-C_2H_5$ | $-CO-CH(C_2H_5)C_4H_9$ | 1 |
| ST-IV-19 | $-C_2H_5$ | $-CO-CH(C_2H_5)C_4H_9$ | 2 |
| ST-IV-20 | $-C_6H_{13}$ | $-CO-CH(C_2H_5)C_4H_9$ | 1 |
| ST-IV-21 | $-C_6H_{13}$ | $-CO-CH(C_2H_5)C_4H_9$ | 2 |
| ST-IV-22 | $-CH_2-CH(C_2H_5)C_4H_9$ | $-CO-CH(C_2H_5)C_4H_9$ | 1 |

-continued $R_{51}O-(CH_2CH_2O)_{m_5}-R_{52}$

| No. | $R_{51}$ | $R_{52}$ | $m_5$ |
|---|---|---|---|
| ST-IV-23 | $-CH_2-CH(C_2H_5)C_4H_9$ | $-CO-CH(C_2H_5)C_4H_9$ | 2 |
| ST-IV-24 | $-CO-CH(C_2H_5)C_4H_9$ | $-CO-CH(C_2H_5)C_4H_9$ | 1 |
| ST-IV-25 | $-CO-CH(C_2H_5)C_4H_9$ | $-CO-CH(C_2H_5)C_4H_9$ | 2 |
| ST-IV-26 | $-CH_2COOC_4H_9$ | $-CO-CH(C_2H_5)C_4H_9$ | 0 |
| ST-IV-27 | $-CH_2COOC_4H_9$ | $-CO-CH(C_2H_5)C_4H_9$ | 1 |
| ST-IV-28 | $-C_4H_9$ | $-C_4H_9$ | 2 |
| ST-IV-29 | $-C_4H_9$ | $-C_4H_9$ | 4 |
| ST-IV-30 | $-C_4H_9$ | $-C_4H_9$ | 6 |
| ST-IV-31 | $-COCH_2-C_6H_5$ | $-COCH_2-C_6H_5$ | 1 |
| ST-IV-32 | $-COCH_2-C_6H_5$ | $-COCH_2-C_6H_5$ | 2 |
| ST-IV-33 | $-C_{12}H_{25}$ | $-C_{12}H_{25}$ | 0 |
| ST-IV-34 | $-C_{12}H_{25}$ | $-C_{12}H_{25}$ | 1 |
| ST-IV-35 | $-C_2H_5$ | $-C(CH_2COOC_4H_9)_3$ | 0 |
| ST-IV-36 | $-C_8H_{17}$ | $-C(CH_2COOC_2H_5)_3$ | 0 |
| ST-IV-37 | $-C_8H_{17}$ | $-CH(CH_2COOC_2H_5)_2$ | 0 |
| ST-IV-38 | $-C_{12}H_{25}$ | $-CH(CH_2COOC_2H_5)_2$ ($OC_{12}H_{25}$) | 0 |
| ST-IV-39 | $-C_2H_5$ | $-CH(CH_2COOC_8H_{17})_2$ ($OC_2H_5$) | 0 |

$R_{51}O-(CH_2)_{n_5}-OR_{52}$

| No. | $R_{51}$ | $R_{52}$ | $n_5$ |
|---|---|---|---|
| ST-IV-40 | $-C_4H_9$ | $-C_4H_9$ | 3 |
| ST-IV-41 | $-C_4H_9$ | $-C_4H_9$ | 4 |
| ST-IV-42 | $-C_4H_9$ | $-C_4H_9$ | 5 |
| ST-IV-43 | $-C_4H_9$ | $-C_4H_9$ | 6 |
| ST-IV-44 | $-C_8H_{17}$ | $-C_4H_9$ | 4 |
| ST-IV-45 | $-COCH_3$ | $-COCH_3$ | 1 |
| ST-IV-46 | $-COCH_3$ | $-COCH_3$ | 3 |
| ST-IV-47 | $-COCH_3$ | $-COCH_3$ | 4 |
| ST-IV-48 | $-COCH_3$ | $-COCH_3$ | 6 |

-continued $R_{51}O-(CH_2)_{n_5}-OR_{52}$

| No. | $R_{51}$ | $R_{52}$ | $n_5$ |
|---|---|---|---|
| ST-IV-49 | $-CH_2-CH(C_2H_5)C_4H_9$ | $-CH_2-CH(C_2H_5)C_4H_9$ | 3 |
| ST-IV-50 | $-CH_2-CH(C_2H_5)C_4H_9$ | $-CH_2-CH(C_2H_5)C_4H_9$ | 4 |
| ST-IV-51 | $-CH_2-CH(C_2H_5)C_4H_9$ | $-CH_2-CH(C_2H_5)C_4H_9$ | 5 |
| ST-IV-52 | $-CH_2-CH(C_2H_5)C_4H_9$ | $-CH_2-CH(C_2H_5)C_4H_9$ | 6 |
| ST-IV-53 | $-CH_2-CH(C_2H_5)C_4H_9$ | $-CO-CH(C_2H_5)C_4H_9$ | 3 |

-continued $R_{51}O-(CH_2)_{n_5}-OR_{52}$

| No. | $R_{51}$ | $R_{52}$ | $n_5$ |
|---|---|---|---|
| ST-IV-54 | $-CH_2-CH(C_2H_5)C_4H_9$ | $-CO-CH(C_2H_5)C_4H_9$ | 4 |
| ST-IV-55 | $-CH_2-CH(C_2H_5)C_4H_9$ | $-COCH_3$ | 3 |
| ST-IV-56 | $-C_6H_{13}$ | $-COCH_3$ | 3 |
| ST-IV-57 | $-C_{12}H_{25}$ | $-C_{12}H_{25}$ | 3 |
| ST-IV-58 | $-C_{12}H_{25}$ | $-C_{12}H_{25}$ | 4 |

$R_{51}OCH_2-C(CH_2OR_{52})(CH_2OR_{52}')-CH_2OR_{52}'$

| No. | $R_{51}$ | $R_{52}$ | $R_{52}'$ | $R_{52}'$ |
|---|---|---|---|---|
| ST-IV-59 | $-C_4H_9$ | $-C_4H_9$ | $-C_4H_9$ | $-C_4H_9$ |
| ST-IV-60 | $-C_6H_{13}$ | $-C_6H_{13}$ | $-C_6H_{13}$ | $-C_6H_{13}$ |
| ST-IV-61 | $-C_8H_{17}$ | $-C_8H_{17}$ | $-C_8H_{17}$ | $-C_8H_{17}$ |
| ST-IV-62 | $-COCH_3$ | $-COCH_3$ | $-COCH_3$ | $-COCH_3$ |
| ST-IV-63 | $-COC_3H_7(t)$ | $-COC_3H_7(t)$ | $-COC_3H_7(t)$ | $-COC_3H_7(t)$ |
| ST-IV-64 | $-COC_4H_9$ | $-COC_4H_9$ | $-COC_4H_9$ | $-COC_4H_9$ |
| ST-IV-65 | $-CH_2-CH(C_2H_5)C_4H_9$ | $-CH_2-CH(C_2H_5)C_4H_9$ | $-CH_2-CH(C_2H_5)C_4H_9$ | $-CH_2-CH(C_2H_5)C_4H_9$ |
| ST-IV-66 | $-CO-CH(C_2H_5)C_4H_9$ | $-CO-CH(C_2H_5)C_4H_9$ | $-CO-CH(C_2H_5)C_4H_9$ | $-CO-CH(C_2H_5)C_4H_9$ |
| ST-IV-67 | $-COCH_3$ | $-COCH_3$ | $-C_4H_9$ | $-C_4H_9$ |
| ST-IV-68 | $-COCH_3$ | $-C_4H_9$ | $-C_4H_9$ | $-C_4H_9$ |

ST-IV-69

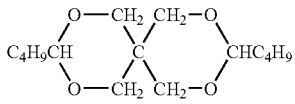

ST-IV-70

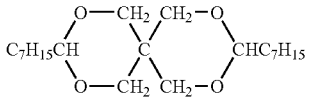

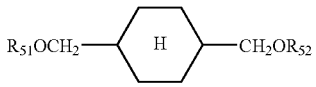

| No. | $R_{51}$ | $R_{52}$ |
|---|---|---|
| ST-IV-71 | $-COC_6H_{13}$ | $-COC_6H_{13}$ |
| ST-IV-72 | $-CO-CH(C_2H_5)C_4H_9$ | $-CO-CH(C_2H_5)C_4H_9$ |

-continued

ST-IV-69

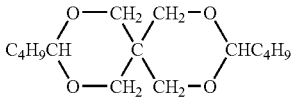

ST-IV-70

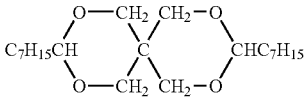

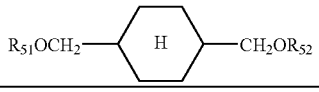

| No. | $R_{51}$ | $R_{52}$ |
|---|---|---|
| ST-IV-73 | $—COC_8H_{17}$ | $—COC_8H_{17}$ |
| ST-IV-74 | $—COC_8H_{17}$ | $—C_6H_{13}$ |
| ST-IV-75 | $—COC_8H_{17}$ | $—COC_6H_{13}$ |
| ST-IV-76 | $—COC_7H_{15}$ | $—COC_7H_{15}$ |
| ST-IV-77 | $—COC_7H_{15}$ | $—C_8H_{17}$ |
| ST-IV-78 | $—C_{12}H_{25}$ | $—C_{12}H_{25}$ |
| ST-IV-79 | $—C_{12}H_{25}$ | $—CO—CH(C_2H_5)C_4H_9$ |
| ST-IV-80 | $—COC_{12}H_{25}$ | $—CO—CH(C_2H_5)C_4H_9$ |

Some of the compounds represented by the formula [ST-IV] are commercially available. Otherwise, these compounds can be synthesized according to the methods described in, for example, JP-B-56-1616, JP-A-62-257152, JP-A-62-272247 and others.

Next, the compound represented by the formula [ST-V] will be explained.

$R_{54}$ represents a hydrophobic group in which the total of the carbon atoms is 10 or more (preferably 10 to 50 and more preferably 10 to 32), and which is preferably the aliphatic or aromatic group, more preferably the aliphatic group, as exemplified as $R_{40}$, $R_{50}$, and $R_{60}$ in the formula [ST-I]. $Y_{54}$ represents a monovalent organic group having an alcoholic hydroxyl group. $Y_{54}$ is preferably a monovalent organic group represented by the following formula (AL).

$$Y_{55}\text{-}(L_{55})m_{55}\text{-} \qquad \text{Formula (AL)}$$

In the formula, $Y_{55}$ represents a group to give a compound formed by eliminating a hydrogen atom from one of the plural hydroxyl groups contained in a polyhydric alcohol. $L_{55}$ represents a bivalent linking group. $m_{55}$ represents 0 or 1.

Preferred examples of the polyhydric alcohol, which becomes the group represented by $Y_{55}$ by the elimination of a hydrogen atom, are glycerin, polyglycerin, pentaerythritol, trimethylol propane, neopentyl glycol, sorbitan, sorbide, sorbit, saccharides, and the like. The bivalent linking groups represented by L are preferably —C(=O)— and $—SO_2—$.

A preferred compound in the other form of the compound represented by the formula [ST-V] is a compound in which $R_{54}$ is an aliphatic group having 12 or more carbon atoms (preferably an alkyl or alkenyl group having 12 to 32 carbon atoms) and $Y_{54}$ is an OH group.

Hereinafter, representative examples of the compound represented by formula [ST-V] will be shown, but the present invention should not be considered to be limited thereto.

ST-V-1

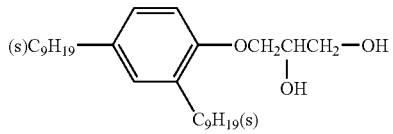

ST-V-2

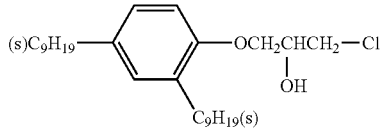

ST-V-3

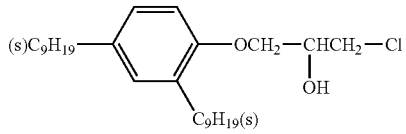

ST-V-4

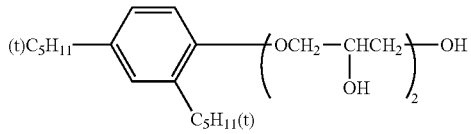

ST-V-5

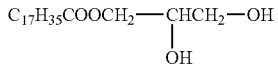

ST-V-6

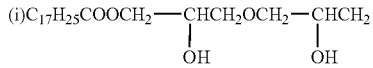

ST-V-7

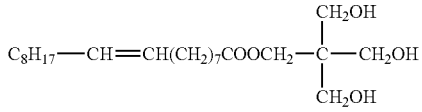

ST-V-8

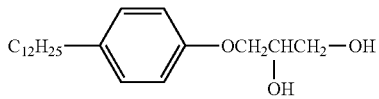

ST-V-9

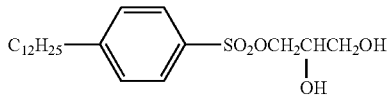

ST-V-10

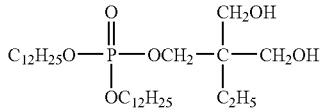

ST-V-11

Diglyceryl diisostearate

ST-V-12

Pentaerythritol dioleate

ST-V-13

Tetraglyceryl tristearate

ST-V-14

Decaglyceryl pentaoleate

ST-V-15

Sorbitan monooleate

ST-V-16

Sorbitan sesquioleate

ST-V-17

Sorbitan trioleate

-continued

ST-V-18

Sorbitan monostearate

ST-V-19

$C_8H_{16}CH{=}CH(CH_2)_8OH$

ST-V-20

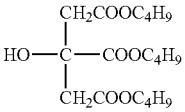

ST-V-21

$C_{12}H_{26}OH$

ST-V-22

$C_{14}H_{29}OH$

ST-V-23

$C_{16}H_{33}OH$

ST-V-24

$C_{18}H_{37}OH$

ST-V-25

$C_{20}H_{41}OH$

The compound, which is represented by any one of the formulae [ST-I] to [ST-V] in the present invention, preferably in the third embodiment, is preferably used in a layer which is incorporated with a yellow dye-forming coupler represented by the formula (I) or (II) in the present invention. It is preferable that the range of the amounts to be used of the compound, which is represented by any one of the formula [ST-I] to [ST-V] in the present invention, preferably in the third embodiment, is the same as the previously described range of the amounts to be used of the compound represented by any one of the formula [S-I] to [S-VI]. Although it is preferable that the compound, which is represented by any one of the formula [ST-I] to [ST-V] in the present invention, preferably in the third embodiment, is used also as a high boiling point organic solvent, it is more preferable that this compound is used in combination with a high boiling point organic solvent in the present invention, preferably in the third embodiment, or another high boiling point organic solvent (preferably in combination with a high boiling point organic solvent in the present invention, preferably in the third embodiment).

Next, the water-insoluble but organic solvent-soluble homopolymer or copolymer, which can be used in the present invention, preferably in the third embodiment, will be explained in detail.

Although various polymers can be used as the water-insoluble but organic solvent-soluble homopolymer or copolymer (hereinafter referred to as the copolymer for use in the present invention, preferably the third embodiment), for example, the following polymers can be used preferably.

(1) Vinyl-based Polymers and Copolymers

The monomers, which are to be used for the formation of the vinyl-based polymers and copolymers relating to the present invention, preferably the third embodiment, are specifically listed below:

Acrylates: for example, methyl acrylate, ethyl acrylate, n-propyl acrylate, isopropyl acrylate, n-butyl acrylate, tert-butyl acrylate, isobutyl acrylate, sec-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxyethyl acrylate, 2-butoxyethyl acrylate, 2-(2-methoxyethoxy)ethyl acrylate, 2-(2-butoxy)ethyl acrylate, ω-methoxypolyethyleneglycol acrylate (number of moles added n=9), 1-bromo-2-methoxyethyl acrylate, 1,1-dichloro-2-ethoxyethyl acrylate;

Methacrylates: for example, methyl methacrylate, ethyl methacrylate, n-propyl methacrylate, isopropyl methacrylate, n-butyl methacrylate, tert-butyl methacrylate, isobutyl methacrylate, sec-butyl methacrylate, amyl methacrylate, hexyl methacrylate, cyclohexyl methacrylate, benzyl methacrylate, chlorobenzyl methacrylate, octyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (number of moles added n=6);

Vinyl esters: for example, vinyl acetate, vinyl propionate, vinyl butylate, vinyl isobutylate, vinyl caproate, vinyl chloroacetate, vinyl methoxy acetate, vinylphenyl acetate, vinyl benzoate, vinyl salicylate;

Acrylamides: for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetoneacrylamide;

Methacrylamides: for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide;

Olefins: for example, dicyclopentadiene, ethylene, propylene, 1-butene, 1-pentene, vinyl chloride, vinylidene chloride, isoprene, chloroprene, butadiene, 2,3-dimethylbutadiene;

Styrenes: for example, styrene, methylstyrene, dimethylstyrene, trimethylstyrene, ethylstyrene, isopropylstyrene, chloromethylstyrene, methoxystyrene, chlorostyrene, dichlorostyrene, bromostyrene, methyl ester of vinylbenzoic acid;

Crotonates: for example, butyl crotonate, hexyl crotonate;

Diesters of itaconic acid: for example, dimethyl itaconate, diethyl itaconate, dibutyl itaconate;

Diesters of maleic acid: for example, diethyl maleate, dimethyl maleate, dibutyl maleate;

Diesters of fumaric acid: for example, diethyl fumarate, dimethyl fumarate, dibutyl fumarate; and the like.

Examples of other monomers are as follows: allyl compounds: for example, allyl acetate, allyl caproate, allyl laureate, allyl benzoate; vinyl ethers: for example, methyl vinyl ether, butyl vinyl ether, hexyl vinyl ether, methoxyethyl vinyl ether, dimethylaminoethyl vinyl ether; vinyl ketones: for example, methyl vinyl ketone, phenyl vinyl ketone, methoxyethyl vinyl ketone; vinyl-heterocyclic compounds: for example, vinylpyridine, N-vinylimidazole, N-vinyloxazolidone, N-vinyltriazole, N-vinylpyrrolidone; gycidyl esters: for example, glycidyl acrylate, glycidyl methacrylate; unsaturated nitriles: for example, acrylonitrile, methacrylonitrile; and the like.

The polymer that can be used in the present invention, preferably in the third embodiment, may be a homopolymer of any of the above-mentioned monomers or, if necessary, a copolymer of two or more of the above-mentioned monomers. Although the polymer that can be used in the present invention, preferably in the third embodiment, may comprise a monomer having an acid group to an extent that the polymer is not made water-soluble (the content of such a monomer is preferably 20% or less), the polymer that is entirely free of such a monomer is preferable. Examples of the monomer having an acid group include acrylic acid; methacrylic acid; itaconic acid; maleic acid; monoalkyl itaconate (e.g., monomethyl itaconate); monoalkyl maleate (e.g., monomethyl maleate); citraconic acid; styrenesulfonic acid; vinylbenzylsulfonic acid; acryloyloxyalkylsulfonic acid (e.g., acryloyloxymethylsulfonic acid); methacryloyloxyalkylsulfonic acid (e.g., methacryloyloxymethylsulfonic acid, methacryloyloxyethylsulfonic acid, methacryloyloxypropylsulfonic acid); acrylamidealkylsulfonic acid (e.g., 2-acrylamide-2-methylethanesulfonic acid, 2-acrylamide-2-methylpropanesulfonic acid, 2-acrylamide-2-methylbutanesulfonic acid); methacrylamidealkylsulfonic acid (e.g., 2-methacrylamide-2-methylethanesulfonic acid, 2-methacrylamide-2-methylpropanesulfonic acid, 2-methacrylamide-2-methylbutanesulfonic acid); acryloyloxyalkyl phosphate (e.g., acryloyloxyethyl phosphate, 3-acryloyloxypropyl-2-phosphate); methacryloyloxyalkyl phosphate (e.g., methacryloyloxyethyl phosphate, 3-methacryloyloxypropyl-2-phosphate); and the like.

These monomers having an acid group(s) may be a salt(s) of alkali metal (e.g., Na, K) or of an ammonium ion.

The monomers, which form the polymers that can be used in the present invention, preferably in the third embodiment, are preferably acrylate-based monomers, methacrylate-based monomers, acrylamide-based monomers, and methacrylamide-based monomers.

The polymers, which comprise the above-mentioned monomers, can be obtained by a solution polymerization process, a bulk polymerization process, a suspension polymerization process, or a latex polymerization process. Examples of the initiators, which can be used in the above-mentioned polymerization processes, include a water-soluble polymerization initiator and a lipophilic polymerization initiator.

Examples of the water-soluble polymerization initiator that can be used include persulfates such as potassium persulfate, ammonium persulfate, and sodium persulfate; water-soluble azo compounds such as sodium 4,4'-azobis-4-cyanovalerate and 2,2'-azobis(2-amidinopropane) hydrochloride; and hydrogen peroxide.

Examples of the lipophilic polymerization initiator include lipophilic azo compounds such as azobisisobutyronitrile, 2,2'-azobis(2,4-dimethylvaleronitrile), 2,2'-azobis(4-methoxy-2,4-dimethylvaleronitrile), 1,1'-azobis(cyclohexanone-1-carbonitrile), 2,2'-azobisdimethylisobutyrate, and 2,2'-azobisdiethylisobutyrate as well as benzoyl peroxide, lauryl peroxide, diisopropylperoxy dicarbonate, and di-tert-butylperoxide.

(2) As a polyhydric alcohol for a polyester resin obtainable by the condensation between a polyhydric alcohol and a polybasic acid, glycols represented by HO—$R_a$—OH (wherein $R_a$ represents a hydrocarbon, particularly an aliphatic hydrocarbon, having 2 to about 12 carbon atoms) or a polyalkylene glycol are effective. As the polybasic acid, polybasic acids represented by HOOC—$R_b$—COOH (wherein $R_b$ represents a simple linkage or a hydrocarbon having 1 to 12 carbon atoms) are effective.

Specific examples of the polyhydric alcohol include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, glycerin, diglycerin, triglycerin, 1-methylglycerin, erythrite, mannite, sorbit, and the like.

Specific examples of the polybasic include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, methaconic acid, isopimelic acid, a cyclopentadiene/maleic anhydride adduct, a rosin/maleic anhydride adduct, and the like.

(3) Polyesters Obtainable by a Ring-opening Polymerization Process

These polyesters are obtained from β-propiolactone, ϵ-caprolactone, dimethylpropiolactone, and the like.

(4) Others

Examples of other polymers include a polycarbonate resin obtained by a polycondensation reaction between a glycol or dihydric phenol and a carbonic ester or phosgene; a polyurethane resin obtained by a polyaddition reaction between a polyhydric alcohol and a polyvalent isocyanate; and a polyamide resin obtained from a polyvalent amine and a polybasic acid.

Although the number average molecular weight of the polymer that can be used in the present invention, preferably in the third embodiment, is not particularly limited, it is preferably 200,000 or less, more preferably 800 or more but 100,000 or less.

Hereinafter, specific examples of the polymer that can be used in the present invention, preferably in the third embodiment, will be shown, but the present invention should not be considered to be limited thereto (the compositions of the polymers in parentheses are indicated in terms of mass ratio).

P-1) poly(N-sec-butylacrylamide)
P-2) poly(N-tert-butylacrylamide)
P-3) diacetoneacrylamide/methyl methacrylate copolymer (25:75)
P-4) poly(cyclohexyl methacrylate)
P-5) N-tert-butylacrylamide/methyl methacrylate copolymer (60:40)
P-6) poly(N,N-dimethylacrylamide)
P-7) poly(tert-butyl methacrylate)
P-8) poly(vinyl acetate)
P-9) poly(vinyl propionate)
P-10) poly(methyl methacrylate)
P-11) poly(ethyl methacrylate)
P-12) poly(ethyl acrylate)
P-13) vinyl acetate-vinyl alcohol copolymer (90:10)
P-14) poly(n-butyl acrylate)
P-1S) poly(n-butyl methacrylate)

P-16) poly(isobutyl methacrylate)
P-17) poly(isopropyl methacrylate)
P-18) poly(octyl acrylate)
P-19) n-butyl acrylate/acrylamide copolymer (95:5)
P-20) stearyl methacrylate/acrylic acid copolymer (90:10)
P-21) methyl methacrylate/vinyl chloride copolymer (70:30)
P-22) methyl methacrylate/styrene copolymer (90:10)
P-23) methyl methacrylate/ethyl acrylate copolymer (50:50)
P-24) n-butyl methacrylate/methyl methacrylate/styrene copolymer (50:20:30)
P-25) vinyl acetate/acrylamide copolymer (85:15)
P-26) vinyl chloride/vinyl acetate copolymer (65:35)
P-27) methyl methacrylate/acrylonitrile copolymer (65:35)
P-28) n-butyl methacrylate/pentyl methacrylate/N-vinyl-2-pyrrolidone copolymer (38:38:24)
P-29) methyl methacrylate/n-butyl methacrylate/isobutyl methacrylate/acrylic acid copolymer (37:29:25:9)
P-30) n-butyl methacrylate/acrylic acid copolymer (95:5)
P-31) methyl methacrylate/acrylic acid copolymer (95:5)
P-32) benzyl methacrylate/acrylic acid copolymer (93:7)
P-33) n-butyl methacrylate/methyl methacrylate/benzyl methacrylate/acrylic acid copolymer (35:35:25:5)
P-34) n-butyl methacrylate/methyl methacrylate/benzyl methacrylate copolymer (40:30:30)
P-35) diacetoneacrylamide/methyl methacrylate copolymer (50:50)
P-36) methyl vinyl ketone/isobutyl methacrylate copolymer (55:45)
P-37) ethyl methacrylate/n-butyl acrylate copolymer (70:30)
P-38) diacetoneacrylamide/n-butyl acrylate copolymer (60:40)
P-39) methyl methacrylate/stearyl methacrylate/diacetoneacrylamide copolymer (40:40:20)
P-40) n-butyl acrylate/stearyl methacrylate/diacetoneacrylamide copolymer (70:20:10)
P-41) stearyl methacrylate/methyl methacrylate/acrylic acid copolymer (50:40:10)
P-42) methyl methacrylate/styrene/vinylsulfonamide copolymer (70:20:10)
P-43) methyl methacrylate/phenyl vinyl ketone copolymer (70:30)
P-44) n-butyl acrylate/methyl methacrylate/n-butyl methacrylate copolymer (35:35:30)
P-45) n-butyl methacrylate/N-vinyl-2-pyrrolidone copolymer (90:10)
P-46) poly(pentyl acrylate)
P-47) cyclohexyl methacrylate/methyl methacrylate/n-propyl methacrylate copolymer (37:29:34)
P-48) poly(pentyl methacrylate)
P-49) methyl methacrylate/n-butyl methacrylate copolymer (65:35)
P-50) vinyl acetate/vinyl propionate copolymer (75:25)
P-51) n-butyl methacrylate/sodium 3-acryloxybutane-1-sulfonate copolymer (97:3)
P-52) n-butyl methacrylate/methyl methacrylate/acrylamide copolymer (35:35:30)
P-53) n-butyl methacrylate/methyl methacrylate/vinyl chloride copolymer (37:36:27)
P-54) n-butyl methacrylate/styrene copolymer (82:18)
P-55) tert-butyl methacrylate/methyl methacrylate copolymer (70:30)
P-56) poly(N-tert-butylmethacrylamide)
P-57) N-tert-butylacrylamide/methylphenyl methacrylate copolymer (60:40)
P-58) methyl methacrylate/acrylonitrile copolymer (70:30)
P-59) methyl methacrylate/methyl vinyl ketone copolymer (28:72)
P-60) methyl methacrylate/styrene copolymer (75:25)
P-61) methyl methacrylate/hexyl methacrylate copolymer (70:30)
P-62) butyl methacrylate/acrylic acid copolymer (85:15)
P-63) methyl methacrylate/acrylic acid copolymer (80:20)
P-64) methyl methacrylate/acrylic acid copolymer (98:2)
P-65) methyl methacrylate/N-vinyl-2-pyrrolidone copolymer (90:10)
P-66; n-butyl methacrylate/vinyl chloride copolymer (90:10)
P-67) n-butyl methacrylate/styrene copolymer (70:30)
P-68) 1,4-butanediaol/adipic acid polyester
P-69) ethylene glycol/sebacic acid polyester
P-70) poly(caprolactam)
P-71) poly(propiolactam)
P-72) poly(dimethylpropiolactone)
P-73) N-tert-butylacrylamide/dimethylaminoethylaramide copolymer (85:15)
P-74) N-tert-butylmethacrylamide/vinylpyridine copolymer (95:5)
P-75) diethyl maleate/n-butyl acrylate copolymer (65:35)
P-76) N-tert-butylacrylamide/2-methoxyethyl acrylate copolymer 155:45)

The polymer of still another preferable mode that can be used in the present invention, preferably in the third embodiment, is a polymer substantially insoluble in water which comprises as a constituent element thereof a monomer unit having at least one aromatic group, and which has a number average molecular weight of 2,000 or less. The number average molecular weight is preferably 200 or more but less than 2,000, and more preferably 200 or more but 1,000 or less. The polymer that can be used in the present invention, preferably in the third embodiment, may be a so-called homopolymer composed of one kind of monomer unit, or a copolymer composed of two kinds or more of monomer units. In the case of a copolymer, it preferably comprises the monomer unit having the aromatic group, according to the present invention, preferably to the third embodiment, in a proportion of 20% or more of the weight composition of the copolymer. The polymer structure is not particularly limited in so far as the above-mentioned condition is fulfilled. Examples of the polymer having the preferred polymer structure include a polymer whose constituent element is styrene, β-methylstyrene, β-methylstyrene, or a monomer having a substituent on the benzene ring of such a monomer; a polymer whose constituent element is an aromatic acrylamide, an aromatic methacrylamide, an aromatic acrylate, or an aromatic methacrylate. Examples of the aromatic group include a phenyl group, a naphthyl group, a benzyl group, a biphenyl group, and the like. These aromatic groups may have a substituent(s) such as an alkyl group, a halogen atom, and the like. In the case of a copolymer, comonomers listed, for example, in JP-A-63-264748 can be used preferably. From the viewpoints of availability of raw materials and stability of an emulsion with the lapse of time, a polymer derived from styrene, α-methylstyrene or β-methylstyrene is preferable.

Hereinafter specific examples of the polymer for use in the present invention, preferably in the third embodiment, will be shown, but the present invention should not be considered to be limited thereto. In the specific examples, l, m, and n may take any value only if the number average molecular weight of the polymer is less than 2,000.

P-1
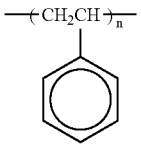
P-2
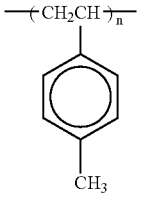
P-3
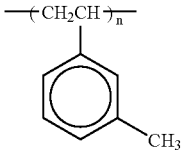
P-4
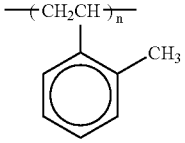
P-5
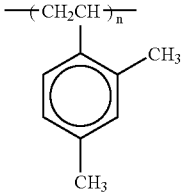
P-6
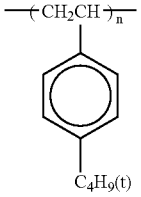
P-7
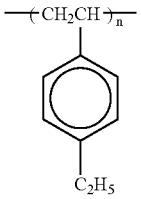
P-8
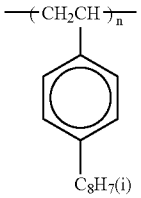
-continued
P-9
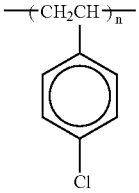
P-10
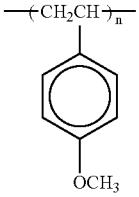
P-11
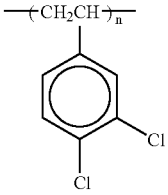
P-12
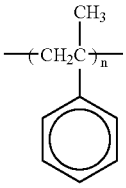
P-13
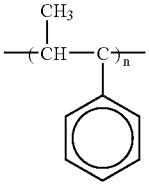
P-14
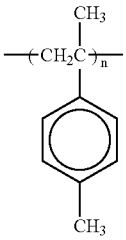
P-15
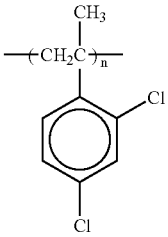

-continued
P-16
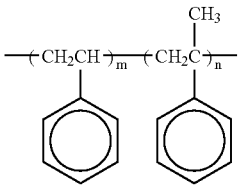
(m:n = 1:4)
P-17
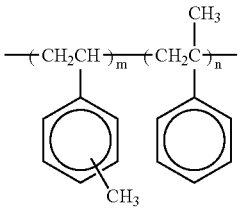
(m:n = 1:1)
P-18
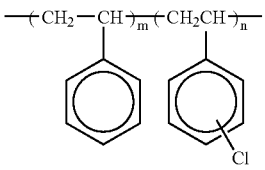
(m:n = 9:1)
P-19
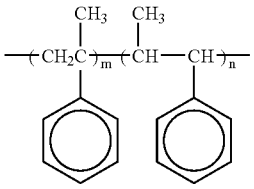
(m:n = 1:1)
P-20
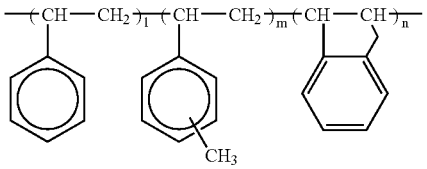
(l:m:n = 5:5:1)
P-21
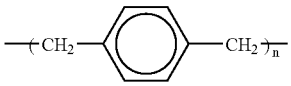
P-22
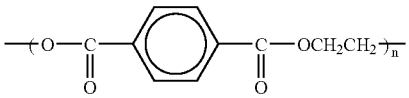
P-23
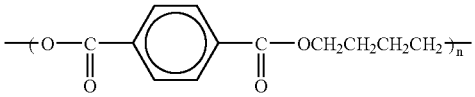
P-24
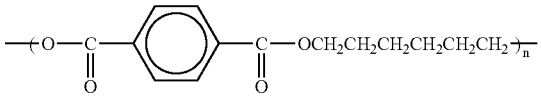
-continued
P-25
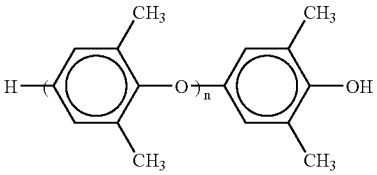
P-26
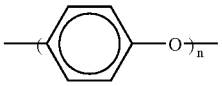
P-27
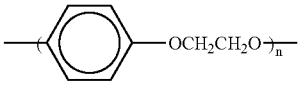
P-28
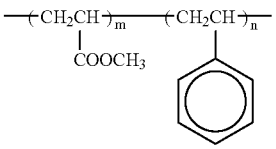
(m:n = 1:1)
P-29
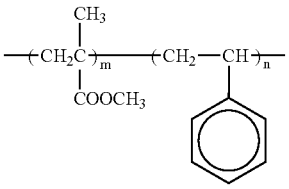
(m:n = 1:1)
P-30
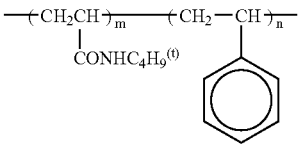
(m:n = 1:9)
P-31
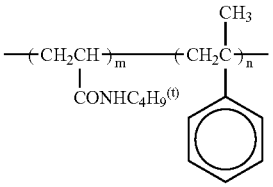
(m:n = 1:4)
P-32
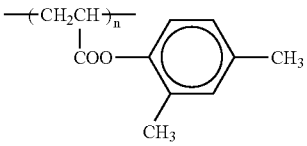
P-33
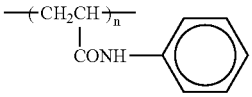
P-34
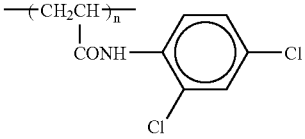

-continued

P-35

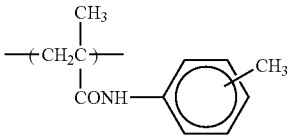

P-36

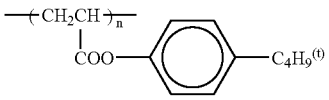

P-37

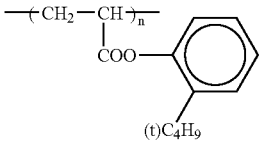

In the present invention, preferably in the third embodiment, the homopolymer or copolymer used in the present invention, preferably in the third embodiment, is used preferably as a dispersion to be present together with the coupler for use in the present invention in lipophilic particles. The dispersion can be obtained by dissolving the coupler and at least one of the homopolymer or copolymer used in the present invention, preferably in the third embodiment, in a high boiling point organic solvent substantially insoluble in water and dispersing the resulting solution by emulsification in a hydrophilic protective colloid.

Herein, the high-boiling-point organic solvent substantially insoluble in water is a compound, which has a melting point of 100° C. or below and a boiling point of 140° C. or above, and which is not miscible with water. Examples thereof include phenol derivatives, esters such as phthalic esters and phosphoric esters, amides of organic acids, carbamates, ketones, and others. These are described, for example, in U.S. Pat. Nos. 2,322,027, 2,353,262, 2,533,514, 2,801,170, 2,801,171, 2,835,579, 2,852,383, 2,870,012, 2,991,171, 3,287,134, 3,554,755, 3,676,137, 3,676,142, 3,700,454, 3,748,141, 3,779,765, and 3,837,863.

For the formation of lipophilic particles by dispersing the coupler related to the present invention and the compound related to the present invention, preferably to the third embodiment, by emulsification in a hydrophilic protective colloid, the dispersing operation is carried out by means of a mixer, a homogenizer, a colloid mill, a flow jet mixer, an ultrasonic apparatus, or the like, using a dispersing aid such as a surfactant. A process for removing a low boiling point organic solvent may be employed simultaneously with the dispersing operation.

An aqueous solution of gelatin is preferably used as the hydrophilic protective colloid. The average particle diameter of the lipophilic particles is preferably 0.04 to 2 μm, and more preferably 0.06 to 0.4 μm. The particle diameter can be measured by Coulter model N4 (trade name) manufactured by U.K. Coulter Corp., or the like.

In the above-described procedure, the mixing ratio of the coupler, homopolymer or copolymer, high boiling point organic solvent, and an auxiliary solvent such as a low boiling point organic solvent or an organic solvent miscible with water, may be selected such that the solution, which is formed by dissolving the coupler, homopolymer or copolymer, and high boiling point organic solvent in the auxiliary solvent, has a viscosity suitable for being easily dispersed in the hydrophilic protective colloid. Although the ratio cannot be defined unqualifiedly because it varies depending on the solubility of the coupler and the kind or degree of polymerization of the polymer to be used, an example of the ratio of the polymer to the coupler (mass ratio) is generally 1:10 to 5:1, and preferably 1:3 to 2:1.

In the case where a polymer insoluble in water and a high boiling point organic solvent are used in combination, the ratio of the high boiling point organic solvent to the coupler (mass ratio) is generally 1:20 to 5:1, and preferably 1:10 to 2:1. The ratio of the low boiling point organic solvent to the polymer (mass ratio) is generally 1:10 to 10:1, and preferably 1:4 to 5:1.

It is preferable that the homopolymer or copolymer is not a polyester made from an aliphatic dicarboxylic acid and an aliphatic diol, in the case of a yellow dye-forming coupler represented by the formula (I) wherein Q is —C(—R11)=C(—R12)-CO— (where R11 and R12 are groups that bond together to form a 5- to 7-membered ring together with the —C=C—, or each independently represent a hydrogen atom or a substituent).

In the present invention, preferably in the third embodiment, among the compounds represented by any one of the formulas [S-I] to [S-VI] or [ST-I] to [ST-V] and the water-insoluble homopolymers or copolymers, which are used together with the yellow dye-forming coupler represented by the formula (I) or (II) in the present invention, preferred compounds or preferred combinations of these compounds are as follows.

In the present invention, preferably in the third embodiment, from the standpoint of stability at the time of rapid processing, preferred compounds or preferred combinations of these compounds are a combination of a compound represented by the formula [S-II] and a compound represented by the formula [S-I], a compound represented by the formula [S-IV], a combination of a compound represented by the formula [ST-II] and a compound represented by the formula [S-I], a combination of a compound represented by the formula [ST-III] and a compound represented by the formula [S-I], and a combination of a compound represented by the formula [ST-V] and a compound represented by the formula [S-I].

Besides, from the standpoint of stability in an unexposed state, preferred compounds or preferred combinations of these compounds are a compound represented by the formula [S-I], a compound represented by the formula [S-III], a compound represented by the formula [S-V], a compound represented by the formula [S-VI], a combination of a compound represented by the formula [ST-IV] and a compound represented by the formula [S-I], and a combination of a compound represented by the formula [S-I] and A water-insoluble polymer used in the present invention, preferably in the third embodiment.

Particularly preferable are a compound represented by the formula [S-V], a compound represented by the formula [S-VI], and a combination of a compound represented by the formula [S-III] and a compound represented by the formula [S-I].

Further, from the standpoint of fastness to humidity and heat, preferred compounds are a compound represented by the formula [S-I], a compound represented by the formula [S-V], a compound represented by the formula [S-VI], and a compound represented by the formula [S-I].

As the cyan dye-forming coupler (herein also referred to as "cyan coupler") which can be used in the present invention, preferably in the third and fourth embodiments, pyrrolotriazole-series couplers are preferably used, and more specifically, couplers represented by any of formulae (1) and (II) in JP-A-5-313324 and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-10-333297 are preferred. As preferable cyan couplers other than the foregoing cyan couplers, mention can be made of: pyrroloazole-type cyan couplers described in European Patent Nos. 0 488 248 and 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, use can be made of diphenyllmidazole-series cyan couplers described in JP-A-2-33144; as well as 3-hydroxypyridine-series cyan couplers (particularly a 2-equivalent coupler formed by allowing a 4-equivalent coupler of a coupler (42), to have a chlorine splitting-off group, and couplers (6) and (9), enumerated as specific examples are particularly preferable) described in European Patent 0333185 A2; cyclic active methylene-series cyan couplers (particularly couplers 3, 8, and 34 enumerated as specific examples are particularly preferable) described in JP-A-64-32260; pyrrolopyrazole-type cyan couplers described in European Patent No. 0456226 A1; and pyrroloimidazole-type cyan couplers described in European Patent No. 0484909.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, preferably to the third embodiment, and therefore the descriptions are preferably incorporated by reference in the present specification.

Next, the relative coupling rate in the present invention, preferably in the fourth embodiment, will be described.

Oxidation of p-phenylenediamine (hereinafter, abbreviated as "PPD") with silver halide is a process that takes place at the outset of the color-developing process and this is a rate-limiting process. The PPD is converted into quinonediimine (hereinafter, abbreviated as "$QDI^+$") when subjected to two-electron oxidation. On the other hand, a coupler present in an oil drop is dissociated into an anion (hereinafter, abbreviated as "$Cp^-$"), which forms a color-forming dye (hereinafter, abbreviated as "Dye") upon reaction with the $QDI^+$.

The relative coupling rate can be calculated, by making the compound A co-exist in the color-development reaction system and measuring the degree of a decrease in the rate of the color development reaction due to competition of the reaction between the compound A (hereinafter, abbreviated as "$A^-$") and the $QDI^+$.

It is assumed that the coupling reaction proceeds as follows.

$QDI^+ + Cp^- \rightarrow$ Dye Reaction rate constant $k_{Cp}$ $QDI^+ + A^- \rightarrow$ QDI-A Reaction rate constant $k_A$ $QDI^+ \rightarrow$ Deactivation/efflux, etc. Reaction rate constant $k_d$ In the above, $A^-$ represents a dissociate form of the compound A, and QDI-A represents a coupling product from the compound A and the QDI.

The dye production yield Φin the system in which the compound A coexists is represented by the equation (1) described below.

$$\Phi = k_{Cp}/(k_{Cp} + k_d + k_A[A]) \quad (1)$$

By taking an inverse number of the equation (1), the equation (2) below is obtained.

$$1/\phi = 1 + (k_d + k_A[A])/k_{Cp} = (1 + k_d/k_{Cp}) + k_A[A]/k_{Cp} \quad (2)$$

In the equation (2) above, [A] is the concentration (mol/l) of the compound A that exists in the system (color developer). Note that, as shown above, the color developer has a pH of 10.05, so that all the molecules of the compound A exist as $A^-$ and hence $[A^-]$ is equal to [A]. Therefore, [A] is used in place of $[A^-]$ herein.

In the equation (2), 1/Φ is plotted as a function of [A], and an inverse number of the inclination ($k_{Cp}/k_A$) of the straight line obtained by the plotting is defined as the relative coupling rate.

The dye production yield Φ can be experimentally obtained, by plotting the number of moles of color forming dye vs. the amount of developed silver at varied concentrations [A] of the compound A, and determining the initial gradient tan θ thereof.

Since the relative coupling rate obtained by the above-mentioned experimental technique varies depending on the color-development processing, the composition of the processing solution and the processing conditions for the color-development processing on which the relative coupling rate calculation in the present invention, preferably in the fourth embodiment, is based are shown below.

| | |
|---|---|
| Triethanolamine | 8.1 g/l |
| Potassium chloride | 2.9 g/l |
| Potassium bromide | 0.02 g/l |
| Potassium hydrogen carbonate | 4.8 g/l |
| Potassium sulfite | 0.1 g/l |
| N-ethyl-N-(β-methanesulfonamidoethyl)-3-methyl-4-aminoaniline 3/2 sulfate monohydrate | 4.5 g/l |
| Potassium carbonate | 18.4 g/l |
| Addition of water to make | 1,000 ml |
| pH (25° C./adjusted with potassium hydroxide and sulfuric acid | 10.05 |
| Temperature | 35° C. |
| Processing time | 45 seconds |

Thereafter, bleach-fixing and washing (rinsing) are performed for desilvering. If desilvering is performed ordinarily, no influence is given on the calculation of relative coupling rates. For example, bleach fixing and rinsing in standard RA-4 [Eastman Kodak] processing or color-development processing B described in Example 4-3 in the present specification (preferably, the latter method) are carried out and a colored sample after drying is measured as described below.

Specifically, 1.0 g/l or less of the compound A is optionally added to the above-mentioned color-development processing solution (preferably, with adjusting the addition amount of the compound A such that a density region from the maximum color density given by the above-mentioned color-developer without addition of the compound A to the density of an unexposed portion can be divided at approximately regular intervals, and with plotting at five or more measuring points, preferably 20 measuring points), and the concentration of a dye obtained from the coupler to be measured is measured with respect to the addition amount, followed by calculating a relative coupling rate, k ($k_{Cp}/K_A$), to the compound A.

The sample of which the relative coupling rate is obtained has a multilayer structure having at least one yellow color-forming light-sensitive silver halide emulsion layer, at least one magenta color-forming light-sensitive silver halide emulsion layer, and at least one cyan color-forming light-sensitive silver halide emulsion layer, and at least one non-light-sensitive and non-color-forming hydrophilic colloid layer. The relative coupling rate of the yellow color-forming coupler can be calculated by exposing it to blue light, the relative coupling rate of the magenta color-forming coupler can be calculated by exposing it to green light, and the relative coupling rate of the cyan color-forming coupler can be calculated by exposing it to red light. The yellow color-forming light-sensitive silver halide emulsion layer, the magenta color-forming light-sensitive silver halide emulsion layer, and the cyan color-forming light-sensitive silver halide emulsion layer each preferably contain a color-forming coupler and a photosensitive silver halide emulsion in the same layer, and each color-forming layer is preferably coated one by one in view of reducing the thickness of layer.

Note that although the ratio of the number of moles of coloring dye to the amount of developed silver may be obtained by any method, the amount of dye in the case of a reflective support can be obtained by extracting the sample that developed a color.

Also, plural couplers may be contained in each color-forming coupler-containing light-sensitive silver halide emulsion layer. In such case, the number of moles of produced dye can be obtained from waveform separation of extracted dyes or liquid-liquid chromatography. The average relative coupling rate, ka, is calculated by weight averaging with a compositional mole fraction.

The average relative coupling rate, kar', of the couplers in each photographic light-sensitive material is obtained as follows. That is, Sample 4-001 described in Example 4-1 in the present specification is exposed to blue light, and the average relative coupling rate, ka, when the yellow coupler forms color is taken as 1.0, and a relative value to this is defined as the average relative coupling rate, kar, defined in the present invention, preferably in the fourth embodiment.

Note that the term "average" is used because when plural couplers are contained in the same photosensitive silver halide emulsion layer, the average relative coupling rate, ka, is weight averaged with the compositional mole fraction as described above, but the case where only one kind of coupler is contained in the emulsion layer should also be included in "average" according to the above-mentioned calculation definition.

For example, the average relative coupling rates, ka, of color papers currently on the market are cyan 1.23, magenta 0.51, and yellow 1.01 for Fuji Color Ever Beauty Paper for Laser (trade name) manufactured by Fuji Photo Film Co., Ltd., cyan 0.99, magenta 0.45, and yellow 1.48 for a product manufactured by a company B, and cyan 0.95, magenta 0.35, and yellow 0.91 for a product manufactured by a company C. These do not meet the definition in the present invention, preferably in the fourth embodiment.

A preferred range of the average relative coupling rate, kar, is 0.6 or more and 2.0 or less, more preferably 0.7 or more and 1.8 or less, still more preferably 0.7 or more and 1.5 or less, for all the color-forming coupler-containing silver halide emulsion layers. The average relative coupling rate, kar, outside the above-mentioned range is not preferable. If the average relative coupling rate, kar, is higher than the range defined in the present invention, preferably in the fourth embodiment, it is necessary to design the thickness of an intermediate layer for preventing color mixing thicker in order to maintain color separability, although color-forming property is enhanced. This deteriorates rapid high-productivity processing suitability, and at the same time, deteriorates bleach stain or stain due to the remaining developing agent. If the average relative coupling rate, kar, is lower than the range defined in the present invention, preferably in the fourth embodiment, the silver coating amount or coupler coating amount must be increased in order to increase color density, which deteriorates rapid high-productivity processing suitability and at the same time tends to cause adverse affects such as blix fading.

For balancing the average relative coupling rates, kar, it is preferred that the layer in which the color-forming coupler has the maximum average relative coupling rate kar, among the color-forming couplers contained in the color-forming photosensitive silver halide emulsion layers, be positioned in the middle of the three color-forming photosensitive silver halide emulsion layers.

The silver halide emulsion contained in the yellow color-forming blue-sensitive silver halide emulsion layer preferably has a relatively high sensitivity as compared with the green-sensitive silver halide emulsion and red-sensitive silver halide emulsion, in consideration of yellow mask of a negative or spectroscopic characteristics of halogen that is the source at the time of exposure. For this purpose, the side length of the grains in the blue-sensitive emulsion is greater than that of the grains in other layers. Further, the generally known molar extinction coefficient of the coloring dye formed by a yellow coupler is low as compared with those of the coloring dyes formed by the magenta coupler and the cyan coupler, so that increasing yellow coupler coating amount is accompanied by an increasing coating amount of the blue-sensitive emulsion.

The yellow color-forming blue-sensitive layer is disadvantageous as compared with other layers when taking into consideration the resistance to pressure applied from the surface of the photosensitive material, such as scratching, and it is preferably positioned on a side closer to the support. More preferably, the yellow color-forming blue-sensitive layer is positioned closest to the support among the silver halide emulsion layers. Most preferably, it is positioned in the position closest to the support among all the layers.

In the present invention, preferably in the fourth embodiment, a preferred total silver coating amount is 0.25 g/m$^2$ to 0.50 g/m$^2$, more preferably 0.25 g/m$^2$ to 0.45 g/m$^2$, still more preferably 0.25 g/m$^2$ to 0.40 g/m$^2$.

In the silver halide color photographic light-sensitive material according to the present invention, preferably to the fourth embodiment, gelatin is generally used as a hydrophilic binder. Other hydrophilic colloids of gelatin derivatives, graft copolymers of gelatin with other polymers, proteins other than gelatin, sugar derivatives, cellulose derivatives, synthetic hydrophilic polymeric substances such as homopolymers and copolymers may be used in combination with gelatin, if necessary. The gelatin that can be used in the silver halide color photographic light-sensitive material of the present invention, preferably of the fourth embodiment, may be any one of lime-processed gelatin and acid-processed gelatin. Alternatively, it may be gelatin produced by using any one of bovine bone, bovine skin, and porcine skin as a raw material. Lime-processed gelatin from bovine bone or porcine skin as a raw material is preferred.

In the present invention, preferably in the fourth embodiment, the total amount of hydrophilic binder contained in the photosensitive silver halide emulsion layer and the non-photosensitive hydrophilic colloid layer from the support to the hydrophilic colloid layer remotest from the support (on the side where the silver halide emulsion layer(s) is provided) is generally 5.7 g/m$^2$ or less and 4.0 g/m$^2$ or more, preferably 5.7 g/m$^2$ or less and 4.5 g/m or more, more preferably 5.5 g/m$^2$ or less and 5.0 g/m$^2$ or more. If the amount of hydrophilic binder is too large, the effects of the present invention, preferably of the fourth embodiment, cannot be sufficiently exhibited, due to deterioration of the rapid processability for color-development processing, deterioration due to blix fading, deterioration of rapid processability for rinsing step, and the like. On the other hand, if the amount of the hydrophilic binder is too small, harmful affection due to insufficient film strength, such as pressure-induced fog streak, tends to occur, which is not preferable.

The water-swelling rate in the present invention, preferably in the fourth embodiment, is that on the side where silver halide emulsion layers are coated on the support, measured under the environment of 25° C. and relative humidity of 55%, which means the water-swelling rate when immersed in water of 35° C. The water-swelling rate is preferably 200% or more and 300% or less, more preferably 220% or more and 280% or less. Outside the preferred range of the water-swelling rate, rapid processability may be lost in some cases.

The film thickness in the present invention, preferably in the fourth embodiment, is preferably 5.0 μm or more and 7.7 μm or less, more preferably 5.0 μm or more and 7.0 μm or less, still more preferably 5.0 μm or more and 6.5 μm or less.

The effects of the present invention, preferably of the fourth embodiment, tends to be more easily exhibited, under the conditions where reciprocity law failure occurs at the time of high illuminance exposure and where silver development in a shadow portion is difficult to occur. However, at low illuminance exposure, similar effects can be obtained.

The present invention, preferably the fourth embodiment, will be described in more detail based on examples referred to hereinbelow, but unless otherwise specified, the present invention should not be considered to be limited thereto.

Hereinafter, silver halide color photographic light-sensitive material of the present invention, preferably of the fourth embodiment, is explained below.

In the present invention, preferably in the fourth embodiment, a silver halide color photosensitive material (hereinafter, sometimes referred to simply as "photosensitive material") which has, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, is preferably used.

In the present invention, preferably in the fourth embodiment, the silver halide emulsion layer containing a yellow dye-forming coupler functions as a yellow color-forming layer, the silver halide emulsion layer containing a magenta dye-forming coupler functions as a magenta color-forming layer, and the silver halide emulsion layer containing a cyan dye-forming coupler functions as a cyan color-forming layer. Preferably, the silver halide emulsions contained in the yellow color-forming layer, the magenta color-forming layer, and the cyan color-forming layer may have photosensitivities to mutually different wavelength regions (for example, light in a blue region, light in a green region and light in a red region).

The photosensitive material of the present invention, preferably of the fourth embodiment, has at least one non-photosensitive, non-color-forming hydrophilic colloid layer, besides the above-mentioned yellow color-forming layer, magenta color-forming layer and cyan color-forming layer. As such hydrophilic colloid layer, as will be described later, an antihalation layer, an intermediate layer, an ultraviolet ray absorbing layer, a protective layer, a colored layer, and the like may be mentioned.

Herein, the silver halide photographic light-sensitive material preferable in the present invention, more preferably in the fourth embodiment is explained below in detail.

The silver halide grains in the silver halide emulsion for use in the present invention, preferably in the fourth embodiment, are not particularly limited in their grain shape, but the silver halide grains are preferably composed of cubic or tetradecahedral crystal grains substantially having a {100} plane (each of the grains may have a round apex and a plane of a higher order); octahedral crystal grains; and tabular grains having an aspect ratio of 2 or more whose main face is of a {100} plane or {111} plane. The aspect ratio is defined as the value obtained by dividing the diameter of a circle corresponding to the circle having the same area as a projected area of an individual grain by the thickness of the grain. In the present invention, preferably in the fourth embodiment, cubic or tetradecahedral grains are more preferable.

The silver halide emulsion which can be used in the present invention, preferably in the fourth embodiment, generally contains silver chloride in a silver chloride content of 95 mol % or more. It is more preferable for rapid processing suitability to use the silver halide emulsion having a silver chloride content of 96 mole % or greater.

Further, the silver halide emulsion for use in the present invention, preferably in the fourth embodiment, preferably contains silver bromide and/or silver iodide. The content of the silver bromide is preferably 0.1 to 7 mole %, more preferably 0.5 to 5 mole %, in view of high contrast and excellent latent image stability. The content of the silver iodide is preferably 0.02 to 1 mole %, more preferably 0.05 to 0.50 mole %, most preferably 0.07 to 0.40 mole %, in view of high contrast and high sensitivity under high illumination intensity exposure.

The silver halide emulsion for use in the present invention, preferably in the fourth embodiment, is preferably a silver iodobromochloride emulsion, more preferably a silver iodobromochloride emulsion having a halogen composition described above.

The silver halide grains in the silver halide emulsion for use in the present invention, preferably in the fourth embodiment, preferably have a silver bromide-containing phase and/or a silver iodide-containing phase. Herein, a region where the content of silver bromide is higher than that in other (surrounding) regions will be referred to as a silver bromide-containing phase, and likewise, a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The localized silver bromide content in the silver bromide-containing phase is preferably 5 mole % or more, more preferably from 10 to 80 mole %, and most preferably from 15 to 50 mole %. The localized silver iodide content in the silver iodide-containing phase is preferably 0.3 mole % or more, more preferably from 0.5 to 8 mole %, and most preferably from 1 to 5 mole %. Such silver bromide- or silver iodide-containing phase may be present in plural numbers in layer form, within the grain. In this case, the phases may have different silver bromide or silver iodide contents from each other. The silver halide grains for use in the present invention, preferably in the fourth embodiment, have at least one of the silver bromide-containing phase and silver iodide-containing phase, and preferably contain both of at least one silver bromide-containing phase and at least one silver iodide-containing phase.

The silver bromide-containing phase or silver iodide-containing phase in the silver halide emulsion preferably used in the present invention, preferably in the fourth embodiment, preferably exists in a layer state so that it surrounds the silver halide grain. One preferred embodiment is that the silver bromide-containing phase or the silver iodide-containing phase formed in the layer form so as to surround the grain center has a uniform concentration distribution in the circumferential direction of the grain, in each phase. However, in the silver bromide-containing phase or silver iodide-containing phase formed in the layer form so as to surround the grain center, there may be the maximum point or the minimum point of the silver bromide or silver iodide concentration, in the circumferential direction of the grain to have a concentration distribution. For example, when a grain has a silver bromide-containing phase or silver iodide-containing phase formed in the layer form so as to surround the grain center in the vicinity of a surface of the grain, the silver bromide or silver iodide concentration of a corner portion or an edge of the grain can be different from that of a main surface of the grain. Further, aside from a silver bromide-containing phase or a silver iodide-containing phase formed in a layer form so as to surround the grain center, another silver bromide-containing phase or silver iodide-containing phase that exists in complete isolation at a specific portion of the surface of the grain, and does not surround the grain center, may exist.

When a silver halide emulsion grain for use in the present invention, preferably in the fourth embodiment, has a silver bromide-containing phase, the silver bromide-containing phase is preferably formed in a layer form so as to have a maximum point of silver bromide concentration inside the grain. Likewise, when the silver halide emulsion grain for use in the present invention, preferably in the fourth embodiment, has a silver iodide-containing phase, the silver iodide-containing phase is preferably formed in a layer form so as to form a maximum point of silver iodide concentration at the surface of the grain. Such a silver bromide-containing phase or silver iodide-containing phase is constituted preferably with a silver amount of 3% to 30% of the grain volume, and more preferably with a silver amount of 3% to 15%, in the meaning to increase the local concentration with a less silver bromide or silver iodide content.

The silver halide emulsion grain for use in the present invention, preferably in the fourth embodiment, preferably contains both a silver bromide-containing phase and a silver iodide-containing phase. In this mode, the silver bromide-containing phase and the silver iodide-containing phase may exist either at the same place in the grain or at different places thereof. However, it is preferred that they exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide or silver iodide content in the silver halide emulsion preferably used in the present invention, preferably in the fourth embodiment, increases with the silver bromide-containing phase or silver iodide-containing phase is being formed inside a grain. This causes the silver chloride content to decrease to more than necessary, resulting in the possibility of impairing rapid processing suitability. Accordingly, for putting together these functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

To a silver halide emulsion grain preferably used in the present invention, preferably in the fourth embodiment, bromide ions or iodide ions are introduced to make the grain contain silver bromide or silver iodide. In order to introduce bromide ions or iodide ions, a bromide or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in the form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. As another source of bromide or iodide ion, fine silver bromide grains or fine silver iodide grains may be used.

The addition of a bromide salt or iodide salt solution may be concentrated at one time of grain formation process or may be performed over a certain period of time. For obtaining an emulsion with high sensitivity and low fog, the position of the introduction of an iodide ion to a high silver chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. When the addition of an iodide salt solution is finished at a little inner side of the grain surface, thereby an emulsion having higher sensitivity and lower fog can be obtained.

On the other hand, the addition of a bromide salt solution is preferably started at 50% or outer side of the volume of a grain, more preferably 70% or outer side of the volume of an emulsion grain.

In this specification, an equivalent spherical diameter of grain means a diameter of a sphere having a volume identical to that of an individual grain. Preferably, the silver halide emulsion for use in the present invention, preferably in the fourth embodiment, is composed of grains having a monodisperse particle size distribution.

The variation coefficient of equivalent spherical diameter of all the grains contained in the silver halide emulsion for use in the present invention, preferably in the fourth embodiment, is preferably 20% or less, more preferably 15% or less, and still more preferably 10% or less. The variation coefficient of equivalent spherical diameter is expressed as a percentage of standard deviation of equivalent spherical diameter of each grain to an average of equivalent spherical diameter. In this connection, for the purpose of obtaining broad latitude, it is preferred that the above-mentioned monodisperse emulsions be used as blended in the same layer or be used in layers formed by multilayer coating.

The equivalent spherical diameter of the grains contained in the silver halide emulsions that can be used in the present invention, preferably in the fourth embodiment, is preferably 0.6 μm or less, more preferably 0.5 μm or less, and still more preferably 0.4 μm or less. Note that the lower limit of the equivalent spherical diameter of the silver halide grains, is preferably 0.05 μm, more preferably 0.1 μm. The grain having an equivalent spherical diameter of 0.6 μm corresponds to a cubic grain having a side length of about 0.48 μm, the grain having an equivalent spherical diameter of 0.5 μm corresponds to a cubic grain having a side length of about 0.4 μm, and the grain having an equivalent spherical diameter of 0.4 μm corresponds to a cubic grain having a side length of about 0.32 μm. Among these, in the present invention, preferably in the fourth embodiment, in particular, cubic grains having an average side length of 0.10 μm to 0.50 μm are preferred, and those having an average side length of 0.15 μm to 0.48 μm are more preferred.

The silver halide emulsion grains used in the present invention, preferably in the fourth embodiment, preferably contains (be doped with) iridium, for example, by containing an iridium compound or complex. Iridium preferably is in the form of an iridium complex. As an iridium complex (compound), a six-coordination complex having 6 ligands and containing iridium as a central metal is preferable, for uniformly incorporating iridium in a silver halide crystal. As one preferable embodiment of iridium compound for use in the present invention, preferably in the fourth embodiment, a six-coordination complex having Cl, Br or I as a ligand and containing iridium as a central metal is preferable. A more preferable example is a six-coordination complex in which all six ligands are Cl, Br, or I and which has iridium as a central metal. In this case, Cl, Br and I may coexist in the six-coordination complex. It is especially preferable that a six-coordination complex having Cl, Br or I as a ligand and containing iridium as a central metal is contained in a silver bromide-containing phase, in order to obtain a hard gradation in a high illumination intensity exposure.

Specific examples of the six-coordination complex in which all of 6 ligands are Cl, Br or I and iridium is a central metal are shown below, but the iridium compound for use in the present invention is not limited thereto.

$[IrCl_6]^{2-}$
$[IrCl_6]^{3-}$
$[IrBr_6]^{2-}$
$[(IrBr_6]^{3-}$
$[IrI_6]^{3-}$

As another preferable embodiment of the iridium (compound) that can be used in the present invention, preferably in the fourth embodiment, a six-coordination complex having at least one ligand other than a halogen or a cyan and containing iridium as a central metal, is preferable. A six-coordination complex having $H_2O$, OH, O, OCN, thiazole, a substituted thiazole, thiadiazole, or a substituted thiadiazole as a ligand and containing iridium as a central metal is preferable. A six-coordination complex in which at least one ligand is $H_2O$, OH, O, OCN, thiazole, or a substituted thiazole and the remaining ligands are Cl, Br or I, and iridium is a central metal, is more preferable. A six-coordination complex in which one or two ligands are 5-methylthiazole, 2-chloro-5-fluorothiadiazole or 2-bromo-5-fluorothiadiazole, and the remaining ligands are Cl, Br or I, and iridium is a central metal, is most preferable.

Specific examples of the six-coordination complex in which at least one ligand is $H_2O$, OH, O, OCN, thiazole or a substituted thiazole and the remaining ligands are Cl, Br or I, and iridium is a central metal, are listed below.

However, the iridium compound for use in the present invention is not limited thereto.

$[Ir(H_2O)Cl_5)]^{2-}$
$[Ir(OH)Br_5]^{3-}$
$[Ir(OCN)Cl_5]^{3-}$
$[Ir(thiazole)Cl_5]^{3-}$
$[Ir(5\text{-methylthiazole})Cl_5]^{2-}$
$[Ir(2\text{-chloro-5-fluorothiadiazole})Cl_5]^{2-}$
$[Ir(2\text{-bromo-5-fluorothiadiazole})Cl_5]^{2-}$ The silver halide emulsion used in the present invention, preferably in the fourth embodiment, preferably contains, besides the above-mentioned iridium complex, a hexacoordination complex containing Fe, Ru, Re or Os as a central metal and containing a CN ligand, such as $[Fe(CN)_6]4$, $[Fe(CN)_6]$, $[Ru(CN)_6]$, $[Re(CN)_6]^{4-}$, and $[Os(CN)_6]^{4-}$. It is preferred that the silver halide emulsion used in the present invention, preferably in the fourth embodiment, further contains a pentachloronitrosyl complex or a pentachlorothionitrosyl complex having Ru, Re or Os as a central metal, or a hexacoordination complex having Cl, Br or I as a ligand and Rh as a central metal. These ligands may be partially aquated.

The above-mentioned metal complexes are anions, and when they form salts with cations, the counter cations are preferably those that are readily soluble in water. Specifically, alkali metal ions, such as sodium ion, potassium ion, rubidium ion, cesium ion, and lithium ion; ammonium ion, and alkylammonium ions are preferred. These metal complexes can be used by dissolving them in water, or in a mixed solvent composed of water and an arbitrary organic solvent miscible with water (for example, alcohols, ethers, glycols, ketones, esters, amides, etc.). These metal complexes are added during formation of silver halide grains in an amount of preferably $1\times10^{-10}$ to $1\times10^{-3}$ mole, more preferably $1\times10^{-9}$ to $1\times10^{-5}$ mole, per mole of silver, although the optimum amount may vary depending on the kind thereof.

The above-mentioned metal complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Also, it is preferred that these metal complexes are incorporated into silver halide grains by physically aging fine grains in which the metal complex has been preliminarily incorporated and then incorporating such fine grains. Further, these methods may be combined to have the metal complex contained in the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having the complexes incorporated therein to modify the grain surface phase. Further, these methods may be used in combination. Two or more kinds of the complexes may be incorporated in the inside of an individual silver halide grain. The composition of halogen at the position where the above-mentioned complex is contained is not particularly limited. It is preferred that the hexacoordination complex in which all the six ligands are any of Cl, Br or I and Ir is a central metal be contained at the maximum portion on silver bromide concentration.

In the present invention, preferably in the fourth embodiment, the above-mentioned gold sensitization together with chalcogen sensitization can be performed using the same molecule, and for this purpose a molecule that can release $AuCh^-$ can be used. Here, Au represents Au(I) and Ch represents a sulfur atom, a selenium atom, or a tellurium atom. Examples of the molecule that can release $AuCh^-$ include a gold compound represented by AuCh-L. Here, L represents a group of atoms that binds to AuCh to constitute the molecule. Further, in addition to Ch-L, one or more ligands may be coordinated to Au. Specific examples of such a compound include Au(I) salts of thio-sugars (e.g. gold thioglucoses such as gold thioglucose; gold peracetylthioglucose, gold thiomannose, gold thiogalactose, gold thioarabinose), Au(I) salts of seleno-sugars (e.g. gold peracetylselenoglucose, gold peracetylselenomannose), Au(I) salts of telluro-sugars, and the like. Here, thio-sugars, seleno-sugars, and telluro-sugars refer to compounds derived from sugars in which the hydroxyl group at the anomer position of the sugar is replaced by an SH group, an SeH group or a TeH group, respectively. The addition amount of these compounds may vary widely depending on the case, and generally it is $5\times10^{-7}$ to $5\times10^{-3}$ mole, preferably $3\times10^{-6}$ to $3\times10^{-4}$ mole, per mole of silver halide.

To the silver halide emulsion for use in the present invention, preferably in the fourth embodiment, the above-mentioned gold sensitization may be used in combination with another sensitizing method, for example, sulfur sensitization, selenium sensitization, tellurium sensitization, reduction sensitization, or noble metal sensitization using a noble metal compound other than gold compounds. The gold sensitization is particularly preferably carried out in combination with sulfur sensitization and/or selenium sensitization.

In the present invention, preferably in the fourth embodiment; the dye-forming coupler (herein, also referred to as "coupler") is generally added to a photographically useful substance or a high-boiling organic solvent, emulsified and dispersed together with the substance or solvent, and incorporated into a photosensitive material as a resulting dispersion. This solution (dispersion) is emulsified and dispersed in fine grain form, into a hydrophilic colloid, preferably into an aqueous gelatin solution, together with a dispersant which is, for example, a surfactant, by use of a known apparatus such as an ultrasonic device, a colloid mill, a homogenizer, a Manton-Gaulin, or a high-speed dissolver, to obtain a dispersion.

The high-boiling organic solvent that can be used in the present invention, preferably in the fourth embodiment, is not particularly limited, and an ordinary one may be used. Examples of which include those described in U.S. Pat. No. 2,322,027 and JP-A-7-152129.

Further, when dissolving the coupler, an auxiliary solvent may be used together with the high-boiling point organic solvent. Examples of the auxiliary solvent include acetates of a lower alcohol, such as ethyl acetate and butyl acetate; ethyl propionate, secondary butyl acetate, methyl ethyl ketone, methyl isobutyl ketone, β-ethoxyethyl acetate, methyl cellosolve acetate, methyl carbitol acetate, and cyclohexanone.

Further, if necessary, an organic solvent that completely admix with water, such as methyl alcohol, ethyl alcohol, acetone, tetrahydrofuran, and dimethylformamide, can be additionally used as a part of the auxiliary solvent. These organic solvents can be used in combination with two or more.

For the purpose of, for example, improving stability with the lapse of time at storage in the state of an emulsified dispersion, and improving stability with the lapse of time and inhibiting the fluctuation of photographic property of the end-composition for coating (applying) that is mixed with an emulsion, if necessary, from the thus-prepared emulsified dispersion, the auxiliary solvent may be removed in its entirety or part of it, for example, by distillation under reduced pressure, noodle washing, or ultrafiltration.

Preferably, the average particle size of the lipophilic fine-particle dispersion obtained in this way is 0.04 to 0.50 μm, more preferably 0.05 to 0.30 μm, and most preferably 0.08 to 0.20 μm. The average particle size can be measured by using Coulter Submicron Particle Analyzer Model N4 (trade name, manufactured by Coulter Electronics Co.) or the like.

In the oil-in-water droplet dispersing method using a high-boiling organic solvent, the ratio of the mass of the high-boiling organic solvent to the total mass of the cyan coupler used may be set arbitrarily, and it is preferably 0.1 or more and 10.0 or less, more preferably 0.3 or more and 7.0 or less, and most preferably 0.5 or more and 5.0 or less. Also, the method may be performed without using any high-boiling organic solvent.

Also, a pigment for coloration may be co-emulsified into the emulsion used in the present invention, preferably in the fourth embodiment, in order to adjust coloration of the white background, or it may coexist in an organic solvent that dissolves the photographically useful compound, such as the coupler, used in the photosensitive material of the present invention, preferably of the fourth embodiment, to be co-emulsified, thereby preparing an emulsion.

In the present invention, preferably in the fourth embodiment, the cyan coupler that can be preferably used, may be any coupler that forms a cyan dye. Examples thereof include phenol-series cyan couplers, naphthol-series cyan couplers, and heterocyclic couplers. Among these, pyrroloazole couplers are preferred in the present invention, preferably in the fourth embodiment, more preferably those cyan couplers represented by formula (PTA-I) or formula (PTA-II) shown below.

formula (PTA-I)

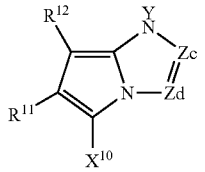

formula (PTA-II)

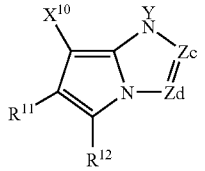

In the above formulae, Zc and Zd each represent —C($R^{13}$)═ or —N═, and when one of Zc and Zd represents —C($R^{13}$)═ the other represents —N═. $R^{11}$ and $R^{12}$ each independently represent an electron-withdrawing group having a Hammett substituent constant, σp, of 0.2 or more and the sum of the $\sigma_p$, values of $R^{11}$ and $R^{12}$ is 0.65 or more. $R^{13}$ represents a hydrogen atom or a substituent. $X^{10}$ represents a hydrogen atom or a group capable of being split-off upon a coupling reaction with an oxidized product of an aromatic primary amine color-developing agent. Y represents a hydrogen atom or a group that splits off during the color development process. The group of $R^{11}$, $R^{12}$, $R^{13}$ or $X^{10}$ may be a divalent group and form a homopolymer or a copolymer by binding to a dimer or a multimer or a polymer chain.

Among them, a cyan coupler that is more preferably used in view of rapid processing suitability, color reproducibility, storage stability of a photosensitive material in an unexposed state is a cyan coupler represented by formula (PTA-III) shown below.

formula (PTA-III)

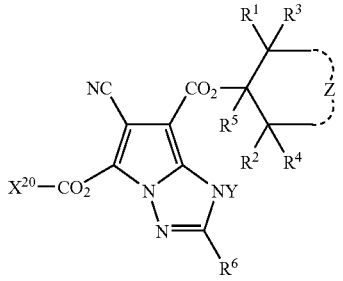

In formula (PTA-III), $R^1$ and $R^2$ each independently represent an alkyl group or an aryl group, $R^3$, $R^4$, and $R^5$ each independently represent a hydrogen atom, an alkyl group or an aryl group, Z represents a group of non-metal atoms necessary to form a saturated ring, $R^6$ represents a substituent, $X^{20}$ represents a heterocyclic group, a substituted amino group or an aryl group, and Y represents a hydrogen atom or a group that splits off during the color development process.

In formula (PTA-III), the alkyl group represented by $R^1$ to $R^5$ is a straight-chain, branched, or cyclic alkyl group having 1 to 36 carbon atoms, preferably a straight-chain, branched, or cyclic alkyl group having 1 to 22 carbon atoms, and especially preferably a straight-chain, or branched alkyl group having 1 to 8 carbon atoms. Specific examples thereof include methyl, ethyl, n-propyl, isopropyl, t-butyl, t-amyl, t-octyl, decyl, dodecyl, cetyl, stearyl, cyclohexyl, and 2-ethylhexyl.

In formula (PTA-III), the aryl group represented by $R^1$ to $R^5$ is an aryl group having 6 to 20 carbon atoms, preferably an aryl group having 6 to 14 carbon atoms, and especially preferably an aryl group having 6 to 10 carbon atoms. Specific examples thereof include phenyl, 1-naphthyl, 2-naphthyl, and 2-phenanthryl.

In formula (PTA-III), the group of non-metallic atoms necessary to from a saturated ring, represented by Z, is a group of non-metallic atoms necessary to form a 5- to 8-membered ring which may have a substituent, and which may be a saturated ring or an unsaturated ring. The ring-forming non-metallic atom may be a carbon atom, an oxygen atom, a nitrogen atom, or a sulfur atom. The ring is preferably a 6-membered saturated carbon ring, and especially preferably a cyclohexane ring which is substituted with an alkyl group having 1 to 24 carbon atoms at the 4-position thereof.

In formula (PTA-III), examples of the substituent represented by $R^6$ include, for example, a halogen atom (e.g., a fluorine atom, a chlorine atom, and a bromine atom), an aliphatic group (e.g., a straight-chain or branched-chain alkyl group, an aralkyl group, an alkenyl group, an alkynyl group, a cycloalkyl group, and a cycloalkenyl group, each having 1 to 36 carbon atoms, and specifically, for example, methyl, ethyl, propyl, isopropyl, t-butyl, tridecyl, t-amyl, t-octyl, 2-methanesulfonylethyl, 3-(3-pentadecylphenoxy)propyl, 3-{4-{2-[4-(4-hydroxyphenylsulfonyl)phenoxy]dodecaneamido}-phenyl}propyl, 2-ethoxytridecyl, trifluoromethyl, cyclopentyl, and 3-(2,4-di-t-amylphenoxy)propyl), an aryl group (e.g., an aryl group having 6 to 36 carbon atoms, for example, phenyl, 4-t-butylphenyl, 2,4-di-t-amylphenyl, 4-tetradecaneamidophenyl, 2-methoxyphenyl), a heterocyclic group (e.g., a heterocyclic group having 1 to 36 carbon atoms, for example, 2-furyl, 2-thienyl, 2-pyrimidinyl, and 2-benzothiazolyl), a cyano group, a hydroxyl group, a nitro group, a carboxy group, an amino group, an alkoxy group (e.g., a straight-chain, branched-chain or cyclic alkoxy group having 1 to 36 carbon atoms, for example, methoxy, ethoxy, butoxy, 2-methoxyethoxy, 2-dodecyloxyethoxy, and 2-methanesulfonylethoxy), an aryloxy group (e.g., an aryloxy group having 6 to 36 carbon atoms, for example, phenoxy, 2-methylphenoxy, 4-t-butylphenoxy, 3-nitrophenoxy, 3-t-butyloxycarbamoylphenoxy, and 3-methoxycarbamoyl), an acylamino group (e.g., an acylamino group having 2 to 36 carbon atoms, for example, acetamido, benzamido, tetradecaneamido, 2-(2,4-di-t-amylphenoxy)butaneamido, 4-(3-t-butyl-4-hydroxyphenoxy)butaneamido, and 2-{4-(4-hydroxyphenylsulfonyl)phenoxy}decaneamido), an alkylamino group (e.g., an alkylamino group having 1 to 36 carbon atoms, for example, methylamino, butylamino, dodecylamino, diethylamino, and methylbutylamino), an anilino group (e.g., an anilino group having 6 to 36 carbon atoms, for example, phenylamino, 2-chloroanilino, 2-chloro-5-tetradecaneaminoanilino, 2-chloro-5-dodecyloxycarbonylanilino, N-acetylanilino, and 2-chloro-5-{2-(3-t-butyl-4-hydroxyphenoxy)dodecaneamido}anilino), a ureido group (e.g., a ureido group having 2 to 36 carbon atoms, for example, phenylureido, methylureido, and N,N-dibutylureido), a sulfamoylamino group (e.g., a sulfamoylamino group having 1 to 36 carbon atoms, for example, N,N-dipropylsulfamoylamino and N-methyl-N-decylsulfamoylamino), an alkylthio group (e.g., an alkylthio group having 1 to 36 carbon atoms, for example, methylthio, octylthio, tetradecylthio, 2-phenoxyethylthio, 3-phenoxypropylthio, and 3-(4-t-butylphenoxy)propylthio), an arylthio group (e.g., an aylthio group having 6 to 36 carbon atoms, for example, phenylthio, 2-butoxy-5-t-octylphenylthio, 3-pentadecylphenylthio, 2-carboxyphenylthio, and 4-tetradecaneamidophenylthio), an alkoxycarbonylamino group (e.g., an alkoxycarbonylamino group having 2 to 36 carbon atoms, for example, methoxycarbonylamino and tetradecyloxycarbonylamino), a sulfonamido group (e.g., an alkyl- or aryl-sulfonamido group having 1 to 36 carbon atoms, for example, methanesulfonamido, butanesulfonamido, octanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., a carbamoyl group having 1 to 36 carbon atoms, for example, N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), a sulfamoyl group (e.g., a sulfamoyl group having 1 to 36 carbon atoms, for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., an alkyl- or aryl-sulfonyl group having 1 to 36 carbon atoms, for example, methanesulfonyl, octanesulfonyl, benzenesulfonyl, and toluenesulfonyl), an alkoxycarbonyl group (e.g., an alkoxycarbonyl group having 2 to 36 carbon atoms, for example, methoxycarbonyl, butyloxycarbonyl, dodecyloxycarbonyl, and octadecyloxycarbonyl), a heterocyclic oxy group (e.g., a heterocyclic oxy group having 1 to 36 carbon atoms, for example, 1-phenyltetrazole-5-oxy and 2-tetrahydropyranyloxy), an azo group (e.g., phenylazo, 4-methoxyphenylazo, 4-pivaroylaminophenylazo, and 2-hydroxy-4-propanoylphenylazo), an acyloxy group (e.g., an acyloxy group having 2 to 36 carbon atoms, for example, acetoxy), a carbamoyloxy group (e.g., a carbamoyloxy group having 1 to 36 carbon atoms, for example, N-methylcarbamoyloxy and N-phenylcarbamoyloxy), a silyloxy group (e.g., silyloxy group having 3 to 36 carbon atoms, for example, trimethylsilyloxy and dibutylmethylsilyloxy), an aryloxycarbonylamino group (e.g., an aryloxycarbonyl amino group having 7 to 36 carbon atoms, for example, phenoxycarbonylamino), an imido group (e.g., an imido group having 4 to 36 carbon atoms, for example, N-succinimido, N-phthalimido, and 3-octadecenylsuccinimido), a heterocyclic thio group (e.g., a heterocyclic thio group having 1 to 36 carbon atoms, for example, 2-benzothiazolylthio, 2,4-di-phenoxy-1,3,5-tirazole-6-thio, and 2-pyridylthio), a sulfinyl group (e.g., a sulfinyl group having 1 to 36 carbon atoms, for example, dodecanesulfinyl, 3-pentadecylphenylsulfinyl, and 3-phenoxypropylsulfinyl), an alkyl-, aryl-, or heterocyclic-oxy carbonyl group (e.g., methoxycarbonyl, butoxycarbonyl, dodecyloxycarbonyl, octadecyloxycarbonyl, phenyloxycarbonyl, and 2-pentadecyloxycarbonyl), an alkyl-, aryl- or heterocyclic-oxy carbonylamino group (e.g., methoxycarbonylamino, tetradecyloxycarbonylamino, phenoxycarbonylamino, and 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, and 2-methoxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy) propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a phosphonyl group (e.g., phenoxyphosphonyl, octyloxyphosphonyl, and phenylphosphonyl), a sulfamido group (e.g. dipropylsulfamoylamino), an imido group (e.g., N-succinimido, hydantoinyl, N-phthalimido, and 3-octadecenylsuccinimido), an azolyl group (e.g., imidazolyl, pyrazolyl, 3-chloro-pyrazol-1-yl, and triazolyl), a hydroxyl group, a cyano group, a carboxyl group, a nitro group, a sulfo group, an unsubstituted amino group.

As $R^6$, preferably can be mentioned an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclic oxy group, an acyloxy group, a carbamoyloxy group, an aryloxycarbonylamino group, an imido group, a heterocyclic thio group, a sulfinyl group, a phosphonyl group, an acyl group, and an azolyl group.

Further preferably an alkyl group or an aryl group, and more preferably an aryl group whose at least p-position is substituted by an alkyl group, are mentioned.

$X^{20}$ represents a heterocyclic ring, a substituted amino group, or an aryl group. As the heterocyclic ring, a 5- to 8-membered ring having a nitrogen atom(s), an oxygen atom(s), and/or a sulfur atom(s) and 1 to 36 carbon atoms is preferable. A 5- or 6-membered ring bonded through a nitrogen atom is more preferable, with particular preference given to a 6-membered ring.

As specific examples, imidazole, pyrazole, triazole, lactam compounds, piperidine, pyrrolidine, pyrrole, morpholine, pyrazolidine, thiazolidine, pyrazoline, and the like can be mentioned, with preference given to morpholine and piperidine.

As the substituent of the substituted amino group, an aliphatic group, an aryl group, or a heterocyclic group can be mentioned. As the aliphatic group, the substituents represented by $R^6$ as mentioned above can be mentioned, which may further be substituted by a cyano group, an alkoxy group (e.g., methoxy), an alkoxycarbonyl group (e.g., ethoxycarbonyl), a chlorine atom, a hydroxyl group, a carboxyl group. As the substituted amino group, a di-substituted amino group is more preferred than a mono-substituted amino group. As the aryl group, one having 6 to 36 carbon atoms is preferable, and a single ring is more preferable. As specific examples, phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl, 2,4-dichlorophenyl, and the like can be mentioned.

Preferable examples of $X^{20}$ in the case where $X^{20}$ is a substituted amino group are shown below.

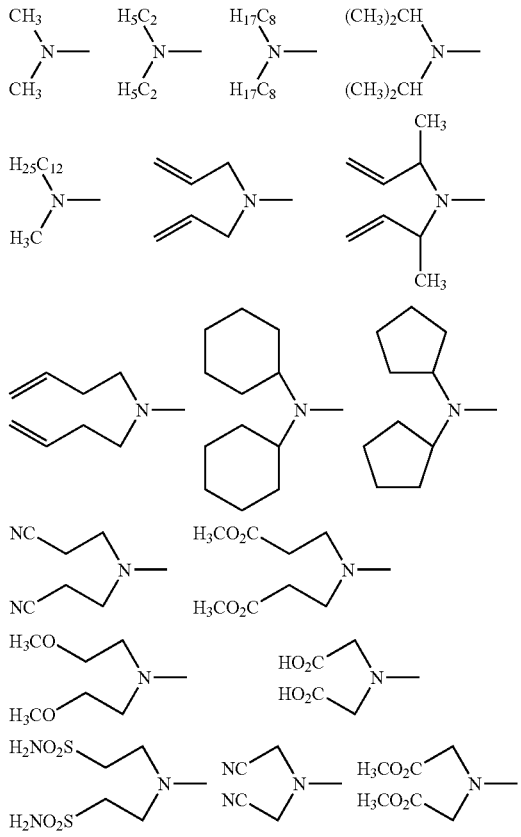

-continued

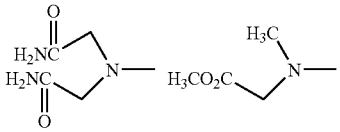

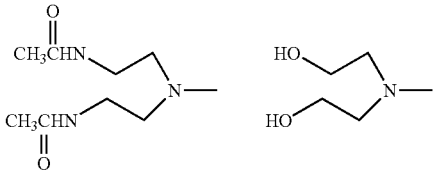

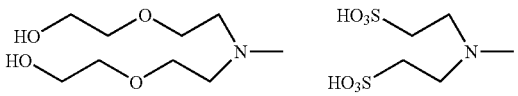

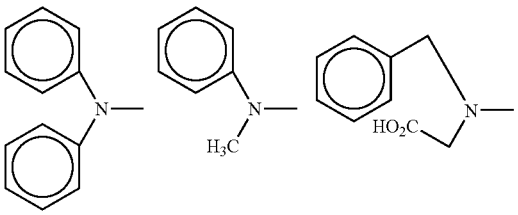

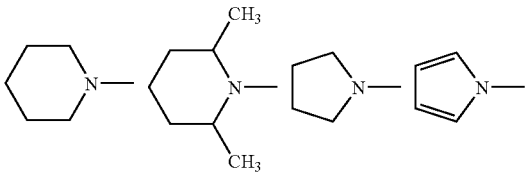

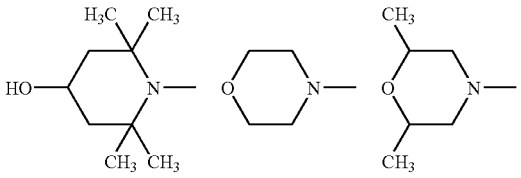

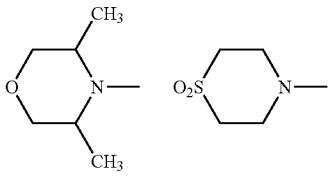

-continued

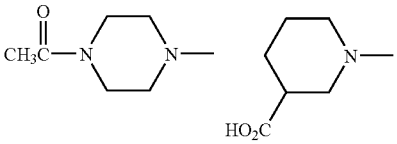

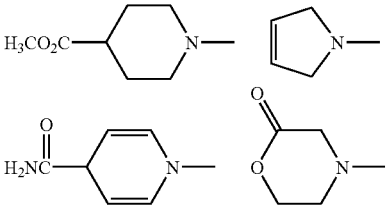

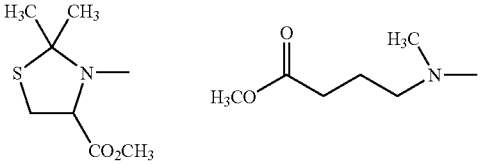

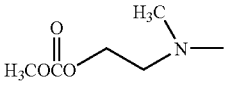

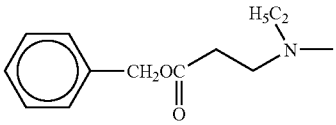

Y is a hydrogen atom, or a group capable of being split-off in a process of color development. Examples of the group represented by Y include a group which can be split-off under an alkaline condition, as described in, for example, JP-A-61-228444, or a group which can be split-off by a coupling reaction with a developing agent, as described in JP-A-56-133734. Y is preferably a hydrogen atom.

The coupler represented by formula (PTA-III) may be a dimer or more polymeric compound wherein $R^6$ contains a residual group formed from the coupler represented by formula (PTA-III), or may be a homopolymer or copolymer wherein $R^6$ contains a macromolecular chain. Typical examples of the homopolymer or copolymer containing a macromolecular chain are homo- or co-polymers of addition polymerization ethylene-type unsaturated compounds having a residual group formed from the coupler represented by formula (PTA-III). One or more kinds of the cyan dye-forming repeating unit having a residual group formed from the coupler represented by formula (PTA-III) may be contained in these polymers. Further, the copolymer may contain as a copolymer ingredient, one or more kinds of a repeating unit derived from a non-coloring ethylene-type monomer which does not couple with an oxidation product of an aromatic primary amine developing agent, such as acrylic acid esters, methacrylic acid esters, and maleic acid esters. The amount of the compound represented by formula (PTA-III) is preferably 0.01 to 1.0 mole, more preferably 0.12 to 1.0 mole, and particularly preferably 0.25 to 0.5 mole, per mole of the photosensitive silver halide in the same layer.

Specific examples of the cyan coupler for use in the present invention, preferably in the fourth embodiment, are shown below. However, the present invention is not limited to these compounds.

(1)
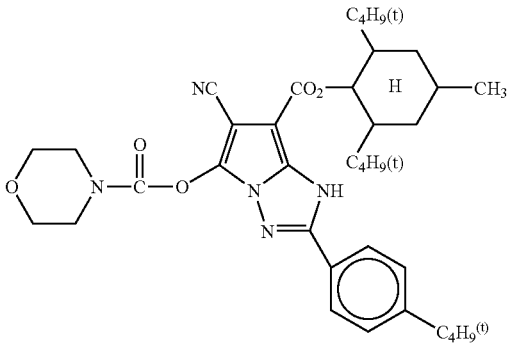
(2)
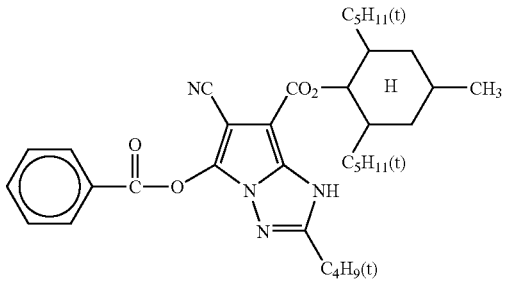
(3)
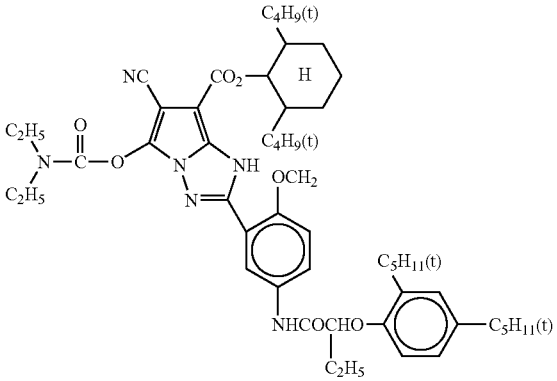
(4)
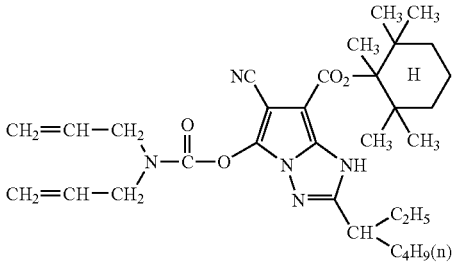
(5)
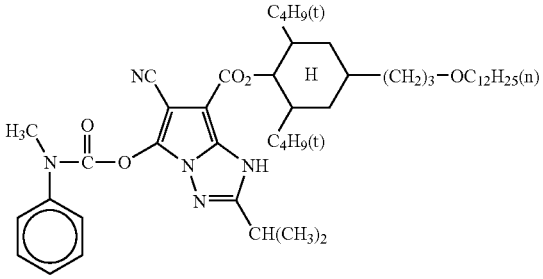
(6)
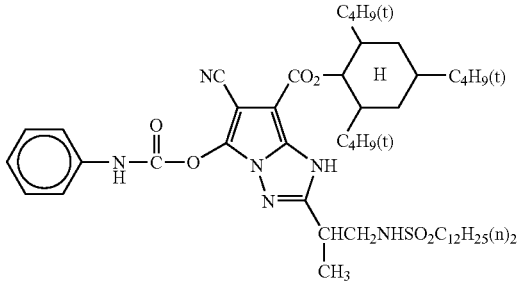
(7)
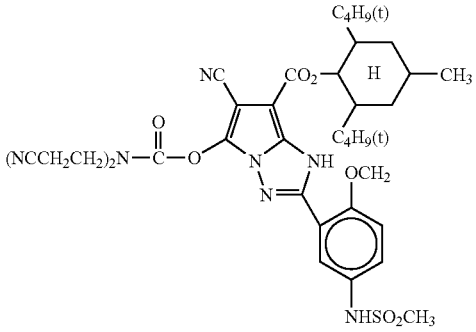
(8)
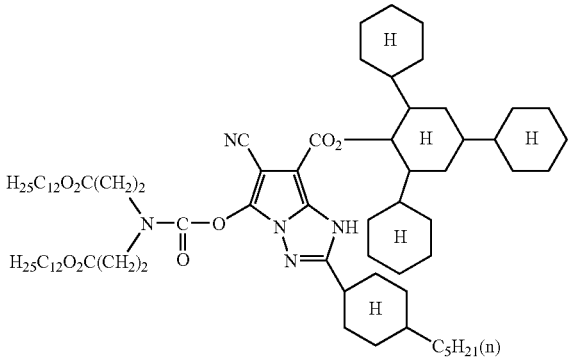

-continued
(9)
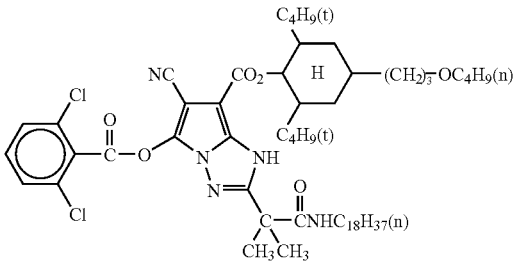
(10)
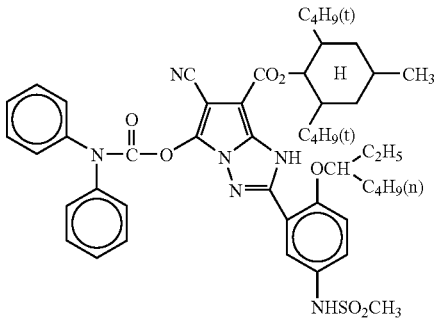
(11)
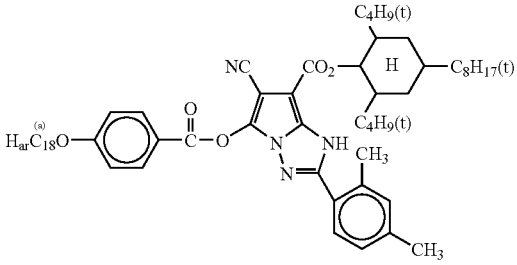
(12)
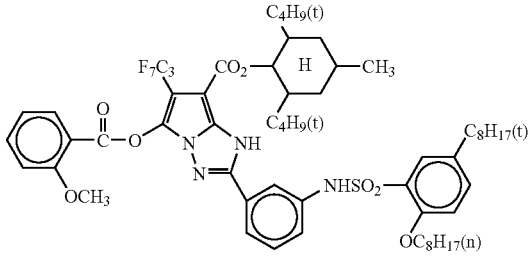
(13)
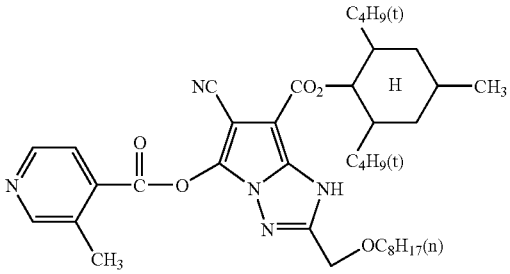
(14)
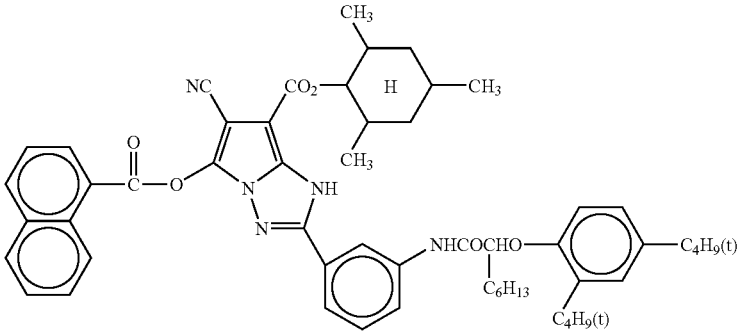
(15)
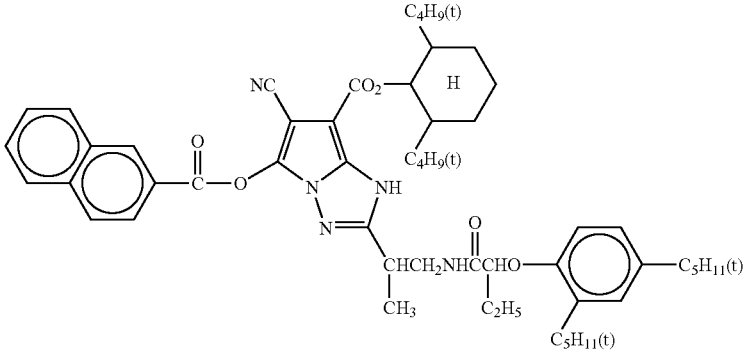

-continued
(16)
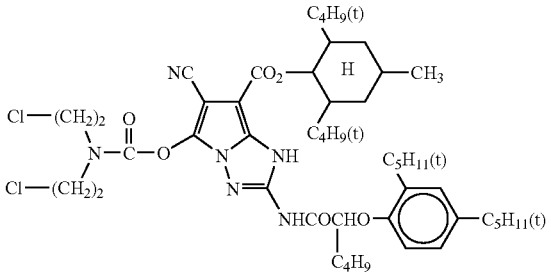
(17)
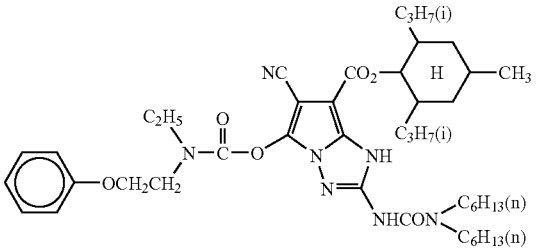
(18)
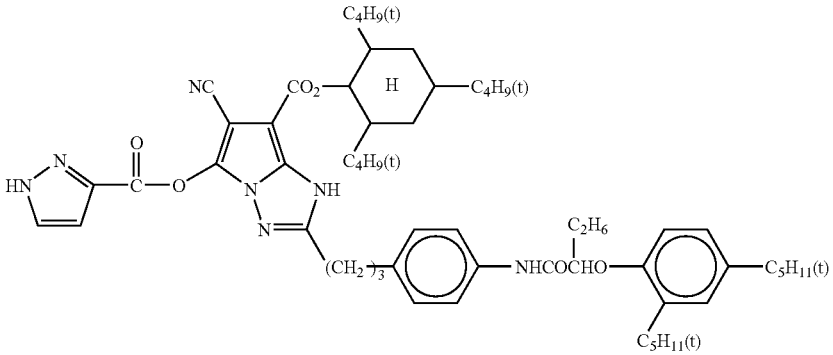
(19)
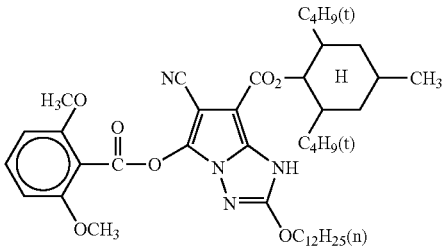
(20)
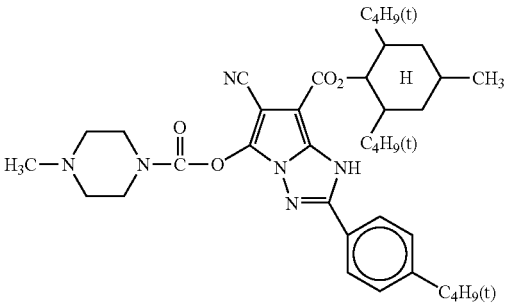
(21)
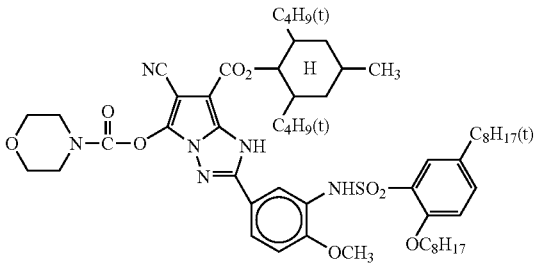
(22)
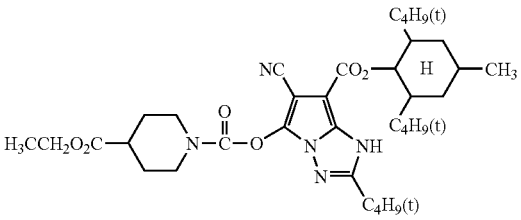

-continued
(23)
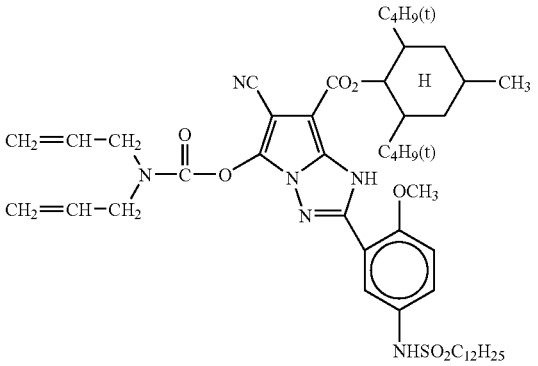
(24)
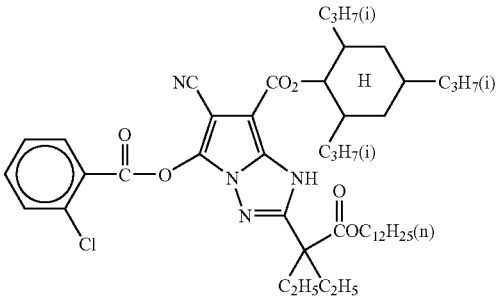
(25)
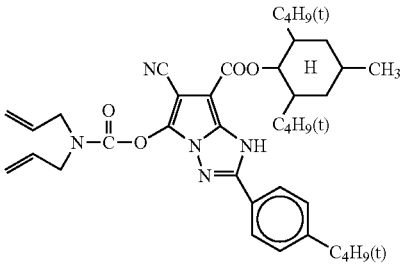
(26)
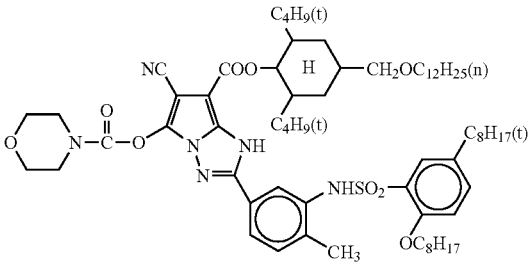
(27)
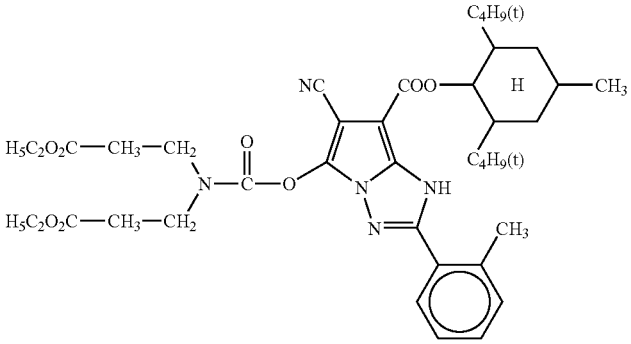
(28)
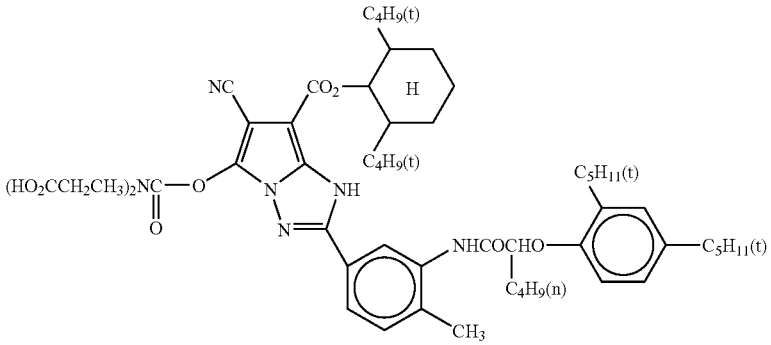

-continued
(29)
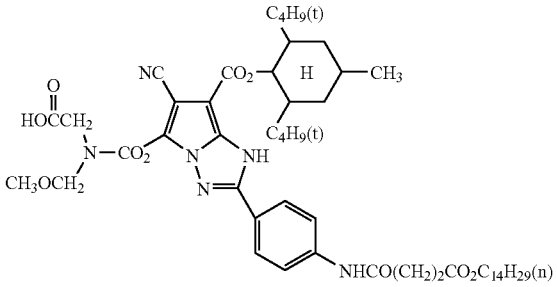
(30)
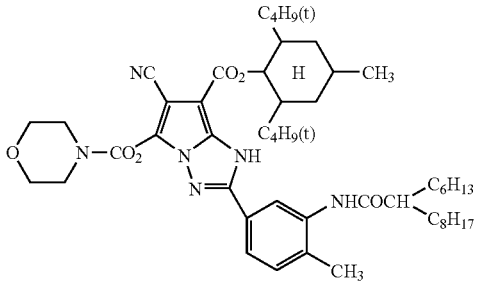
(31)
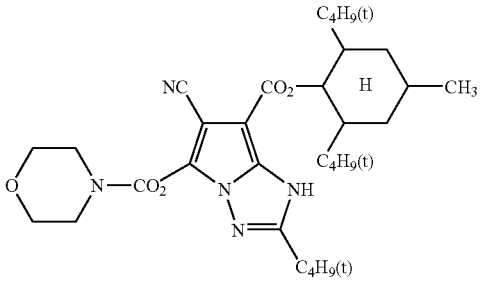
(32)
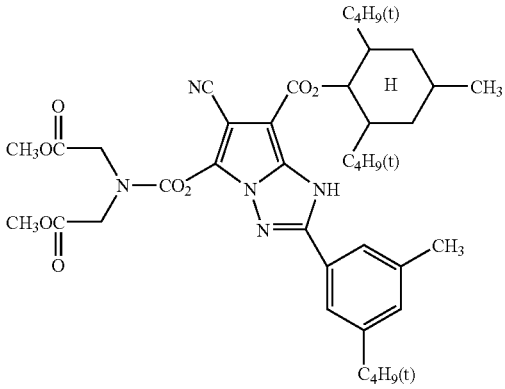
(33)
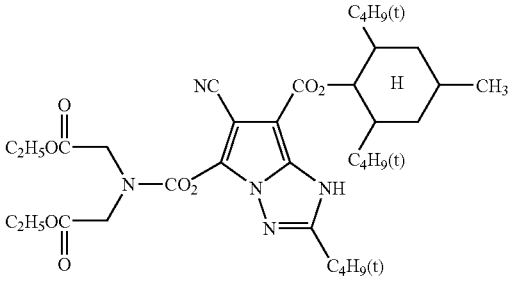
(34)
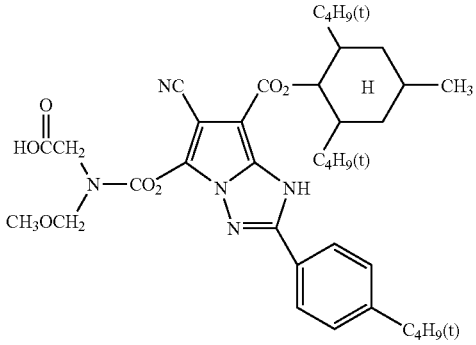
(35)
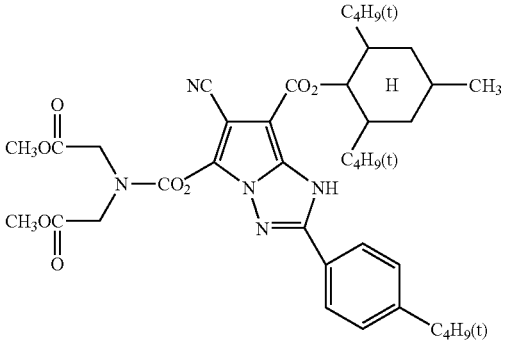
(36)
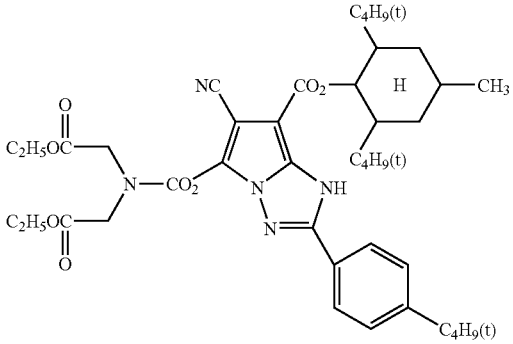

-continued (37)

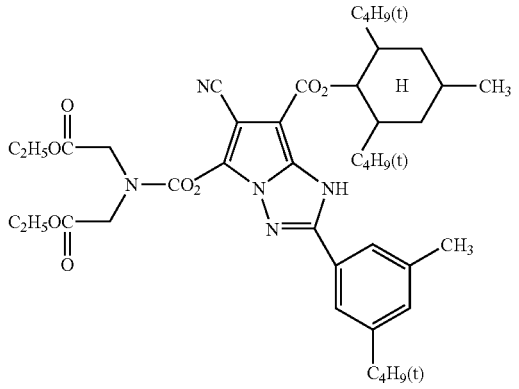

The compound represented by formula (PTA-III) for use in the present invention, preferably in the fourth embodiment, can be synthesized by the known method, for example, by methods described in JP-A-5-255333, JP-A-5-202004, JP-A-7-48376, and JP-A-8-110623.

Also, as the cyan coupler, a compound represented by formula (IA) shown below is preferably used.

formula (IA)

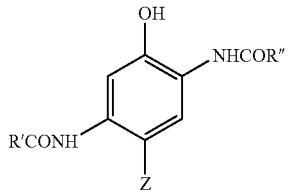

In the formula, R' and R" each independently represent a substituent, and Z represents a hydrogen atom, or a group capable of being split-off in a coupling reaction with an oxidized product of an aromatic primary amine color-developing agent.

Note that R' and R" are preferably those substituents that are selected to make the coupler have a preferable hue mentioned in this specification.

The term "alkyl" as used herein throughout the present specification, unless otherwise indicated specifically, refers to an unsaturated or saturated, straight-chain or branched-chain alkyl group (including alkenyl and aralkyl), including a cyclic alkyl group having 3 to 8 carbon atoms (including cycloalkenyl), and the term "aryl" specifically includes a condensed aryl.

With respect to formula (IA), R' and R" are preferably selected independently from an unsubstituted or substituted alkyl group, aryl group, amino group or alkoxy group, or 5- to 10-membered heterocycle containing at least one heteroatom selected from nitrogen, oxygen and sulfur (the ring being unsubstituted or substituted).

When R' and/or R" are an amino group or an alkoxy group, they may be substituted with, for example, a halogen atom, an aryloxy group, or an alkyl- or aryl-sulfonyl group. Preferably, R' and R" are independently selected from unsubstituted or substituted, alkyl or aryl groups, or five to ten-membered heterocyclic groups, such as a pyridyl group, a morpholino group, an imidazolyl group, and a pyridazolyl group.

R' is preferably an alkyl group substituted with, for example, a halogen atom, an alkyl group, an aryloxy group, or an alkyl- or aryl-sulfonyl group (which may be further substituted). When R" is an alkyl group, it may also be substituted in the same manner as described above.

However, R" is preferably an unsubstituted aryl group, or a heterocyclic group substituted with, for example, a cyano group, a chlorine atom, a fluorine atom, a bromine atom, an iodine atom, an alkyl- or aryl-carbonyl group, an alkyl- or aryl-oxycarbonyl group, an acyloxy group, a carbonamido group, an alkyl- or aryl-carbonamido group, an alkyl- or aryl-oxycarbonamido group, an alkyl- or aryl-sulfonyl group, an alkyl- or aryl-sulfonyloxy group, an alkyl- or aryl-oxysulfonyl group, an alkyl- or aryl-sulfoxide group, an alkyl- or aryl-sulfamoyl group, an alkyl- or aryl-sulfamoylamino group, an alkyl- or aryl-sulfonamido group, an aryl group, an alkyl group, an alkoxy group, an aryloxy group, a nitro group, an alkyl- or aryl-ureido group, or an alkyl- or aryl-carbamoyl group (each of which may by further substituted). Preferred substituent groups are a halogen atom, a cyano group, an alkoxycarbonyl group, an alkylsulfamoyl group, an alkylsulfonamido group, an alkylsulfonyl group, a carbamoyl group, an alkylcarbamoyl group, and an alkylcarbonamido group. When R' is an aryl group or a heterocyclic group, it may also be substituted in the same manner as described above.

Preferably, R" is a 4-chlorophenyl group, a 3,4-dichlorophenyl group, a 3,4-difluorophenyl group, a 4-cyanophenyl group, 3-chloro-4-cyano-phenyl group, a pentafluorophenyl group, or a 3- or 4-sulfonamido-phenyl group.

In formula (IA), Z represents a hydrogen atom or a group that can split off upon a coupling reaction with an oxidized product of an aromatic primary amine color-developing agent. Z is preferably a hydrogen atom, a chlorine atom, a fluorine atom, a substituted aryloxy or a mercaptotetrazole, more preferably a hydrogen atom or a chlorine atom.

Z determines the chemical equivalent of the coupler, that is, whether it is a two-equivalent coupler or a four-equivalent coupler, and the reactivity of the coupler can be changed depending on the kind of Z. Such a group can give advantageous effects on the layers on which the coupler is coated or other layers in a photographic recording material, by exhibiting a function, for example, of dye formation, dye hue adjustment, acceleration of development or inhibition of development, acceleration of bleaching or inhibition of bleaching, facilitation of electron mobilization, color correction, or the like, after it is released from the coupler.

Examples of representative class of such a coupling split-off group include halogen, alkoxy, aryloxy, heterocyclyloxy, sulfonyloxy, acyloxy, acyl, heterocyclyl, sulfonamido, heterocylylthio, benzothiazolyl, phosphonyloxy, alkylthio, arylthio, and arylazo groups. These coupling split-off groups are described, for example, in the following specifications: U.S. Pat. No. 2,455,169, U.S. Pat. No. 3,227,551, U.S. Pat. No. 3,432,521, U.S. Pat. No. 3,467,563, U.S. Pat. No. 3,617,291, U.S. Pat. No. 3,880,661, U.S. Pat. No. 4,052,212, and U.S. Pat. No. 4,134,766, as well as GB Patent No. 1,466,728, GB Patent No. 1,531,927, and GB Patent No. 1,533,039, and GB Patent application publication Nos. 2,066,755 and 2,017,704, the disclosure of which are incorporated herein by reference. Most preferred are a halogen atom, an alkoxy group, and an aryloxy group.

Preferable examples of the coupling split-off group are as follows: —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(O)(OC_2H_5)_2$, —$SCH_2CH_2COOH$,

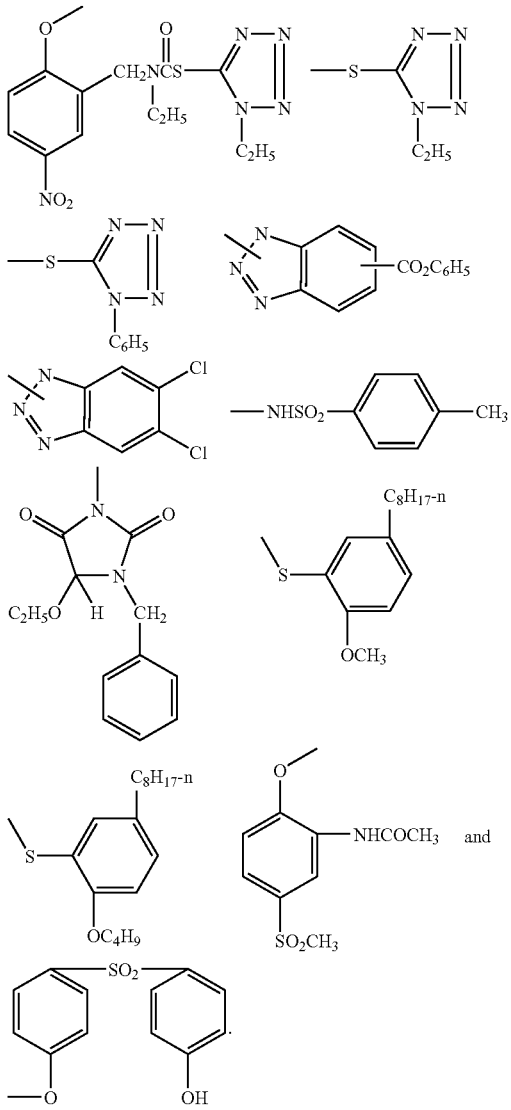

In general, the coupling split-off group is a chlorine atom, a hydrogen atom, or a p-methoxyphenoxy group.

Specific examples of the compound represented by formula (IA) are shown below. However, the present invention is not limited to these compounds.

IC-1

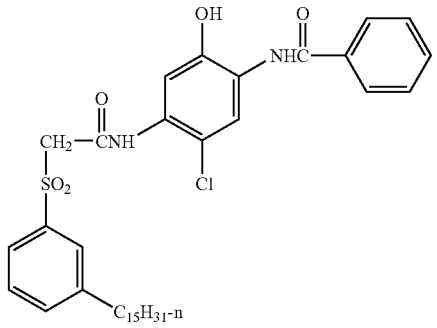

IC-2

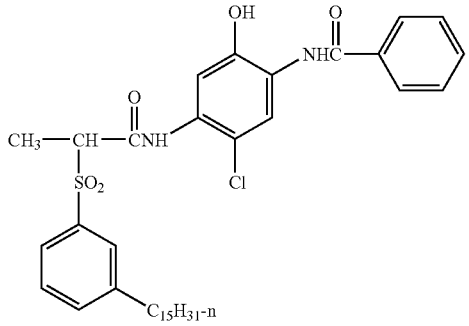

IC-3

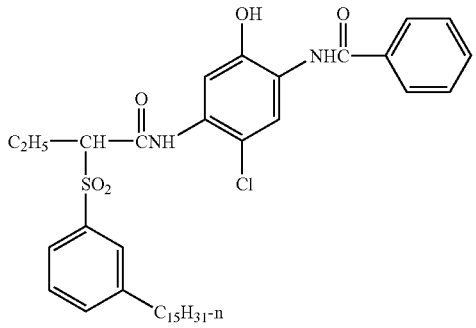

IC-4

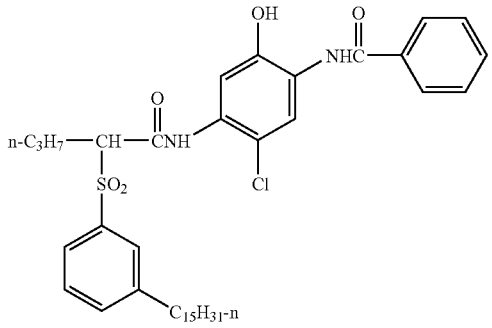

-continued
IC-5
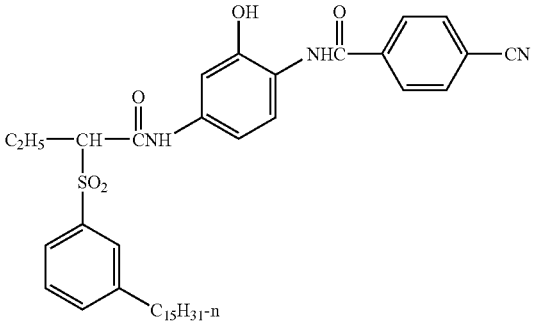
IC-6
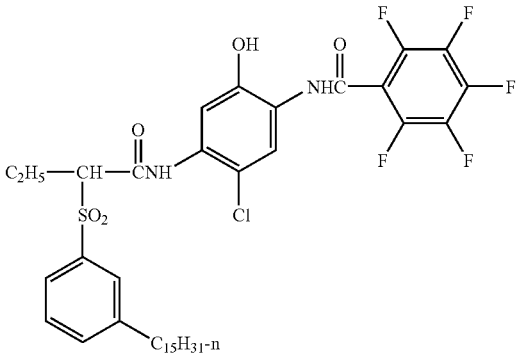
IC-7
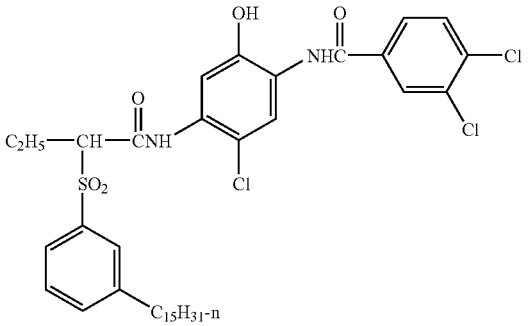
IC-8
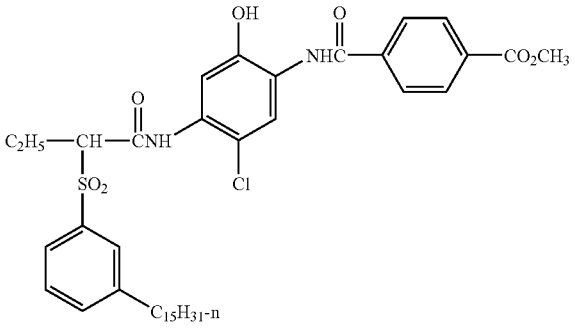
-continued
IC-9
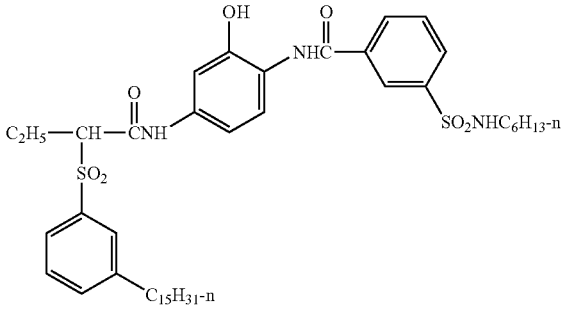
IC-10
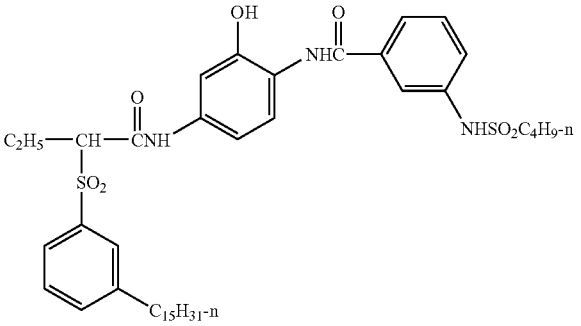
IC-11
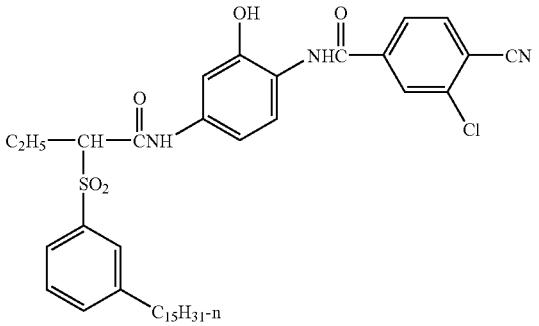
IC-12
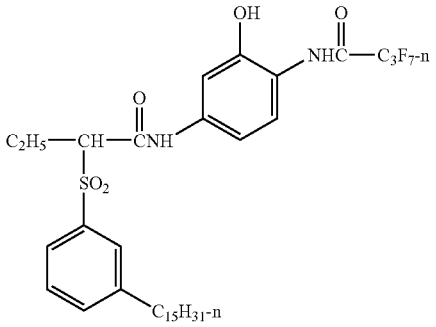

-continued
IC-13
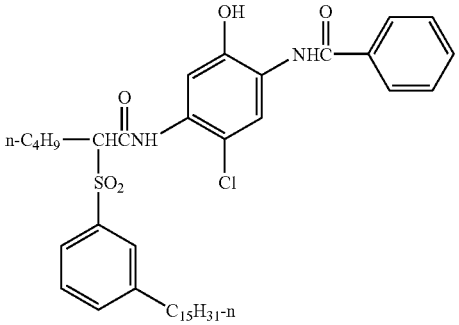
IC-14
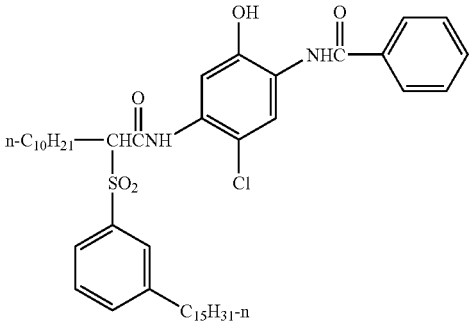
IC-15
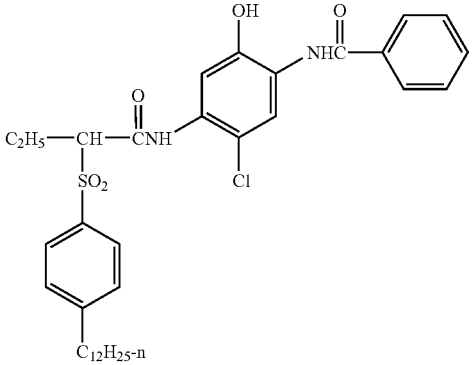
IC-16
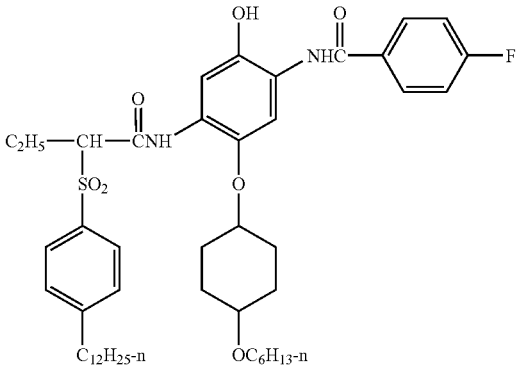
-continued
IC-17
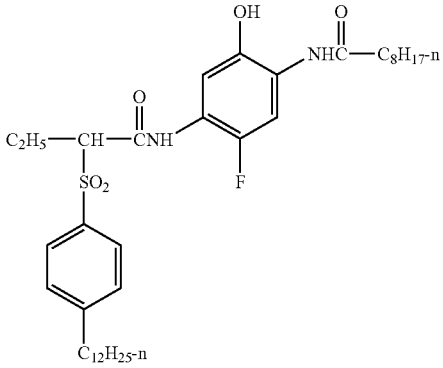
IC-18
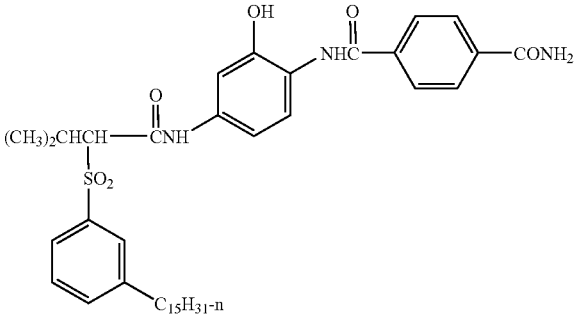
IC-19
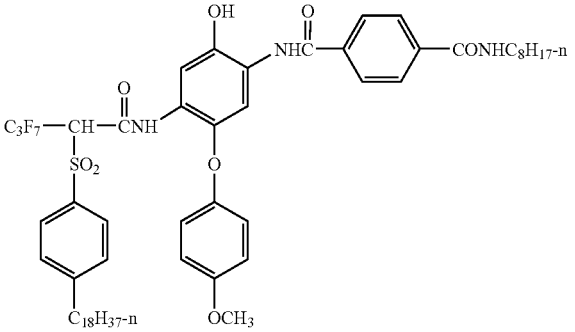
IC-20
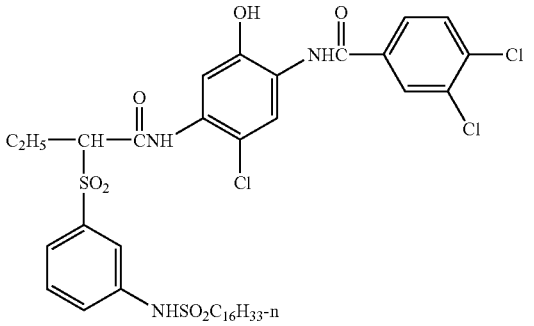

-continued
IC-21
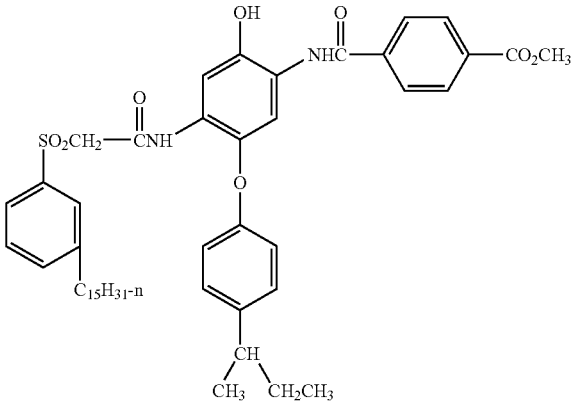
IC-22
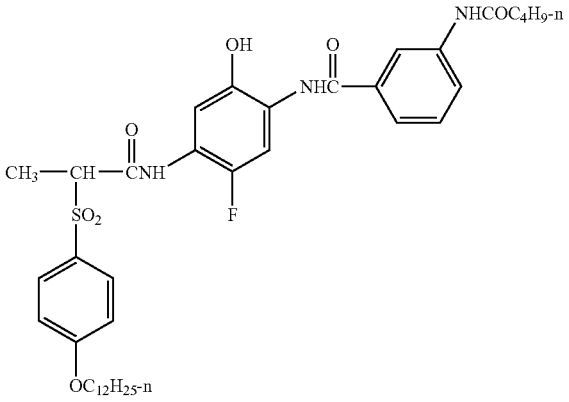
IC-23
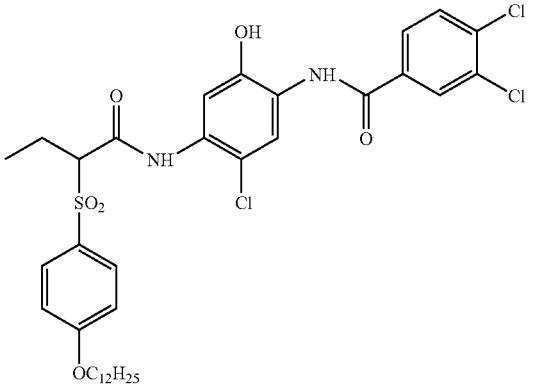
-continued
IC-24
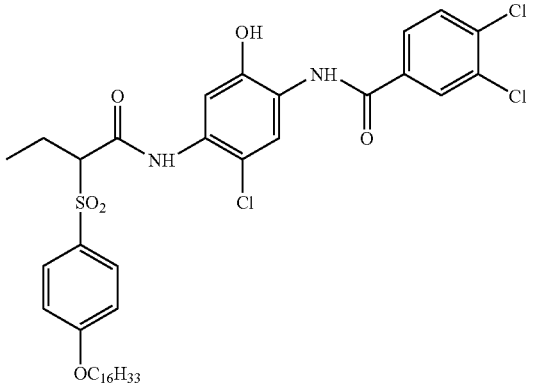
IC-25
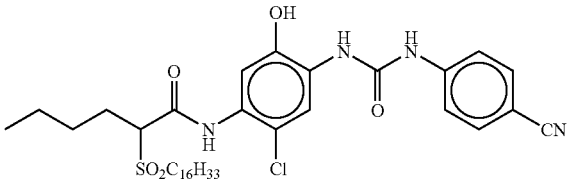
IC-26
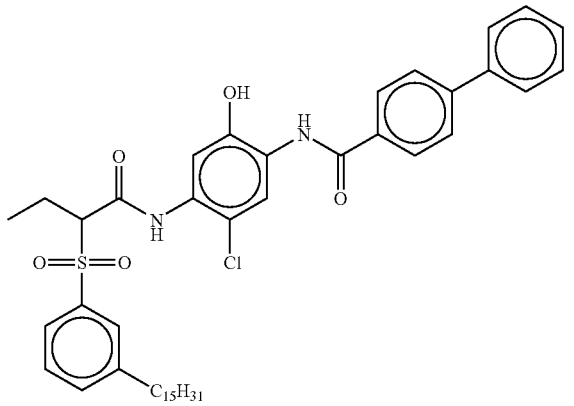
IC-27
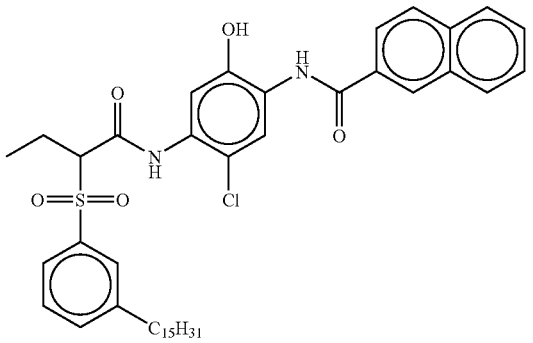

-continued

IC-28

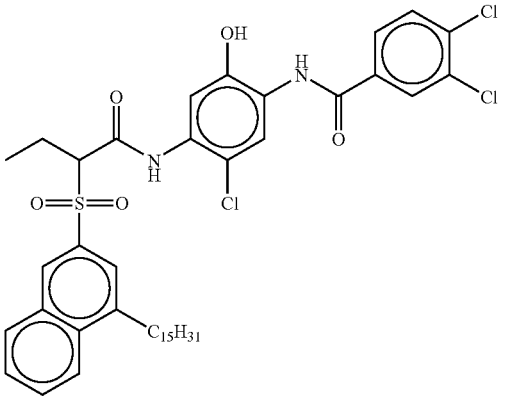

The content of the cyan dye-forming coupler represented by the formula (IA) that is preferably used in the present invention, preferably in the fourth embodiment, in the photosensitive material, is generally 0.01 g/m$^2$ to 10 g/m$^2$, preferably 0.1 g/m$^2$ to 2 g/m$^2$, and it is generally $1\times10^{-3}$ mole to 1 mole, preferably $2\times10^{-3}$ mole to $3\times10^{-1}$ mole, per mole of the silver halide in the same photosensitive emulsion layer.

In the present invention, preferably in the fourth embodiment, a surface-active agent may be added to the light-sensitive material, in view of improvement in coating-stability, prevention of static electricity from generation, and adjustment of charge amount. As the surface-active agent, there are anionic, cationic, betaine and nonionic surfactants. Examples thereof include those described in JP-A-5-333492. As the surface-active agent for use in the present invention, preferably in the fourth embodiment, a fluorine-containing surface-active agent is preferred. In particular, fluorine-containing surface-active agents as shown below can be preferably used. These fluorine-containing surface-active agents may be used singly, or may be used in combination with another known surfactant. Preferably, the fluorine-containing surfactant is used in combination with another known surfactant. The amount of these surface-active agents to be added to the light-sensitive material is not particularly limited, but it is generally in the range of $1\times10^{-5}$ to 1 g/m$^2$, preferably in the range of $1\times10^{-4}$ to $1\times10^{-1}$ g/m$^2$, more preferably in the range of $1\times10^{-3}$ to $1\times10^{-2}$ g/m$^2$.

In the present invention, preferably in the fourth embodiment, as a still more preferable example, a fluorine-containing surfactant of the formula (1) shown below may be mentioned.

formula (1)

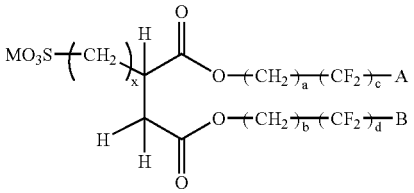

In the formula (1), A and B each independently represent a fluorine atom or a hydrogen atom. a and b each independently are an integer of 1 to 6. c and d each independently are an integer of 4 to 8. x is 0 or 1. M represents a cation.

It is preferred that both A and B are fluorine atoms or hydrogen atoms, and that more preferably both A and B are fluorine atoms.

a and b are preferably an integer of 1 to 6 with a=b, more preferably 2 or 3 with a=b, and further more preferably a=b=2.

c and d are preferably an integer of 4 to 6 with c=d, more preferably 4 or 6 with c=d, and further more preferably c=d=4.

x is 0 or 1 and both cases are equally preferable.

As the cation represented by M, an alkali metal ion (for example, lithium ion, sodium ion, potassium ion, etc.), an alkaline earth metal ion (for example, barium ion, calcium ion, etc.), an ammonium ion, etc. are preferably used. Among those, particularly preferred are lithium ion, sodium ion, potassium ion, and ammonium ion.

The compound represented by the formula (1) is more preferably a compound represented by the formula (1-a) shown below.

formula (1-a)

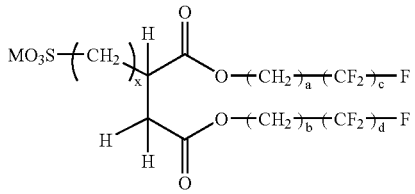

In the formula (1-a), a, b, c, d, M, and x each have the same meanings as those in the formula (1) and the same is true for the preferred ranges.

The compound represented by the formula (1) is further more preferably a compound represented by the formula (1-b) shown below.

formula (1-b)

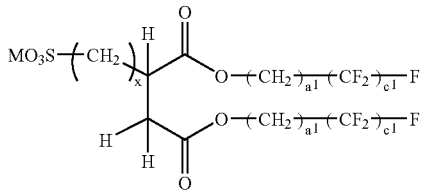

In the formula (1-b), $a^1$ is an integer of 2 or 3. $c^1$ is an integer of 4 to 6. M represents a cation.

$a^1$ is preferably 2, and $c^1$ is preferably 4.

x is 0 or 1, and both cases are equally preferred.

Hereinafter, specific examples of the compound (surfactant) represented by formula (1) are shown below. However, the compound for use in the present invention is not limited thereto.

FS-1
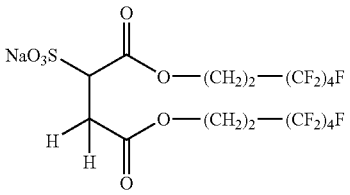
FS-2
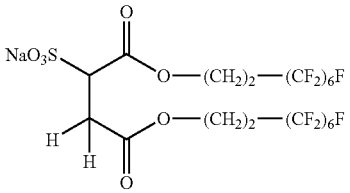
FS-3
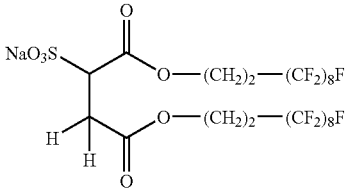
FS-4
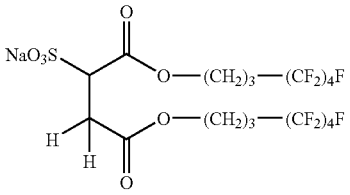
FS-5
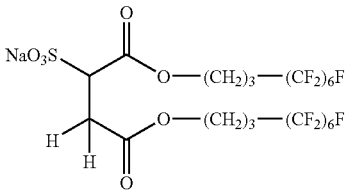
FS-6
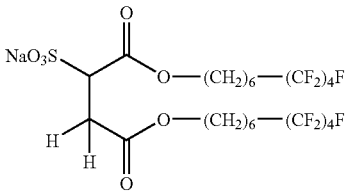
FS-7
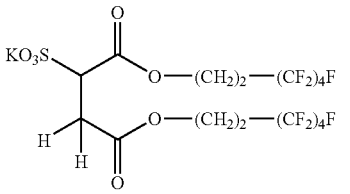
FS-8
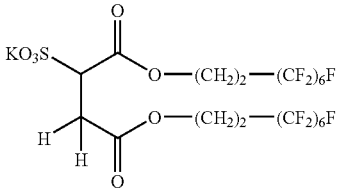
-continued
FS-9
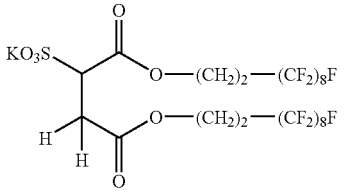
FS-10
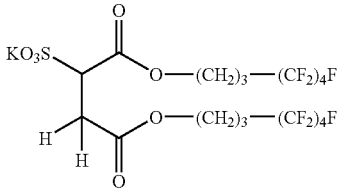
FS-11
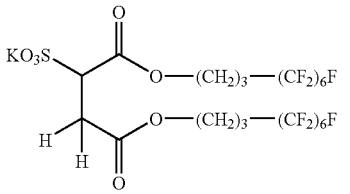
FS-12
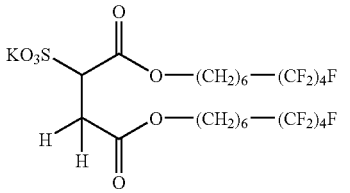
FS-13
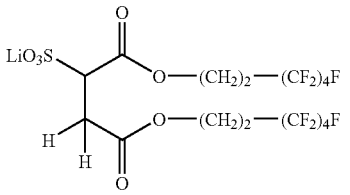
FS-14
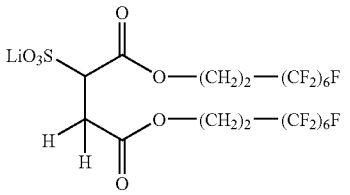
FS-15
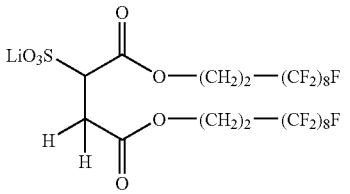
FS-16
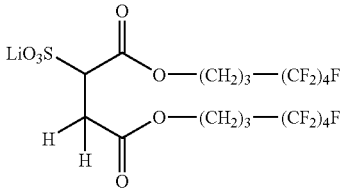

-continued
FS-17
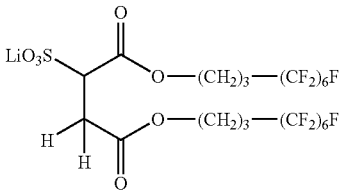
FS-18
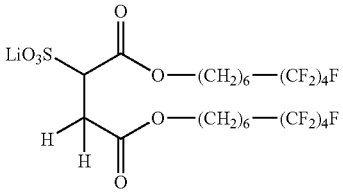
FS-19
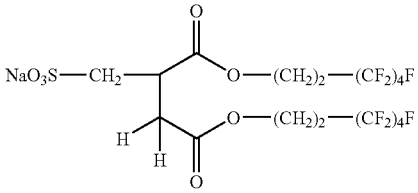
FS-20
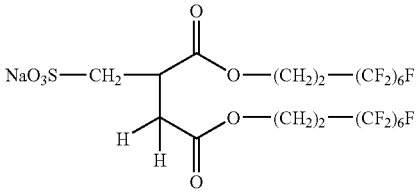
FS-21
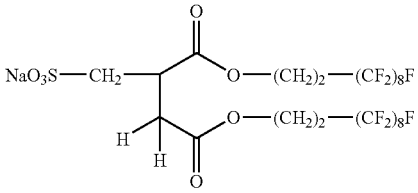
FS-22
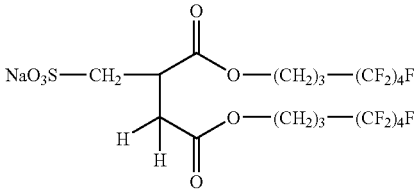
FS-23
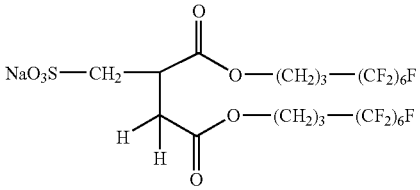
FS-24
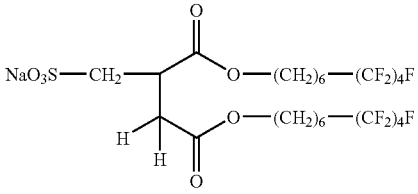
-continued
FS-25
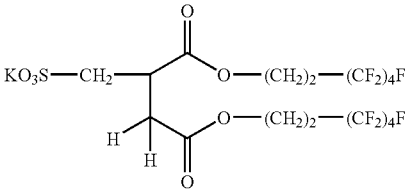
FS-26
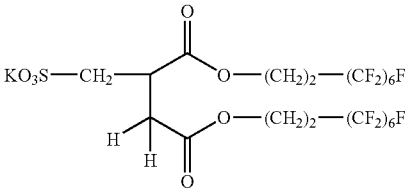
FS-27
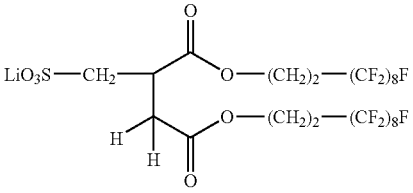
FS-28
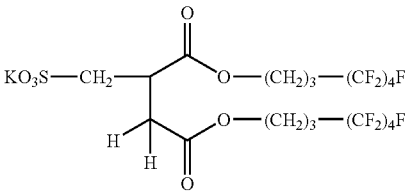
FS-29
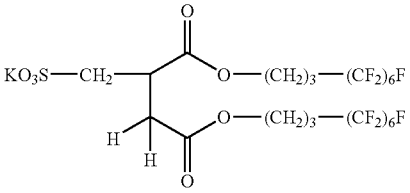
FS-30
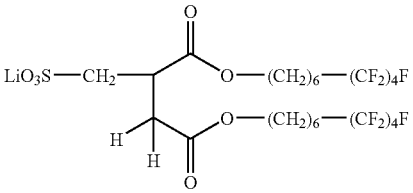
FS-31
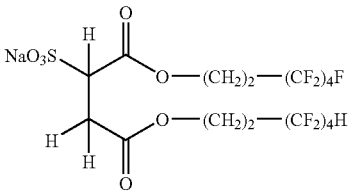

-continued

FS-32

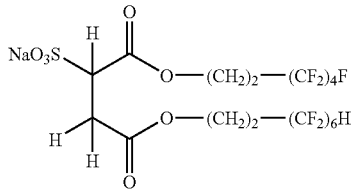

The compounds (surfactants) represented by the formula (1), (1-a) or (1-b) described above preferably used in the present invention, more preferably in the fourth embodiment, can be readily synthesized by a combination of the general esterification reaction and sulfonation reaction. The conversion of the counter cation can be readily performed by use of an ion exchange resin.

Hereinafter, representative examples of the synthesis method will be described. However, the present invention should not be considered as being limited to these specific synthetic examples.

SYNTHETIC EXAMPLE 4-1

Synthesis of Exemplified Compound FS-1

1-1 Synthesis of di(3,3,4,4,5,5,6,6,6-nonafluorohexyl) maleate 9.8 g (0.10 mol) of maleic anhydride, 52.8 g (0.20 mol) of 3,3,4,4,5,5,6,6,6-nonafluorohexanol, and 0.5 g of p-toluenesulfonic acid monohydrate in 30 milliliters (hereinafter, also referred to as "mL") of toluene, were heated under reflux for 24 hours while distilling off water produced. Thereafter, the reaction mixture was cooled to room temperature and hexane and ethyl acetate were added thereto. The organic phase was washed with 1 mol/litter (hereinafter, also referred to as "L") of an aqueous sodium hydroxide solution and an aqueous saturated sodium chloride solution, dried over sodium sulfate, and then after removing the solvent under reduced pressure, purified by silica gel column chromatography (hexane/ethyl acetate: 9/1 to 8/2 v/v) to obtain 53.2 g (yield 88%) of the objective compound as a white solid.

1-2 Synthesis of FS-1

42.8 g (69 mmol) of di(3,3,4,4,5,5,6,6,6-nonafluorohexyl) maleate, and 7.9 g (76 mmol) of sodium hydrogen sulfite, and 50 mL of water-ethanol (1/1 v/v) were added and heated under reflux for 3 hours. Then, the resultant was cooled to 0° C. and the solid precipitated was collected, followed by recrystallization operation from acetonitrile. The crystal obtained was dried under reduced pressure at 60° C. to obtain 27.0 g (yield 54%) of the objective compound as a white crystal.

$^1$H-NMR data of the obtained compound is shown below. $^1$H-NMR (DMSO-$d_6$) δ 2.49-2.62 (m, 4H), 2.85-2.99 (m, 2H), 3.68 (dd, 1H), 4.23-4.35 (m, 4H).

SYNTHETIC EXAMPLE 4-2

Synthesis of Exemplified Compound FS-2

2-1 Synthesis of di(3,3,4,4,5,5,6,6,7,7,8,8,8-tridecafluorooctyl)maleate 4.61 g (47 mmol) of maleic anhydride, 34.1 g (98 mmol) of 3,3,4,4,5,5,6,6,7,7,8,8,8-tridecafluorooctylalcohol, and 0.24 g of p-toluenesulfonic acid monohydrate in 140 mL of toluene, were heated under reflux for 10 hours while distilling off water produced. Thereafter, the reaction mixture was cooled to room temperature and ethyl acetate were added thereto. The organic phase was washed with an aqueous saturated sodium chloride solution, dried over sodium sulfate, and then after removing the solvent under reduced pressure, purified by silica gel column chromatography (hexane/ethyl acetate: 8/2 v/v) to obtain 19.7 g (yield 52%) of the objective compound as a white solid.

2-2 Synthesis of FS-2

10.0 g (12.4 mmol) of di(3,3,4,4,5,5,6,6,7,7,8,8,8-tridecafluorooctyl)maleate, and 1.55 g (14.9 mmol) of sodium hydrogen sulfite, and 15 mL of water-ethanol (1/1 v/v) were added and heated under reflux for 7 hours. Then, the resultant was cooled to room temperature. The crystal obtained was dried under reduced pressure at 60° C. to obtain 9.38 g (yield 81%) of the objective compound as a white crystal.

$^1$H-NMR data of the obtained compound is shown below. $^1$H-NMR (DMSO-$d_6$) δ 2.48 (m, 4H), 2.97 (m, 2H), 3.82 (m, 1H), 4.18-4.58 (m, 4H).

SYNTHETIC EXAMPLE 4-3

Synthesis of Exemplified Compound FS-4

3-1 Synthesis of di(4,4,5,5,6,6,7,7,7-nonafluoroheptyl) maleate 17.6 g (0.18 mol) of maleic anhydride, 100 g (0.36 mol) of 4,4,5,5,6,6,7,7,7-nonafluoroheptanol, and 0.5 g of p-toluenesulfonic acid monohydrate in 250 mL of toluene, were heated under reflux for 12 hours while distilling off water produced. Thereafter, the reaction mixture was cooled to room temperature and chloroform was added thereto. The organic phase was washed with 1 mol/L of an aqueous sodium hydroxide solution and an aqueous saturated sodium chloride solution, to obtain 114.1 g of the objective compound as a white solid quantitatively.

3-2 Synthesis of FS-4

95.8 g (156 mmol) of di(4,4,5,5,6,6,7,7,7-nonafluoroheptyl)maleate, 7.9 g (172 mmol) of sodium hydrogen sulfite, and 100 mL of water-ethanol (1/1 v/v) were added and heated under reflux for 20 hours. Then, ethyl acetate was added thereto and the organic phase was washed with an aqueous saturated sodium chloride solution and dried over sodium sulfate. Thereafter, the solvent was concentrated under reduced pressure, followed by performing recrystallization operation from acetonitrile. The crystal obtained was dried under reduced pressure at 60° C. to obtain 95.8 g (yield 83%) of the objective compound as a white crystal.

$^1$H-NMR data of the obtained compound is shown below. $^1$H-NMR (DMSO-$d_6$) δ 1.80 (m, 4H), 2.19-2.34 (m, 4H), 2.79-2.97 (m, 2H), 3.68 (dd, 1H), 4.01-4.29 (m, 4H)

SYNTHETIC EXAMPLE 4-4

Synthesis of FS-19

4-1 Synthesis of di(3,3,4,4,5,5,6,6,6-nonafluorohexyl)itaconate 13.5 g (0.12 mol) of itaconic anhydride, 69.8 g (0.26 mol) of 3,3,4,4,5,5,6,6,6-nonafluorohexanol, and 1.14 g (6 mmol) of p-toluenesulfonic acid monohydrate in 500 mL of toluene, were heated under reflux for 12 hours while distilling off water produced. Thereafter, the reaction mixture was cooled to room temperature and ethyl acetate was added thereto. The organic phase was washed with 1 mol/L of an aqueous sodium hydroxide solution and an aqueous saturated sodium chloride solution to obtain 51.3 g (yield 69%) of the objective compound as an oily compound.

4-2 Synthesis of FS-19

20.0 g (32 mmol) of di(3,3,4,4,5,5,6,6,6-nonafluorohexyl) itaconate, and 4.0 g (38 mmol) of sodium hydrogen sulfite, and 25 mL of water-ethanol (1/1 v/v) were added and heated under reflux for 6 hours. Then, ethyl acetate was added thereto and the organic phase was washed with an aqueous saturated sodium chloride solution and dried over sodium sulfate. Thereafter, the solvent was concentrated under reduced pressure, followed by performing recrystallization operation from acetonitrile. The crystal obtained was dried under reduced pressure at 80° C. for 2 hours to obtain 20.6 g (yield 89%) of the objective compound as a white crystal.

$^1$H-NMR data of the obtained compound is shown below. $^1$H-NMR (DMSO-$d_6$) δ 2.49-2.78 (m, 5H), 3.04-3.13 (m, 2H), 3.47 (br, 2H), 4.23 (t, 4H)

In the present invention, preferably in the fourth embodiment, in the case where the above-mentioned surfactant is used in the layers of a photographic light-sensitive material, the aqueous coating composition containing the surfactant may consist of the surfactant used preferably in the present invention, preferably in the fourth embodiment, and water, or may contain another component as needed depending on the purpose.

In the above-mentioned aqueous coating composition, the surfactant used in the present invention, preferably in the fourth embodiment, may be used singly, or as a mixture of two or more thereof. Moreover, a surfactant other than the surfactant for use in the present invention may be used in combination with the surfactant for use in the present invention. The surfactant which can be combined with the surfactant for use in the present invention includes various surfactants such as anionic-, cationic-, and nonionic surfactants. Those surfactants may be a polymeric surfactant, or may be a fluorine-containing surfactant that is one other than the surfactant used in the present invention, preferably in the fourth embodiment. Among those, an anionic- or nonionic surfactant is more preferred. Examples of the surfactant which can be combined with the surfactant used in the present invention, include those described in, for example, JP-A-62-215272 (pp. 649-706), and Research Disclosure (RD) Item 17643, pp. 26-27 (December, 1978), RD Item 18716, p. 650 (November, 1979), and RD Item 307105, pp. 875-876 (November, 1989).

A representative example of materials which may be contained in the above-mentioned aqueous coating composition is a polymeric compound. The polymeric compound may be an aqueous medium-soluble polymer, or may be a polymer dispersion in water (that is, a polymeric latex). The soluble polymer is not particularly limited, and includes, for example, gelatin, a polyvinyl alcohol, casein, agar, acacia gum, hydroxyethylcellulose, methylcellulose, and carboxymethylcellolose. The polymeric latex includes dispersions of: homo- or copolymers of various vinyl monomers (for example, acrylate derivatives, methacrylate derivatives, acrylamide derivatives, methacrylamide derivatives, styrene derivatives, conjugate diene derivatives, N-vinyl compounds, O-vinyl compounds, vinyl nitrile, and other vinyl compounds (such as ethylene, and vinylidene chloride)); or condensation-series polymers (for example, polyesters, polyurethanes, polycarbonates, polyamides). Detailed examples for such polymeric compounds can include, for example, those described in JP-A-62-215272 (pp. 707-763), and Research Disclosure (RD) Item 17643, p. 651 (December, 1978), RD Item 18716, p. 650 (November, 1979), and RD Item 307105, pp. 873-874 (November, 1989).

The medium for the above-mentioned aqueous coating composition may be water alone, or a mixed solvent of an organic solvent (for example, methanol, ethanol, isopropyl alcohol, n-butanol, methyl cellosolve, dimethylformamide, acetone, etc.) and water. The proportion of water in the medium for the aqueous coating composition is preferably 50% or more.

The above-mentioned aqueous coating composition may contain various compounds depending on the layer of the photographic light-sensitive material to be used. Such compounds may be dissolved or dispersed in a medium. Examples thereof include various couplers, ultraviolet absorbents, anti-color mixing agents, antistatic agents, scavengers, antifog agents, hardening agents, dyes, fungicides, and the like. To obtain effective antistatic ability and uniformity of coating when used in a photographic light-sensitive material, they are used preferably in the uppermost hydrophilic colloid layer.

In this case, the coating composition in the uppermost hydrophilic colloid layer may contain besides hydrophilic colloid (for example, gelatin) and the fluorine-series surfactant used in the present invention, preferably in the fourth embodiment, other surfactants, matting agents, lubricants, colloidal silica, gelatin plasticizers, and the like.

The use amount of the compounds (surfactants) represented by the formula (1), (1-a) or (1-b) is not particularly limited and the use amount may be varied optionally depending on the structure and application of the surfactant, the kind and amount of compounds contained in the aqueous composition, the constitution of the medium, and the like. For example, in the case where the surfactant used in the present invention, preferably in the fourth embodiment, is used in a coating solution for the uppermost hydrophilic colloid (gelatin) layer in the photographic light-sensitive material that is one preferred embodiment of the present invention, the use amount of the surfactant in terms of the concentration (mass %) in the coating solution is preferably 0.003 to 0.5%, and preferably 0.03 to 5% based on the gelatin solid content.

Further, the above water-resistant resin layers on the reflective-type base preferably contain a fluorescent whitening agent. Further, a fluorescent whitening agent may be dispersed in the hydrophilic colloid layer of the light-sensitive material. As the fluorescent whitening agent, preferably a benzoxazole-series fluorescent whitening agent, a coumarin-series fluorescent whitening agent, or a pyrazoline-series-fluorescent whitening agent can be used, and more preferably a benzoxazolylnaphthalene-series fluorescent whitening agent or a benzoxazolylstilbene-series fluorescent whitening agent is used. Specific examples of the fluorescent whitening agent that is contained in a water-resistant resin layer, include, for example, 4,4"-bis(benzoxazolyl)stilbene, 4,4'-bis(5-methylbenzoxazolyl)stilbene, and mixture of these. The amount to be used is not particularly limited, but preferably it is 1 to 100 mg/m$^2$. When it is mixed with a water-resistant resin, preferably the mixing proportion is 0.0005 to 3% by weight, and more preferably 0.001 to 0.5% by weight, to the resin.

The reflective-type base may be one wherein a hydrophilic colloid layer containing a white pigment is applied on a transmission-type base, or a reflective-type base described in the above.

Further, the reflective-type base may be a base having a specular reflective- or a second-type diffusion reflective metal surface.

A more preferable reflective support for use in the present invention, preferably in the fourth embodiment, is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity (mechanical strength) of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface be polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferably in the fourth embodiment, preferable embodiments of the polyolefin layer provide on the paper substrate include those described in JP-A-10-333277, JP-A-10-333278, JP-A-11-52513, JP-A-11-65024, European Patent Nos. 0880065 and 0880066.

It is preferred that the silver halide color photographic light-sensitive material of the present invention, preferably of the fourth embodiment, is imagewise exposed to coherent light from a blue laser having an emission-wavelength of 420 nm to 460 nm. Among the blue lasers, it is particularly preferable to use a blue semiconductor laser.

Examples of the semiconductor laser include blue semiconductor laser having a wavelength of 430 to 450 nm (Presentation by Nichia Corporation at the 48$^{th}$ Applied Physics Related Joint Meeting, in March, 2001), a blue laser at about 470 nm obtained by wavelength modulation of a semiconductor laser (oscillation wavelength about 940 nm) with a SHG crystal of $LiNbO_3$ having a reversed domain structure in the form of a wave guide, a green laser at about 530 nm obtained by wavelength modulation of a semiconductor laser (oscillation wavelength about 1,060 nm) with a SHG crystal of $LiNbO_3$ having a reversed domain structure in the form of a wave guide, a red semiconductor laser having a wavelength of about 685 nm (Type No. HL6738MG (trade name), manufactured by Hitachi, Ltd.), a red semiconductor laser having a wavelength of about 650 nm (Type No. HL6501MG (trade name), manufactured by Hitachi, Ltd.), and the like.

Exposure to light may be performed in plural times to the same photosensitive layer. In this case, it is preferred that the exposure is performed at least three times. Particularly preferably, an exposure time is $10^{-3}$ second or more (preferably $10^{-4}$ to $10^{-8}$ second). In the case where the exposure time is $10^{-5}$ to $10^{-8}$ second, it is preferred that the exposure be performed at least eight times. As a light source, any light source may be used. For example, a gas laser, a solid laser (LD), LED (organic or inorganic), a Xe light source with a restricted spot. In particular, a solid laser and LED are preferred. The light source must be spectrally separated to color-sensitive wavelength of each dye-forming layer. For this purpose, a suitable color filter (which contains or is deposited with a dye) is used or the oscillation wavelength of LD or LED may be selected. Further, both of these may be used in combination. The spot diameter of the light source is not particularly limited and is preferably 5 to 250 μm, and particularly preferably 10 to 100 μm, in terms of a half width value of light intensity. The shape of the spot may be any of a circle, an ellipse, or a rectangle. The distribution of the quantity of light of one spot may be of a Gaussian distribution or a trapezoid with a relatively constant light intensity. In particular, the light source may either consist of one or an array of plural light sources.

In the present invention, preferably in the fourth embodiment, generally, exposure to light is performed by scanning exposure. The light source may be scanned, or the photosensitive material may be scanned. Also, both may be scanned. The exposure time for a single run is defined by the following equation.

Exposure time=Spot diameter/Moving speed of light source (or Moving speed of photosensitive material)

Here, the spot diameter refers to the diameter of a spot (half width value, unit: μm) in the direction in which the light source used in scanning exposure moves at the time of exposure. Further, the moving speed of light source refers to the speed (unit: μm/second) at which the light source used for scanning exposure moves per unit time. Generally, the spot diameter does not have to be the same as the diameter of the pixel, and may be either greater or smaller than that. The number of times of exposure as used herein refers to the number of times of irradiation of light is sensed by the same color-sensitive layer at a single point (pixel) of the photosensitive material. In the case where irradiation is performed in plural times, it refers to the number of times of exposure performed at an intensity ⅕ time or more of the maximum intensity of light to which the material is exposed. Therefore, exposure performed at an intensity below ⅕ time of the maximum intensity of light, stray light, or overlap between the spots, are not counted into the number of times.

The silver halide color photographic light-sensitive material of the present invention is excellent in color reproducibility. The silver halide color photographic light-sensitive material of the present invention is excellent in rapid processing suitability.

The silver halide color photographic light-sensitive material of the present invention is excellent in rapid processing suitability. Further, the silver halide color photographic light-sensitive material of the present invention is excellent in color reproducibility, storage stability in unexposed state of the light-sensitive material, and image fastness after processing.

According to the present invention, can be provided a silver halide color photographic light-sensitive material that is excellent in rapid high-productivity processing suitability and achieves remarkable cost reduction; and a method of forming an image by using the above light-sensitive material can also be provided. Further, according to the present invention, can be provided a silver halide color photographic light-sensitive material with a layer structure designed, taking into consideration the balance among the coupling rates of the couplers to be used, to increase the reaction efficiency of the oxidized developing agent generated at the time of color development, to reduce the coating amount of materials, and to enable shortening of the image-forming time, bleach-fixing time, and rinsing time without any trouble in color development; and a method of forming an image by using the above light-sensitive material can also be provided.

The silver halide color photographic light-sensitive material of the present invention is excellent in a property for preventing static-induced fog. According to the present invention, the property for preventing static-induced fog of the light-sensitive material can be improved, while maintaining good sharpness of an image formed and high processing suitability of the light-sensitive material without deteriorating these properties.

The silver halide color photographic light-sensitive material of the present invention is excellent in color reproducibility. Further, the silver halide color photographic light-sensitive material of the present invention is excellent in rapid processing suitability, in addition to color reproducibility.

The silver halide color photographic light-sensitive material of the present invention is excellent in rapid processing suitability. Further, the silver halide color photographic light-sensitive material of the present invention is also excellent in color reproducibility, storage stability thereof in an unexposed state, and image fastness after processing, in addition to rapid processing suitability.

The silver halide color photographic light-sensitive material of the present invention exhibits such excellent effects as capable of increasing the reaction efficiency of the oxidized developing agent generated at the time of color development, reducing the coating amount of materials, and enabling shortening of the image-forming time, bleach-fixing time, and rinsing time without any troubles in color development.

Hereinafter, the present invention will be described in more detail based on examples given below, but the present invention is not meant to be limited thereto.

EXAMPLE

Numbering system of the compounds and simplified symbols, and the like, as utilized in each of the examples are independent in each of the examples, unless otherwise specified.

Example 1-1

Support

A support used in the present example was prepared with the below shown method.

1) First Layer and Undercoat Layer

The two surfaces of the 90 μm thick polyethylenenaphthlate supports were subjected to glow discharge treatment under the conditions of processing atmospheric pressure: 2.66×10 Pa; $H_2O$ partial pressure in the atmospheric vapor: 75%; discharge frequency: 30 kHz; output: 2500 W; and processing intensity: 0.5 kV A minute/$m^2$. After that, one surface of the support was coated with a coating solution having the following composition for the first layer so as to give a coating amount of 5 ml/$m^2$, by a bar coat method described in JP-B-58-4589.

A dispersion liquid of conductive fine particles (10% aqueous dispersion of $SnO_2/Sb_2O_5$ particles.

| | |
|---|---|
| Secondary aggregate, whose average particle diameter was 0.05 μm, composed of particles whose primary particle diameter was 0.005 μm.) | 50 mass parts |
| Gelatin | 0.5 mass part |

-continued

| | |
|---|---|
| Water | 49 mass parts |
| Polyglycerolpolyglycidyl ether | 0.16 mass part |
| Poly(polymerization degree 20)oxyethylene sorbitan mono-laurate | 0.1 mass part |

Further, after coating the first layer, the polyethylenenaphthlate (PEN) support was wound around a stainless steel core of 20 cm in diameter and given a thermal history by heating at 110° C. (Tg of PEN support: 119° C.) for 48 hours. Thus, an annealing treatment was completed. The other surface of the support opposite to the first layer was coated with a coating solution having the following composition as an undercoat layer for an emulsion, so as to give a coating amount of 10 ml/$m^2$, by using a bar coat method.

| | |
|---|---|
| Gelatin | 1.01 mass parts |
| Salicylic acid | 0.30 mass part |
| Resorcin | 0.40 mass part |
| Poly(polymerization degree 10)oxyethylene nonylphenylether | 0.11 mass part |
| Water | 3.53 mass parts |
| Methanol | 84.57 mass parts |
| n-Propanol | 10.08 mass parts |

Further, the second layer and the third layer described later were coated on the first layer in this order. At last, the color negative light-sensitive material having the composition described later was multi-coated on the opposite side, so that a transparent magnetic recording medium with a silver halide emulsion was prepared.

2) Second Layer (Transparent Magnetic Recording layer)

(i) Dispersion of Magnetic Substance 1100 mass parts of Co-coated γ-$Fe_2O_3$ magnetic substance (average major axis length: 0.25 μm, SBET: 39 $m^2$/g, Hc: $6.56\times10^4$ A/m, $\sigma_s$: 77.1 A $m^2$/kg, σr: 37.4 A $m^2$/kg), 220 mass parts of water, 165 mass parts of silane coupling agent (3-(poly(polymerization degree 10)oxyethynyl)oxypropyl trimethoxysilane) were added and well mixed by means of an open kneader for 3 hours. The resulting roughly dispersed viscous liquid was dried at 70° C. for a day (one day and one night) to remove water. Thereafter, a heat treatment was performed at 110° C. for 1 hour to prepare surface-treated magnetic particles.

Further, a mixture having the following formulation was kneaded again by means of an open kneader for 4 hours.

| | |
|---|---|
| The above-mentioned surface-treated magnetic particles | 855 g |
| Diacethylcellulose | 25.3 g |
| Methylethylketone | 136.3 g |
| Cyclohexanone | 136.3 g |

Further, a mixture having the following formulation was finely dispersed at 2,000 rpm by means of a sand mill (¼ G sand mill), for 4 hours. 1 mmϕ-glass beads were used as a media.

| | |
|---|---|
| The above kneaded solution | 45 g |
| Diacethylcellulose | 23.7 g |

-continued

| | |
|---|---|
| Methylethylketone | 127.7 g |
| Cyclohexanone | 127.7 g |

Further, an intermediate solution containing a magnetic substance was prepared according to the following formulation.

(ii) Preparation of Intermediate Solution Containing a Magnetic Substance

| | |
|---|---|
| The above-described magnetic substance finely dispersed solution | 674 g |
| Diacethyl cellulose solution (Solid content: 4.34%, Solvent: methylethylketone/cyclohexanone = 1/1) | 24280 g |
| Cyclohexanone | 46 g |

These were mixed and stirred by a dispersing means (Disper) to prepare an "intermediate solution containing a magnetic substance".

A dispersion solution of a-alumina abrasive having the following formulation for use in the present invention was prepared.

(a) Sumicorundum AA-1.5 (average primary particle diameter of 1.5 μm, specific surface area of 1.3 $m^2/g$, trade name, manufactured by Sumitomo Chemical Co., Ltd.)

Preparation of Particle Dispersion Solution

| | |
|---|---|
| Sumicorundum AA-1.5 (trade name, manufactured by Sumitomo Chemical Co., Ltd.) | 152 g |
| Silane coupling agent KBM 903 (trade name, manufactured by Shinetsu silicone Co.) | 0.48 g |
| Diacetyl cellulose solution (solid content 4.5%, solvent: methyl ethylketone/cyclohexanone = 1/1) | 227.52 g |

(solid content 4.5%, solvent: methyl ethylketone/cyclohexanone=1/1)

The mixture having the above formulation was finely dispersed by means of a ceramic-coated sand mill (¼ G), at the rate of 800 rpm, for 4 hours. As a media, zirconia beads having a diameter of 1 mmϕ were used.

(b) Colloidal Silica Particle-dispersed Solution (Fine Particles)

"MEK-ST" (trade name) manufactured by Nissan Chemical Industries Ltd. was used.

This was a dispersed solution of colloidal silica having average primary particle diameter of 0.015 μm in methyl ethyl ketone as a dispersion medium, and the solid content of the colloidal silica was 30%.

(iii) Preparation of Second Layer Coating Solution

| | |
|---|---|
| The above-described magnetic substance-containing intermediate solution | 19053 g |
| Diacetyl cellulose solution (solid content 4.5%, solvent: methylethylketone/cyclohexanone = 1/1) | 264 g |
| Colloidal silica dispersion solution (MEK-ST) (dispersion solution b) (solid content 30%) | 128 g |

-continued

| | |
|---|---|
| Sumicorundum AA-1.5 dispersed solution (dispersion solution a) | 12 g |
| Millionate MR-400 (trade name, manufactured by Nippon Polyurethane Co., Ltd.) diluted solution (solid content 20%, diluting solvent: methyl ethylketone/cyclohexanone = 1/1) | 203 g |
| Methyl ethyl ketone | 170 g |
| Cyclohexanone | 170 g |

The coating solution, which was obtained by mixing and stirring the above, was coated in a coating amount of 29.3 $ml/m^2$ by means of a wire bar. Drying of the coated layer was performed at 110° C. The thickness of the dried magnetic layer was 1.0 μm.

3) Third Layer (a Layer Containing a Higher Fatty Acid Ester Lubricant)

(i) Preparation of Undiluted Dispersion Solution Containing a Lubricant

Solution A presented below was dissolved by heating at 100° C. The resultant solution was added to Solution B, and then the resultant mixture was dispersed by means of a high pressure homogenizer to prepare an undiluted dispersion solution containing a lubricant.

Solution A

| | |
|---|---|
| The compound shown below $C_6H_{13}CH(OH)(CH_2)_{10}COOC_{50}H_{101}$ | 399 mass parts |
| The compound shown below $n\text{-}C_{50}H_{101}O(CH_2CH_2O)_{16}H$ | 171 mass parts |
| Cyclohexanone | 830 mass parts |
| Solution B | |
| Cyclohexanone | 8600 mass parts |

(ii) Preparation of Spherical Inorganic Particle Dispersion Solution

Spherical inorganic particle dispersion solution (c1) was prepared according to the following formulation.

| | |
|---|---|
| Isopropyl alcohol | 93.54 mass parts |
| Silane coupling agent KEM 903 (trade name, manufactured by Shinetsu silicone Co.) | |
| compound 1-1: $(CH_3O)_3Si—(CH_2)_3—NH_2$ | 5.53 mass parts |
| Compound 1 | 2.93 mass parts |
| SEA HOSTER KEP 50 | 88.00 mass parts |

Compound 1

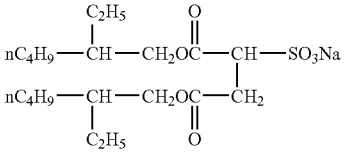

(amorphous spherical silica having an average grain diameter of 0.5 μm; trade name, manufactured by NIPPON SHOKUBAI CO., LTD.)

The mixture having the above-mentioned formulation was stirred for 10 minutes. Then, the following was further added.

| | |
|---|---|
| Diacetone alcohol | 252.93 mass parts |

An ultrasonic homogenizer SONIFIER 450 (trade name, manufactured by BRANSON Co., Ltd.) was used to disperse the resultant mixture solution for 3 hours with stirring while cooling on ice. Thus, a dispersion solution cl of spherical inorganic particles was completed.

(iii) Preparation of a Dispersion Solution Containing Spherical Organic High Molecular Particles A dispersion solution (c2) containing spherical organic high molecular particles was prepared according to the following formulation.

| | |
|---|---|
| XC99-A8808 (trade name, manufactured by Toshiba Silicone Co., Ltd.; spherical cross-linking polysiloxane particles having an average grain size of 0.9 μm) | 60 mass parts |
| Methylethylketone | 120 mass parts |
| Cyclohexanone | 120 mass parts |

(Solid content 20%, Solvent: methylethylketone/cyclohexane=1/1)

An ultrasonic homogenizer SONIFIER 450 (trade name, manufactured by BRANSON Co., Ltd.) was used to disperse the resultant mixture solution for 2 hours with stirring while cooling on ice. Thus, a dispersion solution c2 of spherical organic high-molecular particles was completed.

(iv) Preparation of Third Layer Coating Solution

The following compositions were added to 542 g of the aforementioned undiluted dispersion solution containing a lubricant, so that the third layer coating solution was formed.

| | |
|---|---|
| Diacetone alcohol | 5950 g |
| Cyclohexanone | 176 g |
| Ethyl acetate | 1700 g |
| The aforementioned dispersion solution (c1) of SEA HOSTER KEP 50 | 53.1 g |
| The aforementioned dispersion solution (c2) of spherical organic high molecular particles | 300 g |
| FC431 (trade name, manufactured by 3M Co., Ltd., solid content 50%, Solvent: Ethyl acetate) | 2.65 g |
| BYK310 (trade name, manufactured by BYK Chem Japan Co., Ltd, Solid content: 25%) | 5.3 g |

The above third layer coating solution was coated on the second layer in a coating amount of 10.35 ml/m$^2$ followed by drying at 110° C., and further dried at 97° C. for 3 minutes.

4) Coating of Photosensitive Layer

Then, the opposite surface of the backing layer obtained above was multi-coated with each of the layers of the following composition to prepare a color-negative film.

(Composition of the Photosensitive Layer)

The value corresponding each of the components represents the amount to be coated with the unit of g/m$^2$. Further, the other value in regard to the silver halide represents the coating amount in terms of silver.

First Layer (First Halation Preventing Layer)

| | | |
|---|---|---|
| Black colloidal silver | Silver | 0.122 |
| Silver iodobromide emulsion (0.07 μm) | Silver | 0.01 |
| Gelatin | | 0.919 |
| ExM-1 | | 0.066 |
| ExC-1 | | 0.002 |
| ExC-3 | | 0.002 |
| Cpd-2 | | 0.001 |
| F-8 | | 0.001 |
| HBS-1 | | 0.050 |
| HBS-2 | | 0.002 |

Second Layer (Second Halation Preventing Layer)

| | | |
|---|---|---|
| Black colloidal silver | Silver | 0.055 |
| Gelatin | | 0.425 |
| ExF-1 | | 0.002 |
| F-8 | | 0.001 |
| Solid dispersion dye ExF-7 | | 0.120 |
| HBS-1 | | 0.074 |

Third Layer (Intermediate Layer)

| | |
|---|---|
| ExC-2 | 0.050 |
| Cpd-1 | 0.090 |
| Polyethyl acrylate latex | 0.200 |
| HBS-1 | 0.100 |
| Gelatin | 0.700 |

Fourth layer (Low-Speed Red Light-Sensitive Emulsion Layer)

| | | |
|---|---|---|
| Em-D | Silver | 0.577 |
| Em-C | Silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| ExC-8 | | 0.050 |
| ExC-9 | | 0.020 |
| Cpd-2 | | 0.025 |
| Cpd-4 | | 0.025 |
| UV-2 | | 0.047 |
| UV-3 | | 0.086 |
| UV-4 | | 0.018 |
| HBS-1 | | 0.245 |
| HBS-5 | | 0.038 |
| Gelatin | | 0.994 |

Fifth Layer (Medium-Speed Red Light-Sensitive Emulsion Layer)

| | | |
|---|---|---|
| Em-B | Silver | 0.431 |
| Em-C | Silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-8 | | 0.016 |

-continued

| | | |
|---|---|---|
| ExC-9 | | 0.005 |
| Cpd-2 | | 0.036 |
| Cpd-4 | | 0.009 |
| Cpd-7 | | 0.082 |
| HBS-1 | | 0.129 |
| Gelatin | | 0.882 |

Sixth Layer (High-Speed Red Light-Sensitive Emulsion Layer)

| | | |
|---|---|---|
| Em-A | Silver | 1.108 |
| ExC-1 | | 0.180 |
| ExC-3 | | 0.035 |
| ExC-6 | | 0.029 |
| ExC-8 | | 0.110 |
| ExC-9 | | 0.020 |
| Cpd-2 | | 0.064 |
| Cpd-4 | | 0.008 |
| Cpd-7 | | 0.028 |
| HBS-1 | | 0.329 |
| HBS-2 | | 0.120 |
| Gelatin | | 1.245 |

Seventh Layer (Intermediate Layer)

| | | |
|---|---|---|
| Cpd-1 | | 0.094 |
| Cpd-6 | | 0.369 |
| Solid dispersion dye ExF-4 | | 0.030 |
| HBS-1 | | 0.049 |
| Polyethyl acrylate latex | | 0.088 |
| Gelatin | | 0.886 |

Eighth Layer (Layer which gives an Interlayer Effect to Red Light Sensitive Layer)

| | | |
|---|---|---|
| Em-J | Silver | 0.153 |
| Em-K | Silver | 0.153 |
| Cpd-4 | | 0.030 |
| ExM-2 | | 0.120 |
| ExM-3 | | 0.016 |
| ExM-4 | | 0.026 |
| ExY-1 | | 0.016 |
| ExY-4 | | 0.036 |
| ExC-7 | | 0.026 |
| HBS-1 | | 0.218 |
| HBS-3 | | 0.003 |
| HBS-5 | | 0.030 |
| Gelatin | | 0.610 |

Ninth Layer (Low-speed Green Light-sensitive Emulsion Layer)

| | | |
|---|---|---|
| Em-H | Silver | 0.333 |
| Em-G | Silver | 0.329 |
| Em-I | Silver | 0.088 |
| ExM-2 | | 0.378 |
| ExM-3 | | 0.047 |
| ExY-1 | | 0.017 |
| ExC-7 | | 0.007 |
| HBS-1 | | 0.098 |
| HBS-3 | | 0.010 |

-continued

| | | |
|---|---|---|
| HBS-4 | | 0.077 |
| HBS-5 | | 0.548 |
| Cpd-5 | | 0.010 |
| Gelatin | | 1.470 |

Tenth Layer (Medium-speed Green Light-sensitive Emulsion Layer)

| | | |
|---|---|---|
| Em-F | Silver | 0.457 |
| ExM-2 | | 0.032 |
| ExM-3 | | 0.029 |
| ExM-4 | | 0.029 |
| ExY-3 | | 0.007 |
| ExC-6 | | 0.010 |
| ExC-7 | | 0.012 |
| ExC-8 | | 0.010 |
| HBS-1 | | 0.065 |
| HBS-3 | | 0.002 |
| HBS-4 | | 0.020 |
| HBS-5 | | 0.020 |
| Cpd-5 | | 0.004 |
| Gelatin | | 0.446 |

Eleventh Layer (High-speed Green Light-sensitive Emulsion Layer)

| | | |
|---|---|---|
| Em-E | Silver | 0.794 |
| ExC-6 | | 0.002 |
| ExC-8 | | 0.010 |
| ExM-1 | | 0.013 |
| ExM-2 | | 0.011 |
| ExM-3 | | 0.030 |
| ExM-4 | | 0.017 |
| ExY-3 | | 0.003 |
| Cpd-3 | | 0.004 |
| Cpd-4 | | 0.007 |
| Cpd-5 | | 0.010 |
| HBS-1 | | 0.148 |
| HBS-3 | | 0.003 |
| HBS-4 | | 0.020 |
| HBS-5 | | 0.037 |
| Polyethyl acrylate latex | | 0.099 |
| Gelatin | | 0.939 |

Twelfth Layer (Yellow Filter Layer)

| | | |
|---|---|---|
| Cpd-1 | | 0.094 |
| Solid dispersion dye ExF-2 | | 0.070 |
| Solid dispersion dye ExF-5 | | 0.010 |
| Oil-soluble dye ExF-6 | | 0.010 |
| HBS-1 | | 0.049 |
| Gelatin | | 0.630 |

Thirteenth Layer (Low-speed Blue Light-sensitive Emulsion Layer)

| | | |
|---|---|---|
| Em-O | Silver | 0.112 |
| Em-M | Silver | 0.300 |
| Em-N | Silver | 0.260 |
| ExC-1 | | 0.027 |
| ExC-7 | | 0.013 |

-continued

| | |
|---|---|
| ExY-1 | 0.002 |
| ExY-2 | 0.890 |
| ExY-4 | 0.058 |
| Cpd-2 | 0.100 |
| Cpd-3 | 0.004 |
| HBS-1 | 0.222 |
| HBS-5 | 0.074 |
| Gelatin | 1.553 |

Fourteenth Layer (High-speed Blue Light-sensitive Emulsion Layer)

| | | |
|---|---|---|
| Em-L | Silver | 0.714 |
| ExY-2 | | 0.211 |
| ExY-4 | | 0.068 |
| Cpd-2 | | 0.075 |
| Cpd-3 | | 0.001 |
| HBS-1 | | 0.124 |
| Gelatin | | 0.678 |

Fifteenth Layer (First Protective Layer)

| | | |
|---|---|---|
| Silver iodobromide emulsion (0.07 μm) | Silver | 0.301 |
| UV-1 | | 0.211 |
| UV-2 | | 0.132 |
| UV-3 | | 0.198 |
| UV-4 | | 0.026 |
| F-11 | | 0.009 |
| S-1 | | 0.086 |
| HBS-1 | | 0.175 |
| HBS-4 | | 0.050 |
| Gelatin | | 1.984 |

Sixteenth Layer (Second Protective Layer)

| | |
|---|---|
| H-1 | 0.400 |
| B-1 (diameter: 1.7 μm) | 0.050 |
| B-2 (diameter: 1.7 μm) | 0.150 |
| B-3 | 0.050 |
| S-1 | 0.200 |
| Gelatin | 0.750 |

In addition to the above ingredients, in order to improve storage stability, processing suitability, resistance to pressure, mildew-proofing property, bacteria-proofing property, antistatic property and coating property, the individual layer properly contained W-1 to W-6, B-4 to B-6, F-1 to F-18, lead salts, platinum salts, iridium salts and rhodium salts.

(Preparation of Dispersion of Organic Solid Dispersed Dye)

ExF-2 in the 12th layer was dispersed by the following method.

| | |
|---|---|
| Wet cake of Ex2-F (containing 17.6 mass % of water) | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

(The pH of the mixture is adjusted to 7.2 with NaOH)

(The pH of the mixture is adjusted to 7.2 with NaOH)

The slurry having the above-described composition was roughly dispersed with stirring by a dissolver stirrer, and then dispersed by an agitator mill LMK-4 (trade name) under the conditions of round speed: 10 m/s; discharge amount: 0.6 kg/min; filling rate of zirconia beads having a grain size of 0.3 μm: 80%, until specific absorbance of the dispersion solution became 0.29. Thus, a dispersion of solid fine particles was obtained. An average particle diameter of the dye fine particles was 0.29 μm.

Similarly, solid dispersions of ExF-4 and ExF-7 were obtained. The average particle diameter of these dye particles was 0.28 μm and 0.49 μm, respectively. EXF-5 was dispersed according to the micro precipitation dispersion method described in Example 1 of European Patent No. 549,489 A. An average particle diameter of the dye fine particles was 0.06 μm.

TABLE 2

| Name of Emulsion | Average amount of iodine (mole %) | Sphere-equivalent diameter*1 (μm) | Aspect ratio | Circle-equivalent diameter*2 (μm) | Thickness of grain (μm) | Shape |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

(Note)

*1 A diameter of a sphere whose volume is equivalent to the volume of an individual grain.

*2 A diameter of a circle whose area is equivalent to the projected area of an individual grain.

In Table 2, emulsions Em-A to Em-C were spectrally sensitized by adding an optimal amount of each of spectrally sensitizing dyes 1 to 3, respectively, and they were also optimally gold-sensitized, sulfur-sensitized and selenium-sensitized. Emulsions Em-E to Em-G were spectrally sensitized adding an optimal amount of each of spectrally sensitizing dyes 4 to 6, respectively, and they were also optimally gold-sensitized, sulfur-sensitized and selenium-sensitized. Emulsion Em-J was spectrally sensitized adding an optimal amount of each of spectrally sensitizing dyes 7 to 8, respectively, and further optimally gold-sensitized, sulfur-sensitized and selenium-sensitized. Emulsion Em-L was spectrally sensitized adding an optimal amount of each of spectrally sensitizing dyes 9 to 11, respectively, and further optimally gold-sensitized, sulfur-sensitized and selenium-sensitized. Emulsion Em-O was spectrally sensitized adding an optimal amount of each of spectrally sensitizing dyes 10 to 12, respectively, and further optimally gold-sensitized and sulfur-sensitized. Emulsions Em-D, Em-H, Em-I, Em-K, Em-M, and Em-N were spectrally sensitized adding an optimal amount of each of spectrally sensitizing dyes shown in Table 3, respectively, and they were also optimally gold-sensitized, sulfur-sensitized and selenium-sensitized.

TABLE 3

| Name of Emulsion | Sensitizing dye | Added amount (mol/mol Ag) |
|---|---|---|
| Em-D | Sensitizing dye 1 | $5.44 \times 10^{-4}$ |
| | Sensitizing dye 2 | $2.35 \times 10^{-4}$ |
| | Sensitizing dye 3 | $7.26 \times 10^{-6}$ |
| Em-H | Sensitizing dye 8 | $6.52 \times 10^{-4}$ |
| | Sensitizing dye 13 | $1.35 \times 10^{-4}$ |
| | Sensitizing dye 6 | $2.48 \times 10^{-5}$ |
| Em-I | Sensitizing dye 8 | $6.09 \times 10^{-4}$ |
| | Sensitizing dye 13 | $1.26 \times 10^{-4}$ |
| | Sensitizing dye 6 | $2.32 \times 10^{-5}$ |
| Em-K | Sensitizing dye 7 | $6.27 \times 10^{-4}$ |
| | Sensitizing dye 8 | $2.24 \times 10^{-4}$ |
| Em-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |
| Em-N | Sensitizing dye 9 | $3.28 \times 10^{-4}$ |
| | Sensitizing dye 10 | $3.28 \times 10^{-4}$ |
| | Sensitizing dye 11 | $3.28 \times 10^{-4}$ |

The sensitizers in Table 3 are shown below.

Sensitizing dye 1

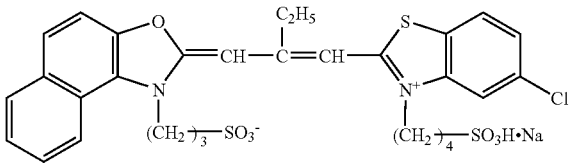

Sensitizing dye 2

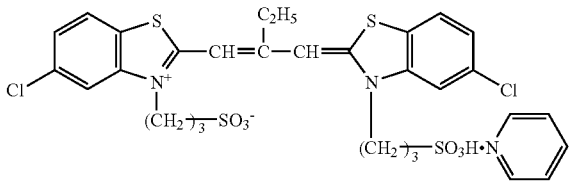

Sensitizing dye 3

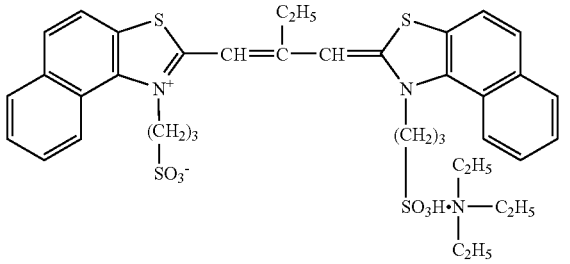

Sensitizing dye 4

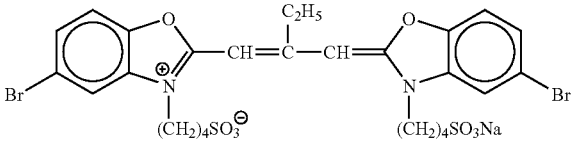

-continued

Sensitizing dye 5

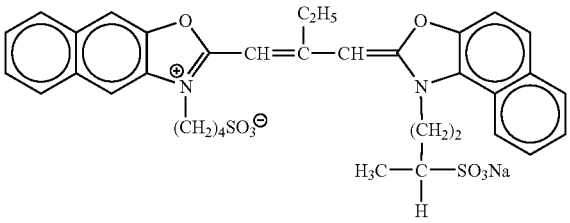

Senstizing dye 6

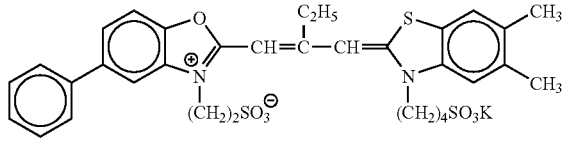

Sensitizing dye 7

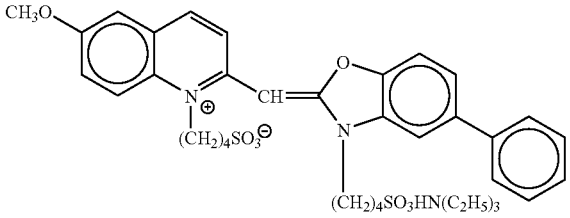

Sensitizing dye 8

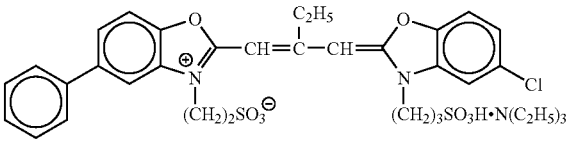

Sensitizing dye 9

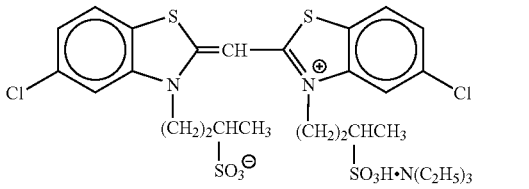

Sensitizing dye 10

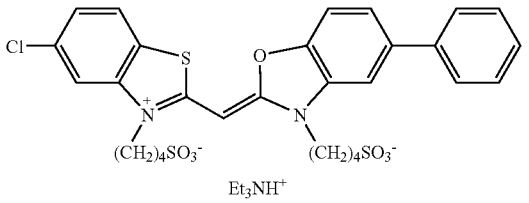

Sensitzing dye 11

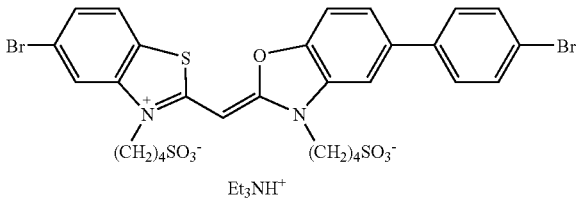

-continued

Sensitizing dye 12

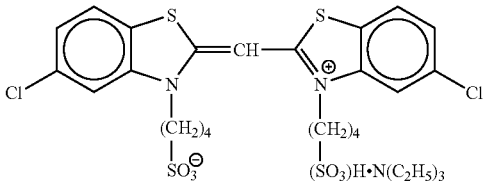

Sensitizing dye 13

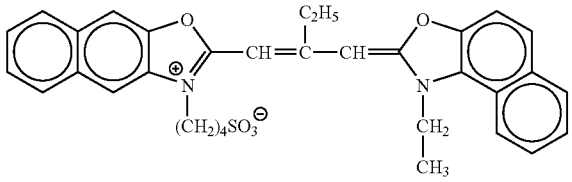

In the preparation of tabular grains, low molecular gelatin was used according to the working examples in JP-A-1-158426.

Emulsions Em-A to Em-K each contained an optimal amount of each of Ir and Fe.

Emulsions Em-L to Em-O each were reduction-sensitized at the time of grain formation.

In the tabular grains, dislocation lines as described in JP-A-3-237450 were observed by means of high-pressure electron microscope.

In Emulsions Em-A to Em-C and Em-J, an iodide ion-releasing agent was used to introduce the dislocation according to the working examples in JP-A-6-11782.

In Emulsion E, silver iodide fine grains that were prepared just before addition in a separate chamber installed with a magnetic coupling induction type stirrer described in JP-A-10-43570, were used to introduce the dislocation.

The compounds that were used in each layer, are shown below.

ExC-1

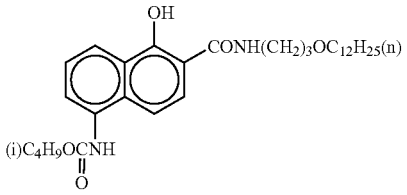

ExC-2

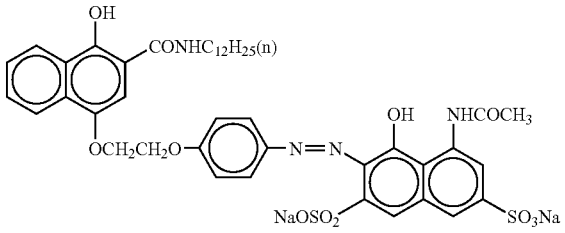

ExC-3

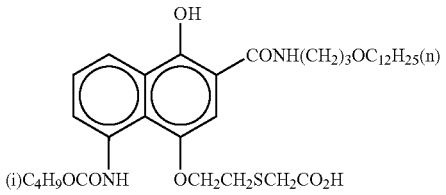

ExC-4

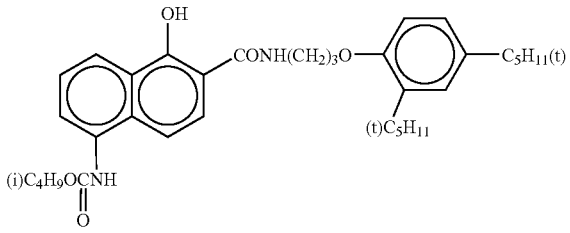

ExC-5

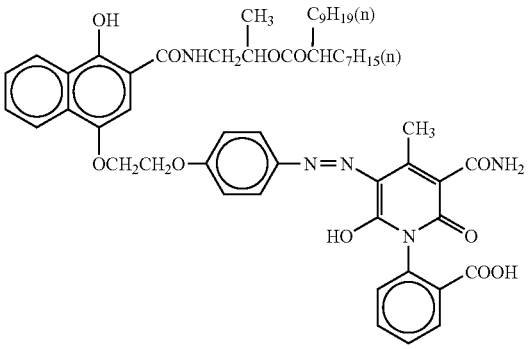

ExC-6

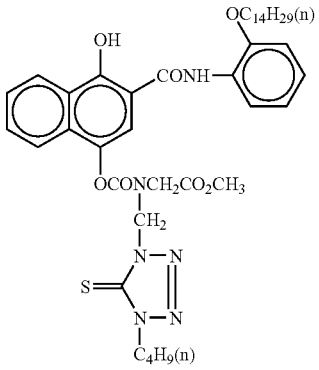

-continued
ExC-7
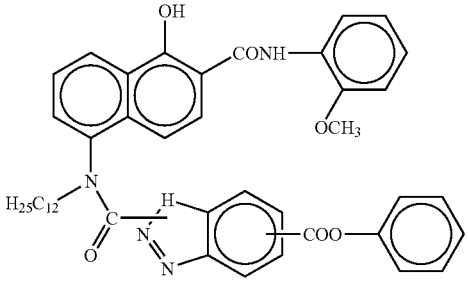
ExC-8
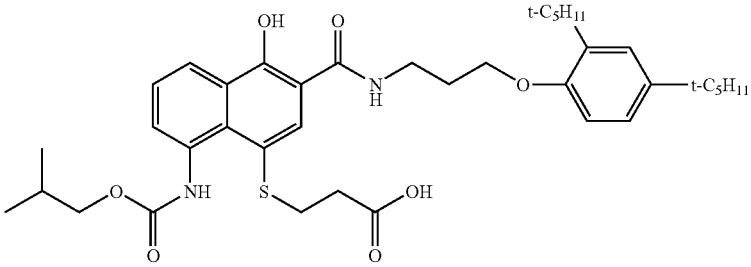
ExC-9
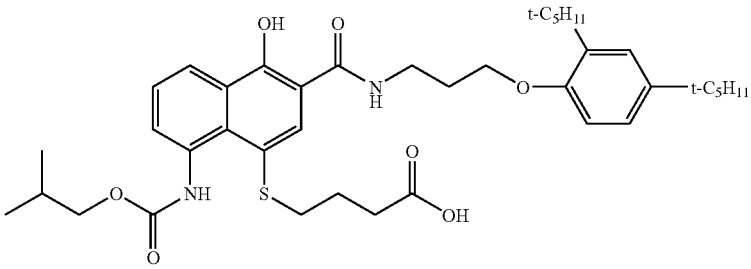
ExM-1
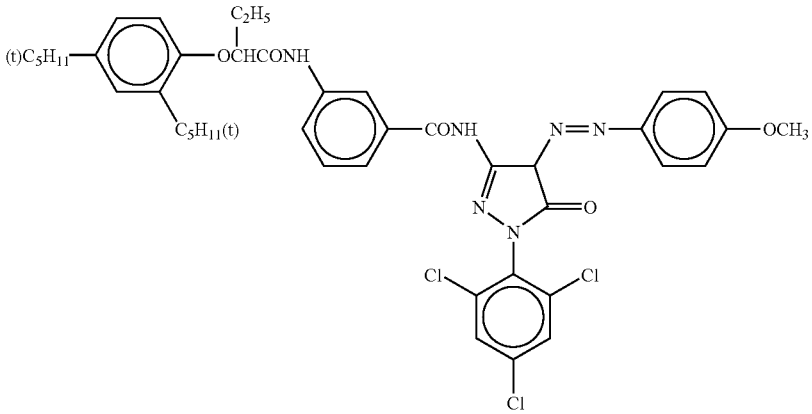

-continued
ExM-2
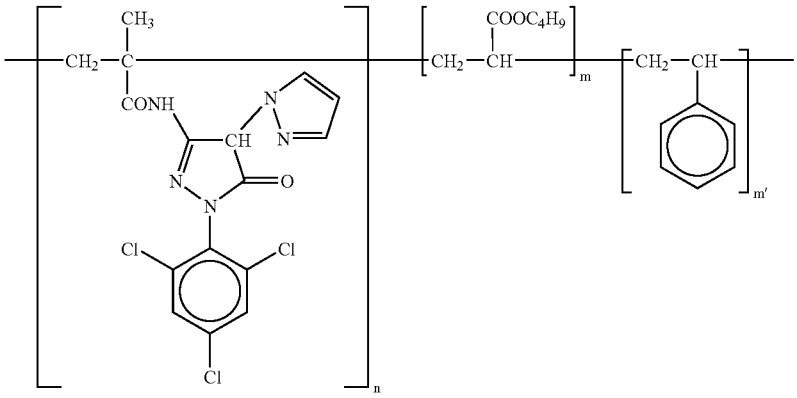
n = 50
m = 25
m′ = 25
mol. wt. about 20,000
ExM-3
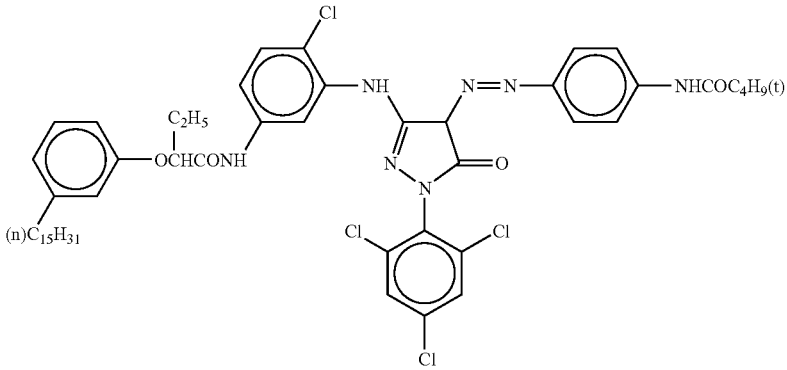
ExM-4
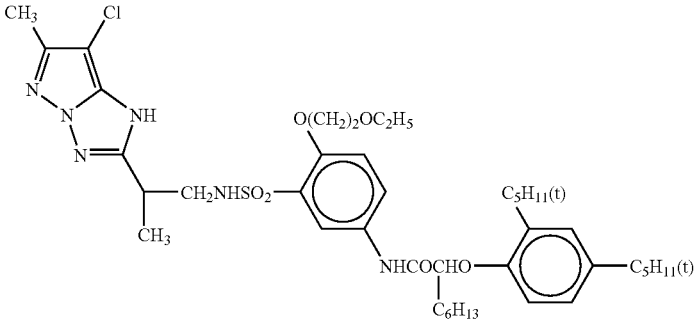
ExY-1
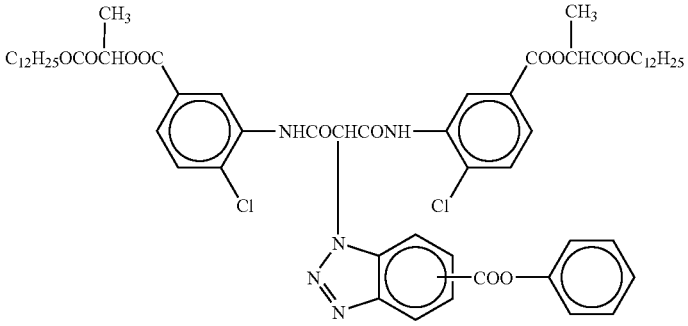

-continued
ExY-2
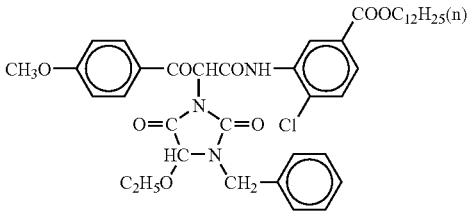
ExY-3
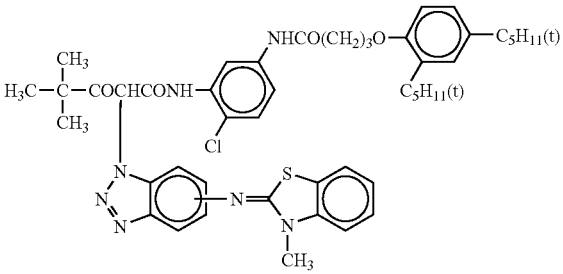
ExY-4
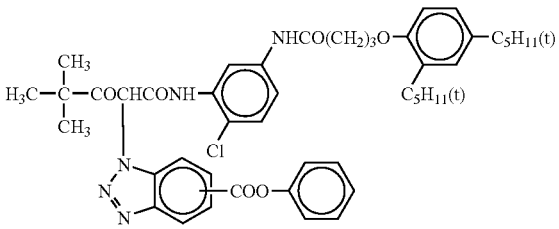
Cpd-1
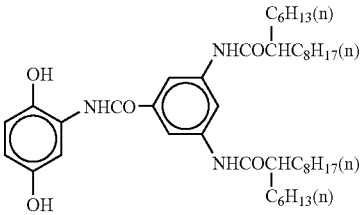
Cpd-2
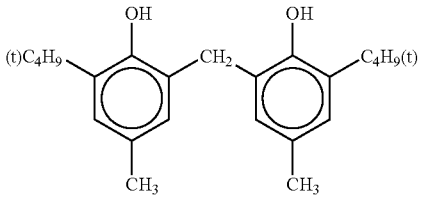
Cpd-3
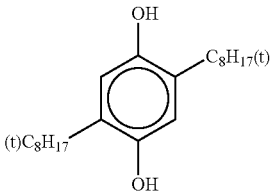
Cpd-4
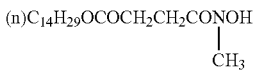
Cpd-5
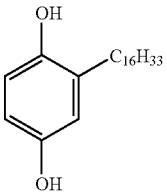
Cpd-6
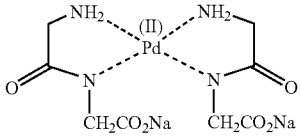
Cpd-7
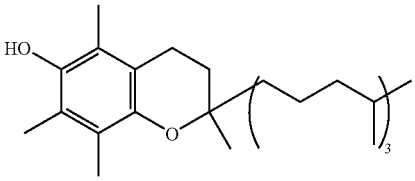
UV-1
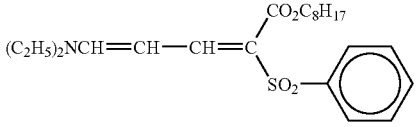
UV-2
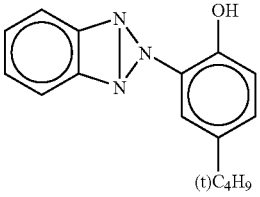
UV-3
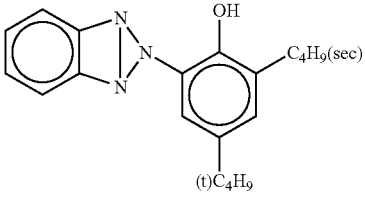
UV-4
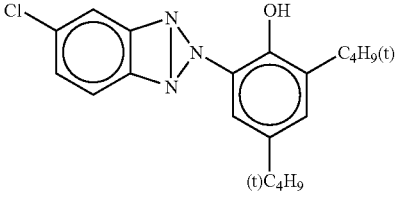

-continued
B-1
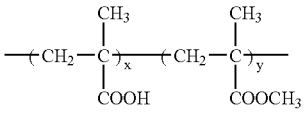
x/y = 10/90 (mass ratio)
average molecular weight : about 35,000
B-2
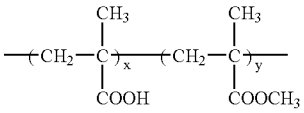
x/y = 40/60 (mass ratio)
average molecular weight : about 20,000
B-3
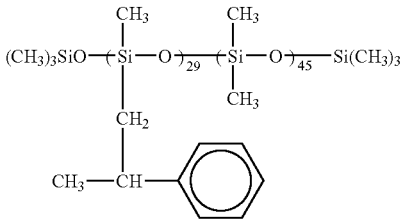
(molecular ratio)
average molecular weight : about 8,000
HBS-1
Tricresyl phosphate
HBS-2
Di-n-butyl-phthalate
HBS-3
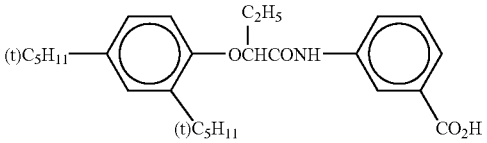
HBS-4
Tri(2-ethylhexyl)phosphate
HBS-5
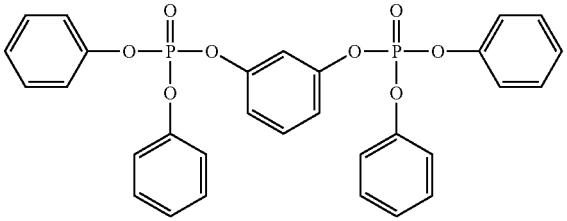
S-1
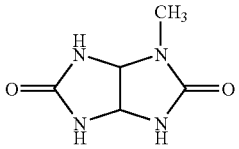
H-1
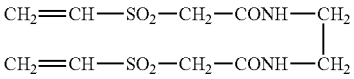
F-1
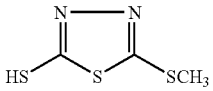
F-2
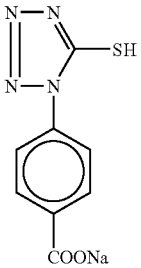
F-3
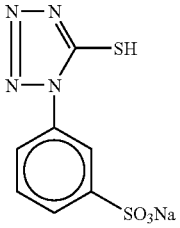
F-4
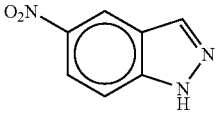

-continued
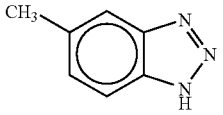
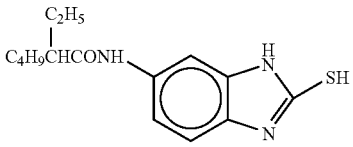
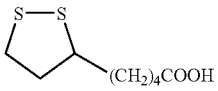
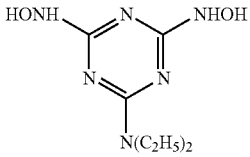
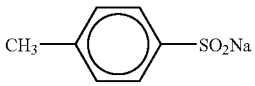
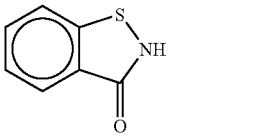
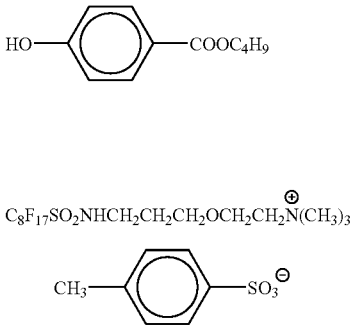
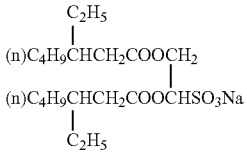
F-5
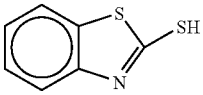
F-6
F-7
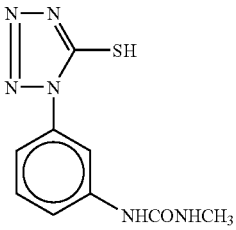
F-8
F-9
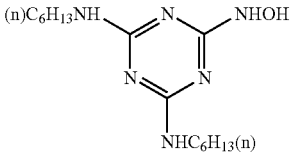
F-10
F-11
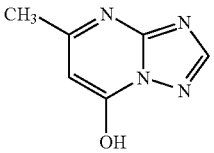
F-12
F-13
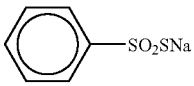
F-14
F-15
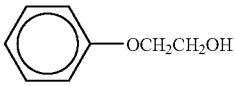
F-16
F-17
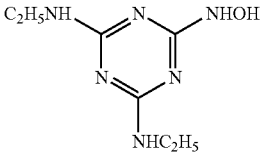
F-18
W-1
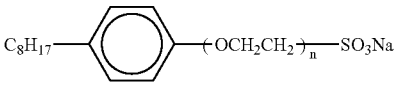
W-2
n = 2~4
W-3
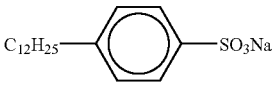
W-4
W-5
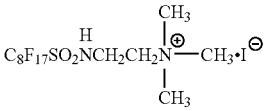
W-6

-continued
B-4
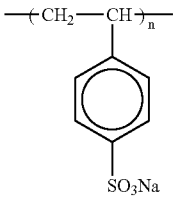
average molecular weight : about 750,000
B-5
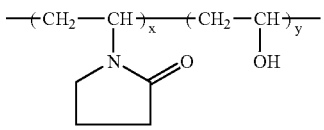
x/y = 70/30 (mass ratio)
average molecular weight : about 17,000
B-6
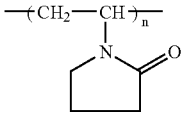
average molecular weight : about 10,000
ExF-1
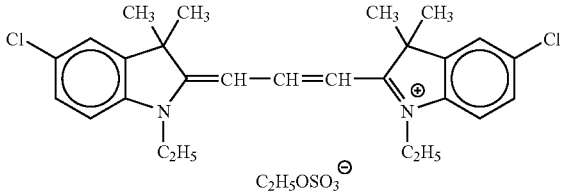
ExF-2
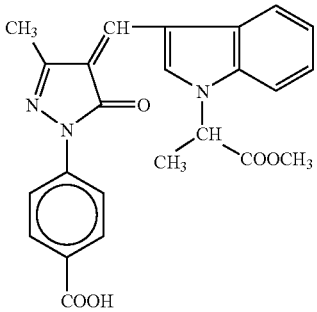
ExF-4
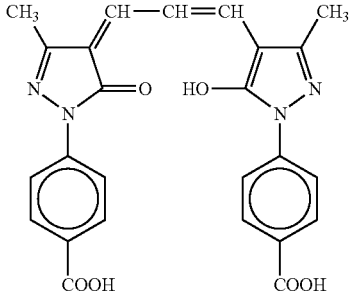
ExF-5
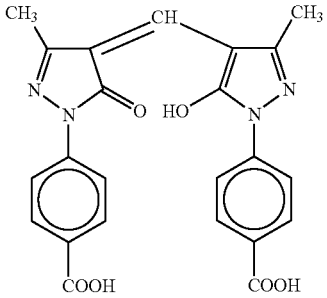
ExF-6
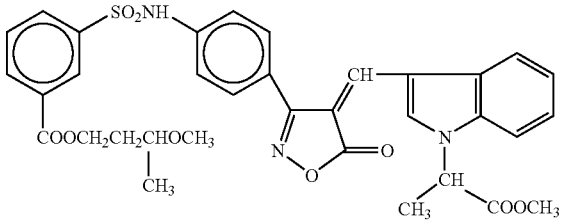
ExF-7
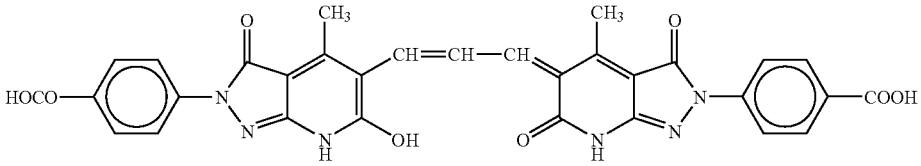

The above-described silver halide color photographic light-sensitive material was named sample 101.

Processing was performed using an automatic processor FP-360 B (trade name) available from Fuji Photo Film Co., Ltd. according to the following steps. Note that the processor was remodeled so that the overflow from the bleaching bath was not introduced to the subsequent bath, but entirely discharged to a waste tank. Note that this FP-360 B was installed with an evaporation correction means described in JIII Technical Disclosure No. 94-4992 (published by Japan Institute of Invention & Innovation).

Processing steps and processing solution compositions are presented below.

(Processing Steps)

(Processing Steps)

| Processing step | Processing time | Processing temperature | Replenisher* | Tank Volume |
|---|---|---|---|---|
| Color developing | 3 min 5 sec | 37.8° C. | 20 ml | 11.5 l |
| Bleaching | 50 sec | 38.0° C. | 5 ml | 5 l |
| Fixing (1) | 50 sec | 38.0° C. | — | 5 l |
| Fixing (2) | 50 sec | 38.0° C. | 8 ml | 5 l |
| Washing | 30 sec | 38.0° C. | 17 ml | 3 l |
| Stabilizing (1) | 20 sec | 38.0° C. | — | 3 l |
| Stabilizing (2) | 20 sec | 38.0° C. | 15 ml | 3 l |
| Drying | 1 min 30 sec | 60.0° C. | | |

*The replenishment rate is represented by a value per 1.1 m of a 35 mm wide light-sensitive material sample (equivalent to one 24-exposure film)

The stabilizer and fixer were made in a counter-flow system from (2) to (1), and the overflow of washing water was entirely introduced to the fixing bath (2). Note that the amount of the developer carried over to the bleaching step, the amount of the bleaching solution carried over to the fixing step, and the amount of the fixer carried over to the washing step were 2.5 ml, 2.0 ml, and 2.0 ml, respectively, per 1.1 m of a 35 mm wide light-sensitive material. Note also the preceding each crossover time was 6 sec, and this time was included in the processing time of the preceding processing step.

The aperture area of the above processor was 100 $cm^2$ for the color developer, 120 $cm^2$ for the bleaching solution, and approximately 100 $cm^2$ for other solutions.

The composition of each processing solution was as follows, respectively:

(Color-developer)

| | Tank solution (g) | Replenisher (g) |
|---|---|---|
| Diethylenetriaminepentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonatoethyl) hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-(β-hydroxyethyl) amino]-aniline sulfonate | 4.5 | 6.5 |

-continued (Color-developer)

| | Tank solution (g) | Replenisher (g) |
|---|---|---|
| Water to make | 1.0 liter | 1.0 liter |
| pH | 10.05 | 10.18 |

(pH was adjusted by potassium hydroxide and sulfuric acid.)

(Bleaching solution)

| | Tank solution (g) | Replenisher (g) |
|---|---|---|
| 1,3-Diaminopropanetetraacetic acid iron (III) ammonium monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 liter | 1.0 liter |
| pH | 4.6 | 4.0 |

(pH was adjusted by aqueous ammonia.)

(Fixing (1) Tank Solution)

A mixed solution of the above bleaching tank solution and the below shown fixing tank solution in the ratio of 5:95 (volume ratio).

(pH 6.8)

(Fixing (2))

| | Tank solution (g) | Replenisher (g) |
|---|---|---|
| Aqueous ammonium thiosulfate solution (750 g/liter) | 240 ml | 720 ml |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1.0 liter | 1.0 liter |
| pH | 7.4 | 7.45 |

(pH was adjusted by aqueous ammonia and acetic acid)

(pH was adjusted by aqueous ammonia and acetic acid)

(Washing Water)

Tap water was treated by passage through a mixed bed ion-exchange column filled with an H-type strong acidic cation exchange resin (Amberlite IR-120B, trade name, made by Rohm & Haas) and an OH-type strong basic anion exchange resin (Amberlite IR-400, the same as the above) so that the concentrations of Ca ions and Mg ions in water were both made to decrease to 3 mg/liter or below, followed by adding 20 mg/liter of sodium dichlorinated isocyanurate and 150 mg/liter of sodium sulfate. The pH of this water was in the range of 6.5 to 7.5.

(Stabilizing Solution)

| (Stabilizing solution) | |
|---|---|
| (Both of tank solution and replenisher) | (g) |
| Sodium p-toluenesulfinate | 0.03 |
| Polyoxyethylene-p-monononylphenylether (av. polymerization degree: 10) | 0.2 |
| Sodium 1,2-benzoisothiazoline-3-one | 0.10 |
| Disodium ethylenediaminetetraacetate | 0.05 |
| 1,2,4-Triazole | 1.3 |
| 1,4-Bis(1,2,4-triazole-1-ylmethyl)piperazine | 0.75 |
| Water to make | 1.0 liter |
| pH | 8.5 |

Samples 102 to 115 were prepared in the same manner as in Sample 101, except that ExY-2 in the 13th and 14th layers was replaced by the compound as shown in Table 4. Then, the samples were stored at 25° C. with RH (relative humidity) 65% for 7 days. These samples were used to be evaluated in the following performances (characteristics).

(Evaluation 1 Calculation of Dmax(UV)/Dmin(V))

A sample subjected to exposure to white light at a color temperature of 4,800° K through a sharp cut filter SC-39 (trade name, manufactured by Fuji Photo Film Co., Ltd.) for an exposure time of 1 second at a quantity of exposure light of 2,000 CMS and a nonexposed sample were each subjected to the color development processing as described above. These two samples, exposed and nonexposed, were measured for color density. Of the values obtained, the one measured for the sample having higher color density (in this Example, the exposed sample) was defined as Dmax, and the one measured for the sample having a lower color density (in this Example, the nonexposed sample) was defined as Dmin. By using 10 $cm^2$ of each sample after the processing, the gelatin in the photographic constituent layer was enzymatically decomposed with 20 ml of water containing 5 mg of actinase at 40° C. for 60 minutes to elute the photographic constituent layer. After cooling the eluate at 25° C., it was treated with 20 ml of ethyl acetate to extract oil-soluble components. The extract was once dried up by use of a rotary evaporator under the conditions of 40° C. under reduced pressure, and the final amount of the extract was made to be 10 ml with ethyl acetate containing 0.3% mass of acetic acid in a volumetric flask. The operations of preparing a solution from the enzymatic decomposition by actinase to this were performed under light-shielded conditions. This solution was measured for absorption spectra at 340 nm to 450 nm in a 1-cm thick silica cell and Dmax(UV))/Dmin(UV) defined below was determined by calculation.

Definition of Dmax(UV)/Dmin(UV): "the smallest value in a range of wavelength UV, in which UV is a wavelength within the range of 340 nm or more and 450 nm or less, among values represented by (an absorbance at a wavelength UV, for a portion having the yellow maximum color density)/(an absorbance at the wavelength UV, for a portion having the yellow minimum color density)."

(Evaluation 2 Calculation of (B−C)/A)

By using the samples used in Evaluation 1, the yellow density B at the portion showing the maximum color density (Dmax) (that is, in this Example, of the exposed sample) and the yellow density C at the portion showing the minimum color density (Dmin) (that is, in this Example, of the nonexposed sample) were measured by use of an SCD meter. (B−C)/A is determined by calculation by using the coating amount of the compound represented by the formula (I), namely A mol/$m^2$.

(Evaluation 3 Static-induced Fog)

Each sample was processed into a roll and rewound at a rate of 100 m/minute in an atmosphere of 25° C. and a relative humidity of 10% in the absence of light, and then the above-mentioned development processing step was performed without exposure to light. The number of static-induced fogs that occurred in the sample (Dmin) after the processing was visually detected. Relative values (%) relative to the number of static-induced fogs occurring in Sample 101 are shown in Table 4 below

TABLE 4

| No. | Coupler in 13th layer (##) | Coupler in 14th layer (##) | Dmax(UV)/Dmin(UV) | (B − C)/A | Static-induced fog |
|---|---|---|---|---|---|
| 101 | ExY-2 | ExY-2 | 1.15 | — | 100 |
| 102 | (31) | ExY-2 | 0.87 | 2600 | 60 |
| 103 | (33) | ExY-2 | 0.85 | 2500 | 50 |
| 104 | (34) | ExY-2 | 0.86 | 2650 | 55 |
| 105 | (39) | ExY-2 | 0.78 | 2580 | 51 |
| 106 | (40) | ExY-2 | 0.75 | 2580 | 49 |
| 107 | (33) | (31) | 0.6 | 2270 | 30 |
| 108 | (33) | (33) | 0.62 | 2300 | 33 |
| 109 | (35) | (35) | 0.64 | 2200 | 35 |
| 110 | (36) | (36) | 0.65 | 2080 | 36 |
| 111 | (37) | (37) | 0.66 | 2100 | 34 |
| 112 | (39) | (39) | 0.62 | 2200 | 31 |
| 113 | (40) | (40) | 0.55 | 2200 | 32 |
| 114 | ExY-2/(39) *1 | (39) | 0.89 | 3800 | 59 |
| 115 | ExY-2/(40) *2 | ExY-2/(40) *2 | 0.9 | 8900 | 70 |

(##) When replacing ExY-2 with the coupler according to the present invention, the amount of the coupler according to the present invention was 0.8 times that of ExY-2 in terms of mole.
*1 50:40 mixture (molar ratio assuming that the amount of ExY-2 in Sample 101 is made up to 100)
*2 75:20 mixture (molar ratio assuming that the amount of ExY-2 in Sample 101 is made up to 100)

From Table 4 above, it can be seen that the photosensitive material of the present invention is apparently excellent in static-induced fog.

Example 1-2

As shown in Table 5, samples prepared in the same manner as in Example 1-1 except that the $15^{th}$ layer was changed in each sample of Example 1-1 as described below were subjected to Evaluations 1, 2 and 3 as in Example 1-1 as well as the following evaluation. Also, the sample described in JP-A-6-130549 was subjected to the same evaluations.

$15^{th}$ Layer (First Protective Layer)

| | | |
|---|---|---|
| 0.07-μm Silver iodobromide emulsion | Silver | 0.301 |
| UV-1 | | 0.175 |
| UV-2 | | 0.110 |
| UV-3 | | 0.164 |
| UV-4 | | 0.022 |
| F-11 | | 0.009 |
| S-1 | | 0.086 |
| HBS-1 | | 0.175 |
| HBS-4 | | 0.050 |
| Gelatin | | 1.647 |

(Evaluation 4 Evaluation of Sharpness)

By using the above-mentioned sample, a pattern for evaluating MTF was written by exposure to white light and then the above-mentioned color development processing was performed in the same manner. The sharpness of magenta density is shown in a relative value relative to that of Sample 101. The greater the numerical value is, the higher the sharpness is, which is more preferred.

TABLE 5

| No. | Sample No. in Example 1-1 which was to be modified | Modification in 15th layer | Dmax(UV)/ Dmin(UV) | (B − C)/A | Static-induced fog | Sharpness G |
|---|---|---|---|---|---|---|
| 101 | 101 | Not modified | 1.15 | — | 100 | 1.00 |
| 108 | 108 | Not modified | 0.62 | 2300 | 33 | 1.20 |
| 201 | 101 | Modified | 1.15 | — | 130 | 1.15 |
| 202 | 108 | Modified | 0.62 | 2300 | 70 | 1.28 |
| 203 | 109 | Modified | 0.64 | 2200 | 75 | 1.30 |
| 204 | 112 | Modified | 0.62 | 2200 | 82 | 1.25 |
| 206 | 113 | Modified | 0.55 | 2200 | 73 | 1.27 |
| 207* | — | — | 1.17 | — | 105 | 1.02 |
| 208* | — | — | 1.17 | — | 107 | 1.01 |

*Samples described in Table 1 of Example 1 in JP-A-6-130549

From Table 5, it can be seen clearly that the silver halide photographic sensitive material of the present invention is excellent in static-induced fog and in sharpness.

Example 1-3

Samples prepared in Example 1-1 and Example 1-2 were processed into a roll of a width of 35 mm, packed into a patrone and subjected to camera passing tests under the conditions of a relative humidity of 10% and room temperature (25° C.) by feeding the film at a high speed. The samples were processed by the above-mentioned development processing and then evaluated on fog, respectively. As a result, samples that were found to be effective to static-induced fog in Examples 1-1 and 1-2 showed no fogs.

Example 1-4

Preparation of Sample having Multilayers

Preparation of Silver Halide Color Photographic Light-Sensitive Material, Sample CR01

(i) Coating of Backing Layers

The following backing layers were coated on one side of triacetylcellulose having the thick of 205 μm support provided with undercoat on both sides.

First Layer

| | |
|---|---|
| Binder: acid-processed gelatin (isoelectric point 9.0) | 1.00 g |
| Polymer latex P-2 (av. particle diameter 0.1 μm) | 0.13 g |
| Polymer latex P-3 (av. particle diameter 0.2 μm) | 0.23 g |
| Ultraviolet ray absorbent U-1 | 0.030 g |
| Ultraviolet ray absorbent U-3 | 0.010 g |
| Ultraviolet ray absorbent U-4 | 0.020 g |
| High-boiling organic solvent Oil-2 | 0.030 g |
| Surface active agent W-3 | 0.010 g |
| Surface active agent W-6 | 3.0 mg |

Second Layer

| | |
|---|---|
| Binder: acid-processed gelatin (isoelectric point 9.0) | 3.10 g |
| Polymer latex: P-3 (av. particle diameter 0.2 μm) | 0.11 g |

-continued

| | |
|---|---|
| Ultraviolet ray absorbent U-1 | 0.030 g |
| Ultraviolet ray absorbent U-3 | 0.010 g |
| Ultraviolet ray absorbent U-4 | 0.020 g |
| High-boiling organic solvent Oil-2 | 0.030 g |
| Surface active agent W-3 | 0.010 g |
| Surface active agent W-6 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |

Third Layer

| | |
|---|---|
| Binder: acid-processed gelatin (isoelectric point 9.0) | 3.30 g |
| Surface active agent W-3 | 0.020 g |
| Potassium sulfate | 0.30 g |
| Sodium hydroxide | 0.03 g |

Fourth Layer

| | |
|---|---|
| Binder: lime-processed gelatin (isoelectric point 5.4) | 1.15 g |
| Copolymer of methacrylic acid and methyl methacrylate (1:9) (av. particle diameter, 2.0 μm) | 0.040 g |
| Copolymer of methacrylic acid and methyl methacrylate (6:4) (av. particle diameter, 2.0 μm) | 0.030 g |
| Surface active agent W-3 | 0.060 g |
| Surface active agent W-2 | 0.010 g |
| Hardener H-1 | 0.23 g |

(iv) Coating of Light-sensitive Emulsion Layers

The surface of the support on the side opposite to the backing layer, was coated with light-sensitive emulsion layers having the following compositions to produce a sample CR01. The number corresponding to each ingredient indicates the addition amount per $m^2$. Note that the effect of the compound added is not limited to the use of the compound described below.

First layer: Anti-halation Layer

| | |
|---|---|
| Black colloidal silver | 0.20 g |
| Gelatin | 2.50 g |
| Compound Cpd-B | 0.050 g |
| Ultraviolet absorber U-1 | 0.050 g |
| Ultraviolet absorber U-3 | 0.10 g |
| Ultraviolet absorber U-4 | 0.030 g |
| Ultraviolet absorber U-5 | 0.050 g |
| Ultraviolet absorber U-7 | 0.10 g |
| Compound Cpd-F | 0.20 g |
| High boiling organic solvent Oil-1 | 0.10 g |
| High boiling organic solvent Oil-2 | 0.15 g |
| High boiling organic solvent Oil-5 | 0.010 g |
| Dye D-4 | 1.0 mg |
| Dye D-8 | 2.5 mg |
| Fine crystal solid dispersion of Dye E-1 | 0.05 g |

Second Layer: Intermediate Layer

| | |
|---|---|
| Gelatin | 1.8 g |
| Compound Cpd-M | 0.20 g |
| Compound Cpd-F | 0.050 g |
| Compound Cpd-K | 3.0 mg |
| Ultraviolet absorber U-6 | 6.0 mg |
| High boiling organic solvent Oil-3 | 0.010 g |
| High boiling organic solvent Oil-4 | 0.010 g |
| High boiling organic solvent Oil-6 | 0.10 g |
| High boiling organic solvent Oil-7 | 2.0 mg |
| Dye D-7 | 4.0 mg |

Third Layer: Intermediate Layer

| | |
|---|---|
| Gelatin | 0.40 g |
| Compound Cpd-D | 0.020 g |
| High boiling organic solvent Oil-3 | 0.010 g |
| High boiling organic solvent Oil-8 | 0.010 g |

Forth Layer: Low-sensitivity Red-sensitive Emulsion Layer

| | | |
|---|---|---|
| Emulsion A | Silver | 0.15 g |
| Emulsion B | Silver | 0.15 g |
| Emulsion C | Silver | 0.15 g |
| Gelatin | | 0.80 g |
| Coupler C-1 | | 0.10 g |
| Coupler C-2 | | 7.0 mg |
| Coupler C-10 | | 2.0 mg |
| Ultraviolet absorber U-3 | | 0.010 g |
| Compound Cpd-I | | 5.0 mg |
| Compound Cpd-D | | 3.0 mg |
| Compound Cpd-J | | 2.0 mg |
| High boiling organic solvent Oil-10 | | 0.030 g |
| Additive P-1 | | 5.0 mg |

Fifth Layer: Middle-sensitivity Red-sensitive Emulsion Layer

| | | |
|---|---|---|
| Emulsion C | Silver | 0.15 g |
| Emulsion D | Silver | 0.15 g |
| Silver bromide emulsion, with inner part of which was fogged (cube, av. sphere-equivalent diameter of 0.11 μm) | Silver | 3.0 mg |
| Gelatin | | 0.70 g |
| Coupler C-1 | | 0.15 g |
| Coupler C-2 | | 7.0 mg |
| Compound Cpd-D | | 3.0 mg |
| Ultraviolet absorber U-3 | | 0.010 g |
| High boiling organic solvent Oil-10 | | 0.030 g |
| Additive P-1 | | 7.0 mg |

Sixth Layer: High-sensitivity Red-sensitive Emulsion Layer

| | | |
|---|---|---|
| Emulsion E | Silver | 0.20 g |
| Emulsion F | Silver | 0.20 g |
| Gelatin | | 1.50 g |
| Coupler C-1 | | 0.60 g |
| Coupler C-2 | | 0.025 g |
| Coupler C-3 | | 0.020 g |
| Coupler C-9 | | 5.0 mg |
| Ultraviolet absorber U-1 | | 0.010 g |
| Ultraviolet absorber U-2 | | 0.010 g |
| High boiling organic solvent Oil-6 | | 0.030 g |
| High boiling organic solvent Oil-9 | | 0.020 g |
| High boiling organic solvent Oil-10 | | 0.20 g |
| Compound Cpd-D | | 5.0 mg |
| Compound Cpd-K | | 1.0 mg |
| Compound Cpd-F | | 0.030 g |
| Compound Cpd-L | | 1.0 mg |
| Compound Cpd-R | | 0.030 g |
| Additive P-1 | | 0.010 g |
| Additive P-4 | | 0.030 g |

Seventh Layer: Intermediate Layer

| | |
|---|---|
| Gelatin | 0.60 g |
| Additive P-2 | 0.10 g |
| Dye D-5 | 0.020 g |
| Dye D-9 | 6.0 mg |
| Compound Cpd-I | 0.010 g |
| Compound Cpd-O | 3.0 mg |
| Compound Cpd-P | 5.0 mg |
| High boiling organic solvent Oil-6 | 0.050 g |

Eighth Layer: Intermediate Layer

| | | |
|---|---|---|
| Yellow colloidal silver | Silver | 0.010 g |
| Gelatin | | 1.30 g |
| Additive P-2 | | 0.05 g |
| Ultraviolet absorber U-1 | | 0.010 g |
| Ultraviolet absorber U-2 | | 0.030 g |
| Compound Cpd-A | | 0.050 g |
| Compound Cpd-D | | 0.030 g |
| Compound Cpd-M | | 0.10 g |
| High boiling organic solvent Oil-3 | | 0.010 g |
| High boiling organic solvent Oil-6 | | 0.10 g |

Ninth Layer: Low-sensitivity Green-sensitive Emulsion layer

| | | |
|---|---|---|
| Emulsion G | Silver | 0.15 g |
| Emulsion H | Silver | 0.30 g |
| Emulsion I | Silver | 0.15 g |
| Gelatin | | 1.30 g |
| Coupler C-4 | | 0.10 g |
| Coupler C-5 | | 0.030 g |
| Compound Cpd-A | | 5.0 mg |
| Compound Cpd-B | | 0.020 g |
| Compound Cpd-G | | 2.5 mg |
| Compound Cpd-F | | 0.010 g |
| Compound Cpd-K | | 2.0 mg |
| High boiling organic solvent Oil-2 | | 0.040 g |
| Additive P-1 | | 5.0 mg |

Tenth Layer: Middle-sensitivity Green-sensitive Emulsion layer

| | | |
|---|---|---|
| Emulsion I | Silver | 0.20 g |
| Emulsion J | Silver | 0.20 g |
| Silver bromide emulsion, with inner part of which was fogged (cube, av. sphere-equivalent diameter of 0.11 μm) | Silver | 3.0 mg |
| Gelatin | | 0.50 g |
| Coupler C-4 | | 0.15 g |
| Coupler C-5 | | 0.050 g |
| Coupler C-6 | | 0.010 g |
| Compound Cpd-A | | 5.0 mg |
| Compound Cpd-B | | 0.020 g |
| High boiling organic solvent Oil-2 | | 0.020 g |

Eleventh Layer: High-sensitivity Green-sensitive Emulsion layer

| | | |
|---|---|---|
| Emulsion K | Silver | 0.40 g |
| Gelatin | | 1.20 g |
| Coupler C-4 | | 0.50 g |
| Coupler C-5 | | 0.20 g |
| Coupler C-7 | | 0.050 g |
| Compound Cpd-B | | 0.030 g |
| Compound Cpd-F | | 0.010 g |
| High boiling organic solvent Oil-2 | | 0.050 g |
| High boiling organic solvent Oil-9 | | 0.020 g |

Twelfth Layer: Yellow Filter Layer

| | | |
|---|---|---|
| Yellow colloidal silver | Silver | 5.0 mg |
| Gelatin | | 1.0 g |
| Compound Cpd-C | | 0.010 g |
| Compound Cpd-M | | 0.030 g |
| High boiling organic solvent Oil-1 | | 0.020 g |
| High boiling organic solvent Oil-6 | | 0.040 g |
| Fine crystal solid dispersion of Dye E-2 | | 0.20 g |
| Thirteenth layer: Intermediate layer | | |
| Gelatin | | 0.40 g |
| Compound Cpd-Q | | 0.20 g |
| Dye D-6 | | 4.0 mg |

Fourteenth Layer: Low-sensitivity Blue-sensitive Emulsion layer

| | | |
|---|---|---|
| Emulsion L | Silver | 0.15 g |
| Emulsion M | Silver | 0.10 g |
| Emulsion N | Silver | 0.10 g |
| Gelatin | | 0.80 g |
| Coupler C-8 | | 0.30 g |
| Compound Cpd-B | | 0.10 g |
| Compound Cpd-I | | 8.0 mg |
| Compound Cpd-K | | 1.0 mg |
| Ultraviolet absorber U-6 | | 0.010 g |
| High boiling organic solvent Oil-2 | | 0.010 g |

Fifteenth Layer: Middle-sensitivity Blue-sensitive Emulsion Layer

| | | |
|---|---|---|
| Emulsion N | Silver | 0.10 g |
| Emulsion O | Silver | 0.20 g |
| Gelatin | | 0.80 g |
| Coupler C-8 | | 0.30 g |
| Compound Cpd-B | | 0.10 g |
| Compound Cpd-E | | 0.030 g |
| Compound Cpd-N | | 2.0 mg |
| High boiling organic solvent Oil-2 | | 0.010 g |

Sixteenth Layer: High-sensitivity Blue-sensitive Emulsion Layer

| | | |
|---|---|---|
| Emulsion P | Silver | 0.20 g |
| Emulsion Q | Silver | 0.25 g |
| Gelatin | | 2.00 g |
| Coupler C-8 | | 1.40 g |
| Coupler C-2 | | 0.010 g |
| High boiling organic solvent Oil-2 | | 0.030 g |
| Ultraviolet absorber U-6 | | 0.10 g |
| Compound Cpd-E | | 0.20 g |
| Compound Cpd-N | | 5.0 mg |

Seventeenth Layer: First Protective Layer

| | |
|---|---|
| Gelatin | 1.00 g |
| Ultraviolet absorber U-1 | 0.10 g |
| Ultraviolet absorber U-2 | 0.050 g |
| Ultraviolet absorber U-5 | 0.10 g |
| Ultraviolet absorber U-7 | 0.10 g |
| Compound Cpd-B | 0.020 g |
| Compound Cpd-O | 5.0 mg |
| Compound Cpd-A | 0.030 g |
| Compound Cpd-H | 0.20 g |
| Dye D-1 | 8.0 mg |
| Dye D-2 | 0.010 g |
| Dye D-3 | 0.010 g |
| High boiling organic solvent Oil-3 | 0.10 g |

Eighteenth Layer: Second Protective Layer

| | | |
|---|---|---|
| Colloidal silver | Silver | 2.5 mg |
| Fine grain silver iodobromide emulsion (av. grain diameter of 0.06 μm, AgI content of 1 mol %) | Silver | 0.10 g |
| Gelatin | | 0.80 g |

-continued

| | |
|---|---|
| Ultraviolet absorber U-1 | 0.030 g |
| Ultraviolet absorber U-6 | 0.030 g |
| High boiling organic solvent Oil-3 | 0.010 g |

Nineteenth Layer: Third Protective Layer

| | |
|---|---|
| Gelatin | 1.00 g |
| Polymethyl methacrylate (av. particle diameter of 1.5 μm) | 0.10 g |
| Copolymer of methyl methacrylate and methacrylic acid (6:4) (av. particle diameter, 1.5 μm) | 0.15 g |

-continued

| | |
|---|---|
| Silicone oil SO-1 | 0.20 g |
| Surface active agent W-1 | 3.0 mg |
| Surface active agent W-2 | 8.0 mg |
| Surface active agent W-3 | 0.040 g |
| Surface active agent W-7 | 0.015 g |

Further, to all emulsion layers, in addition to the above-described components, additives F-1 to F-9 were added. Further, to each layer, in addition to the above-described components, a gelatin hardener H-1 and surface active agents W-3, W-4, W-5, and W-6 for coating and emulsifying, were added.

Further, as antifungal and antibacterial agents, phenol, 1,2-benzisothiazoline-3-one, 2-phenoxyethanol, phenetylalcohol, and p-hydroxybenzoic acid butyl ester were added.

TABLE 6

Constitution for silver halide emulsion

Silver iodobromide emulsions used in Sample 101

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) |
|---|---|---|---|---|---|---|---|---|---|---|---|
| A | Monodisperse tetradecahedral grains | 0.24 | 9 | 3.5 | Triple structured | 1.5 | | ○ | | | |
| B | Monodisperse (111) tabular grains Average aspect ratio 3.0 | 0.25 | 10 | 3.5 | Quadruple structured | 1.5 | ○ | | ○ | ○ | ○ |
| C | Monodisperse (111) tabular grains Average aspect ratio 4.5 | 0.35 | 19 | 3.0 | Triple structured | 0.1 | ○ | ○ | | ○ | ○ |
| D | Monodisperse (111) tabular grains Average aspect ratio 6.0 | 0.35 | 21 | 4.8 | Triple structured | 2.0 | ○ | ○ | | ○ | ○ |
| E | Monodisperse (111) tabular grains Average aspect ratio 6.0 | 0.45 | 10 | 2.0 | Quadruple structured | 1.5 | | ○ | | | |
| F | Monodisperse (111) tabular grains Average aspect ratio 8.0 | 0.60 | 12 | 1.6 | Triple structured | 0.6 | ○ | ○ | | | ○ |
| G | Monodisperse cubic grains | 0.15 | 9 | 3.5 | Quadruple structured | 2.0 | | | ○ | | |
| H | Monodisperse cubic grains | 0.24 | 12 | 4.9 | Quadruple structured | 0.1 | ○ | ○ | | ○ | |
| I | Monodisperse (111) tabular grains Average aspect ratio 4.0 | 0.30 | 12 | 3.5 | Quintet structured | 4.5 | ○ | ○ | | ○ | ○ |
| J | Monodisperse (111) tabular grains Average aspect ratio 7.0 | 0.45 | 21 | 3.0 | Quadruple structured | 0.2 | ○ | ○ | | ○ | ○ |
| K | Monodisperse (111) tabular grains Average aspect ratio 8.5 | 0.60 | 13 | 2.7 | Triple structured | 1.3 | ○ | ○ | | | ○ |
| L | Monodisperse tetradecahedral gains | 0.31 | 9 | 7.5 | Triple structured | 7.0 | | | ○ | | ○ |

TABLE 6-continued

Constitution for silver halide emulsion

Silver iodobromide emulsions used in Sample 101

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) |
|---|---|---|---|---|---|---|---|---|---|---|---|
| M | Monodisperse tetradecahedral grains | 0.31 | 9 | 7.5 | Triple structured | 5.0 | | ○ | | ○ | ○ |
| N | Monodisperse (111) tabular grains Average aspect ratio 3.0 | 0.33 | 13 | 2.1 | Quadruple structured | 4.0 | ○ | ○ | ○ | | |
| O | Monodisperse (111) tabular grains Average aspect ratio 5.0 | 0.43 | 9 | 2.5 | Quadruple structured | 1.0 | | ○ | | ○ | ○ |
| P | Monodisperse (111) tabular grains Average aspect ratio 9.0 | 0.75 | 21 | 2.8 | Triple structured | 0.5 | ○ | ○ | | | ○ |
| Q | Monodisperse (111) tabular grains Average aspect ratio 9.0 | 0.90 | 8 | 1.0 | Quadruple structured | 0.5 | ○ | ○ | | | ○ |

(Other characteristics above)
(1): A reduction sensitizer was added during formation of grains.
(2): A selenium sensitizer was used as an after-ripening chemical.
(3): A rhodium salt was added during formation of grains.
(4): After completion of after-ripening, silver nitrate in an amount of 10% in terms of the silver molar ratio relative to the emulsion grains at the time, and potassium bromide in an equimolar amount to the silver nitrate, were added to form shells.
(5): The presence of 10 or more dislocation lines/grain on average was observed under a transmission electron microscope.

All the photosensitive emulsions were after-ripened using sodium thiosulfate, potassium thiocyanate and sodium chloroaurate. Further, an iridium salt was added as necessary during formation of grains.

Chemically modified gelatin whose amino groups had been partially converted into phthalic amide was added to the emulsions B, C, E, H, J, N, Q and R when the emulsions were prepared.

TABLE 7

Spectral sensitization of Emulsions A to P

| Emulsion | Added sensitizing dye | Added amount per 1 mol of silver halide (g) | Stage when a sensitizing dye was added |
|---|---|---|---|
| A | S-1 | 0.01 | After afterripening |
| | S-2 | 0.15 | Before afterripening |
| | S-3 | 0.02 | Before afterripening |
| | S-8 | 0.03 | Before afterripening |
| | S-13 | 0.25 | Before afterripening |
| | S-14 | 0.01 | Before afterripening |
| B | S-2 | 0.15 | Before afterripening |
| | S-3 | 0.02 | Before afterripening |
| | S-8 | 0.03 | Before afterripening |
| | S-13 | 0.25 | Before afterripening |
| | S-14 | 0.01 | Before afterripening |
| C | S-2 | 0.25 | Before afterripening |
| | S-8 | 0.04 | Before afterripening |
| | S-13 | 0.20 | Before afterripening |
| D | S-2 | 0.2 | After afterripening |
| | S-3 | 0.05 | After afterripening |
| | S-8 | 0.05 | Before afterripening |
| | S-13 | 0.25 | Before afterripening |
| E | S-1 | 0.01 | Before afterripening |
| | S-2 | 0.25 | Before afterripening |
| | S-8 | 0.05 | Before afterripening |
| | S-13 | 0.25 | After afterripening |

TABLE 7-continued

Spectral sensitization of Emulsions A to P

| Emulsion | Added sensitizing dye | Added amount per 1 mol of silver halide (g) | Stage when a sensitizing dye was added |
|---|---|---|---|
| F | S-2 | 0.2 | Before afterripening |
| | S-3 | 0.04 | Before afterripening |
| | S-8 | 0.20 | Before afterripening |
| G | S-4 | 0.3 | After afterripening |
| | S-5 | 0.05 | After afterripening |
| | S-12 | 0.1 | After afterripening |
| H | S-4 | 0.2 | Before afterripening |
| | S-5 | 0.05 | After afterripening |
| | S-9 | 0.15 | Before afterripening |
| | S-14 | 0.02 | After afterripening |
| I | S-4 | 0.3 | Before afterripening |
| | S-9 | 0.2 | Before afterripening |
| | S-12 | 0.1 | Before afterripening |
| J | S-4 | 0.35 | Before afterripening |
| | S-5 | 0.05 | After afterripening |
| | S-12 | 0.1 | Before afterripening |
| K | S-4 | 0.3 | Before afterripening |
| | S-9 | 0.05 | Before afterripening |
| | S-12 | 0.1 | Before afterripening |
| | S-14 | 0.02 | Before afterripening |
| L, M | S-6 | 0.1 | After afterripening |
| | S-10 | 0.2 | After afterripening |
| | S-11 | 0.05 | After afterripening |
| N | S-6 | 0.05 | After afterripening |
| | S-7 | 0.05 | After afterripening |
| | S-10 | 0.25 | After afterripening |
| | S-11 | 0.05 | After afterripening |
| O | S-10 | 0.4 | After afterripening |
| | S-11 | 0.15 | After afterripening |
| P | S-6 | 0.05 | After afterripening |
| | S-7 | 0.05 | After afterripening |
| | S-10 | 0.3 | Before afterripening |
| | S-11 | 0.1 | Before afterripening |
| Q | S-6 | 0.05 | Before afterripening |
| | S-7 | 0.05 | Before afterripening |
| | S-10 | 0.2 | Before afterripening |
| | S-11 | 0.25 | Before afterripening |

C-1

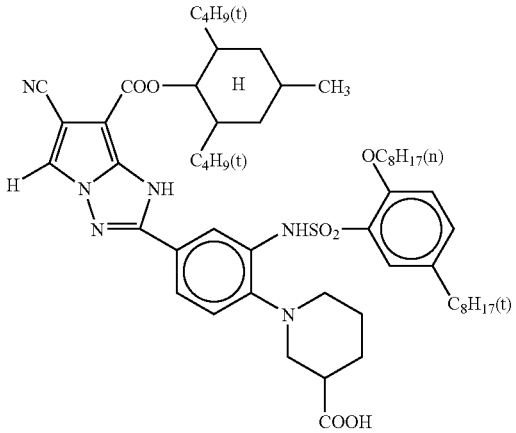

C-2

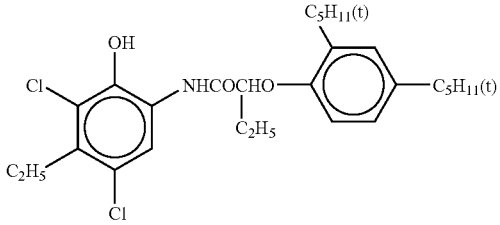

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
| C-3 | 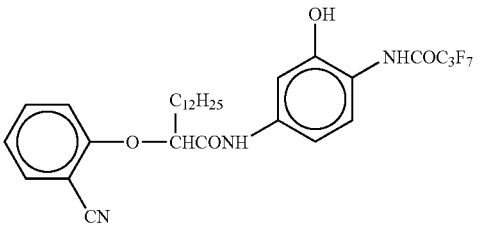 | | |
| C-4 | 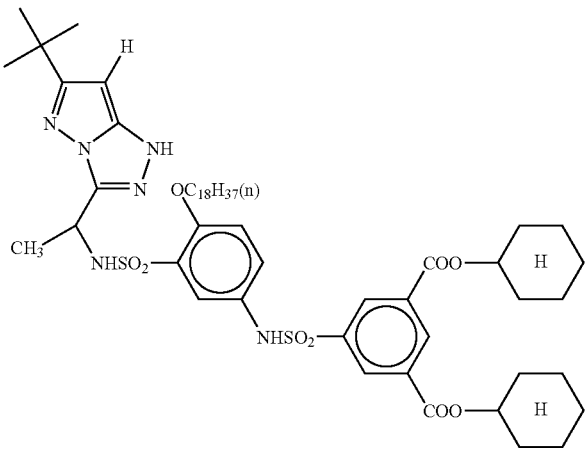 | | |
| C-5 | 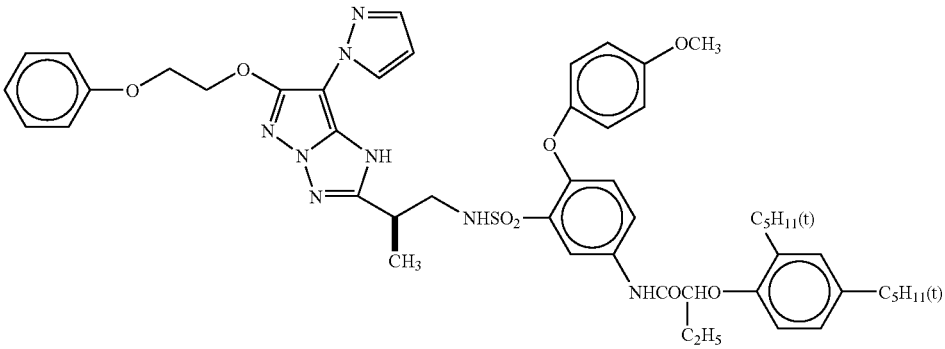 | | |
| C-6 | 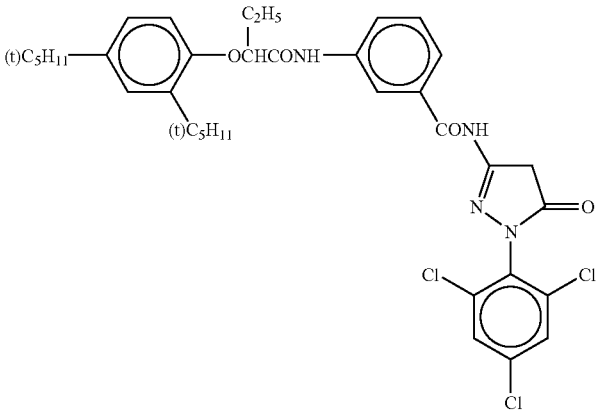 | | |

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
C-7
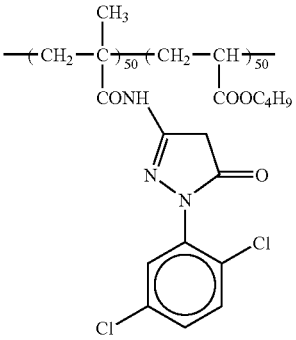
Number means mass %.
Average molecular weight: about 25,000
C-8
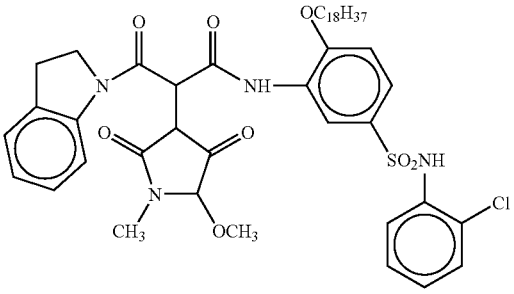
C-9
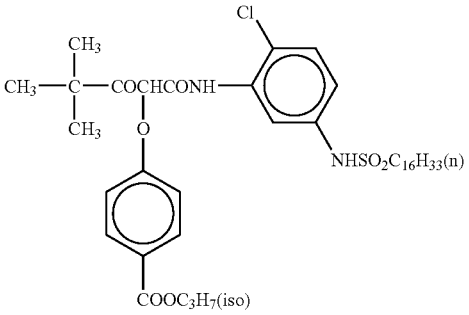
C-10
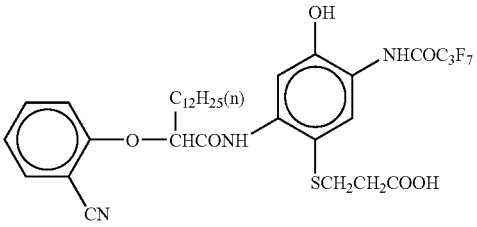
Oil-1
Tri-n-hexyl phosphate
Oil-2
Tricresyl phosphate
Oil-3
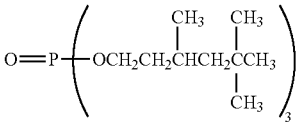

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
Oil-4
Tricyclohexyl phosphate
Oil-5
Bis(2-ethylhexyl)succinate
Oil-6
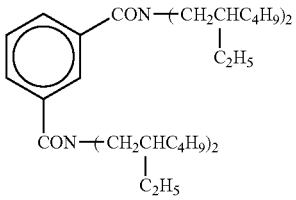
Oil-7
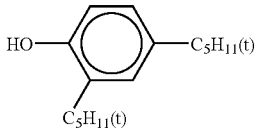
Oil-8
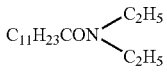
Oil-9
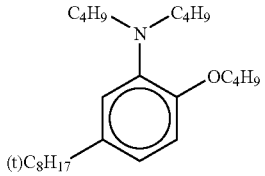
Oil-10
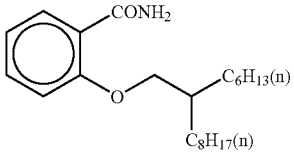
Cpd-A
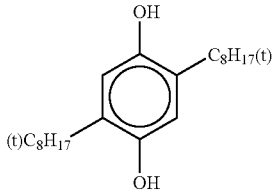
Cpd-B
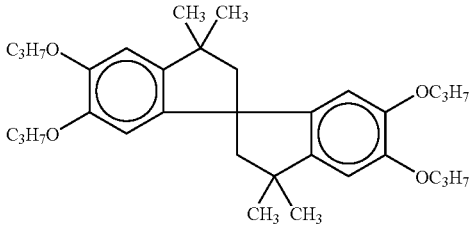

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
Cpd-C
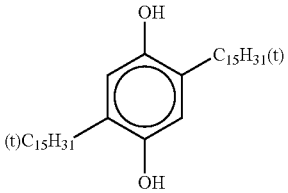
Cpd-D
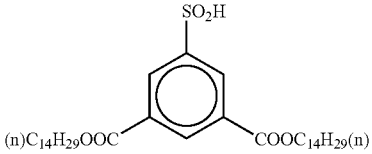
Cpd-E
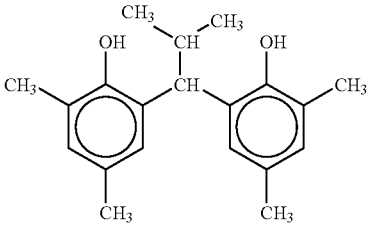
Cpd-F
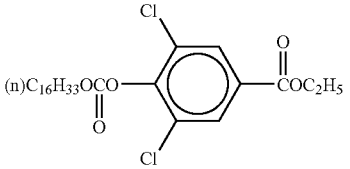
Cpd-G
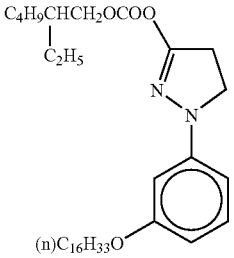
Cpd-H
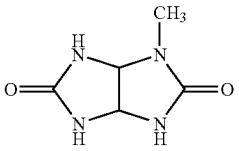
Cpd-I
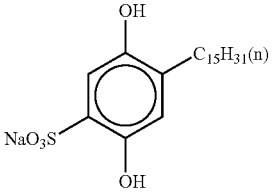

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
Cpd-J
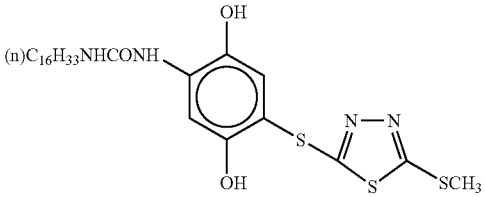
Cpd-K
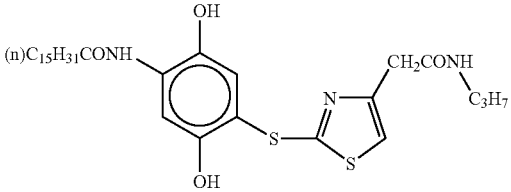
Cpd-L
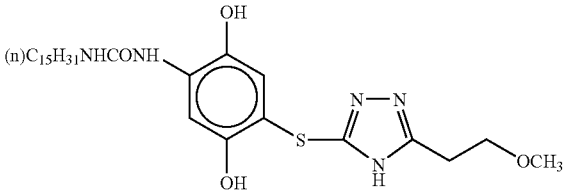
Cpd-M
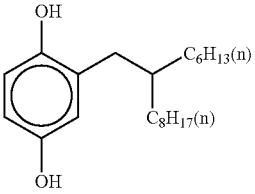
Cpd-N
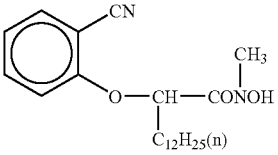
Cpd-O
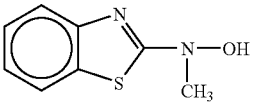
Cpd-P
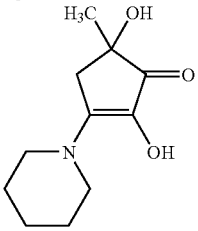
Cpd-Q
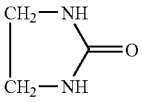

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
Cpd-R
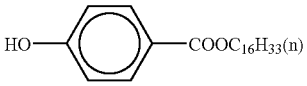
U-1
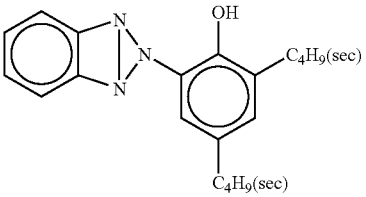
U-2
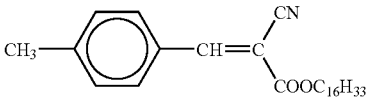
U-3
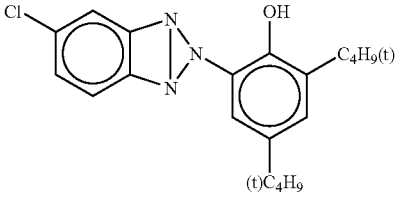
U-4
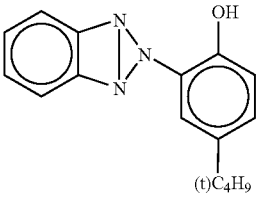
U-5
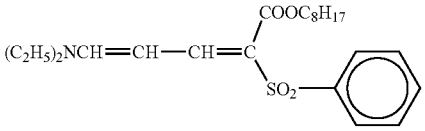
U-6
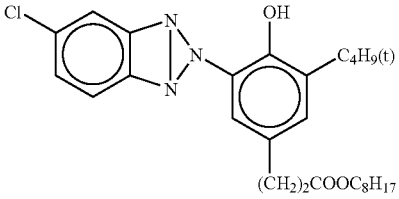

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
| U-7 | 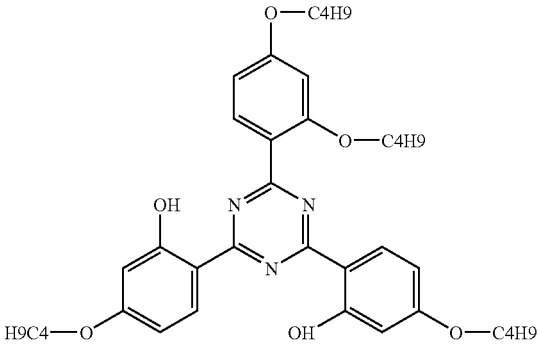 | | |
| S-1 | 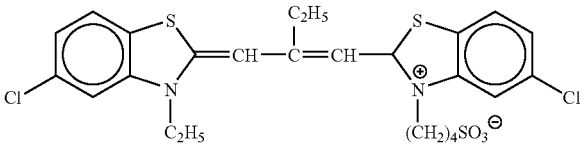 | | |
| S-2 | 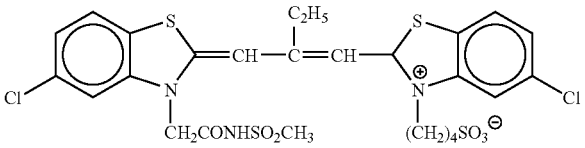 | | |
| S-3 | 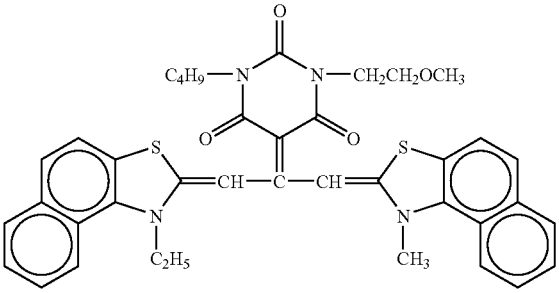 | | |
| S-4 | 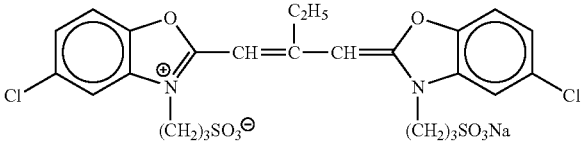 | | |
| S-5 | 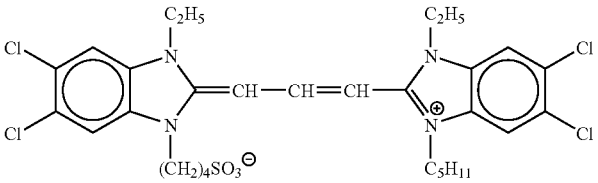 | | |

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
| S-6 | 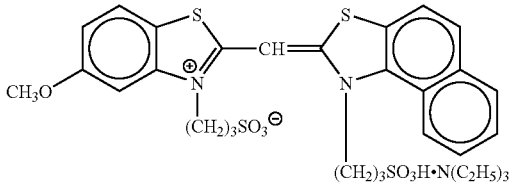 | | |
| S-7 | 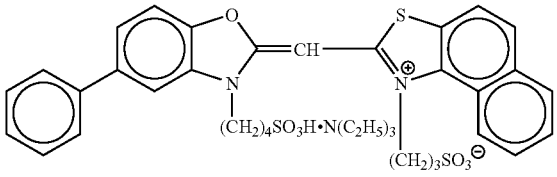 | | |
| S-8 | 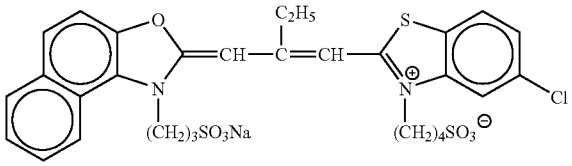 | | |
| S-9 | 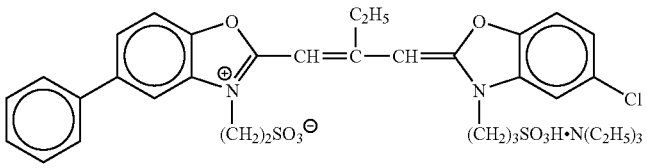 | | |
| S-10 | 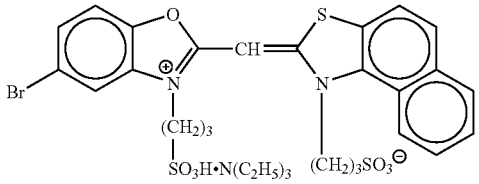 | | |
| S-11 | 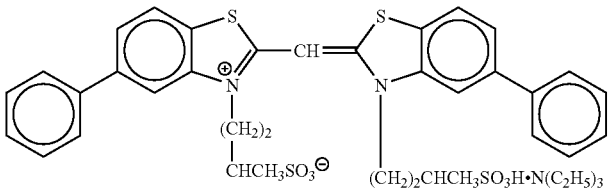 | | |
| S-12 | 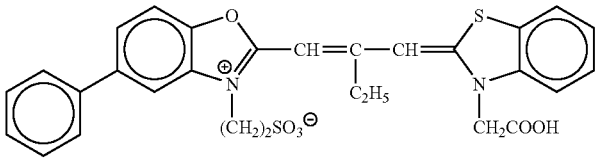 | | |

TABLE 7-continued
Spectral sensitization of Emulsions A to P
| Emulsion | Added sensitizing dye | Added amount per 1 mol of silver halide (g) | Stage when a sensitizing dye was added |
|---|---|---|---|
S-13
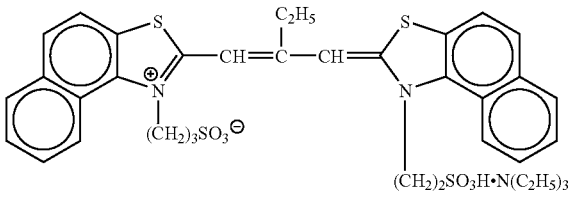
S-14
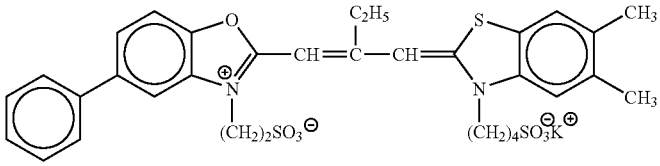
D-1
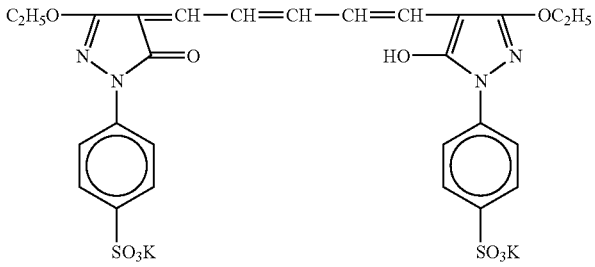
D-2
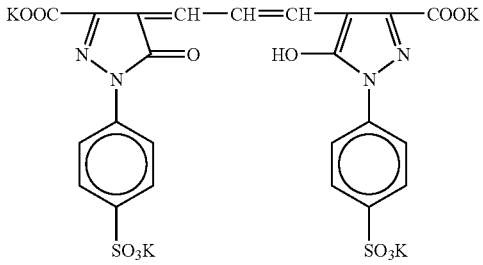
D-3
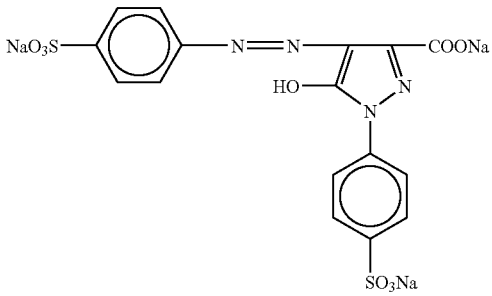

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
D-4
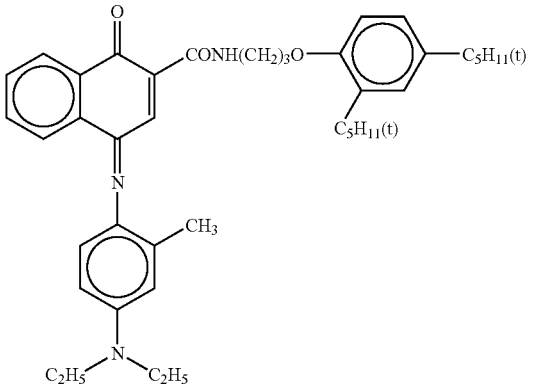
D-5
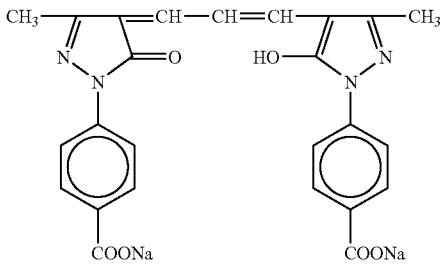
D-6
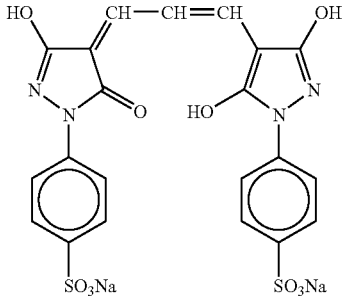
D-7
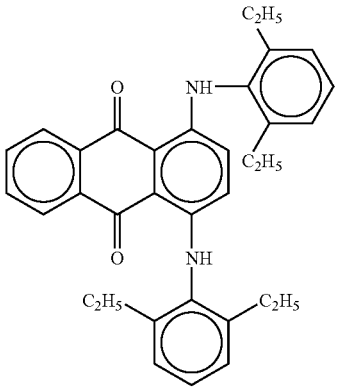

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
| D-8 | 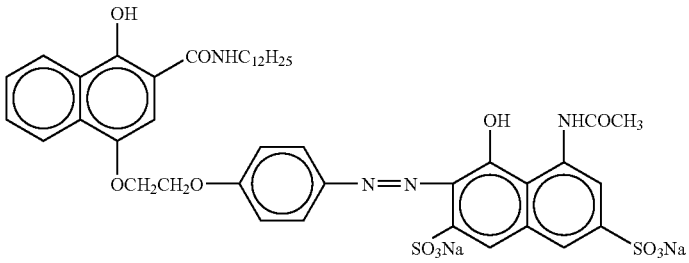 | | |
| D-9 | 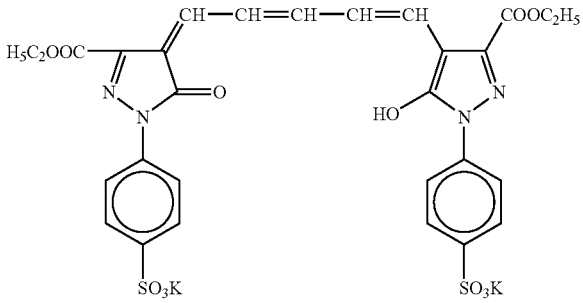 | | |
| D-10 | 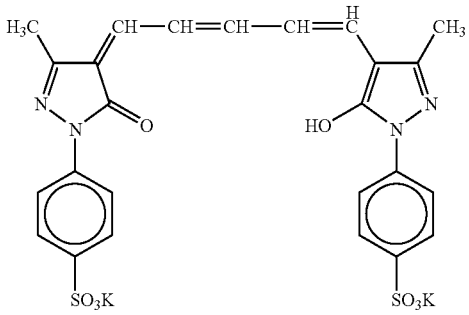 | | |
| E-1 | 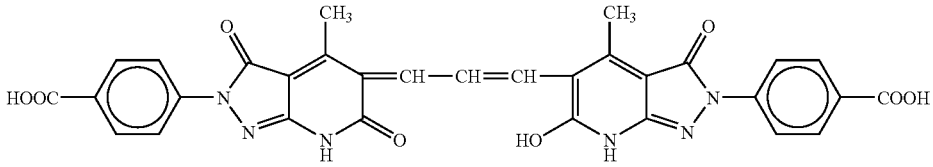 | | |
| E-2 | 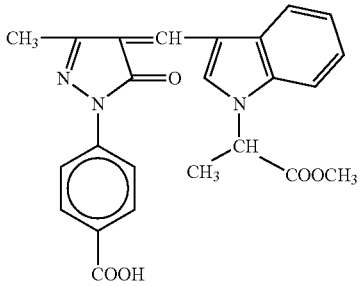 | | |
| H-1 | $CH_2{=}CH{-}SO_2{-}CH_2{-}CONH{-}CH_2$<br>$CH_2{=}CH{-}SO_2{-}CH_2{-}CONH{-}CH_2$ | | |

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
W-1
$C_8F_{17}SO_2NHCH_2CH_2CH_2OCH_2CH_2\overset{\oplus}{N}(CH_3)_3$
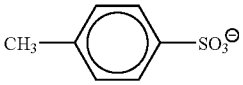
W-2
$C_8F_{17}SO_2N(C_3H_7)CH_2COOK$
W-3
$NaO_3S-CH(CH_2COOCH_2CH(C_2H_5)C_4H_9)COOCH_2CH(C_2H_5)C_4H_9$
W-4
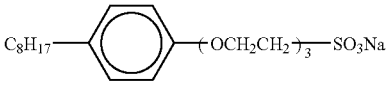
W-5
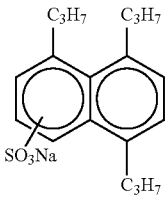
W-6
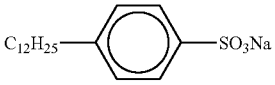
W-7
$C_8F_{17}SO_3Li$
P-1
$-(CH_2-CH(CONHC_4H_9(t))-)_n-$
(n = 100 ~ 1000)
P-2
$-(CH_2-CH(COOC_2H_5)-)_n-$
(n = 100 ~ 1000)
P-3
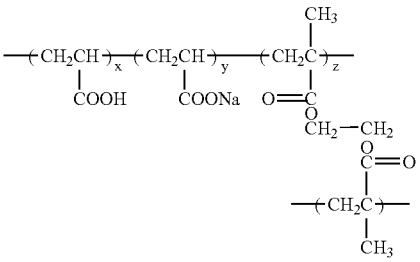
x:y:z = 42.5:7.5:50

TABLE 7-continued
| Spectral sensitization of Emulsions A to P | | | |
|---|---|---|---|
| Emulsion | Added sensitizing dye | Added amount per 1 mol of silver halide (g) | Stage when a sensitizing dye was added |
P-4
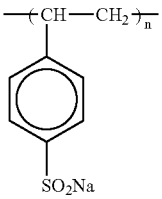
(n = 100 ~ 1000)
F-1
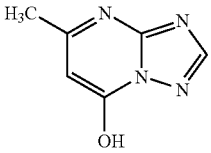
F-2
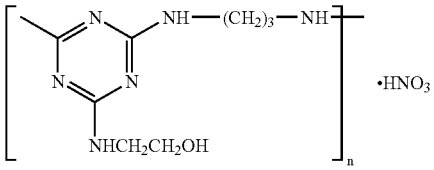
(n = 3 ~ 4)
F-3
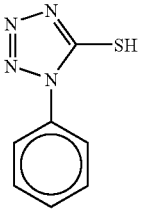
F-4
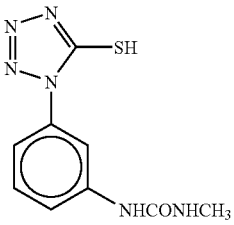
F-5
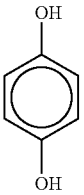

TABLE 7-continued

| Spectral sensitization of Emulsions A to P | | | |
|---|---|---|---|
| Emulsion | Added sensitizing dye | Added amount per 1 mol of silver halide (g) | Stage when a sensitizing dye was added |

F-6

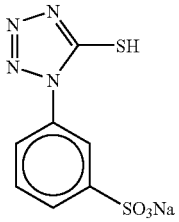

F-7

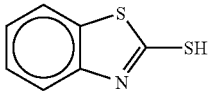

F-8

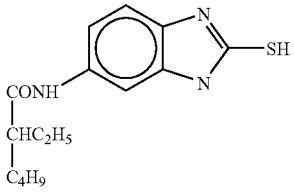

F-9

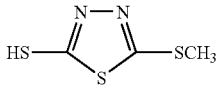

SO-1

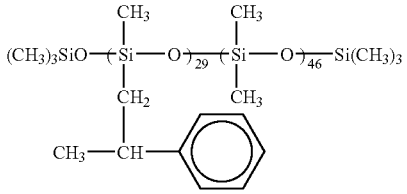

Preparation of Dispersion of Organic Solid Dispersed Dye (Preparation of Dispersion of Dye E-1)

To a wet cake of Dye E-1 (the net amount of E-1: 270 g), 100 g of Pluronic F88 (trade name, block copolymer of ethyleneoxide/propyleneoxide) manufactured by BASF and water were added and stirred. Water was added so as to give a total amount of 4000 g. Next, to the ulutravisco mill (UVM-2 (trade name), manufactured by AIMEX Co., Ltd.) filled with 1700 ml of zirconia beads having an average grain diameter of 0.5 mm, the resultant slurry was added and ground for 2 hours under the conditions of about 10 m/sec of round speed and 0.5 liter/min of discharge amount. The beads were filtered away to obtain a dispersion of the dye. Water was added to the dispersion so that the dye density was diluted to 3%. Then, for the purpose of stabilization, the dispersion was heated at 90° C. for 10 hours. An average particle diameter of thus obtained dye fine particles was 0.30 μm. The range of the distribution of the particle diameter (standard deviation of particle diameter×100/average particle diameter) was 20%.

(Preparation of Solid Dispersion of Dye E-2)

To 1400 g of a wet cake of Dye E-2 containing 30 mass % of water, water and 270 g of W-4 were added and stirred. Water was added so that a slurry containing 40 mass % of E-2 was obtained. Next, to the ulutravisco mill (UVM-2 (trade name), manufactured by AIMEX Co., Ltd.) filled with 1700 ml of zirconia beads having an average grain size of 0.5 mm, the resultant slurry was added and ground for 8 hours under the conditions of about 10 m/sec of round speed and 0.5 liter/min of discharge amount. Thus, a solid fine particle dispersion of Dye E-2 was obtained. This dispersion was diluted with an ion exchanged water to 20 mass %, to obtain solid fine particle dispersion. Note that the average particle size of fine particle dispersion is 0.15 μm.

Then, as shown in Table 8, Samples CR02 to CR07 were prepared by substituting the coupler C-8 in the $14^{th}$, $15^{th}$ and $16^{th}$ layers of Sample CR01 by one.

Upon substitution of the coupler, substitution was performed by substituting a substitute coupler in a mole number by 0.9 time as much as that of the coupler C-8 in Sample CR01. Besides this, the additives other than those particularly indicated were the same as those in Sample CR01.

Note that when the samples were used in the following evaluations, the coated photosensitive materials were evaluated after they were stored under the conditions of 25° C. and a relative humidity of 55% for 14 days.

TABLE 8

| Constitution of Samples | |
|---|---|
| Sample | Coupler in the 14th, 15th and 16th layer |
| CR01 | C-8 (As shown in the specification) |
| CR02 | (41) |
| CR03 | (42) |
| CR04 | (43) |
| CR05 | (46) |
| CR06 | (48) |
| CR07 | (50) |

(Evaluation of Samples)

(1) Calculation of Dmax(UV)/Dmin(UV)

Two pieces of each of Samples CR01 to CR07 cut into a size of 10.5 cm×12.5 cm were prepared. One of them was subjected to exposure to white light at a color temperature of 4,800° K. through a sharp cut filter SC-39 (trade name, manufactured by Fuji Photo Film Co., Ltd.) for an exposure time of 1 second at a quantity of exposure light of 2,000 CMS and then the following development processing-CR was performed (the whole surface gave the minimum density; hereinafter referred to as a minimum density sample).

Another piece maintained nonexposed was passed on to the operations after the reversal processing only in the development processing-CR (the whole surface gave the maximum density of the photosensitive material; hereinafter, referred to as a maximum density sample).

The minimum density sample and maximum density sample thus prepared were punched into small disks in the same manner as described in Example 1-1 and the disks were extracted and measured of ultraviolet absorption. The values of Dmax(UV)/Dmin(UV) thus obtained are shown in Table 9.

(2) Evaluation of Static-induced Fog

Samples CR01 to CR07 were each processed into a roll with a width of 12.7 cm×200 m and rewound at a rate of 100 m/minute in an atmosphere of 25° C. and a relative humidity of 10% in the absence of light, respectively, and then the development processing step —CR was performed without exposure to light (provided that a sensitized development processing in which the first development time was extended to 13 minutes was performed).

The number of static-induced fogs (white areas in the black background) that occurred after the processing was visually detected. Table 9 shows relative values by taking the number of static-induced fogs occurring in Sample CR01 as 1.0. The smaller the numerical value is, the less the static-induced fog is, which is more preferred.

TABLE 9

| Result of evaluation | | |
|---|---|---|
| Sample | Dmax(UV)/ Dmin(UV) | Relative ratio of static-induced fog |
| CR01 | 1.15 | 1.0 (standard) |
| CR02 | 0.68 | 0.4 |
| CR03 | 0.68 | 0.4 |
| CR04 | 0.66 | 0.3 |
| CR05 | 0.66 | 0.3 |
| CR06 | 0.60 | 0.3 |
| CR07 | 0.65 | 0.3 |

According to Table 9, it is revealed that use of the photosensitive material of the present invention results in a remarkably decreased occurrence of static-induced fog.

(Processing-CR)

| Processing step | Time | Temperature | Tank volume | Replenisher amount |
|---|---|---|---|---|
| 1st development | 6 min | 38° C. | 37 liters | 2,200 ml/m$^2$ |
| 1st water-washing | 2 min | 38° C. | 16 liters | 4,000 ml/m$^2$ |
| Reversal | 2 min | 38° C. | 17 liters | 1,100 ml/m$^2$ |
| Color-development | 6 min | 38° C. | 30 liters | 2,200 ml/m$^2$ |
| Pre-bleaching | 2 min | 38° C. | 19 liters | 1,100 ml/m$^2$ |
| Bleaching | 6 min | 38° C. | 30 liters | 220 ml/m$^2$ |
| Fixing | 4 min | 38° C. | 29 liters | 1,100 ml/m$^2$ |
| 2nd water-washing | 4 min | 38° C. | 35 liters | 4,000 ml/m$^2$ |
| Final-rinsing | 1 min | 25° C. | 19 liters | 1,100 ml/m$^2$ |

Compositions of each processing solution used were as follows:

(1st Developer)

| | Tank solution | Replenisher |
|---|---|---|
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |

(pH was adjusted by using sulfuric acid or potassium hydroxide)

(Reversal Solution)

(Both of tank solution and replenisher)

| | |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water to make | 1,000 ml |
| pH | 5.80 |

(pH was adjusted by using acetic acid or sodium hydroxide)

(Color-developer)

| | Tank solution | Replenisher |
|---|---|---|
| Pentasodium nitrilo-N,N,N-trimethylenephosphonate | 2.0 g | 2.0 g |
| Sodium sulfite | 6.0 g | 6.0 g |
| Trisodium phosphate 12-hydrate | 22 g | 22 g |

-continued

| | Tank solution | Replenisher |
|---|---|---|
| Potassium bromide | 1.0 g | — |
| Potassium iodide | 30 mg | — |
| Sodium hydroxide | 12.0 g | 12.0 g |
| Citrazinic acid | 0.5 g | 0.5 g |
| N-Ethyl-N-(β-methanesulfonamidoethyl)-3-methyl-4-aminoaniline-3/2 sulfate-monohydrate | 10 g | 10 g |
| 3,6-Dithiaoctane-1,8-diol | 0.7 g | 0.7 g |
| Water to make | 1,000 ml | 1,000 ml |
| pH | 11.90 | 12.00 |

(pH was adjusted by using sulfuric acid or potassium hydroxide)

(Pre-bleaching Solution)

| | Tank Solution | Repleisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde-sodium bisulfite adduct | 30 g | 35 g |
| Water to make | 1,000 ml | 1,000 ml |
| pH | 6.50 | 6.50 |

(pH was adjusted by using acetic acid or sodium hydroxide)

(Bleaching Solution)

| | Tank solution | Replenisher |
|---|---|---|
| Disodium ethylenediaminetetraacetate dihydrate | 2.0 g | 4.0 g |
| Iron (III) ammonium ethylenediamine-tetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |

(pH was adjusted by using nitric acid or sodium hydroxide)

(Fixing Solution)

(Both of Tank Solution and Replenisher)

| | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

(pH was adjusted by using acetic acid or aqueous ammonia)

(Stabilizing Solution)

| | Tank solution | Replenisher |
|---|---|---|
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

In the above-described processing steps, a processing solution was stirred with a continuous circulation in each bath. The lower part of each tank was installed with a bubble-releasing tube having tiny holes (diameter 0.3 mm) made at intervals of 1 cm. The processing solution was stirred while continuously releasing a nitrogen gas (bubbles) from this bubble-releasing tube. However, such stirring while releasing bubbles was not carried out in the pre-bleaching bath and the second washing bath.

Example 1-5

Preparation of Blue-sensitive Layer Emulsion A

Silver halide cubic grains having the following characteristics were formed.

Halogen composition: AgCl 98.9 mole %, AgBr 1 mole %, AgI 0.1 mole %; Average side length: 0.7 μm; Variation coefficient of side length: 8%. Spectral sensitizing dyes-1 and 2 were added to the silver halide emulsion in an amount of $2.5\times10^{-4}$ mole/mole of Ag and $2.0\times10^{-4}$ mole/mole of Ag respectively.

At the step of grain formation, $K_3IrCl_5(H_2O)$, $K_4Ru(CN)_6$, $K_4Fe(CN)_6$, thiosulfonic acid compound-1, sodium thiosulfate, gold sensitizer-1, mercapto compounds-1 and 2 were used in an optimal amount respectively. Thus, Emulsion A-1 for a high-sensitive layer was prepared.

Similarly, cubic grains having an average side length of 0.55 μm and a variation coefficient of 9% in terms of the side length were formed.

Spectral sensitization and chemical sensitization were performed in the same manner as the above, except for correcting the sensitization amounts so as to meet specific surface area (according to the ratio of the side lengths 0.7/0.55=1.27 fold), to prepare a blue sensitive layer low-sensitivity emulsion A-2.

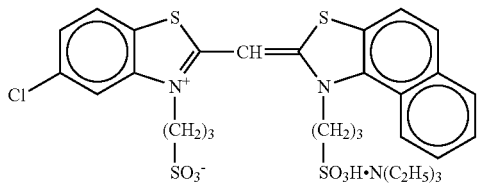

Spectral sensitizing dye-1

-continued

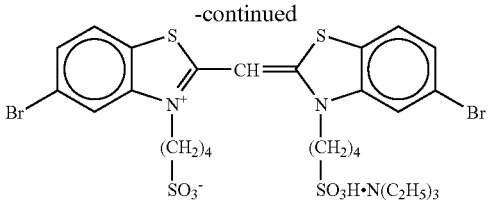

Spectral sensitizing dye-2

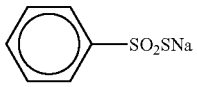

Thiosulfonic acid compound-1

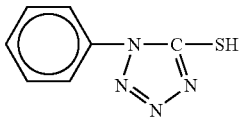

Mercapto compound-1

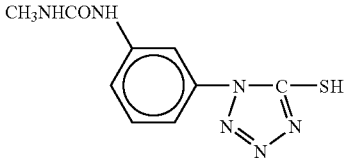

Mercapto compound-2

-continued

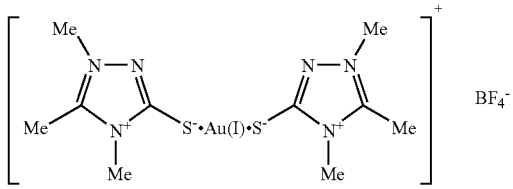

Gold sensitizer-1

(Preparation of Inventive Green Sensitive Layer Emulsions C-1 and C-2)

Under the same preparation conditions for Emulsions A-1 and A-2 in the above Emulsion A, except that the temperature at the time of forming grains was lowered, and that the kind of sensitizing dyes were changed as described below, a green sensitive layer (GL) high-sensitivity emulsion C-1 and a green sensitive layer (GL) low-sensitivity emulsion C-2 were prepared.

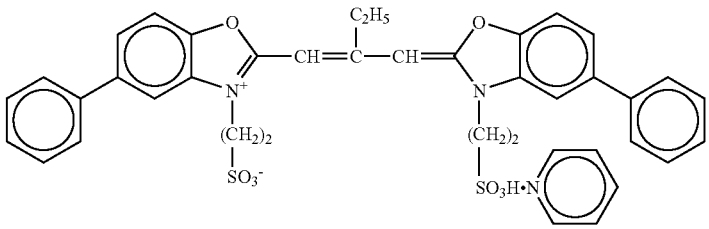

(Sensitizing dye D)

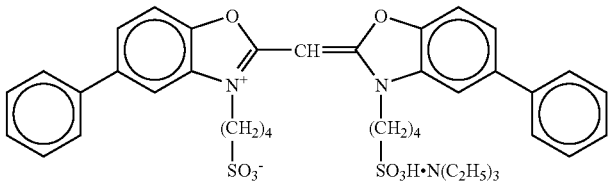

(Sensitizing dye E)

As for the grain size, the high-sensitivity emulsion C-1 had the average side length of 0.40 μm and the low-sensitivity emulsion C-2 had the average side length of 0.30 μm, each with the variation coefficient of average length of 8%.

The sensitizing dye D was added to the large-size emulsion (high-sensitivity emulsion C-1) in an amount of $3.0\times10^{-4}$ mol, and to the small-size emulsion (low-sensitivity emulsion C-2) in an amount of $3.6\times10^{-4}$ mol, per mol of the silver halide; and the sensitizing dye E was added to the large-size emulsion in an amount of $4.0\times10^{-5}$ mol, and to the small-size emulsion in an amount of $7.0\times10^{-5}$ mol, per mol of the silver halide.

(Preparation of Inventive Red Sensitive Layer Emulsions E-1 and E-2)

Under the same preparation conditions for Emulsions A-1 and A-2 in the above Emulsion A, except that the temperature at the time of forming grains was lowered, and the kind of sensitizing dyes were changed as described below, a red sensitive layer high-sensitivity emulsion E-1 and a red sensitive layer low-sensitivity emulsion E-2 were prepared.

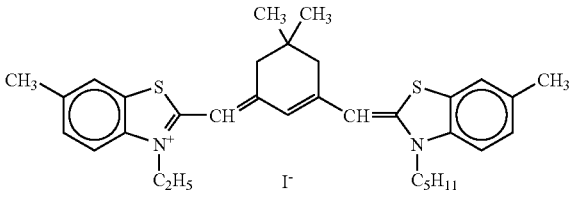

(Sensitizing dye G)

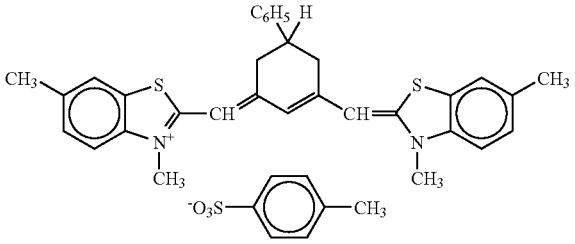

(Sensitizing dye H)

As for the grain size, the high-sensitivity emulsion E-1 had the average side length of 0.38 μm and the low-sensitivity emulsion E-2 had the average side length of 0.32 μm, with the variation coefficient of average length of 9% and 10%, respectively.

(The sensitizing dye G and H was added to the large-size emulsion (high-sensitivity emulsion E-1) in an amount of $8.0\times10^{-5}$ mol, and to the small-size emulsion (low-sensitivity emulsion E-2) in an amount of $10.7\times10^{-5}$ mol, per mol of the silver halide, respectively.

Further, Compound I below was added to red sensitive layer in an amount of $3.0\times10^{-3}$ mol per mol of a silver halide.)

(Compound I)

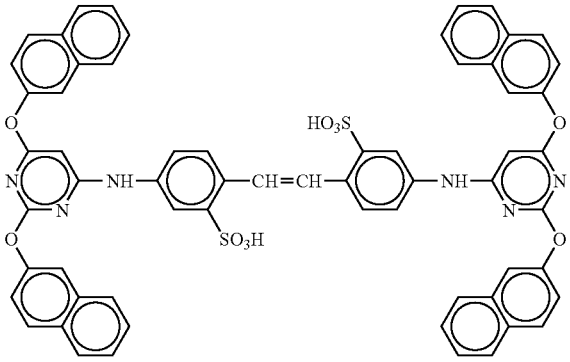

(Preparation of a Coating Solution for the First Layer)

Into 21 g of a solvent (Solv-1) and 80 ml of ethyl acetate were dissolved 57 g of a yellow coupler (ExY), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsions A-1 and A-2 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1)

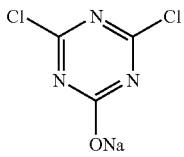

Hardener (used in an amount 1.4 mass % per gelatin)

(H-2)

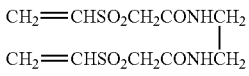

Hardener (H-3)

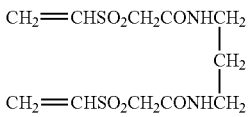

Hardener (Ab-1) Antispetic

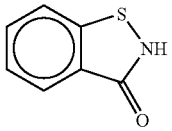

(Ab-2) Antispetic

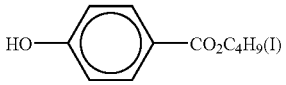

(Ab-3) Antiseptic

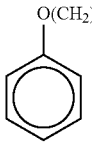

(Ab-4) Antiseptic

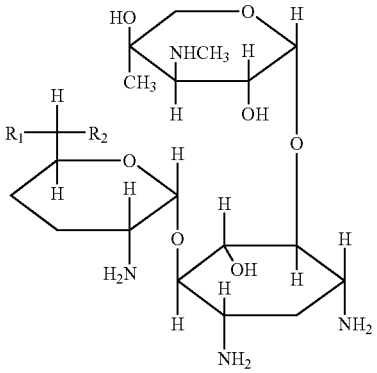

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, and d

Further, to the second layer, the fourth layer, the sixth layer, and the seventh layer, was added 1-(3-methylureidophenyl)-5-mercaptotetrazole in amounts of 0.2 mg/$m^2$, 0.2 mg/$m^2$, 0.6 mg/$m^2$, and 0.1 mg/$m^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/$m^2$.

Disodium salt of catecol-3,5-disulfonic acid was added to the second layer, the fourth layer and the sixth layer so that coating amounts would be 6 mg/$m^2$, 6 mg/$m^2$ and 18 mg/$m^2$, respectively.

Further, in order to prevent irradiation, the following dyes (coating amounts are shown in parentheses) were added.

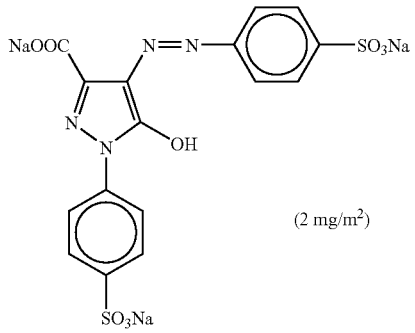

(2 mg/$m^2$)

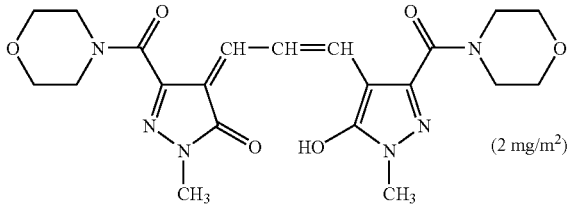

(2 mg/$m^2$)

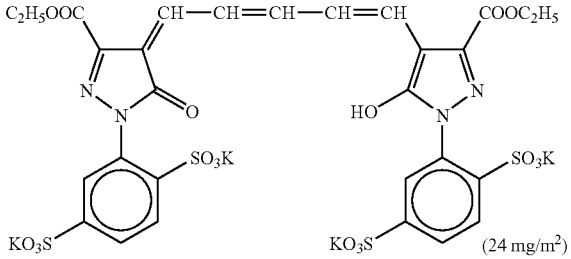

(24 mg/$m^2$)

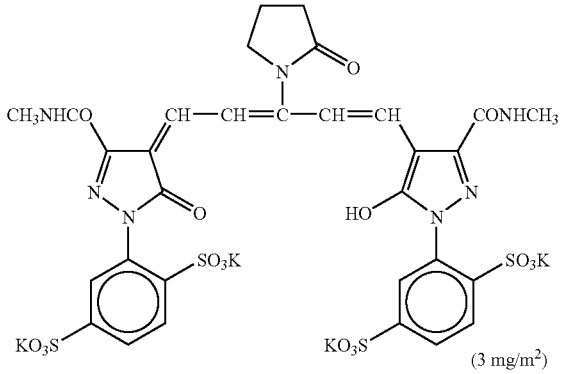

(3 mg/$m^2$)

(Layer Constitution)

The composition of each layer is shown below. The numbers show coating amounts (g/$m^2$). In the case of the silver halide emulsion, the coating amount is in terms of silver.

Support

Polyethylene Resin-laminated Paper (The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine; content of 0.33 mass %). The amount of the polyethylene resin was 29.2 g/$m^2$)

First Layer (Blue-Sensitive Emulsion Layer)

| | |
|---|---|
| Silver chloroiodobromide emulsion A (gold-sulfur sensitized cubes, a 3:7 mixture of the large-size emulsion A-1 and the small-size emulsion A-2 (in terms of mol of silver)) | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |

Second Layer (Color-Mixing Inhibiting Layer)

| | |
|---|---|
| Gelatin | 1.15 |
| Color-mixing inhibitor (Cpd-4) | 0.10 |
| Color-image stabilizer (Cpd-5) | 0.018 |
| Color-image stabilizer (Cpd-6) | 0.13 |
| Color-image stabilizer (Cpd-7) | 0.07 |
| Solvent (Solv-1) | 0.04 |
| Solvent (Solv-2) | 0.12 |
| Solvent (Solv-5) | 0.11 |

Third Layer (Green-Sensitive Emulsion Layer)

| | |
|---|---|
| Silver chloroiodobromide emulsion C (gold-sulfur sensitized cubes, a 1:3 mixture of the large-size emulsion C-1 and the small-size emulsion C-2 (in terms of mol of silver)) | 0.14 |
| Gelatin | 1.21 |
| Magenta coupler (ExM) | 0.15 |
| Ultraviolet absorbing agent (UV-A) | 0.14 |
| Color-image stabilizer (Cpd-2) | 0.003 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-3) | 0.09 |
| Solvent (Solv-4) | 0.18 |
| Solvent (Solv-5) | 0.17 |

Fourth Layer (Color-Mixing Inhibiting Layer)

| | |
|---|---|
| Gelatin | 0.68 |
| Color-mixing inhibitor (Cpd-4) | 0.06 |
| Color-image stabilizer (Cpd-5) | 0.011 |
| Color-image stabilizer (Cpd-6) | 0.08 |
| Color-image stabilizer (Cpd-7) | 0.04 |
| Solvent (Solv-1) | 0.02 |
| Solvent (Solv-2) | 0.07 |
| Solvent (Solv-5) | 0.065 |

Fifth Layer (Red-Sensitive Emulsion Layer)

| | |
|---|---|
| Silver chloroiodobromide emulsion E (gold-sulfur sensitized cubes, a 5:5 mixture of the large-size emulsion E-1 and the small-size emulsion E-2 (in terms of mol of silver)) | 0.16 |
| Gelatin | 0.95 |

-continued

| | |
|---|---|
| Cyan coupler (ExC-1) | 0.023 |
| Cyan coupler (ExC-2) | 0.05 |
| Cyan coupler (ExC-3) | 0.17 |
| Ultraviolet absorbing agent (UV-A) | 0.055 |
| Color-image stabilizer (Cpd-1) | 0.22 |
| Color-image stabilizer (Cpd-7) | 0.003 |
| Color-image stabilizer (Cpd-9) | 0.01 |
| Color-image stabilizer (Cpd-12) | 0.01 |
| Solvent (Solv-8) | 0.05 |

Sixth Layer (Ultraviolet Absorbing Layer)

| | |
|---|---|
| Gelatin | 0.46 |
| Ultraviolet absorbing agent (UV-B) | 0.35 |
| Compound (S1-4) | 0.0015 |
| Solvent (Solv-7) | 0.18 |

Seventh Layer (Protective Layer)

| | |
|---|---|
| Gelatin | 1.00 |
| Acryl-modified copolymer of polyvinyl alcohol (modification degree: 17%) | 0.4 |
| Liquid paraffin | 0.02 |
| Surface-active agent (Cpd-13) | 0.02 |

(ExY)Yellow coupler

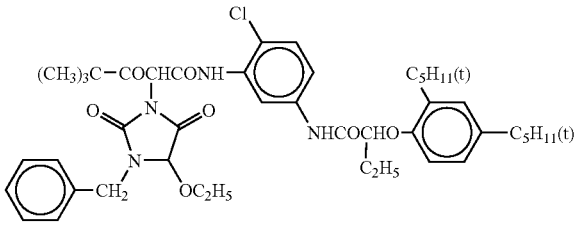

(ExY may be called as a comparative coupler Y1.)

(ExM) Magenta coupler

A mixture in 40:40:40 (molar ratio of

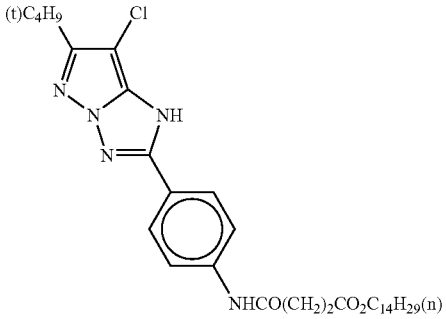

-continued

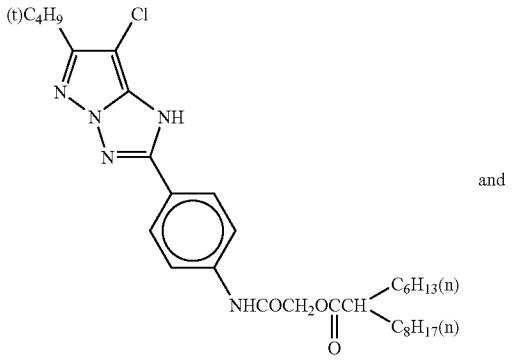

and

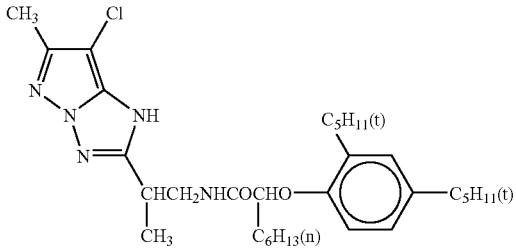

(ExC-1) Cyan coupler

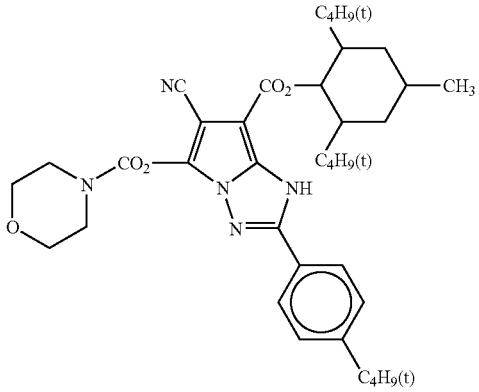

(ExC-2) Cyan coupler

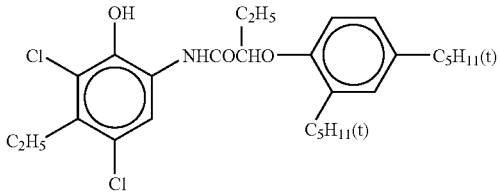

(ExC-3) Cyan coupler

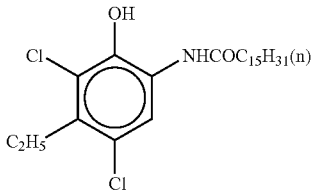

(Cpd-1) Color-image stabilizer

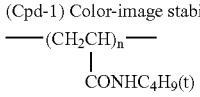

number-average
molecular weight
60,000

-continued (Cpd-2) Color-image stabilizer

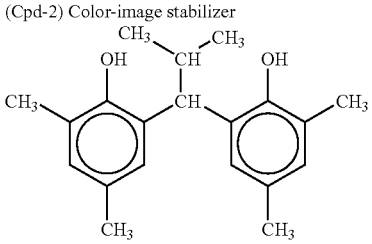

(Cpd-3) Color-image stabilizer

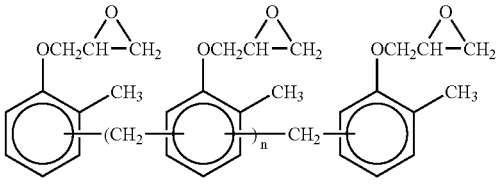

n = 7 ~ 8
(average value)

(Cpd-4) Color-mixing inhibitor

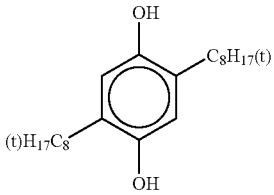

(Cpd-5) Color-image stabilizer

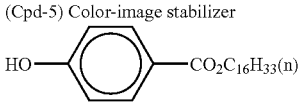

(Cpd-6) Color-image stabilizer

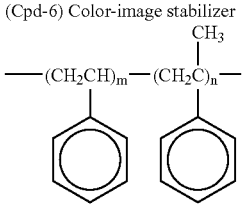

number-average
molecular weight 600
m/n = 10/90

(Cpd-7) Color-image stabilizer

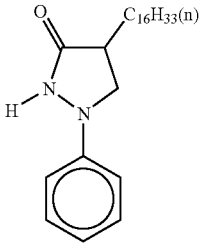

(Cpd-8) Color-image stabilizer

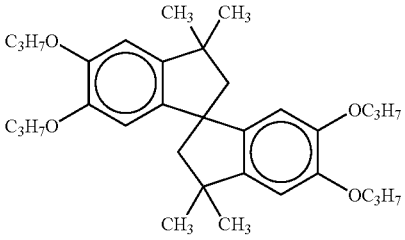

-continued
(Cpd-9) Color-image stabilizer
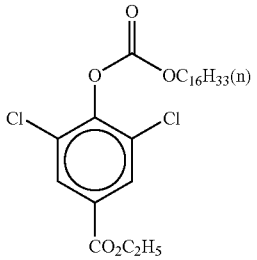
(Cpd-10) Color-image stabilizer
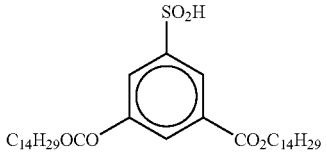
(Cpd-11)
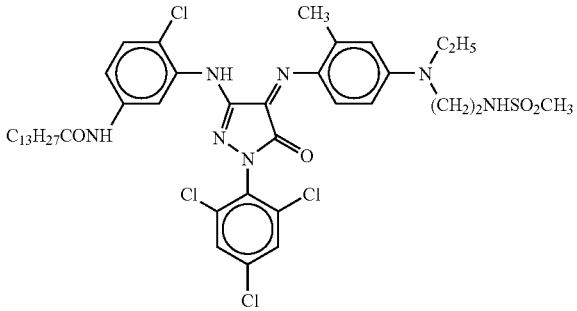
(Cpd-12)
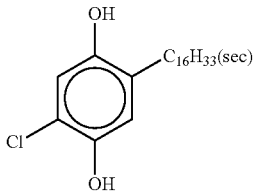
(Cpd-13) Surface-active agent
A mixture in 7:3 (molar ratio) of
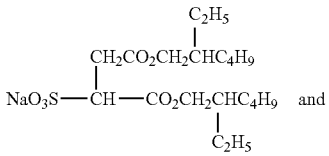
and
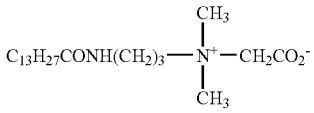
(Cpd-14)
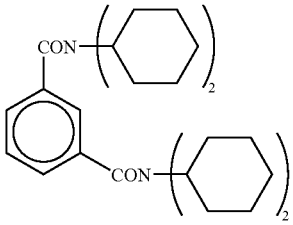
-continued
(Cpd-15)
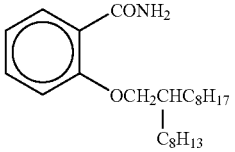
(Cpd-16)
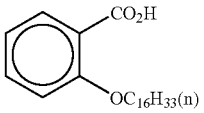
(Cpd-17)
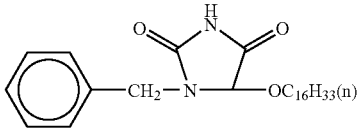
(Cpd-18)
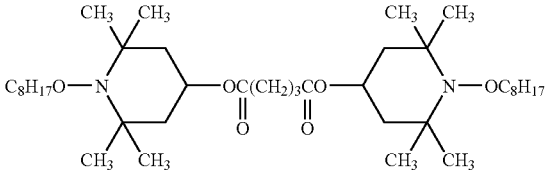
(Cpd-19)
Color-mixing inhibitor
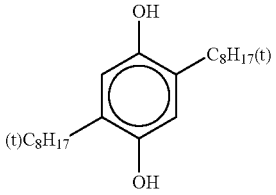
(Cpd-20)
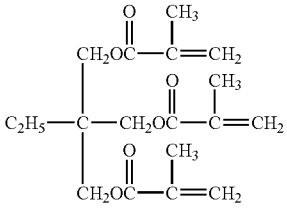
(Solv-1)
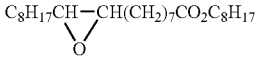
(Solv-2)
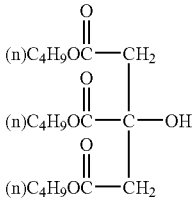
(Solv-3)
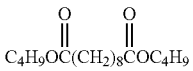
(Solv-4)
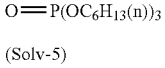
(Solv-5)

-continued

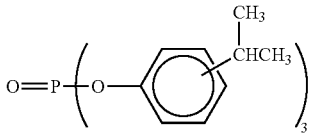

(Solv-7)

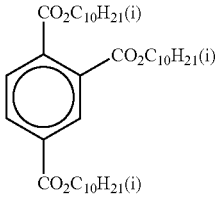

(Solv-8)

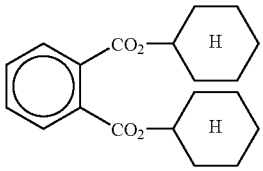

(Solv-9)

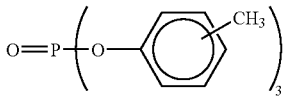

(S1-4)

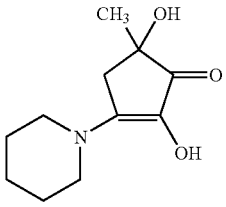

(UV-1)
Ultraviolet absorbing agent

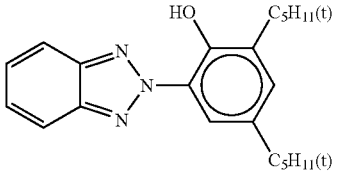

(UV-2)
Ultraviolet absorbing agent

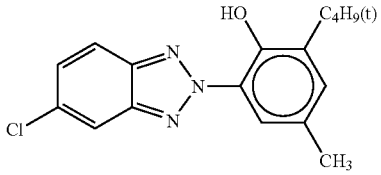

(UV-3)
Ultraviolet absorbing agent

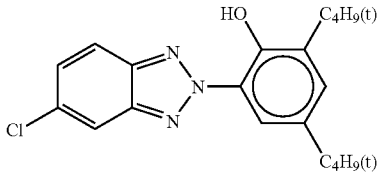

-continued (UV-5)
Ultraviolet absorbing agent

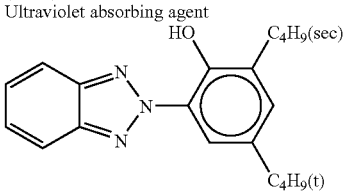

(UV-6)
Ultraviolet absorbing agent

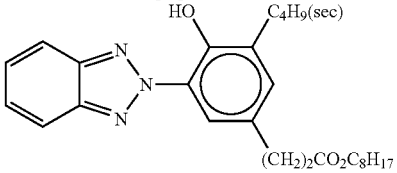

(UV-7)
Ultraviolet absorbing agent

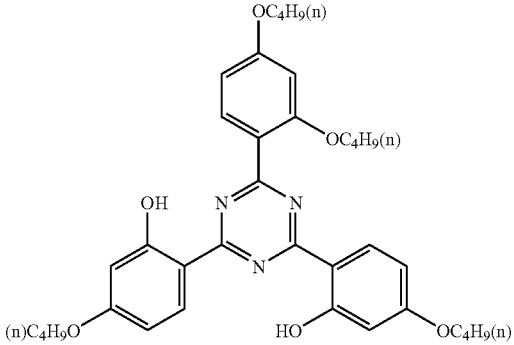

UV-A: A mixture of UV-1/UV-2/UV-3 = 7/2/2 (mass ratio)
UV-B: A mixture of UV-1/UV-2/UV-3/UV-5/UV-6 = 13/3/3/5/3 (mass ratio)
UV-C: A mixture of UV-1/UV-3 = 9/1 (mass ratio)

Samples P102 to P105 were prepared in the same manner as for Sample P101 prepared as described above except that the composition of the first layer was changed as described below.

First Layer of Sample P102 (Blue-Sensitive Emulsion Layer)

| | |
|---|---|
| Silver chloroidobromide emulsion A (gold-sulfur sensitized cubes, a 3:7 mixture of the large-size emulsion A-1 and the small-size emulsion A-2 (in terms of mol of silver)) | 0.24 |
| Gelatin | 1.25 |
| Yellow coupler (ExY) | 0.57 |
| Color-image stabilizer (Cpd-2) | 0.06 |
| Color-image stabilizer (Cpd-8) | 0.07 |
| Color-image stabilizer (Cpd-20) | 0.11 |
| Solvent (Solv-9) | 0.36 |

First Layer of Sample P103 (Blue-Sensitive Emulsion Layer)

| | |
|---|---|
| Silver chloroidobromide emulsion A (gold-sulfur sensitized cubes, a 3:7 mixture of the large-size emulsion A-1 and the small-size emulsion A-2 (in terms of mol of silver)) | 0.15 |
| Gelatin | 1.25 |
| Yellow coupler (Exemplified compound (3)) | 0.30 |
| Color-image stabilizer (Cpd-2) | 0.06 |
| Color-image stabilizer (Cpd-8) | 0.07 |

-continued

| | |
|---|---|
| Color-image stabilizer (Cpd-20) | 0.11 |
| Solvent (Solv-9) | 0.36 |

In Samples P104 and P105, the yellow coupler in Sample P103 was changed to the yellow couplers shown in Table 10, respectively, in an equivalent mole.

Sample P103 mentioned above as a photosensitive material was processed into a form of a roll with a width of 127 mm, and the photosensitive material was imagewise exposed from a negative film of average density, by using Mini Labo Printer Processor PP350 (trade name) manufactured by Fuji Photo Film Co., Ltd. and continuous processing (running test) was performed until the volume of the color developer replenisher used in the following processing step became double the volume of the color developer tank. The photosensitive material was evaluated by subjecting to the following two steps different from each other in the liquid condition and processing time.

Processing Step A

The processing using the following running processing solution was named Processing A.

| Processing step | Temperature | Time | Replenishment rate* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 20 sec | 121 ml |
| Drying | 80° C. | | |

(Notes)
*Replenishment rate per $m^2$ of the light-sensitive material to be processed.
**A rinse cleaning system RC50D, trade name, manufactured by Fuji Photo Film Co. Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated liquid was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a tank counter-current system from (1) to (4).

The composition of each processing solution was as follows.

| (Color developer) | (Tank solution) | (Replenisher) |
|---|---|---|
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethyleneglycol (Average molecular weight 300) | 10.0 g | 10.0 g |
| Ethylenediamine tetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |

-continued

| (Color developer) | (Tank solution) | (Replenisher) |
|---|---|---|
| Disodium-N,N-bis(sulfonatoethyl) hydroxylamine | 8.5 g | 14.0 g |
| 4-amino-3-methyl-N-ethyl-N-(β-methanesulfonamidoethyl)aniline •3/2 sulfate•monohydrate | 4.8 g | 14.0 g |
| Potassium carbonate | 26.3 g | 26.3 g |
| Water to make | 1000 ml | 1000 ml |
| pH (25° C., adjusted using sulfuric acid and potassium hydroxide) | 10.15 | |

| (Bleach-fixing solution) | (Tank solution) | (Replenisher) |
|---|---|---|
| Water | 800 ml | 800 ml |
| Ammonium thiosulfate (750 g/ml) | 107 ml | 214 ml |
| m-Carboxymethylbenzenesulfinic acid | 8.3 g | 16.5 g |
| Ammonium iron (III) ethylenediamine tetraacetic acid | 47.0 g | 94.0 g |
| Ethylenediaminetetraacetate | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C., adjusted using nitric acid and aqueous ammonia) | 6.5 | 6.5 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Processing step B

Sample P103 was processed into a form of a roll with a width of 127 mm, and the photosensitive material was imagewise exposed from a negative film of average density, by using a laboratory processor obtained by modifying Mini Labo Printer Processor PP350 (trade name) manufactured by Fuji Photo Film Co., Ltd. so that the processing time and processing temperature could be changed, and continuous processing (running test) was performed until the volume of the color developer replenisher used in the following processing step became double the volume of the color developer tank. The processing using this running processing solution was named processing B.

| Processing step | Temperature | Time | Replenishment rate* |
|---|---|---|---|
| Color development | 45.0° C. | 20 sec | 45 ml |
| Bleach-fixing | 40.0° C. | 20 sec | 35 ml |
| Rinse (1) | 40.0° C. | 8 sec | — |
| Rinse (2) | 40.0° C. | 8 sec | — |
| Rinse (3)** | 40.0° C. | 8 sec | — |

-continued

| Processing step | Temperature | Time | Replenishment rate* |
|---|---|---|---|
| Rinse (4)** | 38.0° C. | 8 sec | 121 ml |
| Drying | 80° C. | 15 sec | |

(Notes)
*Replenishment rate per $m^2$ of the light-sensitive material to be processed.
**A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module wouldbe maintained in an amount of 50 to 300 ml/min, and the rinse solution was circulated under controlled temperature for 10 hours a day. The rinse was made in a tank counter-current system from (1) to (4).

The composition of each processing solution was as follows.

| (Color developer) | (Tank solution) | (Replenisher) |
|---|---|---|
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-amino-3-methyl-N-ethyl-N-(β-methanesulfonamidoethyl)aniline• ½ sulfate•monohydrate | 7.0 g | 19.0 g |
| Potassium carbonate | 26.3 g | 26.3 g |
| Water to make | 1000 ml | 1000 ml |
| pH (25° C., adjusted using sulfuric acid and potassium hydroxide) | 10.25 | 12.6 |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C., adjusted using nitric acid and aqueous ammonia) | 6.00 | 6.00 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Processing Step C

The processing using the running processing solution of Processing B and changing the carrier-speed of the processor to 1.8 times thereby reducing processing time was named Processing C.

Utilized compounds are shown as follows.

FL-1

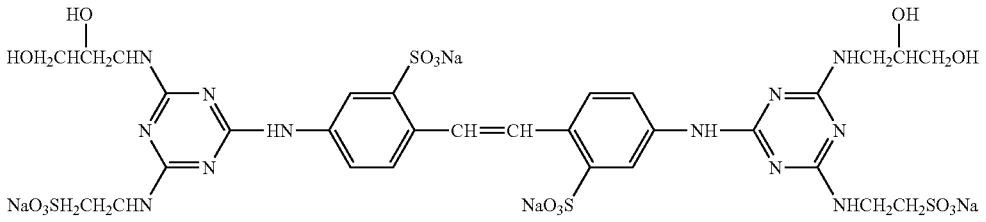

FL-2

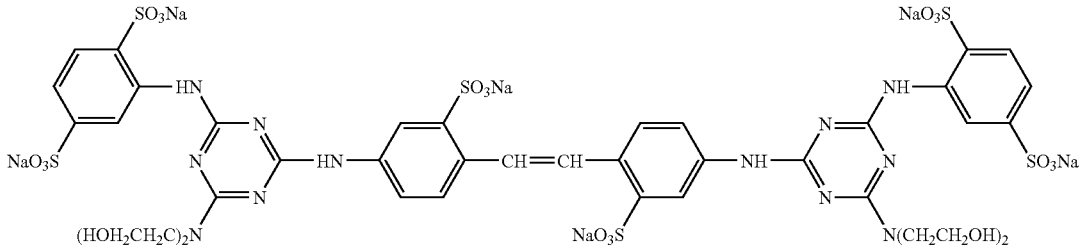

-continued

FL-3

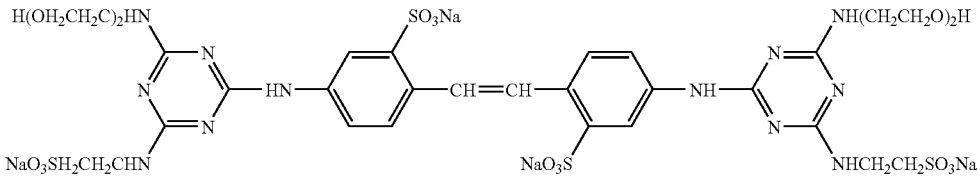

SR-1

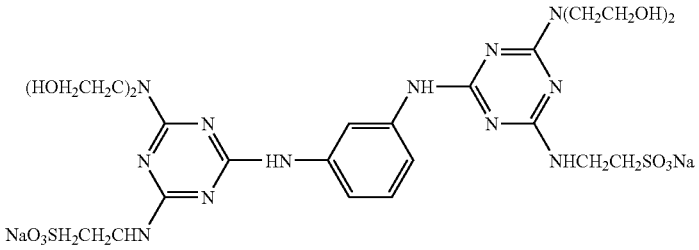

Samples P101 to P105 were evaluated on the following after they were stored under the conditions of 25° C. and a relative humidity of 55% after the coating of the photosensitive material for 10 days.

(Evaluation 1 Rapid Processing Suitability (Dmax Processing Variation))

Each sample was exposed to blue-separated exposure through a 465-nm band pass filter and an optical wedge for an exposure time of 1/10,000 second by using a sensitometer. Each sample after the exposure was processed under the three kinds of processing conditions described below, and the maximum density of the yellow color-formed portion was measured and rapid processing suitability and processing stability were evaluated. Relative values (%) of the maximum density of the yellow color-formed portions in the processing steps B and C relative to the maximum density of the yellow color-formed portions in the processing step A, were calculated, respectively.

(Evaluation 2 Calculation of Dmax(UV)/Dmin(UV))

A sample subjected to exposure to white light at a color temperature of 4,800° K. through a sharp cut filter SC-39 (trade name, manufactured by Fuji Photo Film Co., Ltd.) for an exposure time of 1 second at a quantity of exposure light of 2,000 CMS and a nonexposed sample were each subjected to the color development processing A as described above. These two samples, exposed and nonexposed, were measured of color density. Of the values obtained, the one measured for the sample having higher color density (in this Example, the exposed sample) was defined as Dmax, and the one measured for the sample having a lower color density (in this Example, the nonexposed sample) was defined as Dmin. Each of the samples after the processing was measured of UV density in the same manner as in Example 1-1.

Definition of Dmax(UV)/Dmin(UV): This is defined by "the smallest value in a range of wavelength UV, in which TV is a wavelength within the range of 340 nm or more and 450 nm or less, among values represented by (an absorbance at a wavelength UV, for a portion having the yellow maximum color density)/(an absorbance at the wavelength UV, for a portion having the yellow minimum color density)."

(Evaluation 3 Calculation of (B−C)/A)

By using the samples as used in Evaluation 2, the yellow density B at the portion showing the maximum color density (Dmax) (that is, in this Example, of the exposed sample), and the yellow density C at the portion showing the minimum color density (Dmin) (that is, in this Example, of the nonexposed sample) were measured by use of an HPD densitometer (trade name, manufactured by Fuji Photo Film Co., Ltd., 436 nm). (B−C)/A was determined by calculation by using the coating amount of the compound represented by the formula (I), A mol/m$^2$.

The results of Evaluations 1, 2 and 3 are shown in Table 10.

TABLE 10

| No. | Coupler | Dmax(UV)/ Dmin(UV) | (B − C)/A | Rapid processing suitability (Dmax processing variation) Processing B | Processing C |
|---|---|---|---|---|---|
| P101 | ExY | 1.26 | — | 95 | 80 |
| P102 | ExY | 1.26 | — | 96 | 82 |
| P103 | (3) | 0.74 | 5250 | 102 | 100 |
| P104 | (2) | 0.77 | 5050 | 100 | 99 |
| P105 | (4) | 0.82 | 5100 | 101 | 99 |

According to Table 10, it is revealed that use of the photosensitive material of the present invention containing the yellow coupler of the formula (I) remarkably decreased fluctuation in the maximum density at the time of rapid processing.

Example 1-6

Samples P201 to P210 were prepared in the same manner as for Sample P101 in Example 1-5 except that the composition of the first layer only was changed as described below.

First Layer of Sample P201 (Blue-sensitive Emulsion Layer)

| | |
|---|---|
| Silver chloride emulsion A (a 3:7 mixture (by silver molar ratio) of gold-sulfur-sensitized cube, large-size emulsion A-1 and small size emulsion A-2) | 0.20 |
| Gelatin | 1.25 |
| Yellow coupler (Exemplified compound 3) | 0.15 |
| Yellow coupler (ExY) | 0.28 |
| Color image stabilizer (Cpd-2) | 0.06 |
| Color image stabilizer (Cpd-3) | 0.07 |
| Color image stabilizer (Cpd-20) | 0.11 |
| Solvent (Solv-9) | 0.36 |

First Layer of Sample P202 (Blue Sensitive Emulsion Layer)

| | |
|---|---|
| Silver chloride emulsion A (a 3:7 mixture (by silver molar ratio) of gold-sulfur-sensitized cube, large-size emulsion A-1 and small size emulsion A-2) | 0.22 |
| Gelatin | 1.25 |
| Yellow coupler (Exemplified compound 3) | 0.08 |
| Yellow coupler (ExY) | 0.42 |
| Color image stabilizer (Cpd-2) | 0.06 |
| Color image stabilizer (Cpd-3) | 0.07 |
| Color image stabilizer (Cpd-20) | 0.11 |
| Solvent (Solv-9) | 0.36 |

In Samples P203 to P210, the yellow coupler in Sample P103 was changed to the yellow couplers shown in Table 11, respectively, in an equivalent mole.

By using Samples P101 to P105 in Example 1-5 and samples P201 to P210 described above and after storing the photosensitive material under the conditions of 25° C. and a relative humidity of 55% after the coating for 10 days, they were each processed into a roll of a width of 12.7 cm×200 m. Then, Evaluations 2 and 3 were performed according to Example 1-5, and further Evaluation 4 below was performed.

(Evaluation 4 Static-induced Fog)

Each roll was rewound at a rate of 100 m/minute in an atmosphere of 10° C. and a relative humidity of 25% in the absence of light and the above-mentioned processing step B was performed without exposure to light. The number of static-induced fogs that occurred in the white background after the processing was visually detected. Relative values (%) relative to the number of static-induced fogs occurring in Sample P101 are shown in Table 11 below.

TABLE 11

| No. | Coupler | Dmax(UV)/Dmin(UV) | (B − C)/A | Static-induced fog |
|---|---|---|---|---|
| P101 | ExY | 1.26 | — | 100 |
| P102 | ExY | 1.26 | — | 120 |
| P103 | (3) | 0.74 | 5250 | 30 |
| P104 | (2) | 0.77 | 5050 | 33 |
| P105 | (4) | 0.82 | 5100 | 38 |
| P201 | ExY/(3) *1 | 0.93 | 10000 | 48 |
| P202 | ExY/(3) *2 | 1.05 | 20000 | 63 |
| P203 | (21) | 0.83 | 4620 | 38 |
| P204 | (22) | 0.83 | 4600 | 39 |
| P205 | (23) | 0.82 | 4700 | 37 |
| P206 | (24) | 0.75 | 5080 | 32 |
| P207 | (25) | 0.77 | 5050 | 33 |
| P208 | (26) | 0.75 | 5100 | 32 |
| P209 | (27) | 0.77 | 5000 | 32 |
| P210 | (3)/(27) *3 | 0.75 | 5150 | 31 |

*1 Mixture of 50:50 (molar ratio)
*2 Mixture of 75:25 (molar ratio)
*3 Mixture of 50:50 (molar ratio)

According to Table 11, it is revealed that use of the light-sensitive material of this invention results in a remarkably decreased occurrence of static-induced fog.

Example 1-7

In the Examples 1-5 and 1-6, the composition of the fifth layer was altered as shown below to prepare a sample.

The sample was evaluated according to the method used in Examples 1-5 and 1-6, with the result that the samples according to the present invention were excellent in rapid processability (rapid processing suitability), and resistance to static-induced fog.

Fifth Layer (Red-sensitive Emulsion Layer)

| | |
|---|---|
| Silver chlorobromide emulsion E (gold-sulfur sensitized cubes, a 5:5 mixture of the large-size emulsion E-1 and the small-size emulsion E-2 (in terms of mol of silver)) | 0.10 |
| Gelatin | 1.11 |
| Cyan coupler (ExC-1) | 0.02 |
| Cyan coupler (ExC-3) | 0.01 |
| Cyan coupler (ExC-4) | 0.11 |
| Cyan coupler (ExC-5) | 0.01 |
| Color-image stabilizer (Cpd-1) | 0.01 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.01 |
| Color-image stabilizer (Cpd-17) | 0.01 |
| Color-image stabilizer (Cpd-18) | 0.07 |
| Color-image stabilizer (Cpd-20) | 0.01 |
| Ultraviolet absorbing agent (UV-7) | 0.01 |
| Solvent (Solv-5) | 0.1 |

(ExC-4) Cyan coupler

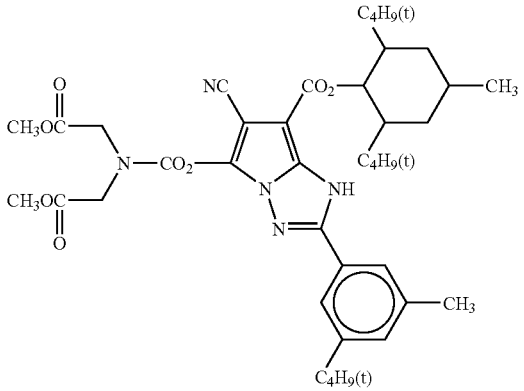

(ExC-5) Cyan coupler

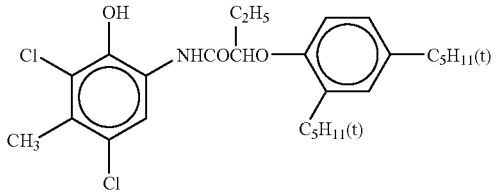

Example 2-1

Sample 2-001 was prepared in the same manner as in Sample P101 of Example 1-5, except that for the sample P101 produced in the above Example 1-5, in the third layer, the amount to be used (coating amount) of the solvent (Solv-5) was changed into 0.10 g/m$^2$ and 0.07 g/m$^2$ of the following solvent (Solv-6) was used, in the seventh layer, the surfactant (Cpd-13) was replaced by the following compounds and the following compounds were used as the ultraviolet absorbers UV-A and UV-B. As shown above, in the thus-prepared Sample 2-001, the first layer was changed to any of BL-A to BL-E shown below and the composition of the fifth layer was changed to those shown by any of RL-A to RL-K. These first and fifth layers were combined, as shown in Table 12, to produce samples 2-101 to 2-116.

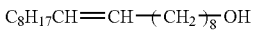

(Solv-6)

(Cpd-13) Surface-active agent to be used in Example 2-1

A mixture in 6:2:2 (molar ratio) of (a)

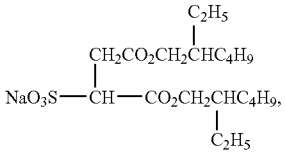

(b)

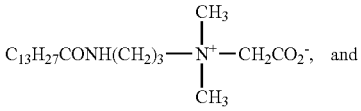

(c)

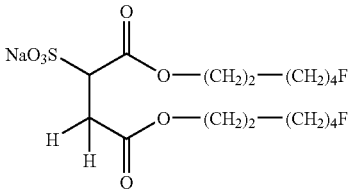

(UV-1)

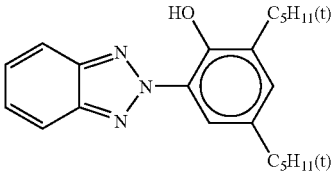

Ultraviolet absorbing agent (UV-2)

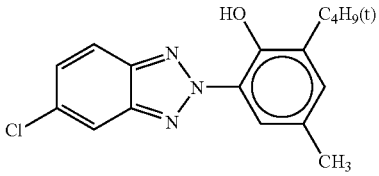

Ultraviolet absorbing agent (UV-3)

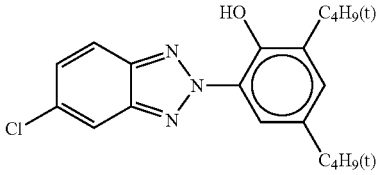

Ultraviolet absorbing agent (UV-5)

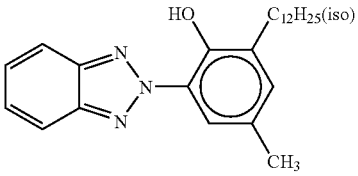

Ultraviolet absorbing agent

-continued (UV-6)

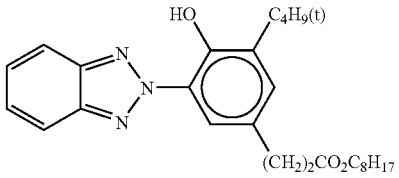

Ultraviolet absorbing agent (UV-7)

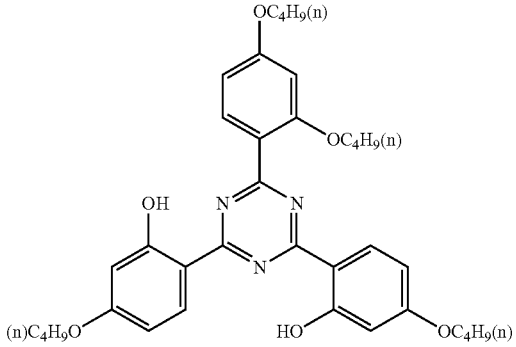

Ultraviolet absorbing agent
UV-A: A mixture of UV-1/UV-2/UV-3 = 7/2/2 (mass ratio)
UV-B: A mixture of UV-1/UV-2/UV-3/UV-5/UV-6/UV-7 = 3/1/1/3/1/3 (mass ratio)

1st layer alteration of the composition of the blue-sensitive emulsion layer

BL-A:

| | |
|---|---|
| Silver chloroiodobromide emulsion A (gold-sulfur sensitized cubes, a 3:7 mixture of the large-size emulsion A-1 and the small-size emulsion A-2 (in terms of mol of silver)) | 0.24 |
| Gelatin | 1.20 |
| Yellow coupler (Yellow coupler for comparison Y) | 0.53 |
| Color-image stabilizer (Cpd-2) | 0.06 |
| Color-image stabilizer (Cpd-8) | 0.07 |
| Color-image stabilizer (Cpd-14) | 0.07 |
| Solvent (Solv-9) | 0.20 |

BL-B:

| | |
|---|---|
| Silver chloroiodobromide emulsion A (gold-sulfur sensitized cubes, a 3:7 mixture of the large-size emulsion A-1 and the small-size emulsion A-2 (in terms of mol of silver)) | 0.15 |
| Gelatin | 0.87 |
| Yellow coupler (Exemplified compound (3)) | 0.30 |
| Color-image stabilizer (Cpd-2) | 0.06 |
| Color-image stabilizer (Cpd-8) | 0.07 |
| Color-image stabilizer (Cpd-14) | 0.07 |
| Solvent (Solv-9) | 0.20 |

BL-C:

In BL-B, the yellow coupler was changed to an equal mol of the exemplified compound (67).

BL-D:

In BL-B, the yellow coupler was changed to an equal mol of the exemplified compound (51).

BL-E:

In BL-B, the yellow coupler was changed to an equal mol of the exemplified compound (56).

5th layer alteration of the composition of the red-sensitive emulsion layer

RL-A:

| | |
|---|---|
| Silver chloroiodobromide emulsion E (gold-sulfur sensitized cubes, a 5:5 mixture of the large-size emulsion E-1 and the small-size emulsion E-2 (in terms of mol of silver)) | 0.17 |
| Gelatin | 1.30 |
| Cyan coupler (Cyan coupler for comparison C1) | 0.30 |
| Color-image stabilizer (Cpd-1) | 0.01 |
| Color-image stabilizer (Cpd-6) | 0.06 |
| Color-image stabilizer (Cpd-7) | 0.02 |
| Color-image stabilizer (Cpd-9) | 0.04 |

-continued

| | |
|---|---|
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.01 |
| Color-image stabilizer (Cpd-17) | 0.01 |
| Color-image stabilizer (Cpd-18) | 0.07 |
| Color-image stabilizer (Cpd-20) | 0.01 |
| Ultraviolet absorbing agent (UV-7) | 0.01 |
| Solvent (Solv-5) | 0.15 |

RL-B:

In RL-A, the amount of the silver chlorobromoiodide emulsion E was altered to 0.08 g/m$^2$ and the cyan coupler was altered to 0.15 g/m$^2$ of the exemplified compound (CC-50).

RL-C:

In RL-B, the cyan coupler (CC-50) was changed to an equal mol of the exemplified compound (CC-57).

RL-D:

In RL-B, the cyan coupler (CC-50) was changed to an equal mol of the exemplified compound (CC-56).

RL-E:

In RL-B, the cyan coupler (CC-50) was changed to an equal mol of the exemplified compound (CC-47).

RL-F:

In RL-B, the cyan coupler (CC-50) was changed to an equal mol of the exemplified compound (CC-10).

RL-G:

In RL-A, the amount of the silver chlorobromoiodide emulsion E was changed to 0.10 g/m$^2$ and the cyan coupler was changed to 0.10 g/m$^2$ of the exemplified compound (CC-50), 0.04 g/m of the above-mentioned (ExC-3), and 0.01 g/m$^2$ of the below mentioned (ExC-4).

RL-H:

In RL-G, the cyan coupler (CC-50) was changed to an equal mol of the exemplified compound (CC-57).

RL-I:

In RL-G, the cyan coupler (CC-50) was changed to an equal mol of the exemplified compound (CC-56).

RL-J:

In RL-G, the cyan coupler (CC-50) was changed to an equal mol of the exemplified compound (CC-47).

RL-K:

In RL-G, the cyan coupler (CC-50) was changed to an equal mol of the exemplified compound (CC-10).

Coupler for comparison Y1

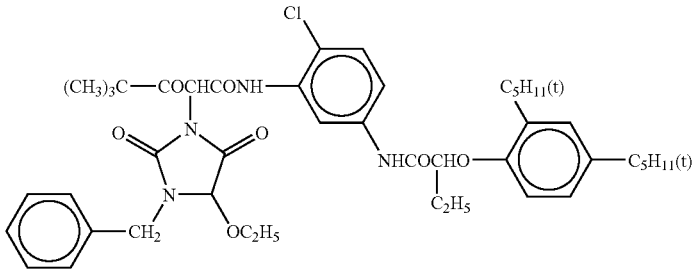

Coupler for comparison C1

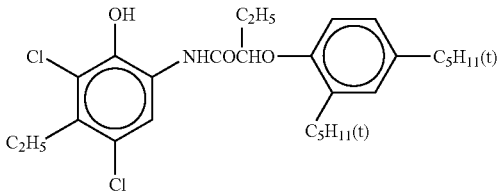

Evaluation was carried out for the photosensitive material 2-113 by subjecting to the image-wise exposure, the continuous treatment (running test) and the two processing steps A and B in the same manner as in the Example 1-5, except that, in the processings A and B of Example 1-5, the photosensitive material P103 was replaced by the above-mentioned photosensitive material 2-113 and color-developing time in the processing B was changed into 17 seconds.

The coating solutions for forming photographic constituent layers were coated and thus Samples (light-sensitive materials) 2-101 to 2-116 were prepared. These light-sensitive materials were used as samples. These samples were stored for 10 days under the conditions of 25° C. and 55% RH. After that, these samples were subjected to the following evaluations.

(Evaluation 1 Color Reproductively)

The samples were subjected to 3-color separation exposure and the samples after the exposure underwent color development processing according to the process A. In this way, monochromatic samples, i.e., yellow, magenta, and cyan samples, were obtained.

As the light source, a semiconductor laser was used to obtain a light source at 688 nm (R light), a semiconductor laser was combined with SHG to obtain a light source at 532 nm (G light) and a light source at 473 nm (B light). The quantity of R light was modulated with using an outer modulator, and scanning exposure was performed to a sample moving in a direction orthogonal to the scanning direction, by reflecting the light on a rotating polygon. The scanning exposure was performed at the density of 400 dpi and the average exposure time per 1 pixel was $8\times10^{-8}$ second. The temperature of the semiconductor laser was kept constant, with using a Peltier element, in order to prevent the change in quantity of light due to change in temperature.

By using the samples thus obtained, the volume of Lab space, which can be reproduced in accordance with the method described in JP-A-2001-194755 (paragraph Nos. 0014-0019 and Example 1), was computed. At Dmax=2.2 under a light source of D50, the volumes of space of L* of 50 or more of the samples, as relative values (percentages) on the basis of Sample 2-101, were computed.

(Evaluation 2 Processing Stability at the Time of Rapid Processing)

By using the light source (apparatus) for exposure of the evaluation 1, the exposing condition of the samples was determined such that a gray gradation was given in the process A. After being given the exposure, the samples were processed for development in the process B at a 1.2-fold transfer speed. The density at the process B of the exposed region, which gave a density of 2.0 at the process A, was measured and the density differences of yellow and cyan ((ΔB, ΔR) of the process B with respect to process A were computed.

(Evaluation 3, Desilverization)

Each sample was exposed to white light having a color temperature of 4800 degrees at 500 CMS. The exposed sample was treated in the processing solution used in the process step B wherein the bleaching and fixing time is shortened to 12 seconds. The amount of the residual silver of the treated sample was measured quantitatively by using a fluorescent X-rays.

(Evaluation 4, Residual Color)

Each sample was treated in the process step B in an unexposed state wherein the carrying speed was increased 1.4 times.

As to the treated sample, the density of yellow was measured in Status A by using an X-rite 310 Densitometer (manufactured by X-rite Company). The density of each sample was again measured after additionally washed using excess of ion exchanged water at 40° C. for 5 minutes. A change ΔY in yellow density between the samples before and after washed additionally with water was calculated to evaluate the degree of residual color.

Samples 2-112 to 2-116 were used together with the following cyan coupler ExC-4 as in the fifth layer.

ExC-4

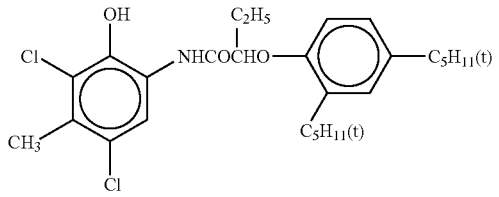

Cyan coupler

The evaluations results are shown in Table 12.

TABLE 12

| No. | Constitution of first layer | Coupler in first layer | Constitution of fifth layer | Coupler in fifth layer | Color reproductivity (Relative %) | Processing stability at the time of rapid processing ΔB | ΔR | Desilverizing ability ($g/m^2$) | Residual color ΔY |
|---|---|---|---|---|---|---|---|---|---|
| 2-101 | BL-A | Coupler for comparison Y1 | RL-A | Coupler for comparison C1 | 100.0 | −0.12 | −0.10 | 0.07 | 0.051 |
| 2-102 | BL-A | Coupler for comparison Y1 | RL-B | CC-50 | 104.5 | −0.09 | −0.03 | 0.04 | 0.041 |
| 2-103 | BL-B | (3) | RL-A | Coupler for comparison C1 | 104.5 | −0.06 | −0.10 | 0.04 | 0.035 |
| 2-104 | BL-B | (3) | RL-B | CC-50 | 111.0 | −0.03 | −0.02 | 0.01 | 0.005 |
| 2-105 | BL-B | (3) | RL-C | CC-57 | 111.0 | −0.03 | −0.02 | 0.01 | 0.005 |
| 2-106 | BL-B | (3) | RL-D | CC-56 | 111.0 | −0.03 | −0.02 | 0.01 | 0.005 |
| 2-107 | BL-B | (3) | RL-E | CC-47 | 110.0 | −0.03 | −0.03 | 0.01 | 0.005 |
| 2-108 | BL-B | (3) | RL-F | CC-10 | 110.0 | −0.03 | −0.02 | 0.01 | 0.008 |
| 2-109 | BL-C | (67) | RL-C | CC-57 | 111.0 | −0.03 | −0.02 | 0.01 | 0.005 |
| 2-110 | BL-D | (51) | RL-C | CC-57 | 111.0 | −0.03 | −0.02 | 0.01 | 0.005 |
| 2-111 | BL-E | (56) | RL-C | CC-57 | 110.5 | −0.03 | −0.02 | 0.01 | 0.005 |
| 2-112 | BL-B | (3) | RL-G | CC-50/EXC-3/EXC-4 | 109.5 | −0.03 | −0.03 | 0.01 | 0.012 |
| 2-113 | BL-C | (67) | RL-H | CC-57/EXC-3/EXC-4 | 109.5 | −0.03 | −0.02 | 0.01 | 0.010 |
| 2-114 | BL-D | (51) | RL-I | CC-56/EXC-3/EXC-4 | 109.5 | −0.03 | −0.02 | 0.01 | 0.010 |
| 2-115 | BL-E | (56) | RL-J | CC-47/EXC-3/EXC-4 | 109.0 | −0.03 | −0.04 | 0.01 | 0.011 |
| 2-116 | BL-D | (51) | RL-K | CC-10/EXC-3/EXC-4 | 109.0 | −0.03 | −0.04 | 0.01 | 0.011 |

It can be found from the results shown in Table 12 that the use of a combination of the yellow coupler used in the present invention and the cyan coupler used in the present invention ensured the silver halide photographic light-sensitive material which was excellent in color reproducibility, and in all of desilverizing ability, residual color and stability during rapid processing.

Example 2-2

The positions of the first and fifth layers in the samples 2-101 to 2-116 in Example 2-1 were reversed to produce samples 2-201 to 2-216. These samples 2-201 to 2-216 were evaluated according to the method used in Example 2-1. As a result, an improvement in yellow and magenta color density was found in a gray process when using the sample using, particularly, the cyan coupler to be used in the present invention. Also, the results of the evaluations 1 to 4, similar to Example 2-1, showed that the use of a combination of the yellow coupler used in the present invention and the cyan coupler used in the present invention ensured the silver halide photographic light-sensitive material which was excellent in color reproducibility, and in all of desilverizing ability, residual color and stability during rapid processing.

Example 2-3

The magenta coupler contained in the third layer of each sample of Examples 2-1 and 2-2 was changed as shown below to produce samples. Each resulting sample was evaluated according to the methods used in Examples 2-1 and 2-2. As a result, it was found that a silver halide color photographic light-sensitive material having excellent color reproducibility and rapid processability was obtained according to the present invention.

3rd Layer Modification of the Composition of the Green-sensitive Emulsion Layer

GL-A:

The magenta coupler in the third layer in Example 2-1 was altered to 1.5 equivalent mol of the magenta coupler M1.

GL-B:

The magenta coupler in the third layer in Example 2-1 was altered to 1.5 equivalent mol of the magenta coupler M2.

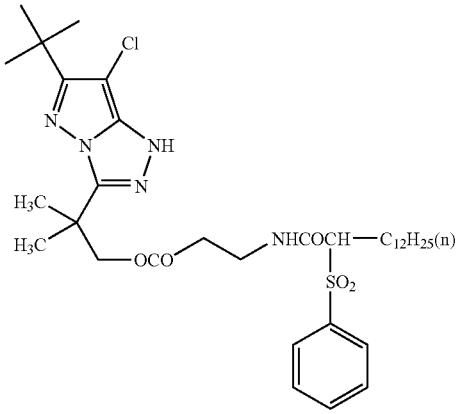

Magenta coupler M 1

-continued

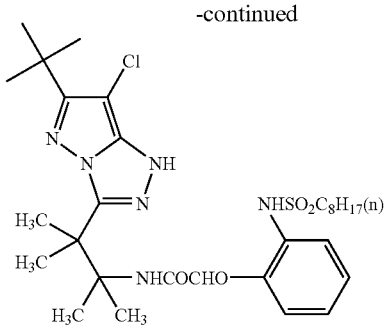

Magenta coupler M 2

Example 2-4

In Example 2-1, the silver halide emulsion was altered as shown below to prepare a sample, which was evaluated according to the method used in Example 2-1. As a result, it was found that according to the present invention, a silver halide color photographic light-sensitive material having excellent color reproducibility and rapid processability was obtained.

First layer: Mixture of (Emulsion B-H) and (Emulsion B-L) in a ratio of 4:6 (in silver molar ratio)

Third layer: Mixture of (Emulsion G-H) and (Emulsion G-L) in a ratio of 5:5 (in silver molar ratio)

Fifth layer: Mixture of (Emulsion R-H) and (Emulsion R-L) in a ratio of 6:4 (in silver molar ratio)

(Preparation of Emulsion B-H)

A cubic high-silver chloride content emulsion which had a sphere equivalent diameter grains of 0.55 μm and a coefficient of variation of 10% was prepared by a usual method in which silver nitrate and sodium chloride were added simultaneously to an aqueous gelatin solution which was stirred to mix them. Potassium bromide (KBr) and $K_4$-[$Ru(CN)_6$] were added to the reaction solution at the step of the addition of from 80% to 90% of the entire silver nitrate amount used in emulsion grain formation, so that the KBr amount became 3 mole % per mole of the finished silver halide. When the addition of 90% of the entire silver nitrate amount was completed, an aqueous solution of potassium iodide (KI) was added, so that the KI amount became 0.3 mole % per mole of the finished silver halide. $K_2$[Ir(5-methylthiazole)$Cl_5$] and $K_2$[Ir($H_2O$)$Cl_5$] were added to the reaction solution at the step of the addition of from 92% to 98% of the entire silver nitrate amount used in emulsion grain formation. The resulting emulsion was subjected to desalting treatment and then a gelatin was added to the emulsion to redisperse. To the emulsion were added sodium thiosulfonate and the following sensitizing dyes A and B, and the resulting emulsion was optimally ripened with sodium thiosulfate pentahydrate as a sulfur sensitizer and bis(1,4,5-trimethyl-1,2,4-triazolium-3-thiolate)aurate(I)tetrafluoroborate as a gold sensitizer. Further, 1-phenyl-5-mercaptotetrazole and 1-(5-methylureidophenyl)-5-mercaptotetrazole were added to the resultant, thereby Emulsion B-H being prepared.

(Preparation of Emulsion B-L)

A cubic high-silver chloride content emulsion which had a sphere equivalent diameter of grains of 0.45 μm and a coefficient of variation of 10%, was prepared in the same manner as in the production of the emulsion B-H, except that the rate of the addition of silver nitrate and sodium chloride was changed. The resulting emulsion was named as an emulsion B-L.

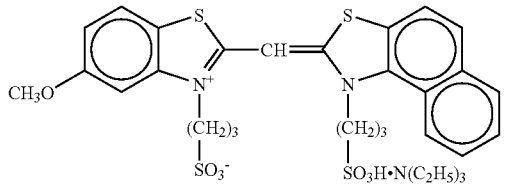

(Sensitizing dye A)

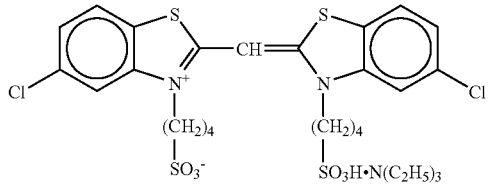

(Sensitizing dye B)

amount used in emulsion grain formation. Further, $K_2[Ir(H_2O)Cl_5]$ was added to the reaction solution at the step of the addition of from 92% to 98% of the entire silver nitrate amount used in emulsion grain formation. The resulting emulsion was subjected to desalting treatment and then a gelatin was added to the emulsion to redisperse. To the emulsion was added sodium thiosulfonate and the resultant emulsion was optimally ripened with sodium thiosulfate pentahydrate as a sulfur sensitizer and bis(1,4,5-trimethyl-1,2,4-triazolium-3-thiolate)aurate(I)tetrafluoroborate as a gold sensitizer. Further, the following sensitizing dye D, 1-phenyl-5-mercaptotetrazole, 1-(5-methylureidophenyl)-5-mercaptotetrazole and potassium bromide were added to the resultant, thereby Emulsion G-H being prepared.

(Preparation of Emulsion G-L)

A cubic high-silver chloride content emulsion which had a sphere equivalent diameter of grains of 0.28 μm and a coefficient of variation of 10% was prepared in the same manner as in the production of the emulsion G-H, except that the rate of the addition of silver nitrate and sodium chloride was changed. The resulting emulsion was named as an emulsion G-L.

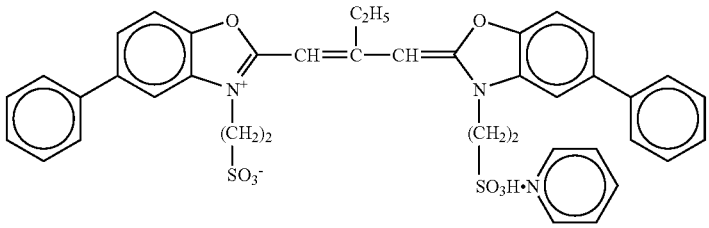

(Sensitizing dye D)

(Preparation of Emulsion G-H)

A cubic high-silver chloride content emulsion which had a sphere equivalent diameter of grains of 0.35 μm and a coefficient of variation of 10% was prepared by a usual method in which silver nitrate and sodium chloride were added simultaneously to an aqueous gelatin solution which was stirred, to mix them. $K_4$-$[Ru(CN)_6]$ was added to the reaction solution at the step of the addition of from 80% to 90% of the entire silver nitrate amount used in emulsion grain formation. Potassium bromide (KBr) was added to the reaction solution at the step of the addition of from 80% to 100% of the entire silver nitrate amount used in emulsion grain formation, so that the KBr amount became 4 mole % per mole of the finished silver halide. When the addition of 90% of the entire silver nitrate amount was completed, an aqueous solution of potassium iodide (KI) was added, so that the KI amount became 0.2 mole % per mole of the finished silver halide. $K_2[Ir(5\text{-methylthiazole})Cl_5]$ was added to the reaction solution at the step of the addition of from 92% to 95% of the entire silver nitrate (Preparation of Emulsion R-H)

A cubic high-silver chloride content emulsion which had a sphere equivalent diameter of grains of 0.35 μm and a coefficient of variation of 10% was prepared by a usual method in which silver nitrate and sodium chloride were added simultaneously to an aqueous gelatin solution which was stirred. $K_4[Ru(CN)_6]$ was added to the reaction solution at the step of the addition of from 80% to 90% of the entire silver nitrate amount used in emulsion grain formation. Potassium bromide (KBr) was added to the reaction solution at the step of the addition of from 80% to 100% of the entire silver nitrate amount used in emulsion grain formation, so that the KBr amount became 4.3 mole % per mole of the finished silver halide. When the addition of 90% of the entire silver nitrate amount was completed, an aqueous solution of potassium iodide (KI) was added, so that the KI amount became 0.15 mole % per mole of the finished silver halide. $K_2[Ir(5\text{-methylthiazole})Cl_5]$ was added to the reaction solution at the step of the addition of from 92% to 95% of the entire silver nitrate amount used in emulsion grain formation. Further, $K_2[Ir(H_2O)Cl_5]$ was added to the reaction solution at the step of the addition of from 92% to 95% of the entire silver nitrate amount used in emulsion grain formation. Further, $K_2[Ir(H_2O)Cl_5]$ was added to the reaction solution at the step of the addition of from 92% to 98% of the entire silver nitrate amount used in emulsion grain formation. The resulting emulsion was subjected to desalting treatment and then a gelatin was added to the emulsion to redisperse. To the emulsion was added sodium thiosulfonate and resultant emulsion was optimally ripened with sodium thiosulfate pentahydrate as a sulfur sensitizer and bis(1,4,5-trimethyl-1,2,4-triazolium-3-thiolate)aurate(I)tetrafluoroborate as a gold sensitizer. Further, the following sensitizing dye H, 1-phenyl-5-mercaptotetrazole, 1-(5-methylureidophenyl)-5-mercaptotetrazole, the following compound I and potassium bromide were added to the resultant, thereby Emulsion R-H being prepared.

(Preparation of Emulsion R-L)

A cubic high-silver chloride content emulsion which had a sphere equivalent diameter of grains of 0.28 μm and a coefficient of variation of 10% was prepared in the same manner as in the production of the emulsion R-H, except that the rate of the addition of silver nitrate and sodium chloride was changed. The resulting emulsion was named as an emulsion R-L.

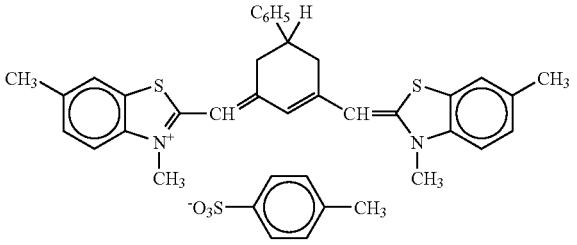

(Sensitizing dye H)

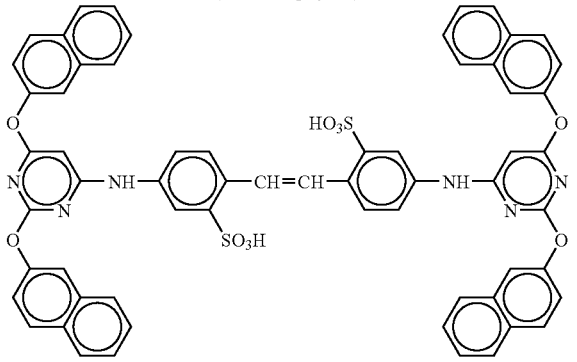

(Compound I)

Example 2-5

The samples produced in Examples 2-1 to 2-4 were scan-exposed using the apparatus shown below, to evaluate the resulting samples according to the methods used in Examples 2-1 to 2-4. As a result, it was found that when the sample having the structure of the present invention was used, the effects of the present invention, such as excellent in Color reproductivity and rapid processability, were exhibited particularly significantly.

Digital Minilabo Frontier 330 (trade name, manufactured by Fuji Photo Film Co., Ltd.), Lambda 130 (trade name, manufactured by Durst), LIGHTJET 5000 (trade name, manufactured by Gretag).

Example 2-6

The following alterations 1) and 2) were made in the sample 109 described in Example 1 of JP-A-2001-142181 to produce a sample.

1) Each composition of the 15th layer, the 16th layer and the 17th layer was altered as follows.

2) In all of the fourth, fifth and sixth layers of the sample 101 of Example 1, only 50% of the mol ratio of each of C-1 and C-2 used in the sample was replaced by the exemplified compound CC-50 that can be used in the present invention. Specifically, C-1 was replaced by a mixture (used in the fourth and fifth layers) of C-1 (the compound described in Example 1 of JP-A-2001-142181) and CC-50 that can be used in the present invention, and C-2 was replaced by a mixture (used in the sixth layer) of C-2 (the compound described in Example 1 of JP-A-2001-142181) and CC-50 that can be used in the present invention.

15th Layer (Low Sensitivity Blue-sensitive Emulsion Layer)

| | | |
|---|---|---|
| Silver bromoiodide emulsion L | silver | 0.11 |
| Silver bromoiodide emulsion M | silver | 0.15 |
| Gelatin | | 0.80 |
| Yellow coupler (exemplified compound (62) to be used in the present invention) | | 0.30 |
| Compound Cpd-M | | 0.01 |
| High-boiling point organic solvent (tricresyl phosphate) | | 0.05 |

16th Layer (Middle Sensitivity Blue-sensitive Emulsion Layer)

| | | |
|---|---|---|
| Silver bromoiodide emulsion N | amount of silver | 0.15 |
| Silver bromoiodide emulsion O | amount of silver | 0.15 |
| Gelatin | | 0.76 |
| Yellow coupler (exemplified compound (62) to be used in the present invention) | | 0.34 |
| Compound Cpd-N | | 0.002 |
| High-boiling point organic solvent (tricresyl phosphate) | | 0.06 |

17th Layer (High Sensitivity Blue-sensitive Emulsion Layer)

| | | |
|---|---|---|
| Silver bromoiodide emulsion O | amount of silver | 0.15 |
| Silver bromoiodide emulsion P | amount of silver | 0.15 |
| Gelatin | | 1.10 |
| Yellow coupler (exemplified compound (62) to be used in the present invention) | | 0.92 |
| Compound Cpd-N | | 0.005 |
| Compound Cpd-Q | | 0.20 |
| High-boiling point organic solvent (tricresyl phosphate) | | 0.17 |

Silver bromoiodide emulsions L to P and Compounds Cpd-M, N and Q were the same as those described in Example 1 in JP-A-2001-142181.

Using the sample obtained in this manner, exposure and development processing (development processing A) were carried out using the methods described in Example 1 of JP-A-2001-142181, to confirm the effects of the present invention.

Example 3-1

Sample 3-001 was prepared in the same manner as in Sample P101 of Example 1-5, except that for the sample P101 produced in the above Example 1-5, in the third layer, the amount to be used (coating amount) of the solvent (Solv-5) was changed into 0.10 g/m$^2$ and 0.07 g/m$^2$ of the following solvent (Solv-6) was used, in the seventh layer, the surfactant (Cpd-13) was replaced by the following compounds and the below-shown compounds were used as the ultraviolet absorbers UV-A and UV-B. In the thus-prepared Sample 3-001, the first layer was changed into the following composition, to prepare Sample Nos. 3-101 to 3-130, respectively.

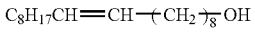

(Solv-6)

(Cpd-13) Surface-active Agent to be used in Example 3-1

A mixture in 6:2:2 (molar ratio) of (a)

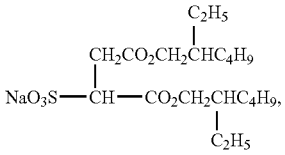

(b)

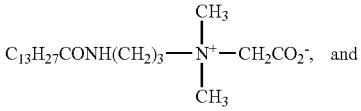

(c)

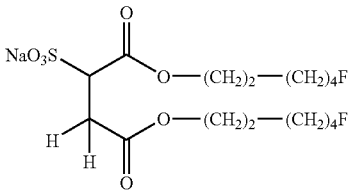

(UV-1)

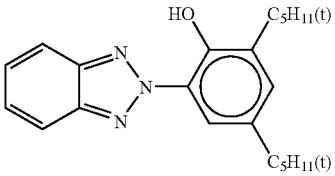

Ultraviolet absorbing agent (UV-2)

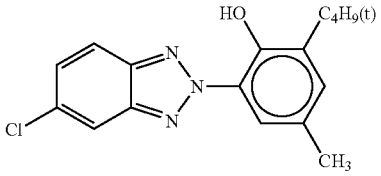

Ultraviolet absorbing agent

-continued (UV-3)

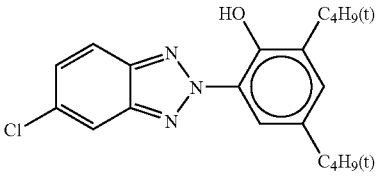

Ultraviolet absorbing agent (UV-5)

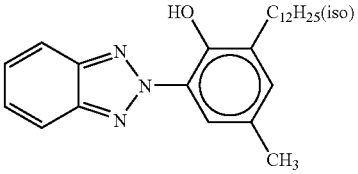

Ultraviolet absorbing agent (UV-6)

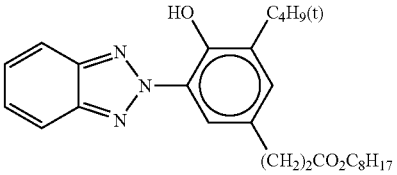

Ultraviolet absorbing agent (UV-7)

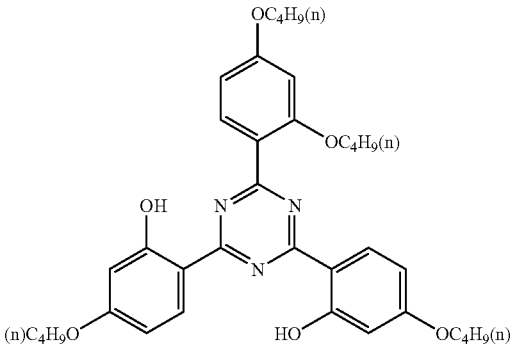

Ultraviolet absorbing agent
UV-A: A mixture of UV-1/UV-2/UV-3 = 7/2/2 (mass ratio)
UV-B: A mixture of UV-1/UV-2/UV-3/UV-5/UV-6/UV-7 = 3/1/1/3/1/3 (mass ratio)

1st Layer Alteration of the Composition of the Blue-sensitive Emulsion Layer

Composition of Sample No. 3-101:

| | |
|---|---|
| Silver chlorobromoiodide emulsion A (sulfur-plus-gold sensitized cubic grains, a 3:7 (in silver molar ratio) mixture composed of the large-size emulsion A-1 and the small-size emulsion A-2) | 0.24 |
| Gelatin | 1.20 |
| Yellow coupler (comparative coupler Y1) | 0.53 |
| Color image stabilizer (Cpd-2) | 0.06 |
| Color image stabilizer (Cpd-8) | 0.07 |
| Color image stabilizer (Cpd-14) | 0.07 |
| Solvent (comparative solvent DBP) | 0.20 |

(comparative solvent DBP: dibutyl phthalate)

Composition of Sample No. 3-102:

The solvent of the 1st layer of the sample No. 3-101 was replaced with the solvent (S-I-6) in the present invention.

Composition of Sample No. 3-103:

| | |
|---|---|
| Silver chlorobromoiodide emulsion A (sulfur-plus-gold sensitized cubic grains, a 3:7 (in silver molar ratio) mixture composed of the large-size emulsion A-1 and the small-size emulsion A-2) | 0.15 |
| Gelatin | 0.87 |
| Yellow coupler (Exemplified compound (3)) | 0.30 |
| Color image stabilizer (Cpd-2) | 0.06 |
| Color image stabilizer (Cpd-8) | 0.07 |
| Color image stabilizer (Cpd-14) | 0.07 |
| Solvent (comparative solvent DBP) | 0.20 |

Composition of Sample No. 3-104:

The solvent of the 1st layer of the sample No. 3-103 was replaced with the solvent (S-I-6) in the present invention.

Compositions of Samples Nos. 3-105 to 3-130

The yellow coupler and the solvent of the 1st layer of the sample No. 3-104 were replaced according to Table 13. The replacement of the coupler was made on equimolar basis and the replacement of the solvent was made on the same mass basis.

Evaluation was carried out by subjecting to the image-wise exposure, the continuous treatment (running test) and the two processing steps A and B in the same manner as in the Example 1-5, except that, in the processings A and B of Example 1-5, the photosensitive material P103 was replaced by the above-mentioned photosensitive material 3-001 and color-developing time in the processing B was changed into 17 seconds.

The coating solutions for forming photographic constituent layers were coated and thus light-sensitive materials were prepared. These light-sensitive materials were used as samples. These samples were stored for 10 days under the conditions of 25° C. and 55% RH. After that, these samples were subjected to the following evaluations.

With respect to (Evaluation 1 Color reproductivity) and (Evaluation 2 processing stability at the time of rapid processing), tests and evaluations were performed in the same manner as in Example 2-1.

(Evaluation 3 Preservation Stability in an Unexposed State)

Two samples (Control and Aging) stored in different conditions were prepared from each sample: in one test (Control), the sample after coated was stored in the condition of a temperature of 25° C. and a relative humidity of 55% for 10 days and in another test, the sample after the above test was further stored in the condition of a temperature of 40° C. and a relative humidity of 75% for 4 days. Thereafter, exposure for separation gradation in which three-colored separation was conducted was carried out using the exposure apparatus used in the Evaluation 1 and developing treatment was carried out in the process step B to perform sensitometry. The yellow density of the sample (Aging) which had been stored in the condition of a temperature of 40° C. and a relative humidity of 75% and exposed at the intensity giving a yellow density of 1.8 to the sample (Control) which had been stored in the condition of a temperature of 25° C. and a relative humidity of 55%, was measured. A difference (ΔB Aging) in the density between the Aging sample and the Control sample was calculated.

(Evaluation 4 Fastness Against Humidity and Heat)

The sample for Control produced in the Evaluation 3 was stored at 80° C. under a relative humidity of 70% for 21 days to measure each density before and after the test. The relative residual rate of the yellow color developed portion of the sample after stored at the point where the initial density was 1.8 was calculated.

(Evaluation 5 Light Fastness)

The sample for Control produced in the Evaluation 3 was used to measure each density before and after it was stored for 14 days under a Xe-light source at an intensity of 100,000 Lux. The relative residual rate of the yellow color developed portion of the sample after stored at the point where the initial density was 1.0 was calculated.

The evaluations results are shown in Table 13.

TABLE 13

| No. | Coupler in the first layer | Solvent for the first layer | Processing stability at the time of rapid processing ΔB | Stability in an unexposed state ΔB Aging | Fastness against humidity and heat (Residual rate %) |
|---|---|---|---|---|---|
| 3-101 | Coupler for comparison Y1 | Solvent for comparison DBP | −0.10 | −0.11 | 80 |
| 3-102 | Coupler for comparison Y1 | S-I-6 | −0.11 | −0.03 | 86 |
| 3-103 | (3) | Solvent for comparison DBP | −0.03 | −0.10 | 96 |
| 3-104 | (3) | S-I-6 | −0.03 | −0.03 | 97 |
| 3-105 | (67) | Solvent for comparison DBP | −0.03 | −0.10 | 96 |
| 3-106 | (67) | S-I-6 | −0.03 | −0.03 | 97 |
| 3-107 | (51) | Solvent for comparison DBP | −0.03 | −0.10 | 96 |
| 3-108 | (51) | S-I-6 | −0.03 | −0.03 | 97 |
| 3-109 | (56) | Solvent for comparison DBP | −0.03 | −0.10 | 97 |
| 3-110 | (56) | S-I-6 | −0.03 | −0.03 | 98 |
| 3-111 | (51) | S-I-2 | −0.03 | −0.02 | 98 |
| 3-112 | (51) | S-I-22 | −0.03 | −0.02 | 98 |
| 3-113 | (51) | S-I-6/S-II-7 *1) | −0.01 | −0.04 | 97 |
| 3-114 | (51) | S-I-6/S-II-2 *1) | −0.02 | −0.04 | 97 |
| 3-115 | (51) | S-III-3 | −0.03 | −0.02 | 98 |

TABLE 13-continued

| No. | Coupler in the first layer | Solvent for the first layer | Processing stability at the time of rapid processing ΔB | Stability in an unexposed state ΔB Aging | Fastness against humidity and heat (Residual rate %) |
|---|---|---|---|---|---|
| 3-116 | (51) | S-III-6 | −0.03 | −0.02 | 98 |
| 3-117 | (51) | S-IV-2 | −0.02 | −0.03 | 97 |
| 3-118 | (51) | S-V-1 | −0.03 | −0.01 | 99 |
| 3-119 | (51) | S-V-7 | −0.03 | −0.01 | 99 |
| 3-120 | (51) | S-VI-1 | −0.03 | −0.01 | 99 |
| 3-121 | (56) | S-I-6/ST-II-121 *2) | −0.01 | −0.02 | 98 |
| 3-122 | (56) | S-I-6/ST-II-122 *2) | −0.01 | −0.02 | 98 |
| 3-123 | (56) | S-I-6/ST-III-18 *2) | 0.00 | −0.02 | 98 |
| 3-124 | (67) | S-I-6/ST-V-25 *2) | −0.01 | −0.02 | 98 |
| 3-125 | (67) | S-I-6/ST-IV-5 *2) | −0.03 | −0.01 | 98 |
| 3-126 | (67) | S-I-6/ST-IV-72 *2) | −0.03 | −0.01 | 98 |
| 3-127 | (67) | S-I-6/P2 *3) | −0.03 | −0.02 | 98 |
| 3-128 | (67) | S-I-6/P10 *3) | −0.04 | −0.02 | 98 |
| 3-129 | (67) | S-I-6/P60 *3) | −0.03 | −0.02 | 98 |
| 3-130 | (67) | S-I-6/PP-16 *3) | −0.02 | −0.02 | 98 |

*1) Mixture (mass ratio: 1/4)
*2) Mixture (mass ratio: 1/3)
*3) Mixture (mass ratio: 1/5)

When the yellow coupler according to the present invention and the compound according to the present invention were used, a silver halide color photographic light-sensitive material was obtained which was excellent in stability in rapid processing, stability in an unexposed state and image fastness.

Example 3-2

The coupler and the solvent in the first layer in the samples 3-101 and 3-102 of Example 3-1 were altered, as shown in Table 14, to prepare samples 3-201 and 3-202. Similarly, the coupler and the solvent in the first layer in the sample 3-104 of Example 3-1 were altered, as shown in Table 14, to prepare samples 3-203 to 3-217. These resulting samples were evaluated according to the method used in Example 3-1. As a result, silver halide color photographic light-sensitive materials excellent in rapid processability and color reproducibility were obtained when the yellow coupler according to the present invention and the compound according to the present invention were used in combination.

TABLE 14

| No. | Coupler in the first layer | Solvent for the first layer | Processing stability at the time of rapid processing ΔB | Color reproducibility (Relative rate %) |
|---|---|---|---|---|
| 3-201 | Coupler for comparison Y1 | Solvent for comparison DBP | −0.1 | 99.0 |
| 3-202 | Coupler for comparison Y1 | S-I-6 | −0.11 | 100.0 |
| 3-203 | (3) | S-I-6 | −0.03 | 106.2 |
| 3-204 | (3) | S-I-1 | −0.03 | 105.8 |
| 3-205 | (3) | S-I-2 | −0.03 | 105.6 |
| 3-206 | (3) | S-III-3 | −0.01 | 105.3 |
| 3-207 | (3) | S-IV-7 | −0.03 | 105.6 |
| 3-208 | (3) | S-V-1 | −0.03 | 105.3 |
| 3-209 | (3) | ST-I-4 | −0.03 | 106.2 |
| 3-210 | (3) | ST-I-68 | −0.05 | 106.5 |
| 3-211 | (3) | S-I-6/ST-I-68 *1) | −0.03 | 106.5 |
| 3-212 | (3) | S-III-3/ST-I-68 *1) | −0.03 | 106.2 |
| 3-213 | (51) | S-I-2 | −0.03 | 105.0 |

TABLE 14-continued

| No. | Coupler in the first layer | Solvent for the first layer | Processing stability at the time of rapid processing ΔB | Color reproducibility (Relative rate %) |
|---|---|---|---|---|
| 3-214 | (51) | S-I-6 | −0.03 | 105.2 |
| 3-215 | (51) | ST-I-4 | −0.03 | 105.0 |
| 3-216 | (51) | ST-I-68 | −0.03 | 105.8 |
| 3-217 | (51) | S-I-6/ST-I-68*1) | −0.03 | 105.8 |

*1) Mixture (mass ratio: ⅓)

Example 3-3

In the samples 3-202 and 3-214 of Example 3-2, only the amount of the solvent was altered, to prepare samples, in which the ratio (the oil soluble content/Cp ratio) of the total amount of the color-image stabilizer and solvent to the coupler in the first layer was altered, as shown in Table 15. In this alteration of the composition, the ratio of the total mass of the coupler, color stabilizer and solvent to the gelatin in the first layer was made constant. The light fastness of each of these samples was evaluated, to find that the yellow coupler according to the present invention was significantly improved in light fastness by increasing the amount of the solvent.

TABLE 15

| No. | Coupler in the first layer | Oil soluble content/Cp ratio | Light fastness (Residual rate %) |
|---|---|---|---|
| 3-301 | Coupler for comparison Y1 | 0.75 | 80 |
| 3-302 | Coupler for comparison Y1 | 1.5 | 76 |
| 3-303 | Coupler for comparison Y1 | 2.0 | 74 |
| 3-304 | Coupler for comparison Y1 | 2.5 | 73 |
| 3-305 | (51) | 0.75 | 75 |
| 3-306 | (51) | 1.5 | 80 |

TABLE 15-continued

| No. | Coupler in the first layer | Oil soluble content/Cp ratio | Light fastness (Residual rate %) |
|---|---|---|---|
| 3-307 | (51) | 2.0 | 91 |
| 3-308 | (51) | 2.5 | 93 |

Example 3-4

In Example 3-1, the silver halide emulsion was altered as shown below to prepare a sample, which was evaluated according to the method used in Example 3-1. As a result, it was found that according to the present invention, a silver halide color photographic light-sensitive material excellent in color reproducibility, rapid processability and preservation stability in the unexposed state of a light-sensitive material was obtained.

First layer: Mixture of (Emulsion B-H) and (Emulsion B-L) in a ratio of 4:6 (in silver molar ratio)

Third layer: Mixture of (Emulsion G-H) and (Emulsion G-L) in a ratio of 5:5 (in silver molar ratio)

Fifth layer: Mixture of (Emulsion R-H) and (Emulsion R-L) in a ratio of 6:4 (in silver molar ratio)

In the above, Emulsion B-H, Emulsion B-L, Emulsion G-H, Emulsion G-L, Emulsion R-H and Emulsion R-L each were prepared in the same manner as in Example 2-4 and used as the amount (ratio) of use described above.

Example 3-5

In the Examples 3-1 to 3-4, the composition of the fifth layer was altered as shown below to prepare a sample. The sample was evaluated according to the method used in Examples 3-1 to 3-4, with the result that according to the structure of the present invention, excellent rapid processability, color reproducibility, preserving ability in the unexposed state of a light-sensitive material, and image fastness were exhibited.

Fifth Layer (Red-Sensitive Emulsion Layer)

| | |
|---|---|
| Silver chloroiodobromide emulsion E (gold-sulfur sensitized cubes, a 5:5 mixture of the large-size emulsion E-1 and the small-size emulsion E-2 (in terms of mol of silver)) | 0.10 |
| Gelatin | 1.11 |
| Cyan coupler (ExC-1) | 0.02 |
| Cyan coupler (ExC-3) | 0.01 |
| Cyan coupler (ExC-4) | 0.11 |
| Cyan coupler (ExC-5) | 0.01 |
| Color-image stabilizer (Cpd-1) | 0.01 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.01 |
| Color-image stabilizer (Cpd-17) | 0.01 |
| Color-image stabilizer (Cpd-18) | 0.07 |
| Color-image stabilizer (Cpd-20) | 0.01 |
| Ultraviolet absorbing agent (UV-7) | 0.01 |
| Solvent (Solv-5) | 0.15 |

-continued (ExC-4) Cyan coupler

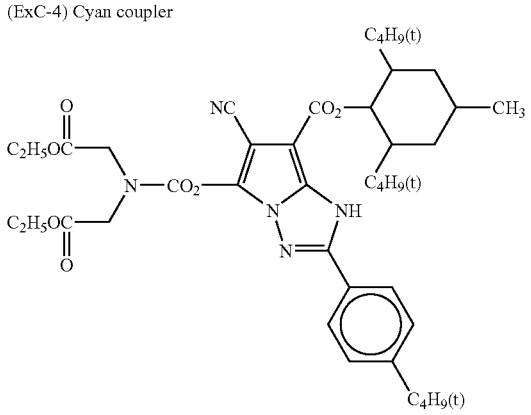

(ExC-5) Cyan coupler

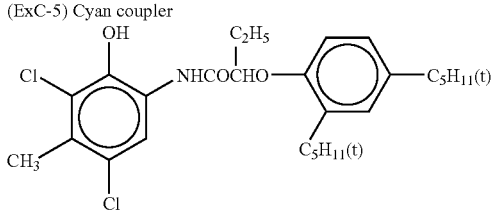

Example 3-6

The samples produced in Examples 3-1 to 3-5 were scan-exposed in the same method as in Example 2-5, to evaluate the resulting samples according to the method used in Examples 3-1 to 3-5. As a result, it was found that when the sample having the structure of the present invention was used, the effects of the present invention, such as excellent color reproducibility and rapid processability, were exhibited particularly significantly.

Example 3-7

In the sample 109 described in Example 1 of JP-A-2001-142181, each composition of the 15th layer, 16th layer and 17th layer was altered as shown below to prepare a sample.

15th Layer (Low Sensitivity Blue-sensitive Emulsion Layer)

| | | |
|---|---|---|
| Silver bromoiodide emulsion L | silver | 0.11 |
| Silver bromoiodide emulsion M | silver | 0.15 |
| Gelatin | | 0.80 |
| Yellow coupler (Exemplified compound (62) according to the present invention) | | 0.30 |
| Compound Cpd-M | | 0.01 |
| High-boiling point organic solvent (Exemplified compound (S-I-6) according to the present invention) | | 0.05 |

16th Layer (Middle Sensitivity Blue-sensitive Emulsion Layer)

| | | |
|---|---|---|
| Silver bromoiodide emulsion N | silver | 0.15 |
| Silver bromoiodide emulsion O | silver | 0.15 |
| Gelatin | | 0.76 |
| Yellow coupler (Exemplified compound (62) according to the present invention) | | 0.34 |
| Compound Cpd-N | | 0.002 |

-continued

| | |
|---|---|
| High-boiling point organic solvent (Exemplified compound (S-I-6) according to the present invention) | 0.06 |

17th Layer (High Sensitivity Blue-sensitive Emulsion Layer)

| | | |
|---|---|---|
| Silver bromoiodide emulsion O | silver | 0.15 |
| Silver bromoiodide emulsion P | silver | 0.15 |
| Gelatin | | 1.10 |
| Yellow coupler (Exemplified compound (62) according to the present invention) | | 0.92 |
| Compound Cpd-N | | 0.005 |
| Compound Cpd-Q | | 0.20 |
| High-boiling point organic solvent (Exemplified compound (S-I-6) according to the present invention) | | 0.17 |

In this connection, Silver bromoiodide emulsions L to P and Compounds Cpd-M, N and Q were the same as those described in Example 1 in JP-A-2001-142181.

Further, samples differing only in the point that the exemplified compound (S-I-6) which was the high-boiling point organic solvent used in each of the 15th layer, 16th layer and 17th layer was altered to an equal amount of compounds or mixtures were produced. As the compounds and mixtures replaced for the exemplified compound (S-I-6), the solvents used in the first layer of the samples 3-111 to 3-130 of Example 3-1 of the present invention were used. Each of these samples was exposed to light and processed (development processing A) by the method described in Example 1 of JP-A-2001-142181. The humidity and heat fastness and light fastness of each resulting sample were evaluated according to the method described in Example 3-1 in the present specification, to confirm the effects of the present invention.

Example 4-1

Preparation of Blue-sensitive Emulsion A

To 1.06 liters of deionized distilled water containing 5.7 mass % of deionized gelatin were added 46.3 ml of a 10% solution of NaCl and further 46.4 ml of $H_2SO_4$ (1 N) and 0.012 g of a compound X. Then, the liquid temperature was adjusted to 60° C. when immediately 0.1 mol of silver nitrate and 0.1 mol of NaCl was added to the reaction vessel in 10 minutes while performing high speed stirring. Subsequently, 1.5 mol of silver nitrate and NaCl solution were added in 60 minutes by a flow rate increasing method so that a final addition rate became 4 times the initial addition rate. Then, 0.2 mol % of silver nitrate and NaCl solution were added in 6 minutes at a constant addition rate. On this occasion, $K_3IrCl_5(H_2O)$ was added to the NaCl solution in an amount of $5\times10^{-7}$ mol based on the total amount of silver to dope the grains with aquated iridium.

Further, 0.2 mol of silver nitrate and 0.18 mol of NaCl as well as 0.02 mol of a KBr solution were added in 6 minutes. On this occasion, $K_4Ru(CN)_6$ and $K_4Fe(CN)_6$ corresponding to $0.5\times10^{-5}$ mol based on the total amount of silver were each added to the silver halide grains by dissolving them in the aqueous halogen solution.

Also, during growth of the grains in this final stage, an aqueous KI solution corresponding to 0.001 mol based on the total amount of silver was added into the reaction vessel in 1 minute. The addition was started at a point in time when 93% of the total grains was formed.

Thereafter, the compound (Y) as a precipitant was added at 40° C. and the pH was adjusted to about 3.5, and then the emulsion was desalted and washed with water.

Compound X

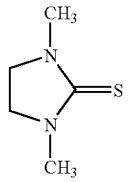

Compound Y

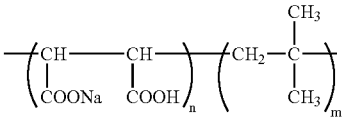

n and m is each integer.

To the emulsion after the desalting and washing with water, deionized gelatin and an aqueous NaCl solution as well as an aqueous NaOH solution were added and the temperature was elevated to 50° C. to adjust the emulsion to pAg 7.6 and pH 5.6.

Thus, a gelatin containing silver halide cubic grains having a halogen composition of 98.9 mol % of silver chloride, 1 mol % of silver bromide, and 0.1 mol % of silver iodide, an average side length of 0.70 μm with a variation coefficient of side length being 8% was obtained.

The above-mentioned emulsion grains were maintained at 60° C. and Spectral sensitizing dye-1 and -2 were added thereto in amounts of $2.5\times10^{-4}$ mol/mol of Ag and $2.0\times10^{-4}$ mol/mol of Ag, respectively. Further, Thiosulfonic acid compound 1 was added in an amount of $1\times10^{-5}$ mol/mol of Ag and then a fine grain emulsion containing 90 mol % of silver bromide and 10 mol % of silver chloride having an average grain diameter of 0.05 μm which was doped with iridium hexachloride was added, and the resultant was aged for 10 minutes. Further, fine grains of 40 mol % of silver bromide and 60% of silver chloride having an average grain diameter of 0.05 μm was added thereto and aged for 10 minutes. The fine grains were dissolved and as a result, the silver bromide content of the host cubic grains increased to 1.3 mol. The iridium hexachloride was doped in an mount of $1\times10^{-7}$ mol/mol of Ag.

Subsequently, $1\times10^{-5}$ mol/mol of Ag of sodium thiosulfate and $2\times10^{-5}$ mol/mol of Ag of Gold sensitizer-1 were added and immediately thereafter the temperature was elevated to 60° C. and the mixture was subsequently aged for 40 minutes and then the temperature was decreased to 50° C. Immediately after the temperature decrease, Mercapto compound-1 and -2 were added in amounts of $6\times10^{-4}$ mol/mol of Ag, respectively. Then, after 10 minutes of aging, an aqueous KBr solution was added to make 0.008 mol based on silver and after 10 minutes of aging, the temperature was decreased and the resultant was stored.

In this manner, a high sensitivity side emulsion A-1 was prepared.

In the same manner as described above except for the above-mentioned emulsion preparation method and temperature during the grain formation, cubic grains having an average side length of 0.55 μm with a variation coefficient of side length being 9% were prepared. The temperature during the grain formation was 55° C.

The spectral sensitization and chemical sensitization were performed in amounts used for corrections performed to make specific surface areas equivalent (side length ratio of 0.7/0.55=1.27 times) to prepare a low sensitivity side emulsion A-2.

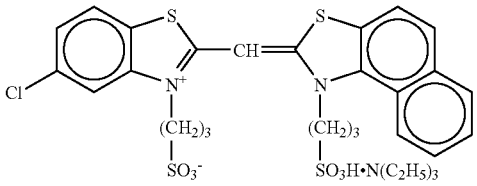

Spectral sensitizing dye-1

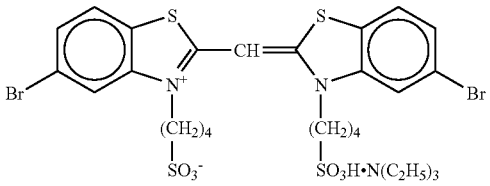

Spectral sensitizing dye-2

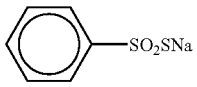

Thiosulfonic acid compound-1

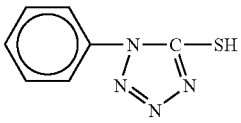

Mercapto compound-1

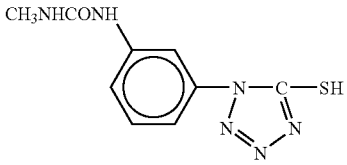

Mercapto compound-2

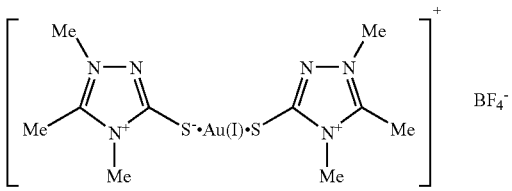

Gold sensitizer-1

The spectral sensitizer and chemical sensitizer were used in amounts of 1.25 times those of Emulsion B-1 taking into consideration of the ratio of surface areas, to prepare a low sensitivity side emulsion B-2.

(Preparation of Inventive Green Sensitive Layer Emulsions C-1 and C-2)

Under the same preparation conditions for emulsions A-1 and A-2, except that the temperature at the time of forming grains was lowered, and the kind of sensitizing dyes were changed as described below, a green sensitive layer (GL) high-sensitivity emulsion C-1 and a green sensitive layer (GL) low-sensitivity emulsion C-2 were prepared.

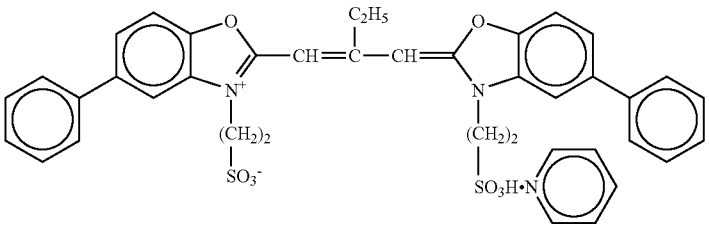

(Sensitizing dye D)

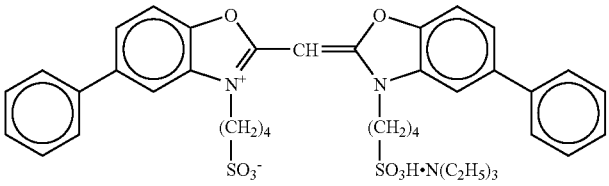

(Sensitizing dye E)

As for the grain size, the high-sensitivity emulsion C-1 had the average side length of 0.40 μm and the low-sensitivity emulsion C-2 had the average side length of 0.30 μm, each with the variation coefficient of average length of 8%.

The sensitizing dye D was added to the large-size emulsion (high-sensitivity emulsion C-1) in an amount of $3.0\times10^{-4}$ mol, and to the small-size emulsion (low-sensitivity emulsion C-2) in an amount of $3.6\times10^{-4}$ mol, per mol of the silver halide; and the sensitizing dye E was added to the large-size emulsion in an amount of $4.0\times10^{-5}$ mol, and to the small-size emulsion in an amount of $7.0\times10^{-5}$ mol, per mol of the silver halide.

(Preparation of Inventive Green Sensitive Layer Emulsions D-1 and D-2)

Under the same preparation conditions for emulsions B-1 and B-2, except that the temperature at the time of forming grains was lowered, and the kind of sensitizing dyes were changed as described below, a green sensitive layer high-sensitivity emulsion D-1 and a green sensitive layer low-sensitivity emulsion D-2 were prepared.

As for the grain size, the high-sensitivity emulsion C-1 had the average side length of 0.50 μm and the low-sensitivity emulsion C-2 had the average side length of 0.40 μm, each with the variation coefficient of average length of 10%, respectively.

The sensitizing dye D was added to the large-size emulsion (high-sensitivity emulsion C-1) in an amount of $4.0\times10^{-4}$ mol, and to the small-size emulsion (low-sensitivity emulsion C-2) in an amount of $4.5\times10^{-4}$ mol, per mol of the silver halide; and the sensitizing dye E was added to the large-size emulsion in an amount of $5.0\times10^{-5}$ mol, and to the small-size emulsion in an amount of $8.8\times10^{-5}$ mol, per mol of the silver halide.

(Preparation of Inventive Red Sensitive Layer Emulsions E-1 and E-2)

Under the same preparation conditions for emulsions A-1 and A-2, except that the temperature at the time of forming grains was lowered, and the kind of sensitizing dyes were changed as described below, a red sensitive layer high-sensitivity emulsion E-1 and a red sensitive layer low-sensitivity emulsion E-2 were prepared.

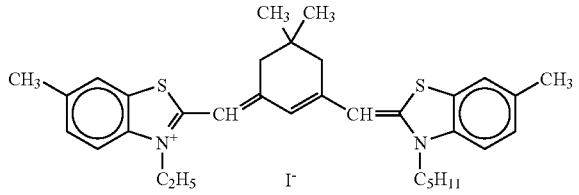

(Sensitizing dye G)

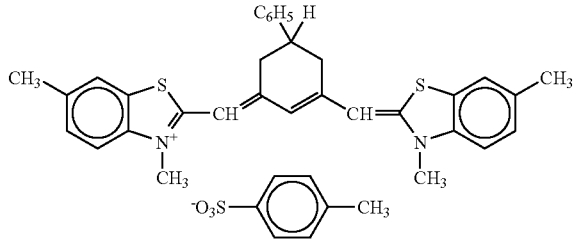

(Sensitizing dye H)

As for the grain size, the high-sensitivity emulsion E-1 had the average side length of 0.38 μm and the low-sensitivity emulsion E-2 had the average side length of 0.32 μm, with the variation coefficient of average length of 9% and 10%, respectively.

The sensitizing dyes G and H were added to the large-size emulsion (high-sensitivity emulsion E-1) in an amount of $8.0\times10^{-5}$ mol, and to the small-size emulsion (low-sensitivity emulsion E-2) in an amount of $10.7\times10^{-5}$ mol, per mol of the silver halide, respectively.

Further, Compound I below was added to red sensitive layer in an amount of $3.0\times10^{-3}$ mol.

(Compound I)

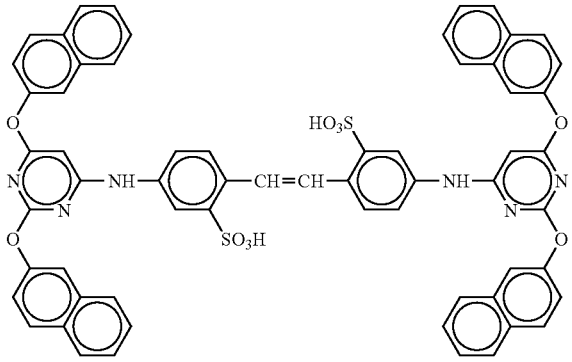

(Preparation of Inventive Red Sensitive Layer Emulsions F-1 and F-2)

Under the same preparation conditions for emulsions B-1 and B-2, except that the temperature at the time of forming grains was lowered, and the kind of sensitizing dyes were changed as described below, a red sensitive layer high-sensitivity emulsion F-1 and a red sensitive layer low-sensitivity emulsion F-2 were prepared.

As for the grain size, the high-sensitivity emulsion F-1 had the average side length of 0.57 μm and the low-sensitivity emulsion F-2 had the average side length of 0.43 μm, with the variation coefficient of average length of 9% and 10%, respectively.

The sensitizing dyes G and H were added to the large-size emulsion (high-sensitivity emulsion F-1) in an amount of $1.0\times10^{-4}$ mol, and to the small-size emulsion (low-sensitivity emulsion F-2) in an amount of $1.34\times10^{-4}$ mol, per mol of the silver halide, respectively.

Further, Compound I was added to red sensitive emulsion layer in an amount of $3.0\times10^{-3}$ mol.

(Preparation of a Coating Solution for the First Layer)

Into 21 g of a solvent (Solv-1) and 80 ml of ethyl acetate were dissolved 57 g of a yellow coupler (ExY), 7 g of a color-image stabilizer (Cpd-1), 4 g of a color-image stabilizer (Cpd-2), 7 g of a color-image stabilizer (Cpd-3), and 2 g of a color-image stabilizer (Cpd-8). This solution was emulsified and dispersed in 220 g of a 23.5 mass % aqueous gelatin solution containing 4 g of sodium dodecylbenzenesulfonate with a high-speed stirring emulsifier (dissolver). Water was added thereto, to prepare 900 g of an emulsified dispersion A.

On the other hand, the above emulsified dispersion A and the prescribed emulsions A-1 and A-2 were mixed and dissolved, and the first-layer coating solution was prepared so that it would have the composition shown below. The coating amount of the emulsion is in terms of silver.

The coating solutions for the second layer to the seventh layer were prepared in the similar manner as that for the first-layer coating solution. As a gelatin hardener for each layer, 1-oxy-3,5-dichloro-s-triazine sodium salt (H-1), (H-2), and (H-3) were used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(H-1) Hardener

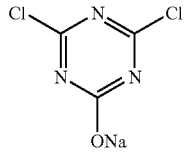

(used in an amount 1.4 mass % per gelatin)

(H-2) Hardener

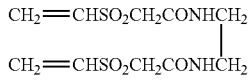

(H-3) Hardener

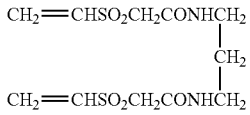

(Ab-1) Antiseptic

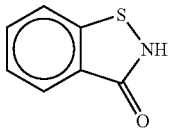

(Ab-2) Antiseptic

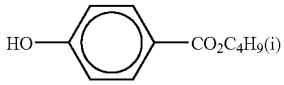

(Ab-3) Antiseptic

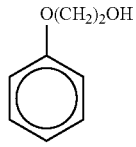

(Ab-4) Antiseptic

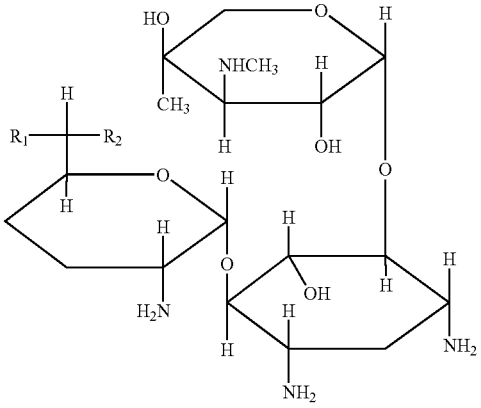

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture in 1:1:1:1 (molar ratio) of a, b, c, and d

Further, to the second layer, the fourth layer, the sixth layer, and the seventh layer, was added 1-(3-methylureidophenyl)-

5-mercaptotetrazole in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to the red-sensitive emulsion layer, was added a copolymer latex of methacrylic acid and butyl acrylate (1:1 in mass ratio; average molecular weight, 200,000 to 400,000) in an amount of 0.05 g/m$^2$. Disodium salt of catecol-3,5-disulfonic acid was added to the second layer, the fourth layer and the sixth layer so that coating amounts would be 6 mg/m$^2$, 6 mg/m$^2$ and 18 mg/m$^2$, respectively.

Further, in order to prevent irradiation, the following dyes (coating amounts are shown in parentheses) were added.

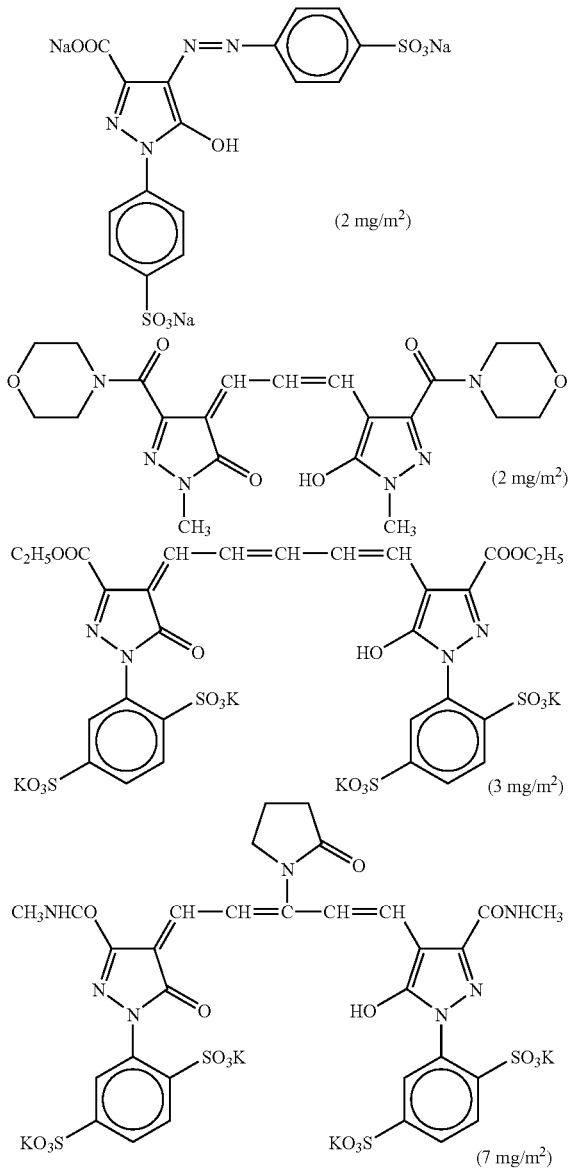

(Layer Constitution)

The composition of each layer is shown below. The numbers show coating amounts (g/m$^2$). In the case of the silver halide emulsion, the coating amount is in terms of silver.

Support

Polyethylene Resin-laminated Paper (The polyethylene resin on the first layer side contained a white pigment ($TiO_2$; content of 16 mass %, znO; content of 4 mass %), a fluorescent whitening agent (4,4'-bis(5-methylbenzoxazolyl)stilbene; content of 0.03 mass %) and a bluish dye (ultramarine; content of 0.33 mass %). The amount of the polyethylene resin was 29.2 g/m$^2$ First Layer (Blue-Sensitive Emulsion Layer)

| | |
|---|---|
| Silver chloroiodobromide emulsion A (gold-sulfur sensitized cubes, a 3:7 mixture of the large-size emulsion A-1 and the small-size emulsion A-2 (in terms of mol of silver)) | 0.24 |
| Gelatin | 1.25 |
| Yellow coupler (ExY-1) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |

(Average size of grain in emulsion: 0.15 μm)

Second Layer (Color-Mixing Inhibiting Layer)

| | |
|---|---|
| Gelatin | 1.15 |
| Color-mixing inhibitor (Cpd-4) | 0.10 |
| Color-image stabilizer (Cpd-5) | 0.018 |
| Color-image stabilizer (Cpd-6) | 0.13 |
| Color-image stabilizer (Cpd-7) | 0.07 |
| Solvent (Solv-1) | 0.04 |
| Solvent (Solv-2) | 0.12 |
| Solvent (Solv-5) | 0.11 |

Third Layer (Green-sensitive Emulsion Layer)

| | |
|---|---|
| Silver chloroiodobromide emulsion C (gold-sulfur sensitized cubes, a 1:3 mixture of the large-size emulsion C-1 and the small-size emulsion C-2 (in terms of mol of silver)) | 0.14 |
| Gelatin | 0.46 |
| Magenta coupler (ExM) | 0.15 |
| Ultraviolet absorbing agent (UV-A) | 0.14 |
| Color-image stabilizer (Cpd-2) | 0.003 |
| Color-mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-3) | 0.09 |
| Solvent (Solv-4) | 0.18 |
| Solvent (Solv-5) | 0.17 |

(Average size of grain in emulsion: 0.25 μm)

Fourth Layer (Color-Mixing Inhibiting Layer)

| | |
|---|---|
| Gelatin | 0.68 |
| Color-mixing inhibitor (Cpd-4) | 0.06 |
| Color-image stabilizer (Cpd-5) | 0.011 |
| Color-image stabilizer (Cpd-6) | 0.08 |
| Color-image stabilizer (Cpd-7) | 0.04 |
| Solvent (Solv-1) | 0.02 |

-continued

| | |
|---|---|
| Solvent (Solv-2) | 0.07 |
| Solvent (Solv-5) | 0.065 |

Fifth Layer (Red-Sensitive Emulsion Layer)

| | |
|---|---|
| Silver chloroiodobromide emulsion E (gold-sulfur sensitized cubes, a 5:5 mixture of the large-size emulsion E-1 and the small-size emulsion E-2 (in terms of mol of silver)) | 0.16 |
| Gelatin | 0.95 |
| Cyan coupler (ExC-1) | 0.023 |
| Cyan coupler (ExC-2) | 0.05 |
| Cyan coupler (ExC-3) | 0.17 |
| Ultraviolet absorbing agent (UV-A) | 0.055 |
| Color-image stabilizer (Cpd-1) | 0.22 |
| Color-image stabilizer (Cpd-7) | 0.003 |
| Color-image stabilizer (Cpd-9) | 0.01 |
| Color-image stabilizer (Cpd-12) | 0.01 |
| Solvent (Solv-8) | 0.05 |

(Average size of grain in emulsion: 0.19 μm)

Sixth Layer (Ultraviolet Absorbing Layer)

| | |
|---|---|
| Sixth Layer (Ultraviolet Absorbing Layer) | |
| Gelatin | 0.46 |
| Ultraviolet absorbing agent (UV-B) | 0.35 |
| Compound (S1-4) | 0.0015 |
| Solvent (Solv-7) | 0.18 |
| Seventh Layer (Protective Layer) | |
| Gelatin | 1.00 |
| Acryl-modified copolymer of polyvinyl alcohol (modification degree: 17%) | 0.4 |
| Liquid paraffin | 0.02 |
| Surface-active agent (Cpd-13) | 0.02 |

(ExY-1) Yellow coupler

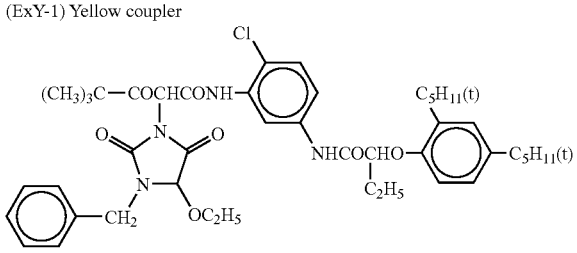

(ExY-2)

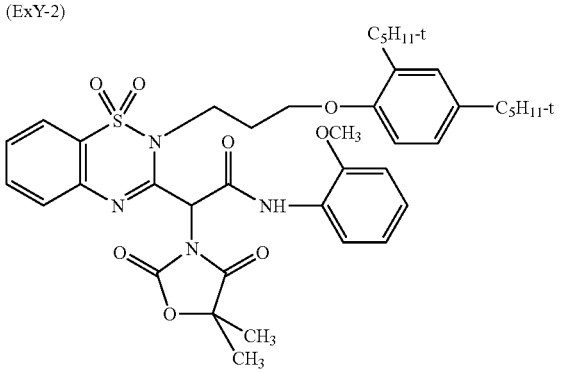

-continued (ExY-3)

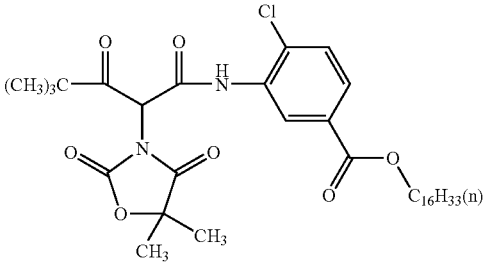

(ExM) Magenta coupler

A mixture in 50:50 (molar ratio) of

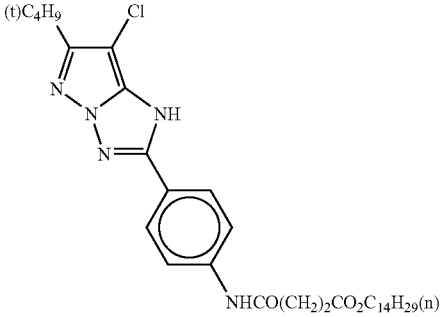

and

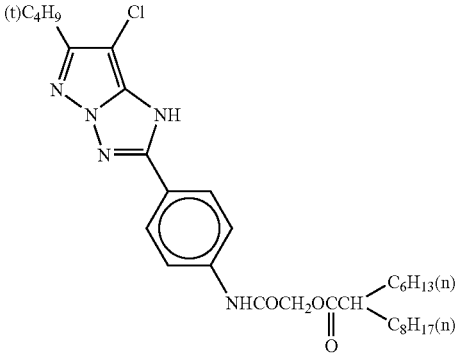

(ExC-1) Cyan coupler

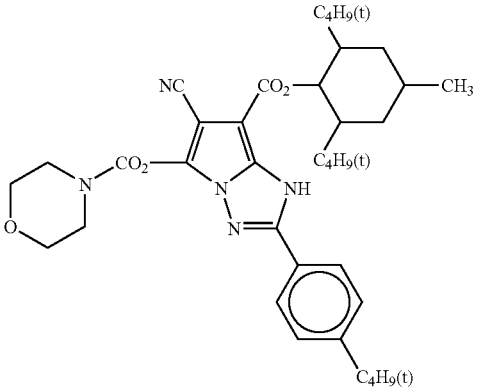

(ExC-2) Cyan coupler

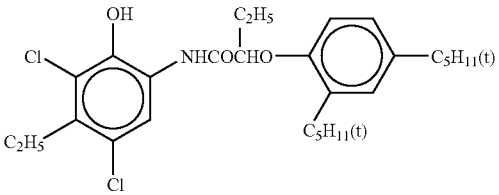

-continued (ExC-3) Cyan coupler

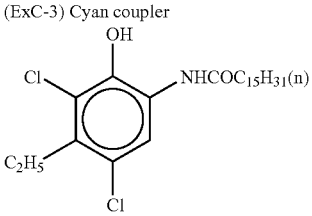

(ExC-4) Cyan coupler

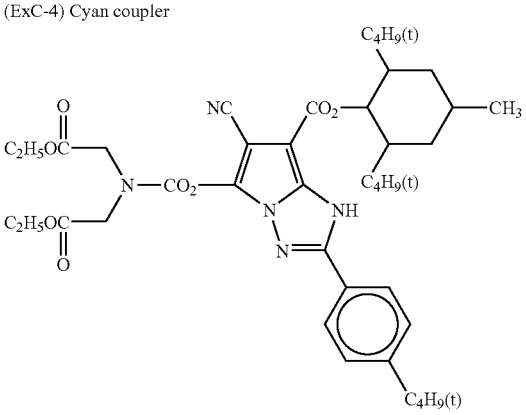

(ExC-5) Cyan coupler

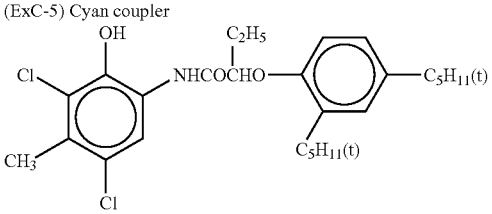

(Cpd-1) Color-image stabilizer

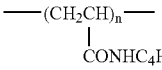

number-average molecular weight 60,000

(Cpd-2) Color-image stabilizer

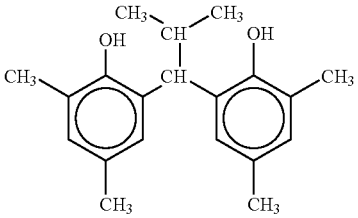

(Cpd-3) Color-image stabilizer

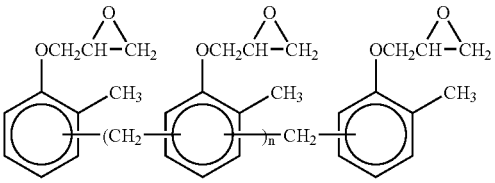

n = 7~8

(average value)

(Cpd-4) Color-mixing inhibitor

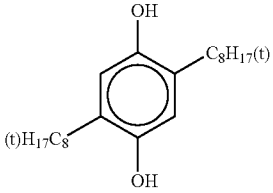

-continued (Cpd-5) Color-image stabilizer

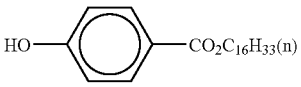

(Cpd-6) Color-image stabilizer

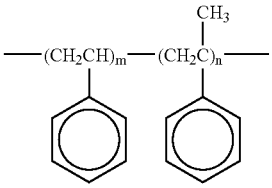

number-average molecular weight 600 m/n = 10/90

(Cpd-7)

Color-image stabilizer

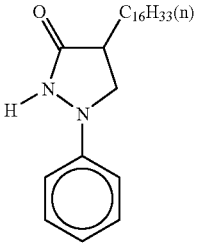

(Cpd-8)

Color-image stabilizer

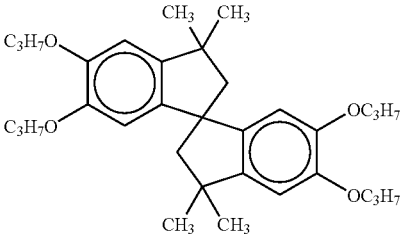

(Cpd-9)

Color-image stabilizer

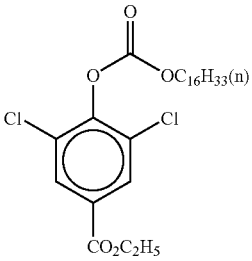

(Cpd-10)

Color-image stabilizer

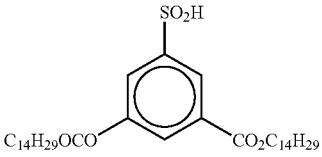

-continued
(Cpd-11)
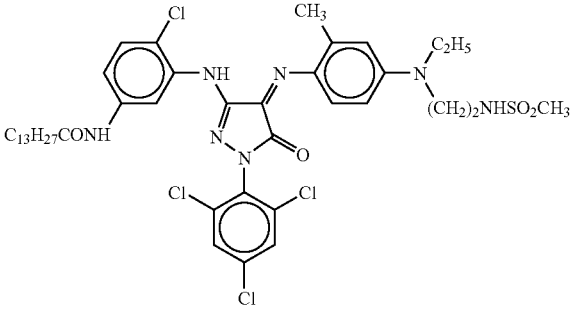
(Cpd-12)
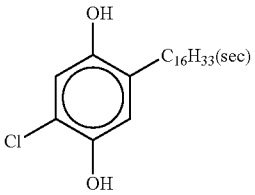
(Cpd-13) Surface-active agent
A mixture in 6:2:2 (molar ratio) of
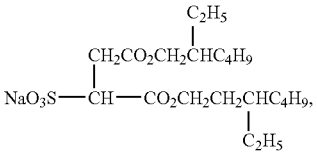
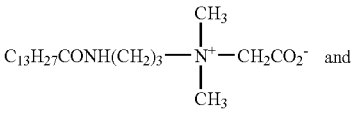
and
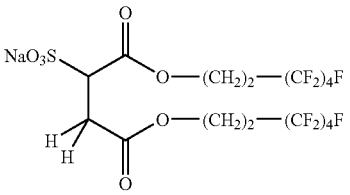
(Cpd-15)
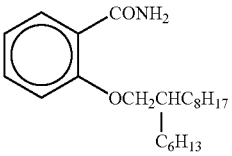
(Cpd-18)
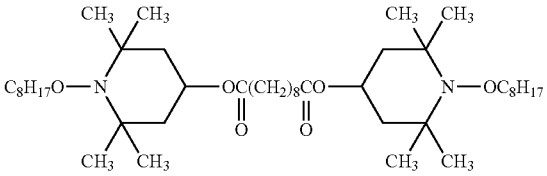
(Cpd-19)
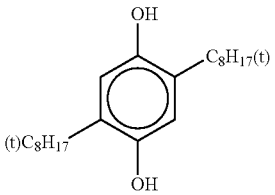
-continued
(Cpd-20)
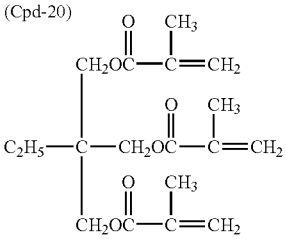
(UV-1)
Ultraviolet absorbing agent
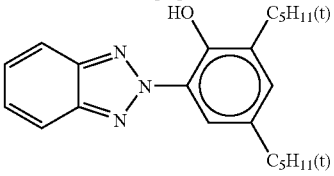
(UV-2)
Ultraviolet absorbing agent
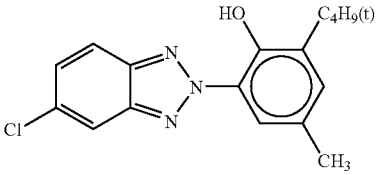
(UV-3)
Ultraviolet absorbing agent
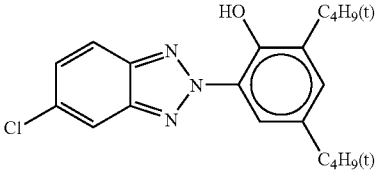
(UV-5)
Ultraviolet absorbing agent
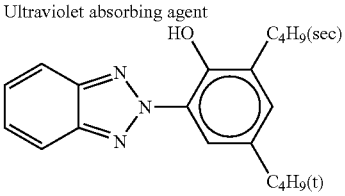
(UV-6)
Ultraviolet absorbing agent
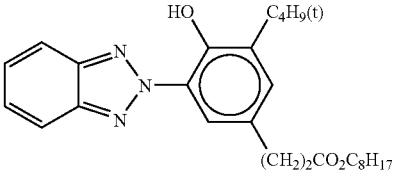
(UV-7) Ultraviolet absorbing agent
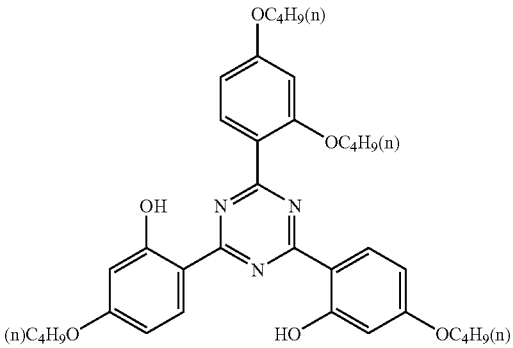

-continued

UV-A A mixture of UV-1/UV-2/UV-3 = 7/2/2 (mass ratio)
UV-B A mixture of UV-1/UV-2/UV-3/UV-5/UV-6 = 13/3/3/5/3 (mass ratio)
UV-C A mixture of UV-1/UV-3 = 9/1 (mass ratio)
(Solv-1)

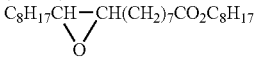

(Solv-2)

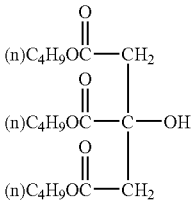

(Solv-3)

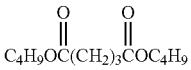

(Solv-4)

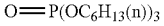

(Solv-5)

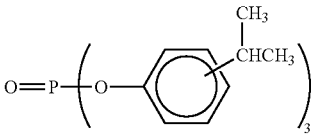

(Solv-7)

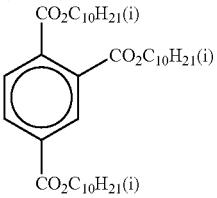

(Solv-8)

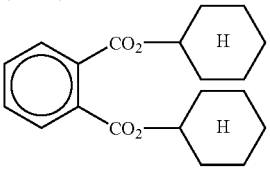

(Solv-9)

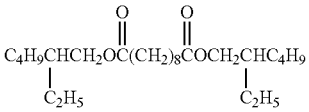

(Solv-10)

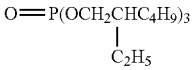

(S1-4)

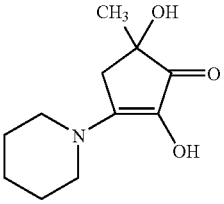

(Solv-11)

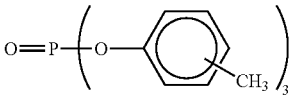

-continued (m, p)
(Solv-12)

(Solv-13) Oleyl alcohol

In the sample 4-001 produced in the above manner, changing was conducted as shown below to produce a sample.

Preparation of Sample 4-101

A sample 4-101 was prepared in the same manner as for sample 4-001, except that the compositions of the first, third and fifth layers of the above-mentioned sample 4-001 were changed as described below.

First Layer (Blue-Sensitive Emulsion Layer)

| | |
|---|---|
| Silver chloroiodobromide emulsion (a 3:7 mixture of the emulsion B-H and the emulsion B-L (in terms of mol of silver)) | 0.21 |
| Gelatin | 1.00 |
| Yellow coupler (ExY-1) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.35 |

(Average size of grain in emulsion: 0.08 μm)

Further, the silver chloroiodobromide emulsions (Emulsion B-H and Emulsion B-L) were prepared in the same manner as in Example 2-4 described above.

Third Layer (Green-Sensitive Emulsion Layer)

| | |
|---|---|
| Silver chloroiodobromide emulsion (a 1:3 mixture of the emulsion G-H and the emulsion G-L (in terms of mol of silver)) | 0.12 |
| Gelatin | 0.36 |
| Magenta coupler (ExM) | 0.12 |
| Color-image stabilizer (Cpd-2) | 0.003 |
| Color-mixing inhibitor (Cpd-4) | 0.002 |
| Color-image stabilizer (Cpd-6) | 0.16 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-11) | 0.08 |
| Solvent (Solv-12) | 0.16 |
| Solvent (Solv-13) | 0.11 |

(Average size of grain in emulsion: 0.08 μm)

Further, the silver chloroiodobromide emulsions (Emulsion G-H and Emulsion G-L) were prepared in the same manner as in Example 2-4 described above.

Fifth Layer (Red-Sensitive Emulsion Layer)

| | |
|---|---|
| Silver chloroiodobromide emulsion (a 5:5 mixture of the emulsion R-H and the emulsion R-L (in terms of mol of silver)) | 0.10 |
| Gelatin | 0.95 |
| Cyan coupler (ExC-1) | 0.10 |
| Cyan coupler (ExC-3) | 0.05 |
| Cyan coupler (ExC-5) | 0.01 |
| Color-image stabilizer (Cpd-6) | 0.01 |
| Color-image stabilizer (Cpd-7) | 0.02 |

-continued

| | |
|---|---|
| Color-image stabilizer (Cpd-9) | 0.04 |
| Color-image stabilizer (Cpd-10) | 0.01 |
| Color-image stabilizer (Cpd-15) | 0.16 |
| Color-image stabilizer (Cpd-18) | 0.04 |
| Color-image stabilizer (Cpd-20) | 0.01 |
| Ultraviolet absorbing agent (UV-7) | 0.07 |
| Solvent (Solv-5) | 0.19 |

(Average size of grain in emulsion: 0.15 μm)

Further, the silver chloroiodobromide emulsions (Emulsion R-H and Emulsion R-L) were prepared in the same manner as in Example 2-4 described above.

Preparation of Sample 4-201

A sample 4-201 was prepared in the same manner, except that the composition of the first layer of the sample 4-101 was changed as described below.

First Layer (Blue-Sensitive Emulsion Layer)

| | |
|---|---|
| Silver chloroiodobromide emulsion (a 3:7 mixture of the emulsion B-H and the emulsion B-L (in terms of mol of silver)) | 0.13 |
| Gelatin | 1.00 |
| Yellow coupler (ExY-2) | 0.34 |
| Color-image stabilizer (Cpd-2) | 0.07 |
| Color-image stabilizer (Cpd-8) | 0.08 |
| Color-image stabilizer (Cpd-20) | 0.08 |
| Solvent (Solv-11) | 0.35 |

(Average size of grain in emulsion: 0.08 μm)

Preparation of Sample 4-301

A sample 4-301 was prepared in the same manner, except that the composition of the third layer of the sample 4-101 was changed as described below.

Third Layer (Green-Sensitive Emulsion Layer)

| | |
|---|---|
| Silver chloroiodobromide emulsion (a 1:3 mixture of the emulsion G-H and the emulsion G-L (in terms of mol of silver)) | 0.10 |
| Gelatin | 0.36 |
| Magenta coupler (ExM) | 0.14 |
| Color-image stabilizer (Cpd-2) | 0.004 |
| Color-mixing inhibitor (Cpd-4) | 0.002 |
| Color-image stabilizer (Cpd-6) | 0.19 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-11) | 0.10 |
| Solvent (Solv-12) | 0.19 |
| Solvent (Solv-13) | 0.13 |

(Average size of grain in emulsion: 0.08 μm)

Preparation of Sample 4-401

A sample 4-401 was prepared in the same manner, except that the composition of the third layer of the sample 4-101 was changed as described below.

Third Layer (Green-Sensitive Emulsion Layer)

| | |
|---|---|
| Silver chloroiodobromide emulsion (a 1:3 mixture of the emulsion G-H and the emulsion G-L (in terms of mol of silver)) | 0.08 |
| Gelatin | 0.36 |

-continued

| | |
|---|---|
| Magenta coupler (ExM) | 0.18 |
| Color-image stabilizer (Cpd-2) | 0.004 |
| Color-mixing inhibitor (Cpd-4) | 0.002 |
| Color-image stabilizer (Cpd-6) | 0.19 |
| Color-image stabilizer (Cpd-8) | 0.02 |
| Color-image stabilizer (Cpd-9) | 0.01 |
| Color-image stabilizer (Cpd-10) | 0.01 |
| Color-image stabilizer (Cpd-11) | 0.0001 |
| Solvent (Solv-11) | 0.20 |
| Solvent (Solv-12) | 0.32 |
| Solvent (Solv-13) | 0.50 |

(Average size of grain in emulsion: 0.06 μm)

Preparation of Sample 4-501

A sample 4-501 was prepared in the same manner, except that the compositions of the first layer and the fifth layer of the sample 4-101 were changed as described below.

First Layer (Blue-Sensitive Emulsion Layer)

| | |
|---|---|
| Silver chloroiodobromide emulsion (a 3:7 mixture of the emulsion B-H and the emulsion B-L (in terms of mol of silver)) | 0.21 |
| Gelatin | 1.00 |
| Yellow coupler (ExY-3) | 0.42 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.35 |

(Average size of grain in emulsion: 0.08 μm)

Fifth Layer (Red-Sensitive Emulsion Layer)

| | |
|---|---|
| Silver chloroiodobromide emulsion (a 5:5 mixture of the emulsion R-H and the emulsion R-L (in terms of mol of silver)) | 0.09 |
| Gelatin | 1.11 |
| Cyan coupler (ExC-1) | 0.14 |
| Color-image stabilizer (Cpd-6) | 0.01 |
| Color-image stabilizer (Cpd-9) | 0.04 |
| Color-image stabilizer (Cpd-10) | 0.01 |
| Color-image stabilizer (Cpd-15) | 0.20 |
| Color-image stabilizer (Cpd-18) | 0.07 |
| Ultraviolet absorbing agent (UV-7) | 0.07 |
| Solvent (Solv-5) | 0.50 |

(Average size of grain in emulsion: 0.07 μm)

Each sample was stored at 25° C. and 55% RH for 10 days after the coating, and then the sample was exposed to light from a conventional Xe light source through a filter that spectrally separates the light into red, green and blue and a 20-stage wedge on HIE type sensitometer manufactured by Fuji Photo Film Co., Ltd. with applying a voltage of 1,000 v to a capacitor in an amount of exposure to light corresponding to 0.0001 second 200,000 1× sec. After the exposed sample was stored for 30 minutes under the conditions of 25° C. and 55% RH, each sample was processed with color-development processing A described hereinbelow.

Color-development Processing Step A

Each photosensitive material sample described above was processed into a form of a roll with a width of 127 mm, and the photosensitive material was imagewise exposed from a negative film of average density, by using a laboratory processor obtained by modifying Mini Labo Printer Processor PP350 manufactured by Fuji Photo Film Co., Ltd. so that the processing time and processing temperature could be changed, and continuous processing (running test) was performed until the volume of the color-developer replenisher used in the following processing step became double the volume of the color-developer tank. The processing using this running processing solution was named processing A.

| Processing step | Temperature | Time | Replenishment rate* |
|---|---|---|---|
| Color development | 45.0° C. | 15 sec | 45 ml |
| Bleach-fixing | 40.0° C. | 15 sec | 35 ml |
| Rinse (1) | 40.0° C. | 6 sec | — |
| Rinse (2) | 40.0° C. | 6 sec | — |
| Rinse (3)** | 40.0° C. | 6 sec | — |
| Rinse (4)** | 38.0° C. | 6 sec | 121 ml |
| Drying | 80° C. | 15 sec | |

(Notes)
*Replenishment rate per $m^2$ of the light-sensitive material to be processed.
**A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a tank counter-current system from (1) to (4).

The composition of each processing solution was as follows.

| (Color developer) | (Tank solution) | (Replenisher) |
|---|---|---|
| Water | 800 ml | 800 ml |
| Fluorescent whitening agent (FL-3) | 4.0 g | 8.0 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-amino-3-methyl-N-ethyl-N-(β-methanesulfonamidoethyl)aniline •3/2 sulfate•monohydrate | 7.0 g | 19.0 g |
| Potassium carbonate | 26.3 g | 26.3 g |
| Water to make | 1000 ml | 1000 ml |
| pH (25° C., adjusted using sulfuric acid and potassium hydroxide) | 10.25 | 12.6 |

| (Bleach-fixing solution) | (Tank solution) | (Replenisher) |
|---|---|---|
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |

-continued

| (Bleach-fixing solution) | (Tank solution) | (Replenisher) |
|---|---|---|
| Potassium metabisulfite | 23.1 g | 46.2 g |
| Water to make | 1000 ml | 1000 ml |
| pH (25° C., adjusted using nitric acid and aqueous ammonia) | 6.00 | 6.00 |

| (Rinse solution) | (Tank solution) | (Replenisher) |
|---|---|---|
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Each sample thus processed were measured for the density of a yellow component, $D_y$, the density of a magenta component, $D_m$, and the density of a cyan component, $D_c$, by determining the density of each patch stepwise exposed by use of an X-rite, and a sensitometry curve was prepared from the measured densities by complementing gaps between the respective measuring points. Similarly, gray stepwise exposure was performed such that neutrality was reached at a density of 0.7 by adjusting with a gelatin color filter without resort to color separation and passing the sample through the above-mentioned color-development processing A. Then, the color-development processing B was performed and the density was measured by use of X-rite. The density of the yellow component was named $D_{gy}$, the density of the magenta component was named $D_{gm}$, and the density of the cyan component was named $D_{gc}$.

As an index of rapid high-productivity processing suitability, the line speed of color development processing was set from 10 seconds to 30 seconds at an interval of 1 second and the time $t_{2.0}$ in which all of the densities, $D_{gy}$, $D_{gm}$, and $D_{gc}$, reached 2.0 was examined. The smaller the time $t_{2.0}$ is, the more rapid high-productivity processing suitability the sample has. Here, $t_{2.0}$ was obtained by interpolation or extrapolation from the experimental data.

Also, as an index for color separation, the values of Dc and $D_y$ at density points that give $D_m$=2.0 of a green-separated exposed patch are defined as $D_{c/m}$ and $D_{y/m}$, respectively, and the value of $D_m$ at the density point that gives $D_y$=2.0 of a blue-separated exposed patch was defined as Dm/y, and evaluation of color mixing was performed.

To evaluate the color stain with a lapse of time, a nonexposed sample was passed through color-development processing A and then the measurement of density of a white background portion was performed by use of X-rite and the initial white background densities were defined as $D_{sy}$, $D_{sm}$, and $D_{sc}$, respectively. Further, after each sample was stored at 35° C. and 60% RH for 3 months in the dark, again the density thereof was measured by use of X-rite and density increments of respective color components were defined as $D_{\Delta sy}$, $D_{\Delta sm}$ and $D_{\Delta sc}$, respectively. The lower the initial white background density is, and the smaller the increase in the density is, the more preferred the sample is.

Samples 4-102, 4-103, 4-202, 4-203, 4-302, 4-303, 4-402, 4-403, 4-502 and 4-503 as shown in Table 16 were prepared in the same manner as described above, except that the coating flow rates of the color mixing preventing layers in Samples 4-001 to 4-501 were changed (changes in flow rate meaning changes in coating amounts), respectively. Then, these samples were measured of rapid processability, $t_{2.0}$, color mixing densities, $D_{c/m}$, $D_{y/m}$ and $D_{m/y}$, white background densities, $D_{sy}$, $D_{sm}$ and $D_{sc}$, coloring densities with a lapse of time, $D_{\Delta sy}$, $D_{\Delta sm}$ and $D_{\Delta sc}$ stain, and average relative coupling rates, kar, of each of the yellow color-forming layer, magenta color-forming layer, and cyan color-forming layer (obtained by the method described herein at 20 measuring points with the densities of dye being determined by extraction and the bleach fixing and subsequent operations being performed according to processing B in Example 4-3 described hereinbelow).

Table 17 shows the results obtained.

TABLE 16

| Sample No. | Coating flow rate of the second layer (%) | Coating flow rate of the fourth layer (%) | No. of sample which was modified | Silver coating amount (g/m$^2$) | Gelatin coating amount (g/m$^2$) |
|---|---|---|---|---|---|
| 4-001 | 100 | 100 | 4-001 | 0.54 | 5.95 |
| 4-002 | 70 | 90 | 4-001 | 0.54 | 5.54 |
| 4-101 | 100 | 100 | 4-101 | 0.43 | 5.60 |
| 4-102 | 70 | 90 | 4-101 | 0.43 | 5.19 |
| 4-103 | 45 | 75 | 4-101 | 0.43 | 4.80 |
| 4-201 | 100 | 100 | 4-201 | 0.35 | 5.60 |
| 4-202 | 70 | 90 | 4-201 | 0.35 | 5.19 |
| 4-203 | 45 | 75 | 4-201 | 0.35 | 4.80 |
| 4-301 | 100 | 100 | 4-301 | 0.41 | 5.60 |
| 4-302 | 70 | 90 | 4-301 | 0.41 | 5.19 |
| 4-303 | 45 | 75 | 4-301 | 0.41 | 4.80 |
| 4-401 | 100 | 100 | 4-401 | 0.39 | 5.60 |
| 4-402 | 70 | 90 | 4-401 | 0.39 | 5.19 |
| 4-403 | 45 | 75 | 4-401 | 0.39 | 4.80 |
| 4-501 | 100 | 100 | 4-501 | 0.42 | 5.60 |
| 4-502 | 70 | 90 | 4-501 | 0.42 | 5.19 |
| 4-503 | 200 | 200 | 4-501 | 0.42 | 7.43 |

TABLE 17

| | Kar | | | | | | | | | | | | |
|---|---|---|---|---|---|---|---|---|---|---|---|---|---|
| Sample No. | Y | M | C | $t_{2.0}$ | Dc/m | Dy/m | Dm/y | $D_{sy}$ | $D_{sm}$ | $D_{sc}$ | $D_{\Delta sy}$ | $D_{\Delta sm}$ | $D_{\Delta sc}$ |
| 4-001 | 1.00 | 0.55 | 1.25 | 12.5 | 0.20 | 0.32 | 0.28 | 0.10 | 0.11 | 0.08 | 0.03 | 0.02 | 0.01 |
| 4-002 | 1.01 | 0.57 | 1.26 | 12.1 | 0.21 | 0.33 | 0.30 | 0.10 | 0.11 | 0.08 | 0.03 | 0.02 | 0.01 |
| 4-101 | 1.05 | 0.67 | 1.34 | 8.0 | 0.18 | 0.31 | 0.24 | 0.09 | 0.10 | 0.07 | 0.02 | 0.01 | 0.01 |
| 4-102 | 1.07 | 0.69 | 1.34 | 7.8 | 0.18 | 0.31 | 0.25 | 0.09 | 0.10 | 0.07 | 0.02 | 0.01 | 0.01 |
| 4-103 | 1.09 | 0.70 | 1.35 | 7.6 | 0.20 | 0.32 | 0.27 | 0.08 | 0.09 | 0.08 | 0.01 | 0.01 | 0.01 |
| 4-201 | 1.18 | 0.66 | 1.34 | 6.8 | 0.18 | 0.30 | 0.26 | 0.10 | 0.10 | 0.07 | 0.02 | 0.01 | 0.01 |
| 4-202 | 1.19 | 0.67 | 1.35 | 6.6 | 0.19 | 0.31 | 0.27 | 0.10 | 0.10 | 0.07 | 0.02 | 0.01 | 0.01 |
| 4-203 | 1.19 | 0.67 | 1.35 | 6.3 | 0.20 | 0.32 | 0.28 | 0.09 | 0.10 | 0.08 | 0.01 | 0.02 | 0.01 |
| 4-301 | 1.04 | 0.75 | 1.34 | 7.5 | 0.18 | 0.30 | 0.24 | 0.09 | 0.10 | 0.07 | 0.02 | 0.01 | 0.01 |
| 4-302 | 1.05 | 0.77 | 1.34 | 7.3 | 0.18 | 0.31 | 0.25 | 0.09 | 0.10 | 0.07 | 0.01 | 0.01 | 0.01 |
| 4-303 | 1.06 | 0.79 | 1.34 | 7.1 | 0.19 | 0.31 | 0.27 | 0.08 | 0.09 | 0.08 | 0.01 | 0.01 | 0.01 |
| 4-401 | 1.04 | 0.80 | 1.35 | 7.1 | 0.18 | 0.29 | 0.24 | 0.09 | 0.10 | 0.07 | 0.02 | 0.01 | 0.01 |
| 4-402 | 1.05 | 0.82 | 1.35 | 6.9 | 0.18 | 0.29 | 0.25 | 0.08 | 0.09 | 0.07 | 0.01 | 0.01 | 0.01 |
| 4-403 | 1.05 | 0.83 | 1.35 | 6.7 | 0.18 | 0.31 | 0.27 | 0.08 | 0.09 | 0.07 | 0.01 | 0.01 | 0.01 |
| 4-501 | 2.24 | 0.65 | 2.08 | 6.5 | 0.32 | 0.41 | 0.26 | 0.14 | 0.12 | 0.11 | 0.12 | 0.03 | 0.08 |
| 4-502 | 2.23 | 0.67 | 2.09 | 6.2 | 0.35 | 0.49 | 0.26 | 0.14 | 0.12 | 0.11 | 0.11 | 0.02 | 0.07 |
| 4-503 | 2.25 | 0.67 | 2.08 | 12.6 | 0.22 | 0.35 | 0.27 | 0.16 | 0.13 | 0.12 | 0.09 | 0.02 | 0.08 |

Note that R in the table above indicates a cyan color-forming layer, G indicates a magenta color-forming layer, and B indicates a yellow color-forming layer.

As compared with Samples 4-001 and 4-002 in Table 17, Samples 4-101 to 4-403 had shortened $t_{2.0}$, while they had decreased $D_{c/m}$, $D_{y/m}$ and $D_{m/y}$, that is, they had an improved color separability while having rapid processing suitability. Further, no deterioration was observed in the white background density $D_{sy}$, $D_{sm}$ and $D_{sc}$, or in the color densities with a lapse of time, $D_{\Delta sy}$, $D_{\Delta sm}$ and $D_{\Delta sc}$ stain. On the other hand, it was revealed that Samples 4-501 and 4-502 showed shortening of $t_{2.0}$, but the color separability was deteriorated. Further, it was revealed that Sample 4-503 of which the color mixing preventing ability was increased in order to improve the color separability underwent deterioration of $t_{2.0}$, so that it did not have rapid processing suitability and setting the average relative coupling rate, kar, at a high level was found to be not preferable. It was demonstrated that setting the average relative coupling rate, kar, in the range stipulated by the present invention enabled imparting rapid processing suitability while improving the color separation.

Example 4-2

The order of the layers constituting the silver halide emulsion-containing layers of Samples 4-101 and 4-201 described in Example 4-1 was changed as shown in Table 18 and rapid processability $t_{2.0}$ and color mixing densities, $D_{c/m}$, $D_{y/m}$ and $D_{m/y}$, were measured. The results obtained are shown in Table 19.

TABLE 18

| Sample No. | Coating flow rate of the second layer (%) | Coating flow rate of the fourth layer (%) | No. of sample which was modified | Fifth layer/third layer/first layer |
|---|---|---|---|---|
| 4-001 | 100 | 100 | 4-001 | R/G/B |
| 4-101 | 100 | 100 | 4-101 | R/G/B |
| 4-102 | 70 | 90 | 4-101 | R/G/B |
| 4-103 | 45 | 75 | 4-101 | R/G/B |
| 4-104 | 100 | 100 | 4-101 | G/R/B |
| 4-105 | 70 | 90 | 4-101 | G/R/B |
| 4-106 | 45 | 75 | 4-101 | G/R/B |
| 4-201 | 100 | 100 | 4-201 | R/G/B |
| 4-202 | 70 | 90 | 4-201 | R/G/B |
| 4-203 | 45 | 75 | 4-201 | R/G/B |
| 4-204 | 100 | 100 | 4-201 | G/R/B |
| 4-205 | 70 | 90 | 4-201 | G/R/B |
| 4-206 | 45 | 75 | 4-201 | G/R/B |
| 4-207 | 100 | 100 | 4-201 | B/R/G |
| 4-208 | 70 | 90 | 4-201 | B/R/G |

TABLE 19

| Sample No. | Kar | | | Fifth layer/ | | | | |
|---|---|---|---|---|---|---|---|---|
| | Y | M | C | third layer/first layer | $t_{2.0}$ | $D_{c/m}$ | $D_{y/m}$ | $D_{m/y}$ |
| 4-001 | 0.99 | 0.55 | 1.25 | R/G/B | 12.5 | 0.20 | 0.32 | 0.28 |
| 4-101 | 1.05 | 0.67 | 1.34 | R/G/B | 8.0 | 0.18 | 0.31 | 0.24 |
| 4-102 | 1.05 | 0.67 | 1.34 | R/G/B | 7.8 | 0.18 | 0.31 | 0.25 |
| 4-103 | 1.05 | 0.67 | 1.34 | R/G/B | 7.6 | 0.20 | 0.32 | 0.27 |
| 4-104 | 1.05 | 0.67 | 1.34 | G/R/B | 6.2 | 0.18 | 0.29 | 0.24 |
| 4-105 | 1.05 | 0.67 | 1.34 | G/R/B | 6.0 | 0.18 | 0.29 | 0.24 |
| 4-106 | 1.05 | 0.67 | 1.34 | G/R/B | 5.8 | 0.19 | 0.29 | 0.24 |
| 4-201 | 1.18 | 0.66 | 1.34 | R/G/B | 6.8 | 0.18 | 0.30 | 0.26 |
| 4-202 | 1.18 | 0.66 | 1.34 | R/G/B | 6.6 | 0.19 | 0.31 | 0.27 |
| 4-203 | 1.18 | 0.66 | 1.34 | R/G/B | 6.3 | 0.20 | 0.32 | 0.28 |
| 4-204 | 1.18 | 0.66 | 1.34 | G/R/B | 5.5 | 0.18 | 0.29 | 0.24 |
| 4-205 | 1.18 | 0.66 | 1.34 | G/R/B | 5.2 | 0.19 | 0.29 | 0.24 |
| 4-206 | 1.18 | 0.66 | 1.34 | G/R/B | 4.9 | 0.20 | 0.29 | 0.24 |
| 4-207 | 1.18 | 0.66 | 1.34 | B/R/G | 5.8 | 0.19 | 0.29 | 0.24 |
| 4-208 | 1.18 | 0.66 | 1.34 | B/R/G | 5.6 | 0.20 | 0.29 | 0.25 |

Comparison of Samples 4-101 to 4-103 with Samples 4-104 to 4-106 in Table 19 revealed that $t_{2.0}$ was greatly shortened while $D_{c/m}$, $D_{y/m}$ and $D_{m/y}$ were decreased. This indicates that locating the red-sensitive emulsion layer having a high average relative coupling rate, kar, as the third layer imparts the photographic light-sensitive material with rapid processing suitability while it further improved the color separability. Further, comparison between Samples 4-201 to 4-203 with Samples 4-204 to 4-208 showed similar results. From the above, it was revealed that locating the emulsion layer of which the average relative coupling rate, kar, was the highest among the three silver halide-containing emulsion layers between the color mixing inhibitor-containing layers so as to be sandwiched thereby enabled imparting rapid processing suitability while improving the color separability.

Example 4-3

Similar evaluations performed in the same manner as in Examples 4-1 and 4-2, except that the color-development processing A was changed to the following color-development processing B gave similar results.

Color-developing Processing Step B

Each of the samples above was processed into a form of a roll with a width of 127 mm, and the photosensitive material sample was imagewise exposed from a negative film of average density, by using Mini Labo Printer Processor PP350 manufactured by Fuji Photo Film Co., Ltd., and continuous processing (running test) was performed until the volume of the color-developer replenisher used in the following processing step became double the volume of the color-developer tank. The processing using this running processing solution was named processing B.

| Processing step | Temperature | Time | Replenishment rate* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |

-continued

| Processing step | Temperature | Time | Replenishment rate* |
|---|---|---|---|
| Rinse (3)** | 38.0° C. | 20 sec | — |
| Rinse (4)** | 38.0° C. | 20 sec | 121 ml |
| Drying | 80° C. | | |
| Drying | 80° C. | | |

(Notes)

*Replenishment rate per $m^2$ of the light-sensitive material to be processed.

**A rinse cleaning system RC50D, trade name, manufactured by Fuji Photo Film Co., Ltd., was installed in the rinse (3), and the rinse solution was taken out from the rinse (3) and sent to a reverse osmosis membrane module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a tank counter-current system from (1) to (4).

The composition of each processing solution was as follows.

| (Color developer) | (Tank solution) | (Replenisher) |
|---|---|---|
| Water | 800 ml | 800 ml |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethylene glycol (average molecular weight 300) | 10.0 g | 10.0 g |
| Ethylenediamine tetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl) hydroxylamine | 8.5 g | 14.0 g |
| 4-amino-3-methyl-N-ethyl-N-(β-methanesulfonamidoethyl)aniline •3/2 sulfate•monohydrate | 4.8 g | 14.0 g |
| Potassium carbonate | 26.3 g | 26.3 g |
| Water to make | 1000 ml | 1000 ml |
| pH (25° C., adjusted using sulfuric acid and potassium hydroxide) | 10.15 | |

| | (Tank solution) | (Replenisher) |
|---|---|---|
| (Bleach-fixing solution) | | |
| Water | 800 ml | 800 ml |
| Ammonium thiosulfate (750 g/l) | 107 ml | 214 ml |
| m-Carboxy benzene sulfinic acid | 8.3 g | 16.5 g |
| Ammonium iron (III) ethylenediaminetetraacetate | 47.0 g | 94.0 g |
| Ethylenediaminetetraacetic acid | 1.4 g | 2.8 g |
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C., adjusted using nitric acid and aqueous ammonia) | 6.5 | 6.5 |
| (Rinse solution) | | |
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

Example 4-4

In the case where the photosensitive materials described in Examples 4-1 to 4-3 were exposed to light by the exposure method described below, the effects of the present invention were exhibited similarly as in Example 4-1.

(Method for Exposure)

The scanning exposure was carried out for the photosensitive materials prepared in Examples 4-1 and 4-2 using a scanning exposure device illustrated in FIG. 1 of JP-A-11-88619. As the light source, in the scanning exposure device, a light source of 688 nm (R light) taken out by using a laser semiconductor, a light source of 532 nm (G light) and a light source of 473 nm (B light) each taken out by combining a semiconductor laser with SHG, respectively, were used. The quantity of each of lights was modulated by an external modulator, and laser beams were, in order, scan-exposed to a sample moving in the direction vertical to the scanning direction by the reflection to a rotating polyhedron. The scanning pitch was 400 dpi and the average exposure time per pixel was $8\times10^{-8}$ sec. The temperature of the semiconductor laser was kept constant by using a Peltier device to prevent the quantity of light from being changed by temperature.

Example 4-5

Each of the photosensitive materials prepared in Examples 4-1 to 4-4 were subjected to scanning exposure by use of the apparatus described below and evaluations according to Examples 4-1 to 4-4 were performed. As a result, it was revealed that the effects of the present invention, that is, use of the samples having the constitution of the present invention can give rise to excellent color separability and rapid processing suitability, can be obtained significantly.

Digital Minilabo Frontier 330 (trademark, manufactured by Fuji Photo Film Co., Ltd.), Lambda 130 (trademark, manufactured by Durst), LIGHTJET 5000 (trademark, manufactured by Gretag).

Having described our invention as related to the present embodiments, it is our intention that the invention not be limited by any of the details of the description, unless otherwise specified, but rather be construed broadly within its spirit and scope as set out in the accompanying claims.

This nonprovisional application claims priority under 35 U.S.C. § 119 (a) on Patent Application No. 2002-56655 filed in Japan on Mar. 1, 2002, Patent Application No. 2002-111023 filed in Japan on Apr. 12, 2002, Patent Application No. 2002-111282 filed in Japan on Apr. 12, 2002, and Patent Application No. 2002-112176 filed in Japan on Apr. 15, 2002, which are herein incorporated by reference.

We claim:

1. A silver halide color photographic light-sensitive material, having at least one yellow color forming light-sensitive silver halide emulsion layer, at least one magenta color-forming light-sensitive silver halide emulsion layer, and at least one cyan color-forming light-sensitive silver halide emulsion layer, on a support, and containing at least one yellow dye-forming coupler represented by the following formula (I), and at least one compound selected from the group consisting of compounds represented by any of the following formula [S-I], [S-II], [S-III], [S-IV], [S-V], [S-VI], [ST-I], [ST-II], [ST-III], [ST-IV] or [ST-V] and water-insoluble homopolymers or copolymers:

formula (I)

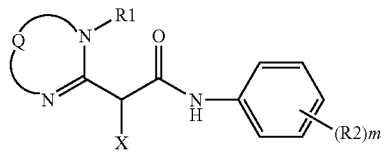

wherein, in formula (I), Q represents a group of non-metal atoms necessary to form a 5-to 7-membered ring together with the —N═C—N(R1)-; R1 represents a substituent; R2 represents a substituent; m represents an integer of 0 to 5; when m is 2 or more, R2s may be the same or different from each other, or R2s may bond together to form a ring; and X represents a hydrogen atom, or a group capable of being split-off upon a coupling reaction with an oxidized product of a developing agent;

formula [S-I]

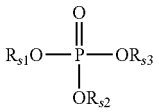

wherein, in formula [S-I], $R_{s1}$, $R_{s2}$ and $R_{s3}$ each independently represent an alkyl group, a cycloalkyl group, an alkenyl group or an aryl group, in which the total number of carbon atoms contained in the groups represented by $R_{s1}$, $R_{s2}$ and $R_{s3}$ is 12 to 60;

formula [S-II]

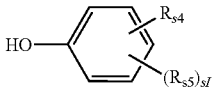

wherein, in formula [S-II], $R_{s4}$ and $R_{s5}$ each independently represent an alkyl group, a cycloalkyl group, an alkoxy group or a halogen atom; s1 represents an integer from 0 to 4; and when s1 is 2 or more, plural $R_{s5}$s may be the same or different, and $R_{s4}$ and $R_{s5}$ may bond with each other to form a five- or six-membered ring;

$R_{s6}$—$(COOR_{s7})_{sm}$ formula [SIII]

wherein, in formula [S-III], $R_{s6}$ represents a linking group having no aromatic group; $R_{s7}$ represents an alkyl, cycloalkyl, alkenyl or alkynyl group having 20 or less carbon atoms; sm represents an integer from 2 or more and 5 or less; and when sm is 2 or more, plural —$COOR_{s7}$s may be the same or different;

$R_{s8}$-$(OCOR_{s9})_{sn}$ formula [S-IV]

wherein, in formula [S-IV], $R_{s8}$ represents a linking group; $R_{s9}$ represents an alkyl, cycloalkyl, alkenyl or alkynyl group having 20 or less carbon atoms; sn represents an integer from 2 or more and 5 or less; and when sn is 2 or more, plural —$OCOR_{s9}$s may be the same or different;

formula [S-V]

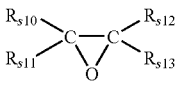

wherein, in formula [S-V], $R_{s10}$, $R_{s11}$, $R_{s12}$ and $R_{s13}$ each independently represent a hydrogen atom, an aliphatic oxycarbonyl group or a carbamoyl group, in which the total group, an aliphatic oxycarbonyl group, an aromatic number of carbon atoms contained in $R_{s10}$, $R_{s11}$, $R_{s12}$ and $R_{s13}$ is 8 to 60; and $R_{s10}$ and $R_{s11}$, $R_{s10}$ and $R_{s12}$, or $R_{s12}$ and $R_{s13}$ may bond with each other, to form a five- to seven-membered ring, respectively; with the proviso that all of $R_{s10}$, $R_{s11}$, $R_{s12}$ and $R_{s13}$ simultaneously do not represent a hydrogen atom;

$R_{s14}$-$(COOR_{s15})_{sp}$ formula [S-VI]

wherein, in formula [S-VI], $R_{s14}$ represents an aromatic linking group; $R_{s15}$ represents an alkyl, cycloalkyl, alkenyl or alkynyl group having 20 or less carbon atoms; sp represents an integer from 3 or more and 5 or less; and when sp is 2 or more, plural —$COOR_{s15}$s may be the same or different;

formula [ST-I]

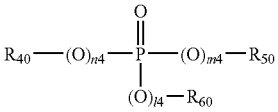

wherein, in formula [ST-I], $R_{40}$, $R_{50}$ and $R_{60}$ each independently represent an aliphatic group or an aromatic group; and l4, m4 and n4 each independently represent 0 or 1, with the proviso that l4, m4 and n4 simultaneously are not 1;

$R_{A—NH—SO2}$—$R_B$ formula [ST-II]

wherein, in formula [ST-II], $R_A$ and $R_B$ each independently represent a hydrogen atom, an alkyl group, a cycloalkyl group, an alkenyl group, a cycloalkenyl group, an alkynyl group, an aryl group, a heterocyclic group, an alkoxy group, an aryloxy group, a heterocyclic oxy group, or a group represented by the following formula:

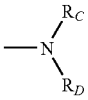

in which $R_C$ and $R_D$ each independently represent a hydrogen atom, an alkyl group or an aryl group; and $R_A$ and $R_B$ each may be the same or different;

formula [ST-III]

HO—(J')—COOY wherein, in formula [ST-III], J' represents a divalent organic group; and Y represents an alkyl group, a cycloalkyl group, an aryl group, an alkenyl group, an alkynyl group, a cycloalkenyl group or a heterocyclic group;

formula [ST-IV]

$R_{51}$—O—($CH_2$—$J_5$—$CH_2O$)$_{l5}$—$R_{52}$ wherein, in formula [ST-IV], $R_{51}$ and $R_{52}$ each independently represent an aliphatic group or —$COR_{53}$, in which $R_{53}$ represents an aliphatic group; $J_5$ represents a divalent organic group or simply a connecting bond; and $l_5$ represents an integer from 0 to 6; and $R_{54}$—$Y_{54}$ formula [ST-V]

wherein, in formula [ST-V], $R_{54}$ represents a hydrophobic group having the total number of carbon atoms of 10 or more; and $Y_{54}$ represents a monovalent organic group containing an alcoholic hydroxyl group.

2. The silver halide color photographic light-sensitive material as claimed in claim 1, wherein Q in the formula (I) is a group represented by —C(—R11)=C(—R12)-$SO_2$— or —C(—R11)=C(—R12)-CO—, in which R11 and R12 bond with each other to form a 5- to 7-membered ring together with the —C=C—, or R11 and R12 each independently represent a hydrogen atom or a substituent.

3. The silver halide color photographic light-sensitive material as claimed in claim 1, wherein Q in the formula (I) is a group represented by —C(—R11)=C(—R12)-$SO_2$—, in which R11 and R12 bond with each other to form a 5- to 7-membered ring together with the —C=C—, or R11 and R12 each independently represent a hydrogen atom or a substituent.

4. The silver halide color photographic light-sensitive material as claimed in claim 1, wherein the yellow dye-forming coupler represented by formula (I) is a yellow dye-forming coupler represented by formula (II):

formula (II)

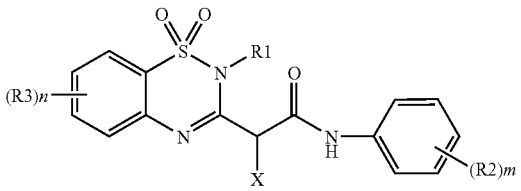

wherein, in formula (II), R1 represents a substituent; R2 represents a substituent; m represents an integer of 0 to 5; when m is 2 or more, R2s may be the same or different from each other, or R2s may bond together to form a ring; R3 represents a substituent; n represents an integer of 0 to 4; when n is 2 or more, R3s may be the same or different from each other, or R3s may bond together to form a ring; and X represents a hydrogen atom, or a group capable of being split-off upon a coupling reaction with an oxidized product of a developing agent.

5. The silver halide color photographic light-sensitive material as claimed in claim 4, wherein R1 in the dye-forming coupler represented by formula (II) is a substituted or unsubstituted alkyl group.

* * * * *